US006149506A

United States Patent [19]

Duescher

[11] Patent Number: 6,149,506

[45] Date of Patent: Nov. 21, 2000

[54] LAPPING APPARATUS AND METHOD FOR HIGH SPEED LAPPING WITH A ROTATABLE ABRASIVE PLATEN

[75] Inventor: Wayne O. Duescher, Roseville, Minn.

[73] Assignee: Keltech Engineering, St. Paul, Minn.

[21] Appl. No.: 09/168,057

[22] Filed: Oct. 7, 1998

[51] Int. Cl.[7] ..... B24B 1/00

[52] U.S. Cl. ..... 451/59; 451/36; 451/178; 451/285; 451/286

[58] Field of Search ..... 451/36, 178, 285, 451/286, 287, 288, 290, 59

[56] References Cited

U.S. PATENT DOCUMENTS

| | | | |
|---|---|---|---|
| 648,264 | 4/1900 | Jacobson . | |
| 1,291,572 | 1/1919 | Lorenz . | |
| 1,353,966 | 9/1920 | Lorenz . | |
| 1,353,967 | 9/1920 | Lorenz . | |
| 1,355,345 | 10/1920 | Lorenz . | |
| 1,401,832 | 12/1921 | Taylor . | |
| 1,414,172 | 4/1922 | Brown . | |
| 2,854,829 | 10/1958 | Porter | 64/7 |
| 3,182,428 | 5/1965 | Hannon | 51/118 |
| 3,561,164 | 2/1971 | Dunn | 51/116 |
| 3,841,031 | 10/1974 | Walsh | 51/283 |
| 4,010,583 | 3/1977 | Highberg et al. | 51/284 |
| 4,011,689 | 3/1977 | Cozzini | 51/5 D |
| 4,045,919 | 9/1977 | Moritomo | 51/165.77 |
| 4,062,152 | 12/1977 | Mehrer | 51/170 R |
| 4,085,549 | 4/1978 | Hodges | 51/119 |
| 4,194,324 | 3/1980 | Bonora et al. | 51/131.5 |
| 4,336,765 | 6/1982 | Coughlin | 118/50 |
| 4,403,567 | 9/1983 | daCosta et al. | 118/500 |
| 4,481,741 | 11/1984 | Bouladon et al. | 51/131.1 |
| 4,483,703 | 11/1984 | Kellar et al. | 65/273 |
| 4,506,184 | 3/1985 | Siddall | 310/328 |
| 4,511,387 | 4/1985 | Kellar et al. | 65/287 |
| 4,567,694 | 2/1986 | Sekiya et al. | 51/209 R |
| 4,593,495 | 6/1986 | Kawakami et al. | 51/118 |
| 4,620,738 | 11/1986 | Schwartz et al. | 294/64.1 |
| 4,680,893 | 7/1987 | Cronkhite et al. | 51/5 R |
| 4,707,012 | 11/1987 | Takagi | 294/64.1 |
| 4,709,508 | 12/1987 | Junker | 51/105 R |
| 4,742,651 | 5/1988 | Wittstock | 51/165.9 |
| 4,851,749 | 7/1989 | Forrester | 318/568.11 |
| 4,860,498 | 8/1989 | Gosis | 51/165.77 |
| 4,926,493 | 5/1990 | Junker | 384/490 |
| 4,943,148 | 7/1990 | Mondragon et al. | 350/529 |
| 5,029,555 | 7/1991 | Dietrich et al. | 118/730 |
| 5,062,384 | 11/1991 | Foley et al. | 118/500 |
| 5,109,631 | 5/1992 | Biebesheimer et al. | 51/111 R |
| 5,121,572 | 6/1992 | Hilscher | 51/111 R |
| 5,133,285 | 7/1992 | Mahler et al. | 118/719 |
| 5,140,774 | 8/1992 | Onodera | 51/134 |
| 5,197,228 | 3/1993 | Sharkey, III et al. | 51/165.71 |
| 5,205,077 | 4/1993 | Wittstock | 51/165 R |
| 5,299,393 | 4/1994 | Chandler et al. | 51/272 |
| 5,317,836 | 6/1994 | Hasegawa et al. | 51/106 R |
| 5,324,012 | 6/1994 | Aoyama et al. | 269/21 |
| 5,374,021 | 12/1994 | Kleinman | 248/362 |
| 5,414,491 | 5/1995 | Bryant | 355/73 |
| 5,421,768 | 6/1995 | Fujiwara et al. | 451/283 |

(List continued on next page.)

FOREIGN PATENT DOCUMENTS

| | | | |
|---|---|---|---|
| 225093 | 7/1984 | Germany | 451/494 |
| 4053682 | 2/1992 | Japan | 451/494 |
| 117656 | 7/1917 | United Kingdom | 451/494 |

*Primary Examiner*—Timothy V. Eley
*Assistant Examiner*—Willie Berry, Jr.
*Attorney, Agent, or Firm*—Schwegman, Lundberg, Woessner & Kluth, P.A.

[57] ABSTRACT

Lapping or polishing at high speeds with fine abrasive particles offer significant advantages in the speed of lapping, savings of time in lapping, and smoothness in the finished articles. An improved lapping system comprises a lapper platen system comprising: a) a frame (e.g., having a total weight of at least 200 kg) supporting a work piece holder b) a rotatable platen having an abrasive surface comprising an abrasive sheet secured to said platen, said platen being capable of providing surface feet per minute speeds on in outer edge of at least about 1,500 surface feet per minute; and c) a work piece holder which is movable on said frame.

73 Claims, 27 Drawing Sheets

U.S. PATENT DOCUMENTS

| | | | |
|---|---|---|---|
| 5,514,025 | 5/1996 | Hasegawa et al. | 451/44 |
| 5,534,073 | 7/1996 | Kinoshita et al. | 118/728 |
| 5,563,683 | 10/1996 | Kamiya | 355/53 |
| 5,573,448 | 11/1996 | Nakazima et al. | 451/41 |
| 5,576,754 | 11/1996 | Korem | 347/262 |
| 5,584,746 | 12/1996 | Tanaka et al. | 451/41 |
| 5,584,749 | 12/1996 | Mitsuhashi et al. | 451/285 |
| 5,584,898 | 12/1996 | Fulton | 51/309 |
| 5,613,896 | 3/1997 | Haus et al. | 451/50 |
| 5,624,304 | 4/1997 | Pasch et al. | 451/287 |
| 5,651,724 | 7/1997 | Kimura et al. | 451/41 |
| 5,664,990 | 9/1997 | Adams et al. | 451/60 |
| 5,665,656 | 9/1997 | Jairath | 438/692 |
| 5,667,433 | 9/1997 | Mallon | 451/287 |
| 5,672,097 | 9/1997 | Hoopman | 351/526 |
| 5,690,541 | 11/1997 | Dalke | 451/63 |
| 5,690,545 | 11/1997 | Clowers et al. | 451/359 |
| 5,704,827 | 1/1998 | Nishi et al. | 451/285 |
| 5,762,544 | 6/1998 | Zuniga et al. | 451/285 |
| 5,800,254 | 9/1998 | Motley et al. | 451/285 |
| 5,816,891 | 10/1998 | Woo | 451/6 |
| 5,820,448 | 10/1998 | Shamouilian et al. | 451/287 |
| 5,830,045 | 11/1998 | Togawa et al. | 451/288 |
| 5,853,317 | 12/1998 | Yamaoto | 451/288 |
| 5,857,898 | 1/1999 | Hiyama et al. | 451/56 |
| 5,860,847 | 1/1999 | Sakurai et al. | 451/10 |
| 5,910,041 | 6/1999 | Duescher | 451/28 |

LAPPING APPARATUS AND METHOD FOR HIGH SPEED LAPPING WITH A ROTATABLE ABRASIVE PLATEN

BACKGROUND OF THE INVENTION

1. Field of the Invention

The present invention relates to lapping, polishing, finishing or smoothing of surfaces with apparatus and processes which use abrasive sheeting. In particular, the present invention relates to such processes and apparatus, preferably those which use removable or replaceable abrasive sheeting, which operates at high surface speeds, and preferably which secures the abrasive sheeting to a platen on a flexible shaft, which platen moves the sheeting at those high speeds. The lapping system is capable of extremely smooth surface finishing at high speeds.

2. Background of the Art

The field of lapping or polishing traces it roots far back into time, even before substantial technical developments. Early jewelry and decorations were provided by minerals or materials (shells or wood) that had been smoothed by natural elements. Stones smoothed by water currents or sand storms gave a much more pleasant look and feel than unpolished stones or stones which had been roughly smoothed by available means such as rubbing two stones together.

Early efforts at sharpening blades for plows or swords were amongst the first technical advances in lapping and smoothing of materials, and these technical means are still used in much the same way today. Swords and plow shears were sharpened by moving the blade against a stone surface. The abrasive action of the stone against the blade removed metal and thinned the blade at its edge. Grinding wheels, kitchen knife sharpeners, and the like are not significantly different in function than the stone sharpening tools, such as the grinding wheel which has been used to sharpen blades for thousands of years.

In the $17^{th}$ and $18^{th}$ century, the combination of die casting and abrasive polishing enabled the manufacture of interchangeable generic parts for equipment (especially the rifle and hand gun) as opposed to the standard method of fitting individually made parts into a unique piece of equipment with uniquely fitting parts. Each succeeding advance in the ability of materials and processes to create smoother and more uniform surfaces advanced the quality and capability of the resultant articles to perform whatever tasks for which they were designed. Lenses with greater smoothness and uniformity advanced the degree to which observation could be extended downward by microscopy and outward into space by telescopes. Better fitting parts extended the longevity of equipment and increased efficiency by reducing internal friction. The need for increasing efficiency, precision, consistency and smoothness in lapping is as important today as ever. Each incremental increase in the quality of lapping materials and processes advances many fields of technology and industry, while at the same time offering the possibility of reducing the cost of manufacture of goods.

Lapping and polishing are performed in many fields and industries. Metal and parts polishing is the most obvious field, but smoothing of surfaces is extensively used in lens manufacture, semiconductive wafer manufacture, gem polishing, preparation of supports for optical elements, providing surfaces which can be joined or seamed and the like. The smoothness and reproducibility of the processes and apparatus used to create the needed levels of smoothness are critical to the success of products. U.S. Pat. No. 5,584, 746 (Tanaka) describes a method of polishing semiconductor wafers and apparatus therefor. The import of Tanaka is the physical control placed over the wafer as it is being polished. The wafer is secured by a vacuum system on a wafer mounting plate. The relative flexibility of the wafer is discussed as a method of controlling uniformity of the wafer surface as is the uniformity of the vacuum applied through the wafer support. The polishing of the wafer surface is accomplished by typical means including a polishing pad which is mounted on a polishing surface (turntable). It is suggested that the pad should not be subject to plastic deformation and may be preferably selected from a group comprising close cell foam (e.g., polyurethane), polyurethane impregnated polyester non-woven fabric and the like, which are known materials in the art. No specific means of securing the polishing pad to the support surface is described in Tanaka. No specific speeds of rotation for the operation of the process are shown in the examples.

U.S. Pat. No. 5,317,836 (Hasegawa) describes an apparatus for polishing chamfers of a wafer. Hasegawa describes that in the manufacture of wafer materials from single crystal ingots such as silicon, the wafer is produced by a combination or selection of processes including slicing, chamfering, lapping, etching, buffing, annealing and polishing. It is noted that chipping and/or incomplete surface polishing are a problem in such ingot conversions to wafers. Hasegawa describes the use of a rotary cylindrical buff formed with at least one annular groove in its side describing a circle normal to the axis of the cylindrical buff and a wafer holder capable of holding and turning the wafer about an axis. The improvement is described as including at least the ability of the cylindrical buff being adapted to freely shift axially, that the annular groove has a width substantially greater than the thickness of the wafer, and that the apparatus further comprises a means for axially biasing the cylindrical buff. No specific speeds of rotation for the operation of the process are shown in the examples.

U.S. Pat. No. 5,007,209 (Saito) describes an optical fiber connector polishing apparatus and method. Saito describes a method and apparatus for polishing optical fiber connectors with high accuracy. Saito indicates that the polishing is accomplished by using an elastic polishing board rotating at high speed, but no specific speed of rotation or method of attachment of the polishing board is described. Positioning pins and other controls are provided in the system to accurately align the swing fulcrum arm carrying the polishing material.

U.S. Pat. No. 4,085,549 (Hodges) describes a lens polishing machine comprising a lap tool holder and lens blank holder including independent means to provide linear and rotary movement between a lens blank and lap tool. The machine is described as useful for high speed grinding and polishing. The polishing element is gimbal mounted on its lower extreme in a spherical bearing to allow a lens blank holder to follow the contour of the lens during the polishing process. The movement between the rotary drive and linear drive mechanisms independent of each other provides a balanced and low vibration operation. No specific speeds of rotation are recited and the abrasion is provided by a slurry.

U.S. Pat. No. 4,612,733 (Lee) describes a very high speed lap with a positive lift effect. The apparatus and method comprises a rotary lapping system which uses a liquid slurry of abrasive particles. The diameters of the particles are shown to be from about 1.5 to 5 micrometers, but may be outside this range. The system is described as producing positive lift by presenting leading edge surfaces with a positive angle of attack in the liquid abrasive slurry, the leading edge surfaces generating a positive lift through hydrodynamic interaction with the slurry. Each of the positive lift tools presents a grinding surface to said workpiece when it is rotated in the slurry. There is again no specific rotational speed provided in the description, and the use of liquid slurries would cause higher lapping/abrasive areas on the exterior of the grinding/lapping face as the slurry would be at higher levels at the outside of the rotating grinding area work surface.

U.S. Pat. No. 4,709,508 (Junker) describes a method and apparatus for high speed profile grinding of rotatably clamped, rotation symmetrical workpieces. Rather than the grinding element contacting the surface to be ground with a grinding surface which is rotating within a plane, the edge of the grinding element (e.g., at the circumference of a disk rather than on its face) is brought against the surface to be ground.

U.S. Pat. No. 5,197,228 describes methods and apparatus for grinding metal parts, especially with devices having a cooperative workpiece holder and a tool holder which form a grinding station. The grinder table is reciprocally moveable along an axis which is at right angle to the axis of travel of the workpiece. The grinder table may also be equipped for controlled simultaneous movement along two axes. A microprocessor is designed to send and receive signals to or from all of the moving parts of the grinding machine for moving the workpiece table towards or away from the grinding bit.

U.S. Pat. No. 4,194,324 describes a carrier for semiconductive wafers during polishing steps in their manufacture. An annular flange is present to receive pressure loading from the polishing machine during the wafer polishing operation. The holder of the polishing machine includes the ability to apply a vacuum to the carrier to maintain the carrier selectively on the polishing machine. The arrangement on the equipment allows release of the vacuum during polishing and enables simple intentional removal of the carrier. Cam follower-slot arrangements permit tilting of the mounting head.

U.S. Pat. No. 5,576,754 describes a sheet holding device for an arcuate surface with vacuum retention. The sheet and device are described as useful for internal drum plotters in imaging equipment. Vacuum pressure is applied to imaging film to keep it securely positioned within the arcuate focal plane of the imaging equipment.

U.S. Pat. No. 5,563,683 describes a substrate holder for vacuum mounting a substrate. The holder is provided with two kinds of grooves or clearances in the supporting surface. Circular support faces with multiple grooves and/or a plurality of pins to support the work are shown. The device is generally described to be useful as a holder, with such particular uses as in the manufacture of semiconductors and the support of photosensitive substrate being shown. Similarly, U.S. Pat. No. 4,943,148 describes a silicon wafer holder with at least one access port providing access to the underside of the wafer with vacuum pressure. U.S. Pat. No. 4,707,012 also describes a method of applying vacuum holding forces to a semiconductor wafer during manufacture in an improved manner. U.S. Pat. No. 4,620,738 shows the use of a vacuum pickup system for semiconductor wafers. The wafers are placed into or removed from holders by the vacuum pickup.

Similarly, U.S. Pat. No. 5,414,491 describes a vacuum holder for sheet materials comprising a plurality of arrays of vacuum channels including a plurality of vacuum plenums. Flow sensors are provided so that the system can indicate the presence and/or size of the sheets being held. Specifically described are common types of imaging materials using sheets of plain paper, photographic paper and photographic film.

U.S. Pat. No. 5,374,021 describes a vacuum holding system which is particularly useful as a vacuum table for holding articles. The holding table is particularly described with respect to the manufacture of printed circuit boards. Controlled passageways are provided which are supposed to control the application of reduced pressure and to reduce the application of the vacuum when vacuum support is not required.

U.S. Pat. No. 5,324,012 describes a holding apparatus for holding an article such as a semiconductor wafer. At least a portion of the holder contacting the wafer comprises a sintered ceramic containing certain conductive materials. The use of conductive materials and fewer pores reduces the occurrence and deposition of fine particles during use. The benefits of the materials are said to be in contributions to the cleanability of the surface, insurance of mechanical strength, reduction of weight and increased dimensional stability.

U.S. Pat. No. 5,029,555 describes a holding apparatus and method for supporting wafers during a vacuum deposition process. The apparatus is an improved system for the angled exposure of at least one surface portion of a substrate supported on a surface holder to an emission of a source impinging obliquely on the surface portion. The device moves the surface holder to improve the uniformity of the emission received on the surface portion. Wheel mechanisms are coupled together to provide maintenance capability for predetermined positions of the surface. The substrate holder is moved while its orientation to the source is carefully controlled.

U.S. Pat. Nos. 4,483,703 and 4,511,387 describe vacuum holders used to shape glass. Frames are shown with slidable members moving a deformable vacuum holder between a shaping station and a mold retraction station. Pistons drive movable elements, such as the vacuum holder, on a supporting frame.

U.S. Pat. No. 4,851,749 describes a motor driven mechanical positioner capable of moving an arm to any one of about 840 discrete angular positions. An infrared light emitting device acts with a phototransistor to control the appropriate angular position. Sensing devices also act on interdependent speed controls so as to increase the accuracy of the positioning of the arm.

U.S. Pat. No. 5,180,955 describes a positioning apparatus comprising an electromechanical system which provides controlled X-Y motion with high acceleration, high maximum speeds, and high accuracy, particularly for positioning an end-effector at predetermined locations. A high speed mini-positioner is provided comprising a positioning linkage having a changeable parallelogram structure and a base structure. A main benefit of the system is the fact that the bars and bearings of the positioner are symmetrical about the X-Y plane passing through the linkage height. The symmetry means that all actuator forces and all inertial reaction forces act in vectors lying in the plane of symmetry.

U.S. Pat. No. 5,547,330 describes an ergonomic three axis positioner. The positioner is intended to move an article along three mutually perpendicular axes through a system of interconnected slides and slide joints. Rack and pinions are also used to independently move the slides. The device is suggested for use in the visual inspection of work, particularly in the semiconductor industry.

U.S. Pat. No. 4,219,972 describes a control apparatus for a grinding machine. A revolution speeds changing means is provided which can selectively effect changes at high speeds when grinding and changes at low speeds when dressing the article. The relationship and control of the timing of the speed changes and the operations detection circuits and timers.

U.S. Pat. No. Re. 30,601 describes an apparatus and method particularly effective in the positioning of a semiconductor wafer in a preferred plane with respect to a photomask. Sensors regularly monitor the position of the wafer and a reference plane. A photoalignment system is provided in which a wafer is not physically touched by any portion of the photoalignment tool, thereby avoiding any contamination.

These systems have been described as providing benefits to particular technical and commercial fields, but they have not been shown to provide any particular benefits to truly high speed lapping/polishing systems and materials.

U.S. patent application Ser. No. 09/036126, filed on Mar. 6, 1998 describes advances in the performance of lapping technology, including at least the following technology. Lapping or polishing at high speeds with fine abrasive particles offer significant advantages in the speed of lapping, savings of time in lapping, and smoothness in the finished articles. Materials, processes, apparatus and specific features integrated into the lapping processes and apparatus of the present invention can provide a unique lapping effect with regard to both the quality (smoothness and uniformity of the produced surface) and efficiency of the system. The invention of U.S. patent application Ser. No. 09/036126 relates to a new field of lapping technology with its own unique complexities due to the combination of high rotational speeds on the abrasive platen and the use of sheets of abrasive material rather than slurries. The combination of these two aspects creates dynamics and forces which have not been addressed by previous lapping systems and requires an entirely new background of engineering to address the problems.

Another aspect is a preferred process within the scope of the invention which comprises:

a) providing a work piece to be lapped, said work piece having a first surface and a second surface which are parallel to each other, and at least one of said first and second surface is a surface to be lapped, b) providing a first and second rotating platen, each of said first and rotating platen having I) a back surface and ii) a flat front surface which can be adjusted so that said first platen is facing and parallel to said first surface of said work piece and said second platen is facing and parallel to said second surface of said work piece, c) providing a sheet of abrasive material on said flat surface of said first platen with an abrasive face of said sheet facing said first surface of said work piece which is said at least one surface to be lapped, d) securing said sheet of abrasive material to said flat surface of said first platen, and e) putting a liquid between both I) said first platen and said first surface of said work piece and ii) said second platen and said second surface of said work piece, f) rotating both of said platen at at least 500 revolutions per minute and contacting said abrasive material and said work piece, g) wherein contact pressure between said both I) said first platen and said first surface of said work piece and ii) said second platen and said second surface of said work piece are sufficiently similar that said work piece does not flex more than 0.1 mm at its exterior regions between said two platens.

A very important process aspect of that invention includes the initial positioning and contacting of the workpiece and the abrasive sheet material as in a process for initiating contact between a workpiece to be ground and an abrasive surface comprising abrasive sheeting on a rotatable platen, the process comprising:

a) supporting a workpiece on a workpiece holder, b) supporting said workpiece holder on a linearly movable support, c) advancing the workpiece into contact with an abrasive surface comprising abrasive sheeting on a rotatable platen, said process being further characterized by d) determining a position at least approximating the position of contact between a surface of said workpiece to be ground and said abrasive surface, e) removing said workpiece from said position approximating the position of contact, f) advancing the workpiece towards said abrasive surface while said rotatable platen is rotating, and g) controlling forces which advance said workpiece towards said abrasive surface and into contact with said abrasive surface.

In that process, mechanical alignment of said workpiece and/or said workpiece holder is effected to promote parallelism between a surface of said workpiece to be ground and said abrasive surface after step c) but before step e). The controlling forces provides a preferred contact force between 0.1 and 10 pounds per square inch between a surface of said workpiece to be ground and said rotating platen during lapping of said workpiece while said abrasive sheet is moving with at least 1,500 surface feet per minute while in contact with said workpiece. This process and lapping system has the workpiece holder supported by a pivot joint and said workpiece holder pivots upon contact between said workpiece and said abrasive surface to hold a surface of said workpiece to be lapped in a more parallel orientation with said abrasive surface. Another desirable aspect of the process of the present invention is that pressure is applied between the work piece and the abrasive sheet by a flexible joint or engagement or gimbal supporting the work piece. The pressure applied between the workpiece and the rotating platen may be from 0.1 psi to 100 psi, preferably from 0.1 to 25 psi, more preferably from 0.1 or 0.5 to 5 psi.

Generally a particular improved process of that invention may be considered to comprise a process for lapping a surface comprising:

a) providing a work piece to be lapped, having at least one surface to be lapped, b) providing a rotatable platen having a back side and a front side, said front side facing said work piece and having a flat plateau which is continuous around the perimeter of said front side of said rotatable platen and is elevated with respect to a central area on said front side, c) providing a sheet of abrasive material on said flat plateau, said sheet of abrasive material having a front surface with an abrasive face and a back surface, with said abrasive face facing said at least one surface to be lapped, d) securing said sheet of abrasive material to said flat surface of said plateau, and e) rotating said platen at at least 500 revolutions per minute and contacting said abrasive material and said work piece to remove material from said work piece.

That process particularly benefits when the plateau defines an annular shape on said front face, and more particularly where the sheet of abrasive material comprises a circular sheet or annular sheet of material. The sheet of abrasive material most preferably comprises an annular shape in which a central open portion is at least three times the radial dimension as the width of said annular sheet. A reduced gas pressure may be applied against said back surface of said sheet between said sheet and said platen through vents which are present at least or only on said flat surface of said plateau, the reduced pressure securing the sheet against rotational movement relative to the rotatable platen. A preferred abrasive sheet comprises an annular distribution of abrasive material on a backing material, with a center area of said sheet being a self-supporting structure which passes across said center area, contacting inner edges of said annular distribution of abrasive material. That is, the central area may be free of abrasive material, such as where said abrasive sheet comprises a continuous substrate with a central area having no abrasive on said backing material, and an annular zone of said backing material surrounding said central area having abrasive material on a surface overlaying said plateau and facing away from said platen, or where said abrasive sheet comprises an annular zone and said central area, said central area being bonded to said annular zone, having less height than said annular zone when said sheet is lying flat, and there being a seam or bond between said annular zone and said central area.

A preferred lapper platen system according to that present invention may comprise:

a) a shaft which is connected to a rotatable platen having vents for air on a front surface of said platen, said platen having a back side to which said shaft is connected and a flat front side on said platen to which can be secured an abrasive sheet by reduced air pressure conveyed through said vents;

b) a frame having a total weight of at least 200 kg supporting a work piece holder and said shaft connected to a rotatable platen;

c) a work piece holder which is movable on said frame;

d) said work piece holder being attached to a movable element on said frame which is capable of moving along said frame in a direction towards and away from said platen to perform lapping of a work piece held on said work piece holder;

e) said work piece holder having control element thereon which allow for independent movement and alignment of said work piece holder along three perpendicular axes so that a work piece on said work piece holder can be adjusted and oriented towards parallel orientation (variously referred to herein as parallelity or parallelism) parallelity with said platen so that a work piece can be lapped; and f) most preferably said control elements having at least 50 settings per rotation, each setting moving said shaft along one of said three axes by a dimension less than 0.05 mm.

Movement and control of movement of the workpiece holder can be extremely important in the performance of the present invention. The control of the movement is best effected by the use of support systems for the workpiece which allow smooth motion of the workpiece, especially by air pressure, hydraulic pressure, linear electric motors and the like.

Another improved process for lapping a surface according to that invention comprises:

using a lapper system comprising:

a) a frame having a total weight of at least 200 kg supporting a work piece holder b) a rotatable platen having an abrasive surface comprising an abrasive sheet secured to said platen;

c) a work piece holder which is movable on said frame;

d) said frame being movable in three dimensions, with controls for each of the dimensions of movement (e.g., hinges, positioning screws, hydraulics, electric motors, etc), e) walls may be present above a plane defined by a surface on said rotatable platen which carries abrasive; and f) said rotatable platen being surrounded on all sides by said walls which may be angled (over said plane and towards said platen) to deflect impacting material downward or at least preventing impacting material from ricocheting upwardly out of the impact area (e.g., by using extensions or lips from the walls which overlay the impact area and prevent vertical ricocheting off of the walls).

It is preferred that a safety box system is also included within the lapping system which may include a means for introducing a first amount of liquid onto said abrasive surface of said platen at a location before contact between a work piece held on said work piece holder and said abrasive surface on said platen;

g) a means for introducing a second amount of liquid onto said abrasive surface of said platen after contact between said work piece and said abrasive surface; and h) means for directing air against said abrasive surface after introduction of said second amount of liquid.

The second amount of water is larger than the first amount, the first amount providing a function as a lubricant, coolant, or the like, and the second amount assisting in washing away residue from the work piece and/or the abrasive sheet. The means for directing air against the abrasive surface of the platen assisting in the rapid removal of the liquid and the solid matter carried with it.

There are extreme and diverse forces present within that lapping system, with high speed, surface to surface contact, highly abrasive contact, liquid flow, torque forces, centrifugal forces and the like. Many of these forces operate against the primary objectives and needs of the lapping system, in keeping the rotating platen and work piece surface in level and uniform contact with each other. Controls and modifications of the original equipment have to be made to assure improvement of the performance of the original equipment.

SUMMARY OF THE INVENTION

In combination with many of the features and essentials of the copending invention of U.S. Ser. No. 09/036126 described above, the present invention provides additional advances in the field of lapping and polishing including at least the following.

When lapping, grinding or polishing is performed, it is a practice of the present invention to provide an apparatus which places the center of rotation of the workpiece as close as possible to being within the approximate plane of contact between the working surface of the work piece (the surface being polished) and the surface supporting the abrasive. The abrasive used in this practice is preferably flexible sheets of abrasive (such as diamond abrasive sheeting), but this aspect of the invention is also equally beneficial for use with slurry abrasive material or grinding wheels and grinding surfaces.

One method of accomplishing this goal is to construct the work piece holder as a segment of a spherical element, with the widest crossection of the work piece holder having a surface area less than that of a hemisphere of the same diameter of the spherical element. The spherical segment work piece holder is supported by a support which establishes at least three point contact with the surface of the sphere to guide rotation or swiveling of the spherical segment. Most preferably, the spherical segment nestles within a spherical recess, within which the segment of the spherical element will glide to conform to the surface of the platen during lapping or during alignment prior to lapping. The work piece holder may be held or secured within the support by vacuum. There may be fluid flow between the work piece and the support which acts both to seal the vacuum, provide a vibration damping effect, and clean out detritus or swarf from the lapping process.

This type of rotational control on the work piece may also be effected by the use of cylindrical housings. These cylindrical housings are still arcuate, or circular in cross section, preferably with grooves cut within the housing to support bearing elements (e.g., pins or bearings) which move within the grooves. The pins or bearings rotate within the grooves and are secured to an extension such as an axel or frame extension which supports the work piece holder. The extension will usually be connected to the work piece holder at a point which is identical with the center of rotation of the arcuate element (e.g., the center of the circle forming the cylinder).

When a gimbal mechanism is constructed with the use of cylindrical grooved arc housings, it is important to reduce the number of bearing elements that travel in that groove to effect a workpiece holder for grinding or lapping. It is important that the bearing and also the groove not become contaminated with debris resulting from the lapping, polishing or grinding steps. Such debris would increase sliding friction, promote wear and create vibration across wear gaps in the bearing. Also, a method is required to prevent axial motion of the bearings. To maximize the benefits of the present invention, especially by keeping the abrasive surface in plane and otherwise stable, the bearing should be located above the surface of an abrasive platen. At least two pins will usually be located within the groove in the cylindrical grooved arc housing, but three or more are useful, although more than three tends to be superfluous or even less efficient, with more drag and/or greater likelihood for accumulation of materials within the groove that might restrain movement.

To effect the proper positioning of the bearing with respect to the surface of the abrasive platen, a single cylindrical groove can be machined into a gimbal bearing housing segment. Two roller bearings (or sliding pins) can be inserted into this groove with their bearing shafts extending to a gimbal yoke which has a pivot center located some distance below the gimbal bearing mechanism. An alternative bearing could be a close fitting cylindrical segment of porous structural material which would act as an air or liquid fluid bearing. Fluid injected into the porous bearing would tend to self-clean the bearing contact surfaces. Use of triangular shaped surfaces or spherical surfaces on a sealed mechanical needle bearing or on the grooved track also would provide self-cleaning of the bearing surface. An independent bearing element can be used to limit axial motion of the gimbal yokes. If the abrasive contact friction force is directed approximately at the center of gimbal rotation, there will be no tipping torque imparted to the workpiece. Another method of addressing this need is to apply suction through a porous segment of the support to restrict movement of the spherical segment element to act as brake and control gap position.

DETAILED DESCRIPTION OF THE INVENTION

Figure 1:
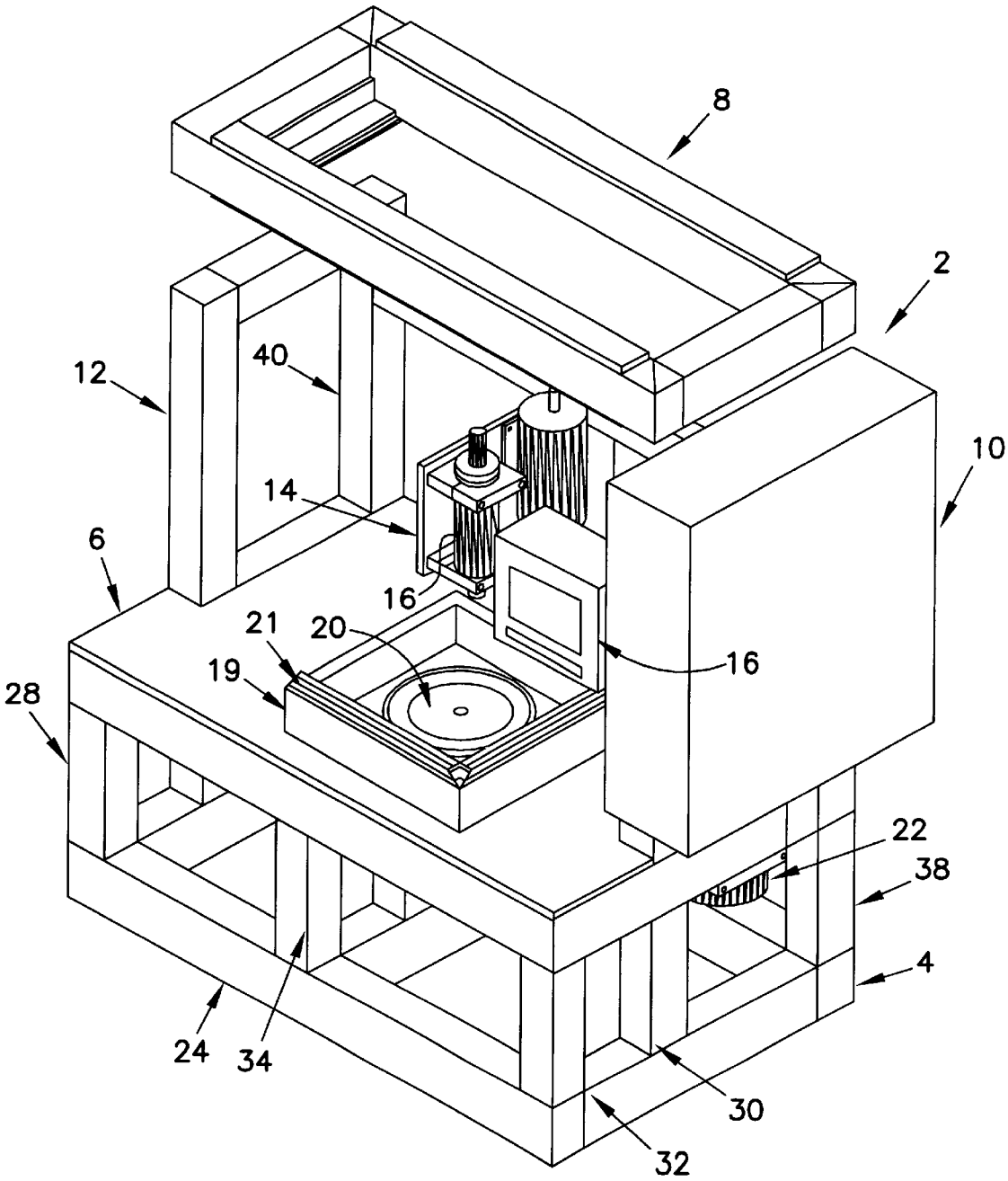
FIG. 1 is a perspective view of a lapping apparatus according to the present invention.

The present invention includes a process for lapping a surface comprising:

a) providing a work piece to be lapped onto a workpiece support, the workpiece having a surface which is to be lapped, b) providing a rotating platen having
   i) a back surface and
   ii) front surface, c) providing an abrasive material on the front surface of the platen with the abrasive facing the surface of the workpiece which is to be lapped, and d) rotating the platen while the abrasive is in contact with the surface of the workpiece to be lapped, and e) supporting the workpiece on a workpiece support having a center of rotation and a support surface for the workpiece, the workpiece support comprising a spherical segment having a thickness along a radius passing through the center of rotation of the workpiece support which is less than the radius of a sphere defining the borders of the spherical segment, and the support surface has a surface area which is less than the surface area of the flat surface of a hemisphere cut from the sphere defining the borders of the spherical segment. The spherical segment element may also be described as a split inverted spherical bearing, particularly a fluid bearing. The spherical segment may be supported by a workpiece support holder which allows the workpiece support to rotate against at least three-point support of the spherical segment by the workpiece support holder. The fluid bearing may be a water bearing. The workpiece and said abrasive effectively and approximately contact each other within a plane which in a preferred practice of the invention passes within 1.5 cm of the center of spherical rotation for the workpiece holder, more preferably within 1.0 cm of the center of spherical rotation for said workpiece holder, and most preferably within a plane which passes within 0.5 cm or 0.25 cm of the center of spherical rotation for the workpiece holder. The process may be performed with an anti-rotation pin present in the spherical segment which is connected to the workpiece support, and the anti-rotation pin restrains the spherical segment workpiece support from rotating axially while allowing the spherical workpiece support to pivot.

An apparatus for lapping surfaces according to the present invention comprises:

a) a workpiece support, b) a rotatable platen having a back surface and a front surface, c) an abrasive material on the front surface of the platen with the abrasive facing the workpiece support, and d) a workpiece holder having a center of rotation and a support surface for a workpiece, the workpiece holder comprising a spherical segment having a thickness along a radius passing through the center of rotation of the workpiece holder which is less than the radius of a sphere defining the borders of the spherical segment, and the support surface has a surface area which is less than the surface area of the flat surface of a hemisphere cut from the sphere defining the borders of the spherical segment. The apparatus may have the spherical segment supported by a workpiece support holder which allows the spherical segment to rotate within the workpiece support holder against at least three-point support of the spherical segment by the workpiece support holder.

The spherical segment may comprises a bearing, for example, a liquid bearing. With such a liquid bearing, a source of liquid, such as water, is provided to the liquid bearing in the apparatus. In the apparatus, an anti-rotation pin may be present in said the spherical segment which is connected to the spherical segment workpiece support, and the anti-rotation pin restrains the spherical segment workpiece support from rotating axially while allowing the spherical segment workpiece support to pivot. The apparatus may provide the platen with air holes for transmission of vacuum pressure to the front surface of the platen. The apparatus may provide a retainer stop attached to the spherical segment workpiece holder which limits a gap distance through which the spherical segment workpiece support can free-fall down and away from a workpiece holder support and also limits the maximum spherical angle through which the spherical segment workpiece holder can be rotated. One particular additional benefit of the apparatus is provided by having the spherical segment workpiece holder with a recessed area into which a workpiece may be set for lapping. There is a cavity provided in the workpiece holder which is recessed away from where the platen would lie. Where a workpiece is thick, and its thickness could extend the point of contact between the work surface and the abrasive beyond the center of rotation for the spherical segment work piece holder, the recess will enable the system to be used with such thicker work pieces without having to configure a much larger system. The recess allows for workpieces of different sizes to be used, with supplemental holders fitted into the recess to accommodate the workpieces of different thicknesses. For example, if the center of rotation were 10 cm from the lowest surface of the recess in the spherical segment work piece holder, a 10 cm thick work piece could be directly set into the recess, or an 8 cm thick work piece with a 2 cm thick supplemental holder, or a 5 cm thick work piece with a 5 cm thick supplemental holder, or a 3 cm thick work piece with a 7 cm thick supplemental holder. This offers flexibility and ease of adjustment to the system.

The apparatus may have the workpiece support holder with a dual-arm gimbal bearing mounted onto the workpiece support holder. The dual-arm gimbal bearing may be mounted such that arms of the dual-arm gimbal bearing extend down past the front surface of the platen. The dual-arm gimbal bearing may be mounted such that arms of the dual-arm gimbal bearing extend down past the front surface of said platen such that bearing axes of the gimbal bearing are mounted above the front surface of the platen such that the spherical pivot center is located 0.1 to 1.2 cm below the front surface of the platen. The dual-arm gimbal bearing may also be mounted such that arms of said dual-arm gimbal bearing extend down past the front surface of the platen such that axes of the gimbal bearing are located 0.1 to 1.2 cm above the plane of the front platen surface. The apparatus may have a mechanical constraint present which allows limited spherical gimbal motion of the spherical segment workpiece holder of up to 5 degrees and also acts to retain the spherical segment workpiece holder away from a spherical segment workpiece support holder. The mechanical restraint retains the spherical segment workpiece support away from said spherical segment workpiece support holder with a gap of, for example, between 0.05 and 0.5 cm. The apparatus may have both a top segment and a bottom segment of the spherical segment workpiece holder have been removed from the sphere defining the borders of the spherical segment. This apparatus may have fluid, such as water, present within a volume created by removal of the top segment of the spherical segment workpiece holder. The apparatus may be constructed with the spherical segment workpiece support having a top portion and a lower portion, and between the top portion and the lower portion is an annular groove. The top portion may have reduced gas pressure applied thereto and said lower portion may have fluid pressure applied thereto. A liquid evacuation dam may be present on the lower portion of the spherical segment workpiece holder.

The present invention, in certain aspects, particularly those related to the use of a spherical segment workpiece holder revolving within a frame which effects at least three point contact with the spherical surface of the work piece holder, relates broadly to the field of grinding, abrading and lapping. The technology in this area, for example, is useful with slurry abrasion, low speed or intermediate speed abrading, grinding or lapping, and the use of rigid abrasive surfaces as well as the preferred high speed grinding with sheets of abrasive material. Other aspects of the invention may have a more limited technical field of application within more preferred embodiments.

For example, apparatus and methods are needed for super high speed lapping at greater than 500 rpm, greater than 1500 rpm, higher than 2000 rpm, and even speeds of 2500, 3000 rpm and greater, equating to surface speeds at the periphery of the abrasive sheet of from about 500 to more than 25,000 surface feet per minute (sfpm, or sfm), depending upon the diameter of the platen and sheet as well as the angular speed. In addition, these higher speeds should be useable with finer and harder pre-made abrasive materials without the use of liquid abrasive slurries. Some earlier attempts at using liquid slurries at high rotational speeds were less effective than desired because of hydroplaning of the liquid slurries, excessively rapid movement of the slurries out of the work area, channeling of the slurry liquid and other effects. The different forces at the different distances from the rotational center contributed to distributional difficulties in the placement of the liquid. The different amounts of liquid slurry at different radial positions caused variations in pressures and thickness at different radial points. These effects in turn caused the lapping to be less even than should be the capability of such lapping systems and materials.

A lapping apparatus according to the present invention comprises at least the following elements:

1) a frame to support a rotatable platen and a workpiece holder;
2) a rotatable platen capable of rotating at least 500 revolutions per minute (e.g., with an at least 6, 8, 10 or 12 inch outside diameter outer edge of the abrasive sheet to attain the desirable level of surface feet per minute, as the surface feet per minute changes at a given rotational speed depending upon the diameter of the sheet at the point at which contact is made between the workpiece and the abrasive sheet.);
3) a workpiece holder; and
4) an abrasive sheet secured to a surface of the rotatable platen which faces the workpiece holder. There are an extraordinary number of subtleties and issues which combine to make the lapping system perform at its maximum efficiency, some of which are independently unique contributions and inventions within the field of lapping, and all of which that are known to the inventors in the best mode of practicing the invention are described herein. The various areas and specific problems addressed by these various methods are listed within this patent. The entire background description of the practice of the fundamental lapping system according to the above identified U.S. patent application Ser. No. 09/03126, filed Mar. 6, 1998 is incorporated herein by reference for all aspects of the disclosure of that invention.

That invention includes at least some of the following.

One process practiced in that invention is a process for lapping a surface comprising:

a) providing a work piece to be lapped, having at least one surface to be lapped which can be adjusted to a position parallel to said at least one surface of a rotating platen,
b) providing a rotating platen having I) a back surface and ii) a front surface with a periphery, said front surface of said rotating platen having a raised edge (preferably symmetrically) disposed about said periphery,
c) providing a sheet of abrasive material having an abrasive face and a back side onto said raised edge to provide a (preferably symmetrical, but see non-symmetrical distributions later described herein) distribution of abrasive material on said rotating platen, said back side of said sheet of abrasive material being on (e.g., in contact with) said front surface of said platen with the abrasive face of said sheet facing said at least one surface to be lapped,
d) securing said sheet of abrasive material to said front surface of said rotating platen, and
   rotating said rotating platen at a rotational speed of at least 500 revolutions per minute, and
   contacting said abrasive face and said at least one surface to be lapped on said work piece.

Another process practiced in that invention may be described as follows:

a) providing a work piece to be lapped, having at least one surface to be lapped which can be adjusted to a position parallel to said at least one surface of a rotating platen,
b) providing a rotating platen within an area which is surrounded by walls on five perpendicular planes (e.g., the four approximately vertical planes and a "floor" plane underneath the rotatable platen) of six planes which would define a cube around said platen to provide a safety box area, said five planes intersecting all extensions of a plane of rotation of said rotatable platen; said platen having I) a back surface, ii) a front surface, and a periphery,
c) providing a sheet of abrasive material having an abrasive face and a back side onto said rotating platen, with the abrasive face of said sheet facing said at least one surface to be lapped,
d) securing said sheet of abrasive material to said front surface of said rotating platen, rotating said rotating platen at a rotational speed of at least 500 revolutions per minute, and contacting said abrasive face and said at least one surface to be lapped on said work piece, said walls intercepting any liquid or debris projected from said rotating platen, and said intercepted debris falling to a lower section of said safety area;

providing a first amount of liquid to assist lapping to said abrasive surface physically in front of an area where work piece contacts said abrasive face, optionally providing a second amount of liquid to assist in washing solid material from said abrasive surface physically after said area, and optionally directing air against said abrasive surface physically after providing said second amount of liquid to assist in removing said first and second amounts of liquid from said abrasive surface.

Still another process according to that invention includes a process for initiating contact between a workpiece to be ground and an abrasive surface comprising abrasive sheeting on a rotatable plate, said process comprising:

a) supporting a workpiece on a workpiece holder, b) supporting said workpiece holder on a linearly movable support, c) advancing the workpiece into contact with an abrasive surface comprising abrasive sheeting on a rotatable platen, d) determining a position at least approximating the position of contact between a surface of said workpiece to be ground and said abrasive surface, e) removing said workpiece from said position approximating the position of contact, f) advancing the workpiece towards said abrasive surface while said rotatable platen is rotating, and g) controlling forces which advance said workpiece towards said abrasive surface and into contact with said abrasive surface.

This process may effect mechanical alignment of said workpiece and/or said workpiece holder to promote parallelity or parallelism between a surface of said workpiece to be ground and said abrasive surface after step c) but before step e). The process may also have said controlling forces providing a contact force between 0.1 and 10 pounds per square inch between a surface of said workpiece to be ground and said rotating platen during lapping of said workpiece while said abrasive sheet is moving with at least 1,500 surface feet per minute while in contact with said workpiece.

The process may also have the workpiece holder supported by a pivot joint and said workpiece holder pivoting upon contact between said workpiece and said abrasive surface to hold a surface of said workpiece to be lapped in a more parallel orientation with said abrasive surface.

It is more preferred with respect to the protective walls that, rather than merely having four essentially vertical walls intercept material which is expelled from the work area by the rotational forces from the rotating platen (and often a rotating workpiece holder in conjunction with a rotating platen), the surfaces (the walls) which are intersected by the plane formed by the contact points between the platen and the workpiece are angled (hereinafter referred to as the intersection plane), sloped or curved so that impacting expelled material is deflected downward from the point of contact by the angle of impact. This is a protective measure which can still be improved by the provision of a lip, movable lip, fixed frame guard or the like which extends from the walls (or continues from the walls as a continuous extension of the walls) to provide additional protection from ricocheting materials. For example, the walls may be curved, and the curve extends from above the intersection plane towards the shaft supporting the workpiece to form an umbrella-like protective area. The extension from the walls may be curved, flat, stepped, movable (e.g., on a rotating hinge so that it may be lifted), slidable (so that it may be moved back and forth to open up the work area if access to it is needed), and the like.

This guard wall or enclosure is neither a trivial matter nor a system which is relevant to traditional lapping. In traditional lapping, much lower rotational speeds, such as 200 revolutions per minute and/or smaller diameters (producing lower surface speeds, e.g., less than 300 surface feet per minute) allow materials such as detritus, used slurry, cooling liquid and the like the flow or stream off the surface at speeds which are comparable to the rotational speeds of the platen. With the much higher speeds used in the present invention, and the use of abrasive sheets, the dynamics, problems, and failure of the system are unique and require differ considerations.

When high speed platen rotation is used with abrasive sheeting failure of the system can occur for different reasons and with different results than in lower speed slurry systems or lower speed abrasive sheet systems. For example, it must be remembered that the clearance between the platen, sheet and workpiece are essentially nonexistent. With the extremely high rotational speeds, events could and do occur as follows. In one circumstance, the workpiece may be advanced into contact with the rotating platen at less than perfect parallelism. If that difference from parallelism is too great, the workpiece may grip and lift, fold, crinkle or crumple the abrasive sheet. Because there is no volume within which the abrasive sheet may move (being confined by the platen and the workpiece), the extremely high speeds of rotation cause extraordinarily high forces to be brought to bear against the platen, the workpiece and the abrasive sheet. The result of these extraordinary forces is an explosion created by the kinetic energy from the high mass inertia and momentum of the platen, but usually also the workpiece, and possibly the broken workpiece holder and the platen become muzzle velocity shrapnel from the apparatus. These exploded fragments of materials do not merely fly parallel to the intersection plane, but spray out of the work area, bounce off each other, ricochet of the walls and floor of the work area, and can seriously injure persons in the area or even damage the environment around the apparatus. This event is unique to combination of the abrasive sheet and the high platen speed of rotation. Neither the abrasive sheeting alone nor high speed rotation (with slurry or powder) creates the forces effecting this explosive event. The guard system is therefore uniquely necessary with the combined system of the present invention.

A process for lapping a surface according to this invention is also described wherein a back surface of the workpiece is pivotally connected to a rotating joint which is in turn connected to a shaft which rotates said workpiece, and said workpiece is allowed to pivot around said pivot joint as contact is made between said abrasive surface and said work piece so that said surface to be lapped becomes more parallel towards said platen after said contact as compared to before said contact.

The process for lapping a surface according to the present invention may also comprise an underlying process of:

a) providing a work piece to be lapped, having at least one surface to be lapped which can be adjusted to a position parallel to said at least one surface of a rotating platen, b) providing a rotating platen having i) a back surface and ii) a flat surface, said back surface having a pivoting joint with a shaft which rotates said platen, c) providing a sheet of abrasive material having an abrasive face and a back side, said back side being on said flat surface of said platen with the abrasive face of said sheet facing said at least one surface to be lapped, d) securing said sheet of abrasive material to said flat surface of said platen, and rotating said platen at a rotational speed of at least 500 revolutions per minute by rotating said shaft, and contacting said abrasive face and said at least one surface to be lapped on said work piece, and allowing said workpiece to pivot around said pivot joint so that said abrasive sheet and said at least one surface to be lapped become more parallel to each other.

One particular advantage of one optional alternative of the present invention (the vacuum hold-down of the abrasive sheet) is the ability of the apparatus to use preformed sheets of abrasive materials at high speeds, and to rapidly and cleanly replace the sheets without significant delays. During lapping and polishing processes, it is often necessary to change the abrasive medium at various stages. In prior art usage of sheets of abrasive materials, the individual sheets were secured to the chuck or rotating face by an adhesive. The adhesive may have been precoated on the backside of the abrasive sheet or applied as coating to the rotating support surface or the backside of the sheet immediately before use. This adhesive coating adds another parameter or variable which must be controlled in attempts to precisely lap surfaces. Even the best coating techniques provide layers which have what are presently considered minor variations in thickness in some fields of use. However, each variation, no matter how small, is part of an additive effect upon the final article. The adhesive creates another problem in that adhesives that are strong enough to secure the abrasive sheet to the platen do not necessarily remove cleanly from the platen with the removal of the sheet. Some adhesives build up on the platen surface, requiring washing or stripping to remove them, if increasing variations in non-planarity of the surface are to be avoided. This is time consuming, labor intensive, and expensive. Where the objective of the system is to provide uniform flatness, even this additional minor variable component becomes undesirable or limiting in the capability of the final article. This is particularly true where the variations can cause uneven or non-uniform exposure of abrasive material towards the workpiece, causing uneven grinding, polishing or lapping of that workpiece surface. The use of rotational abrasive action, particularly at high speeds for short duration, can quickly cause undesirable effects upon the workpiece. When sheets are regularly changed with respect to their degree of coarseness in the abrasive grit, subsequent variations because of the adhesive layers will not only fail to correct the previous errors, but add further variations into the workpiece surface which were not intended. Additionally, some adhesives remain liquid or pliable (e.g., pressure-sensitive adhesives) and the centrifugal forces produced in high speed rotational abrasion can cause the adhesive to shift, flow or shear, altering the thickness of the adhesive layer even while the process is being performed.

One optional, but highly preferred aspect of the present invention therefore is to support a sheet having at least one abrasive work face and a backside on a rotatable support by vacuum forces, and to perform the abrading process with the vacuum forces maintaining at least part, if not all of the contact between the support and the backside of the sheet. Adhesive supplemental forces may be particularly used to advantage where the adhesive contacts or adheres the abrasive sheet and the rotatable platen in a region which will not place the abrasive sheet into contact with the workpiece. For example, where an annular distribution of abrasive is present on the abrasive sheet and the central area has no abrasive and is not brought into contact with the workpiece, the use of adhesive between the platen and the abrasive sheet in this region is quite acceptable, though still not preferred. Although vacuum forces have been used to support or assist in the support of workpieces, there is not known to be any description of the vacuum support of abrasive sheet materials in a high speed lapping process, nor is their any indication of the potential problem with abrasive sheet thickness variations because of the addition of adhesive coatings between the support and the sheet. The references described above, even though they may refer to high speed in production of materials, do not describe rotational speeds in excess of 1500, 2000, 2500 or even 3000 rpm, or expressed in other units, with surface speeds at the periphery of the rotatable lapping platen of at least 550, at least 1,000, more preferably at least 1500 or at least 2,000 sfpm, still more preferably at least 2,500 or 3,000 sfpm, again still more preferably at least 3,500 or 4,000 sfpm, and most preferably at least 8,000 or 10,000 or even 12,000 and more sfpm. Furthermore, it is usually the abrasive segment of the apparatus and process of that prior art which is being rotated (although as shown in U.S. Pat. No. 5,317,836, both a semiconductor wafer and the buff are rotated), while the vacuum secured workpiece remains fixed. There is no teaching in the prior art or consideration of the physical problems which could be encountered in attempting to use vacuum pressure, and particularly only vacuum pressure to support an abrasive sheet at high speed rotational lapping. For example, there is no consideration in the prior art as to whether the vacuum forces could successfully restrain movement of the abrasive sheet materials when forces (e.g., rotational) are applied to the abrasive face. The shearing forces, especially if applied unevenly on the face by non-symmetrical contact with the workpiece, could easily be envisioned to cause the abrasive sheet to shift. This would be disastrous in a lapping system and could well destroy all the earlier polishing steps performed or ruin the workpiece entirely. Although adhesives provide problems as indicated above, a change from adhesive support to vacuum support could have been considered to alter the system in unpredictable ways. As adhesives can elongate with the rotational forces, there may have been some benefit to the use of a somewhat elastic layer under the abrasive sheet, particularly in removing any waves or irregularities in the original positioning of a sheet (although this would not be technically desirable at low speed polishing or lapping since the forces would be less likely to have a significant effect). The use of a vacuum would not allow such elastic behavior in an intermediate layer, as there would be no intermediate layer. This would be another unpredictable effect in such a change from adhesive to vacuum support of an abrasive sheet material in high speed rotational lapping.

In the practice of the present invention, the abrasive sheets comprise sheets of exposed abrasive grit as either a self-supporting sheet or film material or an adhered layer on a support sheet. The sheets may have any type of abrasive material or surfacing on the face which is to contact the workpiece. The preferred sheets are sheet abrasive material manufactured and sold by Minnesota Mining and Manufacturing Company, St. Paul, Minn., and comprises either a polymeric backing sheet with high Mohs hardness abrasive particulates on a coated layer or a self supporting sheet of such high Mohs hardness abrasive particulates. Preferred abrasive material comprises diamond particles or particles comprising small diamond particles supported in a binding matrix (other than any adhesive matrix forming the self-supporting layer or adhering the particles to a support). The sheets may comprise a single layer of material (e.g., a binder with abrasive grit therein or sintered abrasive grit without any other binder) or multiple layers of materials. Such multiple layers could comprise one or more supporting layers, intermediate layers (e.g., primer layers, vibrational damping layers, electrically conductive or antistatic layers, magnetic layers, printed layers, sealer or barrier layers to prevent migration of materials between other layers), and an abrasive outer layer. The single layer, at least one layer in the combination of layers, or the interaction of the combination of layers must be able to support a vacuum against the back surface. Preferably the back surface (of the abrasive sheet) itself is non-porous or low porosity. This is desirable as too much porosity would prevent the sheet from being held against the rotatable support surface. The sheet does not have to be completely non-porous, although this is the preferred method of making the sheets used in the present invention, especially when combined with the vacuum draw-down or vacuum securement of the abrasive sheets. In addition to limiting the porosity of the sheets, the back surface should not have such a degree of topography which would allow free air flow along the back surface when it is being held against a surface by a pressure of at least 8, 9, 10, 11 or at least 12 $lb/in^2$. If there were raised channels, ridges or the like which would allow air flow from the center of the sheet to its outer edges, the pressure would not consistently support the sheet as air would more readily leak out from the region between the support surface and the backside of the abrasive sheet. That construction would be useful, but less preferred in the practice of the present invention.

The abrasive material may be any known abrasive material, depending upon the ultimate needs in the process for grinding, polishing or lapping a particular finished article. The abrasive particulate or raised particulate areas may comprise any solid, hard, material such as silica, titania, alumina, carborundum, boron nitride, homogeneous inorganic oxides (such as metal oxides) or blends of inorganic oxides, diamonds (natural or synthetic), or any other material which is harder than the solid surface to be polished, ground or lapped. The abrasive surface may be abrasive particles bound in a binder, either partially embedded, superficially bound to the surface, or initially embedded so that the binder must initially wear away to expose the particles. The abrasive surface may be a replicated surface structure of a pure abrasive material, an etched abrasive surface, molded surface or the like. The abrasive surface may also be deposited islands of abrasive material, with either physical processes used to place the abrasive (e.g., vapor deposition, screened application of powders which are fused, powder arrays which are electrostatically deposited and bonded to the surface, impact embedding of the particles) or chemical processes (e.g., electrochemical deposition, chemical deposition at seeded sites) to form the particles in a random or ordered manner. The preferred material is an abrasive sheeting manufactured by Minnesota Mining and Manufacturing Co., known as Diamond Abrasive Disks (3M). These sheets are quite effective for the high speed, fine finish lapping processes and apparatus of the present invention. Also useful in the practice of the present invention are diamond particles contained in a metal matrix on a sheet of plastic backing material (e.g., 3M Metal Bond™ Abrasive). The only modification of the sheets which is essential for making them completely compatible with the present invention is having the sheet converted (cut) to fit the abrasion platen. The sheets may be cut into, for example, circular shapes, with or without positioning holes or a centering hole in the sheet. This abrasive sheet material has been able to provide an improvement at high speed lapping which was not recognized at lower speed lapping, where the problem was not notice and/or was not as significant. The 3M Metal Bond™ Abrasive has islands of the abrasive material, as opposed to having a continuous matrix of binder with the abrasive particles therein. The islands therefore allow swarf, debris and liquid to pass between the islands (driven by centrifugal forces) and away from the contact area between the abrasive sheet and the workpiece.

Preferred applications of the present invention relate to the use of abrasive sheeting. When using flexible diamond media for high speed lapping, e.g., at rotational speeds over 4,000 surface feet per minute at the periphery, such as at 8,000–10,000 surface feet per minute, it is desirable to have the media in the shape of an annular ring, e.g., with a twelve inch (30.5 cm) diameter O.D. with an eight inch (20.3 cm) diameter for the opened or uncoated area of the annular sheet (I.D.). It is difficult to hold this ring down to a flat steel platen during operation of the high speed lapping equipment without portions of the annular disk lifting off the surface. It is also difficult to keep the annular disk on center radially on the rotating platen. It is critical that the abrasive media, during the entire lapping process, is held down flat to the platen and on center for stability. Vacuum can be used to hold the media to the platen but radial location and stability is still a problem.

In the manufacture of the flexible abrasive sheets used in the present invention, such as the abrasive diamond media such as Minnesota Mining and Manufacturing Co. (3M) Diamond Abrasive Sheets, the islands of diamond particles are attached to a fabric backing which is then attached to a plastic backing to form the abrasive sheet. The abrasive sheets are then die cut out into various shapes. The twelve inch O.D. by eight inch I.D. annular ring mentioned above could be die cut before attaching the cloth backed material to the plastic backing. Then the twelve inch O.D.×eight inch I.D. flex diamond ring could be attached to an approximately twelve inch die cut diameter plastic backing with about a one half inch (1.27 cm) diameter hole on center in the backing sheet. The use of this backing sheet would allow for more facile vacuum hold down on the entire twelve inch diameter plastic surface (which as a composite or as the layer itself would be less flexible and less prone towards dimensional shifting) and the approximately one-half inch hole (e.g., one-eighth inch (~0.32 cm) to one-and-a-quarter inch hole (~3.19 cm) would securely locate the ring radially on the center post of the platen. This prevents the moving material from forcing the workpiece out of alignment, creating different grinding functions locally, or causing other mischief with the system.

The present invention may be further understood by consideration of the figures and the following description thereof. FIG. 1 shows a perspective of a basic, generic lapping apparatus 2 according to the present invention. The apparatus 2 usually comprises at least a main support frame 4 with a vibration absorbing surface 6 which may be a single layer 6 as shown in FIG. 1 or multiple layers (not shown). The composition of the layer may be thick metal, layered metal, composite, coated metal, and the like. Two thick sheets of metal (not shown) is preferred, with one sheet fixed to the main frame 4 and the other sheet fixed to the frame top 8 at the arms 12 or which is removably attached to the first layer (not shown). There is also conveniently a frame top 8 which may be removably or permanently attached to the main frame 4. An electrical enclosure 10 is shown over the vibration absorbing surface 6. A supporting frame 14 is shown for a workpiece spindle 16. A computer 18 is also shown in the lapping apparatus 2 to provide controls over the operation. The abrasive sheet (not shown) support platen 20 is located at a position on the vibration damping surface 6 over which the workpiece spindle 16 may be positioned. Various positioning systems (later shown) which operate to keep the alignment of the workpiece spindle 16 and the abrasion support platen 20 can be preferred part of the apparatus 2. An abrasion platen drive motor 22 can be seen underneath the vibration damping surface 6. The size of the apparatus 2 is somewhat dependent upon the needs for the user. The length 24 of the base of the main frame 24 may be, for example, between about 3 to 8 feet (0.9 to 2.42 m), the width (not specifically identified) of the main frame 4 may be, for example, between 1.5 feet and 4 feet (0.45 to 1 .22 m), and the height (not specifically identified) of the main frame 4 may be, for example, between 1.5 feet and 4 feet (0.45 to 1.22 m). Greater variations in the dimensions are of course possible, but the preferred dimensions are within this range, and especially between 4.5 feet and 5.5 feet (1.64 and 2.0 m) in length and 2 to 3 feet (0.68 and 0.91 m) in width and height. A heavy construction is preferred, with at least 0.6 cm thick steel plate in the arms 12, 30, 32, 34, 38, 40, etc. (collectively referred to as the arms 12). The arms 12 may be hollow with sheet metal of that thickness or larger, or may be solid. The dimensions of the arms 12 may be, for example, from 2 to twelve inches (5 to 31 cm) a side (assuming a square). This fairly massive composition will keep vibration to a minimum. A four wall box 19 is shown surrounding the platen 20 above its flat surface (e.g., the plane of rotation of the surface). A curved lip 21 is shown at the top of the four wall box 19 to prevent ricochet of exploded pieces and to deflect them down within the box 19, possibly to a collection area (not shown).

Figure 2:
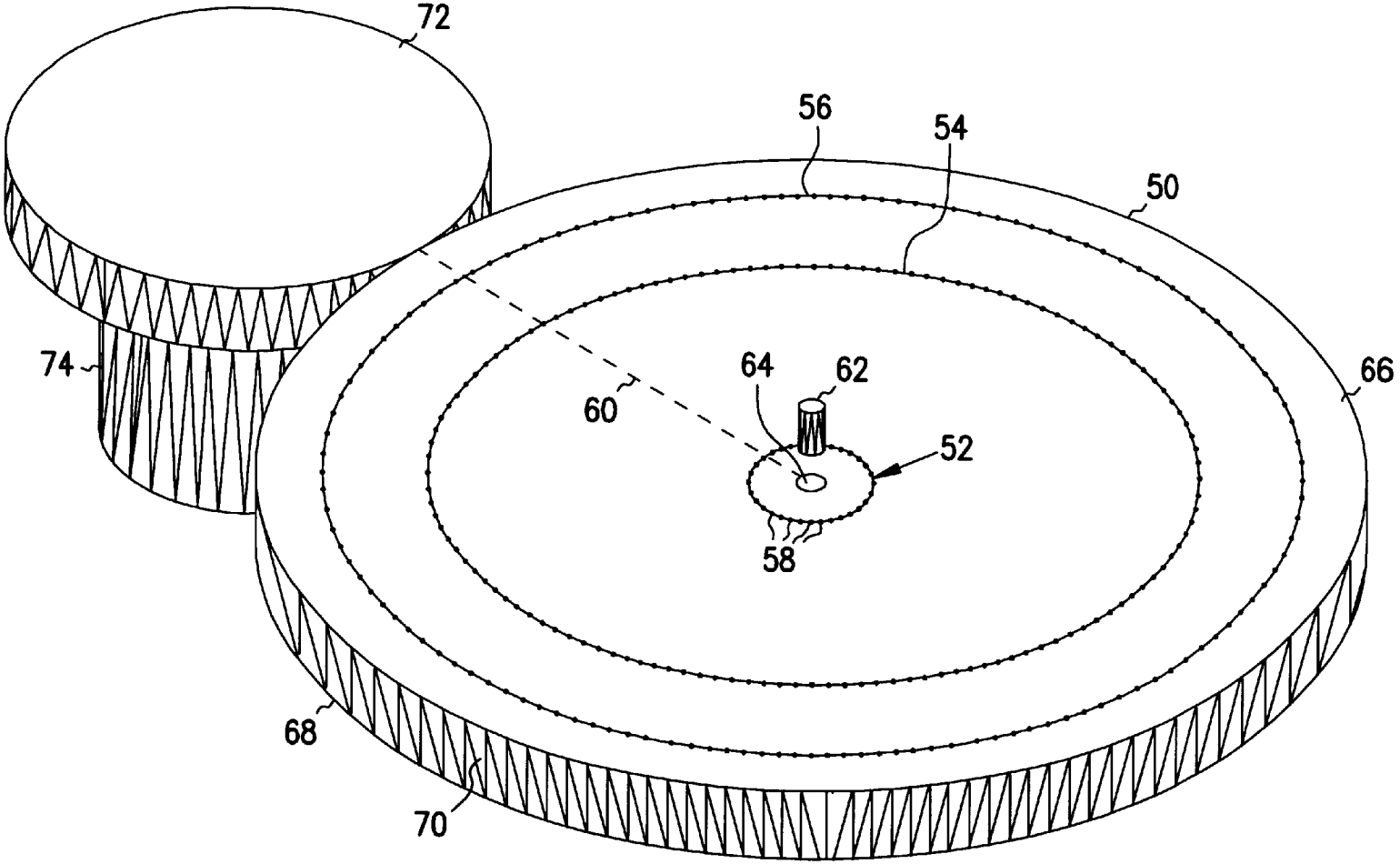
FIG. 2 is a perspective view of a lapping platen for supporting abrasive sheets according to the present invention.

FIG. 2 shows an abrasive platen 50 useful in the practice of the present invention. In the practice of the present invention, a wide range of diameters is useful for such abrasive platens 50. Typical diameters are from 7.5 to 50 cm, more preferably from 7.5 to 40 cm in diameter. The abrasive platens 50 of the invention are provided with a sufficient number of ports or holes (not numbered) to enable a vacuum to be distributed against the backside of an abrasive sheet (not shown). In FIG. 2, three circular distributions of such holes 52, 54, 56 are shown distributed as a series of holes 58. The holes 58 are a convenient, exemplary distribution, but are not essential to the practice of the present invention. Vacuum access to the backside of an abrasive sheet may be provided in many different types of distribution. The distributions do not even have to be symmetrical, but should be reasonably distributed so that sections of an abrasive pad will not lift from the platen 50 during high speed rotation while other areas are secure. There is no need to have an asymmetric distribution of holes 58, but it is a feasible construction. A circular distribution is convenient as the abrasive sheets generally used tend to be circular to fit with the circular motion of rotation and the usually circular shape of the platen 50. Other shapes may be selected, but they would tend to be prone to greater eccentricities in their motion and therefore would be less desirable. The circular set 52 of holes 58 nearer the center of the top surface 66 of the platen 50 help to secure the center portion of an abrasive pad to the platen 50. Likewise, the circular distributions 54 and 56 tend to secure an abrasive pad to the surface 66 of the platen 50 along a radius 60. The number and spacing of holes on the platen surface 66 are designed to secure an abrasive sheet without the holes (e.g., 58) being so large as to deform the sheet into the contours (not shown) of the holes. Holes on the surface are preferably less than 5 mm in diameter, more preferably less than 4 mm, still more preferably less than 3.5 or less than 3.0 mm, and most preferably greater than 0.5 mm and less than 3 mm. The minimum size and number is determined by that number and size which will support a vacuum against the backside of an abrasive sheet. A minimum size of about 0.2 mm is a reasonable starting point for commercial design. Smaller holes would clog too easily from materials produced during operation of the apparatus. More preferred would be diameters of at least 0.5 mm, more preferably at least 0.7, still more preferably at least 1.0 mm. These are average diameters, and hole sizes that differ within each circular distribution or amongst circular distributions are contemplated. Ranges of between 0.2 and 5 mm may generally be used. The circumferential edge 68 of the platen 50 may have engaging grooves or cogs 70. These cogs 70 would be used to engage with driving gears 72 and 74. A motor (not shown) would drive these driving gears 72 and 74 to rotate the abrasive platen 50. It is also desirable to have the material around the edges of the holes hard or abrasion resistant to avoid enlargement of the holes by abrasive grit being drawn into the holes. Abrasion resistant coatings, sacrificial coatings, hardened metal (e.g., hard chrome plating (Rc 80) and the like can be used to strengthen and harden the holes.

FIG. 2 shows an approximately 32.9 cm diameter (13 inch) platen 50 with a centering post 62 which may be a removable centering post 62 inserted into a hole 64 in the surface 66 of the platen 50. In FIG. 2, the first circular distribution of holes 52 at a diameter of about 62.8 mm (2.5 inch) comprises 30 holes having diameters of about 1.5748 mm (0.062 inches). The third circular distribution of holes 56 at a diameter of about 29.2 cm comprises 180 holes of about 1.5748 mm (0.062 inches). The second circular distribution of holes 54 is at a diameter of 22.8 cm (9.0 inches). Radial, rather than circular patterns of holes may be easily placed on the surface 66 of the platen 50. Designs or other patterns, or even random distributions of holes may be placed onto the surface as long as a vacuum can be supported on the backside of an abrasive sheet.

Smoothness and flatness are two characteristics which are used in the art to measure the quality of lapping and polishing performance. Smoothness can be measured by profilometers (either, for example, confocal or stylus) and is measured in linear dimensions and standard deviations or variations from uniformity. Flatness is conventionally measured in terms of light bands, using equipment such as LAPMASTER™ Monochromatic Lights (e.g., Models CP-2 and CP-1) in combination with flat glass over the surface to be evaluated for flatness. The use of light band units (e.g., the number of lightbands per unit of horizontal dimension on the surface being evaluated, e.g., per inch) can measure surface flatness within millionths of an inch. Curvature of radiating lines away from a line of contact between the glass and the surface against which light is being projected would indicate a degree of convexity to the surface and lines curving towards the point of contact would indicate a degree of concavity. Straight, parallel, evenly spaced lines indicate true flatness. Normal lapping procedures of the prior art are able to achieve 1–2 lightbands of smoothness, but the process commonly takes hours, depending on the material started with. Particularly when the material is hard (e.g., tungsten carbide or special alloys), conventional lapping is performed in hours, not necessarily including the necessary cleaning time. The use of the apparatus, processes and materials of the present invention can easily achieve 4–5 lightbands of smoothness in minutes (e.g., 5 minutes or less), and with apparatus and processes combining all of the improvements described in the present invention,. 1–2 lightband smoothness has actually been achieved in less than an hour (e.g., 15 minutes or less, even at 10 minutes), which time included replacement of sheets at the various stages and time for normal cleaning operations. Other conventional parameters of lapping have been exceeded by practice of the technology of the present invention.

It is a standard assumption, proven consistently by reported data and analysis, that lapping with abrasives causes fracturing within the workpiece to a depth which is equal to the average diameter of the abrasive particles. That is, if the average size of particles in a slurry or coated on a sheet are 50 micrometers, the workpiece, from that operation, will show microfracturing on the lapped surface which is equal to the average diameter of the abrasive particles used to lap the surface. Each successive lapping operation (e.g., starting with 50 micron, then 10 micron, then 2 micron particles) will leave successively smaller microfractures, but each will be approximately equivalent to the average size of the abrasive particles used in the last lapping step. The amount of material removed in each lapping step, however, will more nearly approximate the degree of damage created in the previous step. Therefore, if 50 micron particles are used in one step and 10 micron particles are used in a second step, the second step will remove approximately 50 microns (the damaged depth remaining from the previous step) and itself leave a damaged depth of about 10 microns. By operating at speeds of at least 500 rpm (that is surface speeds of at least 1000 surface feet per minute), diminished amount of microfracturing (where individual grains of material are broken loose, resulting in "pick-out") has been reported in some cases in the practice of the present invention. By using higher surface speeds, the microfracturing continues to be reduced until microfracturing pick-out as little as or less than 90%, 80%, 70%, 60%, and even 50% of the actual average diameter of the abrasive particles occurs in the work piece. This is a potentially improved characteristic of the lapping effect of the present invention. No other lapping operation is known to provide this reduction in pick-out. This is a definable aspect of a process according to the present invention, and may be seen in many different materials, such as in tungsten carbide, blends or alloys of metals (e.g., copper and tungsten), plastics, composites, etc. The process also tends to smooth out non-homogeneous mixtures with less gouging of material, thus leaving fewer holes or pits in the surface because lapping and polishing, rather than gouging, is being effected. Even when performing conventional lapping processes using slurries of individual abrasive particle material in liquid carrier, low speeds of 5–200 revolutions per minute (rpm) are normally used. Some processes do use higher speeds with slurries up to 2500 rpm, for example, and the pressures used to hold the rotating platen face and the work piece face together are perhaps 200 pounds with a 10 cm by 10 cm work piece face (which is about 12.9 pounds per square inch contact force). It is considered by abrasive technology researchers that a primary method of material removal from the work piece is for the individual abrasive particles to roll along between the piece part and the platen, rolling off or flattening high spots, or the abrasive particles are dragged along by the moving platen and shear off high spots. In either case, because the average normal clamping force is high, very large localized forces are concentrated against individual grains or areas of the piece part material at its surface. These localized forces are strong enough to weaken and break the bond between the grain in the piece part and the main bulk of the piece part at the grain boundary. Subsequently, the loosened grain will be forced out of its original position and leave a void, pocket or pit where it was originally located. These pits are referred to in the art as "pick-outs" and are very undesirable.

With high speed lapping according to the present invention, the normal (perpendicular) force can be generally much lower than in lower speed lapping processes, being as low as 10% of the forces normally encountered in lower speed lapping, such as only 20 pounds (8 kg) of normal force for a 10 cm by 10 cm work piece. As noted above, the contact pressures in the practice of the present invention may range from 0.1 to 100 psi, but are more preferred between 0.1 and 10 psi, still more preferred between 0.1 and 5 psi, and most preferred between 0.1 and 3 or 0.5 and 3 psi. Because this normal force is so much less, the localized forces on individual grains and abrasive particles are reduced and much less fracturing of the piece part surface and grains on the piece part surface occur. Pick-outs on the surface have been shown to be reduced by from 10 to 90% as compared to surfaces with the same flatness, so that the smoothness of the surface is improved even while the good flatness is preserved. This is particularly important in the lapping of blends or composite materials where the surface to be lapped is not uniform on a molecular scale (e.g., solid state solution), but rather provides a surface with regions of different materials (e.g., particles in a matrix, dispersed metal in a matrix, etc.), and where different responses to the action of abrasive grains may be experienced in local areas of microscopic proportions. For example, where blends of metals are present (e.g., tungsten and copper), high speed lapping will tend to cut off both metals by impact fracture at the same level or height, providing a superior surface finish (less roughness, more smoothness).

With the very high speeds of the abrasive particles in the practice of the present invention, particularly at speeds above 7,500 or above 10,000 surface feet per minute, as compared to 1,000 surface feet per minute, a completely different mechanism of lapping appears to occur on the smallest levels of the materials. With the higher speed lapping by particles on the abrasive sheet, the tops or high spots on the piece part surface appear to be removed by impact fracturing in addition to involving the normal mechanisms and effects of shearing and rolling down high spots. Removal of excess tall material by the mechanism of impact fracturing results in lower levels of disturbance to grain boundaries between grains in the piece part and reduces the number of individual grains being broken loose.

Another significant advantage of the use of the abrasive sheets at high rotational speeds according to the present invention is that wear on the platen surface itself is greatly reduced. In slurry processes, the abrasive action works equally forcefully against the platen face and can eventually wear off the surface of the platen to a degree where the platen would have to be replaced. Even though the wear would of course tend to be even, there is no functional reason to continually sacrifice or wear out the platen. Some uneven patterns of wear may develop in the platen, and these would be translated into uneven lapping of the piece part.

Other features of the lapping apparatus of the invention, problems addressed, and solutions to these problems are also described herein. They are numerically listed below.

1. FLEXIBLE PIVOT TOOL HOLDER

Problem: When grinding or lapping single or multiple piece parts held by a tool holder with a typical diameter of 4 inches held by a center post, the tool holder is slowly (or quickly) rotated as it is presented downwardly and vertically. This movement is intended to uniformly contact the work piece and an abrasive surface rotating at very high speeds of from 2000 to 3,000 rpm (this can effectively be equivalent to more than 9,000 surface feet per minute (sfpm), depending upon the diameter of the platen. During this process, it is important that the piece part holder be "flat" so that the piece parts which contact the abrasive first are not damaged. This would be the case if the holder had one edge lower than another in its presentment to the abrasive sheet. Furthermore, with high speed lapping and grinding, it has been found to be important that the piece part holder assembly be held by a ball or gimbal pivot type of device located as low as possible toward the high speed abrasive surface. This is the best design found to align the total piece part assembly so all the individual parts (e.g., the platen carrying the abrasive sheet and the work pieces) are floated equally by the thin boundary layer of coolant fluid on the surface of the disk which may be less than 0.001 inch (0.0254 mm) in depth. Boundary layers do not normally remain constant as the distance from the leading edge (contact point or liquid introduction point, or radial distance on the platen or circumferential distance along the tangential distance on the workpiece). The changes in the thickness of the boundary layer cause significant variations in platen separation distances from the work piece and effective variations in penetration of the workpiece by abrasive particles on the sheet. With this type of ball or gimbal pivot, the piece part tends to lay flat with respect to the platen abrasive and also this boundary layer thickness has a tendency to remain uniform even with slight out-of-perfect-perpendicular alignment between the vertical piece part holder shaft and the high speed abrasive platen. Foreign debris can be accumulated in pivot joints and create unwanted friction.

Solution: A work holder device is created with the use of a special ball attached to a shaft which ball and shaft combination provides a pivot action close to the bottom of the work piece holder assembly. A sandwich of washers acts as a rigid base to transfer downward a polishing normal force on the vertical shaft to push the piece parts into the abrasive platen. The pivot action is restrained by encapsulating the whole assembly with room temperature vulcanizing (RTV) silicone rubber or other elastomeric resin (e.g., fluoroelastomers) which seals the unit from debris and also provides the function on an elastic restraint that self centers the disk type part holder perpendicular to the axis of the support shaft. Yet the elastic spring which centers the unit is weak enough to allow conformal pivoting of the assembly during lapping action. Thus when there is little side load present, as when lowering the piece part assembly, the unit is flat aligned. But when the assembly is subjected to a normal force, the unit is free to pivot. A piece part holder with the back stem and RTV resin was constructed and used in a piece part assembly for lapping optical connectors and appeared to function well.

2. ABRASIVE METAL POLISHING MACHINE

Problem: The surfaces of metal objects are polished for many reasons including for optical examination of metallurgical characteristics, to create a smooth, low-wear, tight hydraulic or fluid seal and others. Usually this polishing is done at low speed (e.g., 5–200 rpm), with rotating flat platen disk wheels of various types of construction molding aluminum, steel, plastic cloth and others. The wheel surface is very flat and the workpiece to be polished is held with controlled pressure by hand or work holder. Water or other fluid, such a lubricant or wetted abrasive particles are introduced as a slurry, or disks of fine abrasive sheets are "stuck" or bonded to the rotating wheel. This process is slow to produce a highly polished surface, and it is labor intensive if not automated. Inaccurate platen or shaft machining, loose bearings, or weak machine structure and framework may cause polishing accuracy problems.

Solution: The present invention enables very high quality polishing which can be achieved in a fraction of the conventional lapping time by using abrasive sheeting, such as 3M brand of micro abrasive disk sheets, for polishing at very high speeds of 2,000 rpm and more using disks about 8–10" in diameter. However, it is critical that the rotating platen disk run very "true" and flat at the operation, speed range to provide a mechanically stable moving surface against which the to-be polished workpiece is held stationary with a controlled normal force or pressure (against the fine particle wetted abrasive). Options also may change the pressure as a function of process time or the workpiece rotated to distribute polishing across the surface.

A unique method to provide a very "flat" and accurate stable rotations platen disk surface would be to mount the platen to a "weak" shaft which allows the rotating disk mass to seek a true "smooth" center at speeds above its first rotating natural frequency. The motor drive speed would be increased above its natural frequency, the workpiece part presented in contact for polishing; then removed prior to reducing the disk RPM below its critical harmonic speed.

3. REDUCTION OF HYDROPLANING

Problem: The presence of liquid on the abrasive surface adjacent the work piece has combined with higher rotational speeds to generate significant hydroplaning of the liquid and unequal forces on the face of the abrasive sheet and the work piece at differing positions along the radial distribution from the center to the outer edge of the abrasive sheet and also along the tangential contact length of the piecepart surface. The liquid is often essential to control heat, friction and cleansing of waste materials, and can not be easily removed.

Solution: The greatest needs for the liquid are 1) to control friction between the abrasive surface and the work piece, 2) control the temperature of the sheet and the work piece, and 3) to wash away residue of abrasive and abraded material from the work piece. These effects do not have to be performed at the same location between the sheet and the work piece and do not need the same amount of liquid (e.g., water, lubricant, coolant, etc.) to accomplish the separate tasks. The inventor has recognized that the amount of water needed to affect friction (a surface phenomenon, and essentially two-dimensional [very thin] amounts of liquid may be effective) tends to be much less than the amount needed to control temperature (a bulk, three-dimensional phenomenon) and waste removal (a three-dimensional and mass flow process). With this recognition, it has been found that liquid may be applied to the lapping process of the present invention with controlled amounts, specified positions, and timed introduction to perform the process with reduced likelihood of hydroplaning because of reduced amounts of liquid between the abrasive (as a sheet or other form) and the work piece. This is accomplished in the following manner.

The abrasive sheet is of a sufficient size relative to the work piece that less than fifty percent (50%) of the abrasive surface will be in contact with the work piece surface during lapping. Preferably less than 40%, more preferably less than 25%, and most preferably less than 15% of the total surface area of the abrasive sheet is in contact with the work piece during lapping at any specific time. The area where the abrasive and work piece are in actual contact is called the work area. In a zone or area rotationally before the work area, water is placed on the surface of the abrasive sheet. The amount of liquid (e.g., water) provided is preferably less than 120% by volume of that amount sufficient to fill the valleys between the peaks of the raised abrasive particles (100% essentially forming a smooth, continuous layer of liquid over the abrasive material). More preferably it is less than 110%, less than 100%, but at least 30% of that filling volume of liquid. Preferably the amount is between 30% and 120%, more preferably between 40 and 115%, still more preferably between 50 and 110%, and most preferably between 90 and 105% of the volume necessary to exactly fill the valleys on the abrasive sheet so that an essentially flat film of liquid appears although surface tension between the peaks and the film may distort the appearance so that slight circular patterns may appear without dry exposure of more than 20% by number of the particles. This approximately 100% volume amount is called the "leveling amount of liquid" in the practice of the present invention.

At a zone which is rotationally before the work area, a first amount of liquid equal to 30 to 120% of the leveling amount of liquid is placed on said abrasive surface. The area where this is performed is called the wetting area. On the surface of the abrasive sheet, rotationally after the work area, a second amount of liquid is applied to said abrasive surface, said second amount being both sufficient to have the sum of said first amount and said second amount equal to at least 120% of said leveling amount of liquid, and equaling at least 30% of the leveling amount of liquid. Preferably the total of said first and second amount comprises at least 150%, more preferably at least 170% of said leveling amount. Likewise, it is preferable that the amount of said second volume is equal to or greater than at least 50% of said leveling amount, and more preferably at least 75% or at least 100% of said leveling amount. This second volume will assist in carrying or washing the total residue on the abrasive sheet (the residue abrasive and the swarf from the piece part). The second volume is applied in what is referred to as a flood area on the abrasive surface. The high rotational speeds will remove a significant amount of the liquid and total residue on the abrasive surface, but because of the high quality sought in the lapping performance of the present invention, this may not always be relied upon. To improve the removal of the liquid carrying the total of the residue, air blades (e.g., hypodermic air knives) can be positioned between the flood area and before the wetting area. The air blades, in combination with the rotational forces, will remove a very high percentage of the applied liquid and the total residue so that an essentially dry surface can be assumed to enter the wetting area. To whatever degree it is found that not all liquid is removed by the rotational forces and air knives, the first amount of liquid may be reduced so that the appropriate percentage of leveling is provided.

Figure 4:
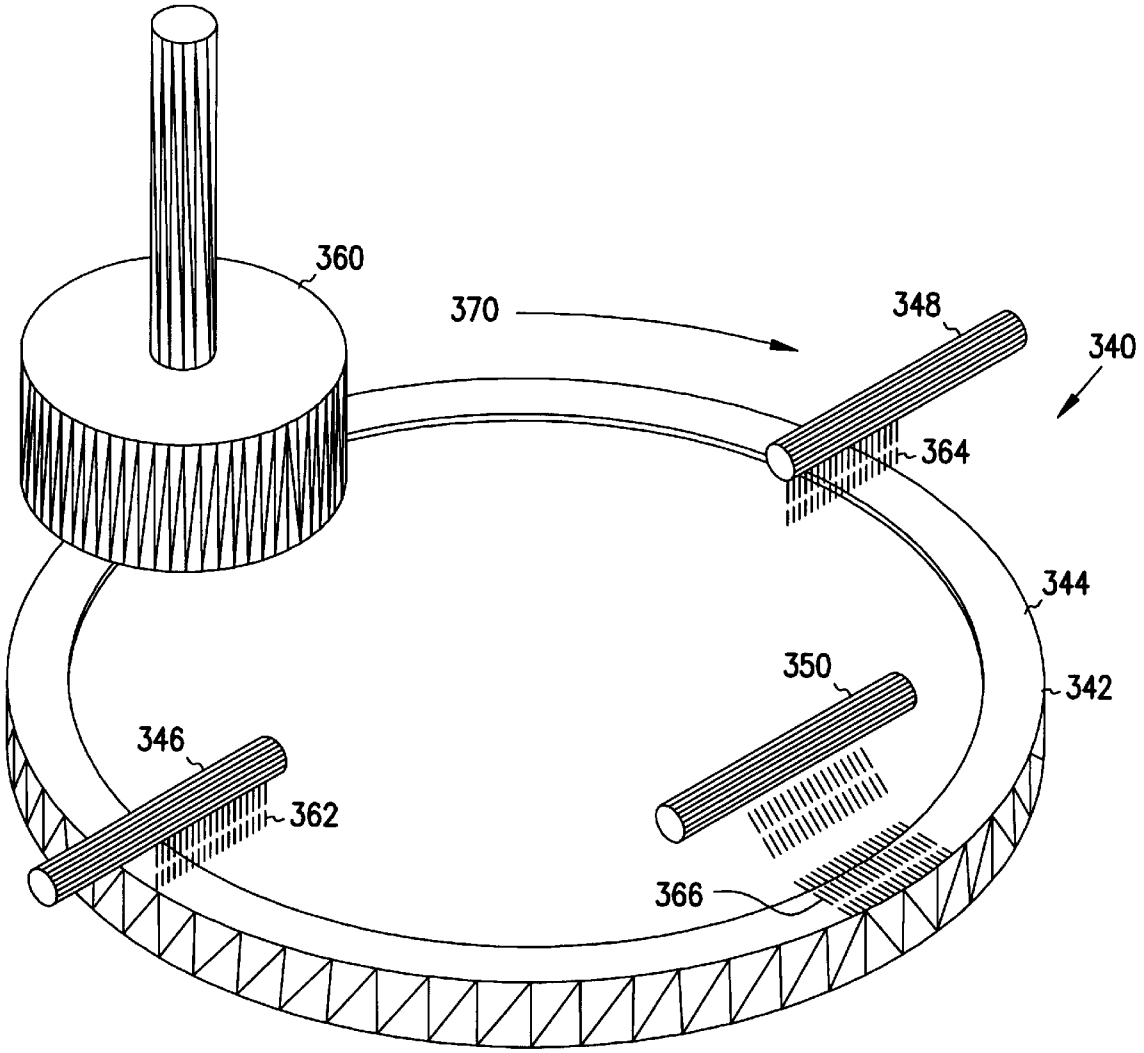
FIG. 4 is a perspective view of an apparatus for applying liquid to the surface of a lapping platen according to the present invention.

The schematics of this apparatus and process are shown in FIG. 4. A water controlled system 340 according to the present invention is shown comprising a platen 342 having an annular distribution of abrasive sheeting 344. The annular distribution 344 is preferred, but not required in the practice of the present invention. A first liquid (e.g., water) supply means 346 lays over said annular distribution 344. A second liquid supply means 348 is also shown to overlay the annular distribution 344. An air blowing means 350 is also shown to overlay the annular distribution 344 on said platen 342. A work piece 360 is shown over the platen 342. The rotation direction 370 of the platen 342 is such that liquid 362 deposited from said first liquid supply means 346 is upstream of the work piece 360. The liquid 364 provided by said second liquid supply means 348 is located downstream of the work piece 360. The air blowing means 350 is downstream of the second liquid supply means 348. The air blowing means 350 provides sufficient volume and intensity of air movement to assist in removing liquid 366 which had been on the platen 344.

4. PLATEN FLATNESS GRINDING

Problem: After a high speed 3,000 rpm, 12" (30.5 cm) diameter rotating abrasive platen has been manufactured and used on a lapping machine, it does not remain perfectly flat as originally machined. A platen which has been ground or damaged by wear or impact away from a required or desired flatness is no longer effective for high precision. For example, a platen should have a deviation in flatness of less than 0.0005 inch (0.0126 mm) at the outer periphery with a need for the best performance to reach 0.0002 inch (0.00508 mm) or less than 0.0001 inch (0.00254 mm). The platen should be flatter than the variations in thickness of the rotating abrasive disk surface. The platens are ground to the above tolerances (e.g., less than 0.0126 mm variation in thickness along an entire circle within the disk surface). These measurements can be made, for example, with a micrometer or other linear measuring device. The flatness is measured by reading the variations in thickness along such circles within the disk surface. The abrasive sheet (e.g., the diamond sheeting) lays relatively flat on the surface of the platen, but is expected to have some variations in thickness of the backing material (e.g., plastic film, such as polyester) and the abrasive coating. However, it is desirable to minimize variations and prevent additive deviations from occurring. This measurement can be made by a dial indicator placed at the outside diameter and the disk rotated by hand for one revolution to measure the maximum excursion. Any deviation acts either as a "valley" where the abrasive does not contact the piece part or a "high spot" which is the only area that contacts the piece part. When the disk rotates at its normal high speed, the high spot will have a tendency to hit the piece part and set up a vibration which will reduce the smoothness of the lapping abrasive action. Localized distortions of the platen surface will also have a tendency to penetrate the boundary layer of liquid between the platen (covered with a thin sheet of diamond or other coated abrasive) and the piece part. This can produce a localized scratch or track on the piece part surface. Any surface defect on the platen structure is generally transmitted through the thin abrasive disk and produces a bump or high spot on the disk.

Solution: An existing platen can be "dressed" as a machine by bringing it up to full high speed RPM and lowering a heavy flat abrasive coated piece unit directly onto the bare rotating platen and grinding or lapping off the bumps. High spots and even full out-of-flatness surface variations can be removed by first using a coarse abrasive and progressively using finer abrasive or lapping abrasive medium. A typical first abrasive may comprise 40 micron metal-bonded diamond and a final abrasive may comprise 3 micron or less diamond or ceramic abrasive depending on if the platen surface is chrome plated, stainless or base steel. The abrasive lapper disk could be oscillated back and forth across the platen, it could be stationary or it could rotate at either slow speed or rotate at a very high speed so the tip speed of the grinding disk will provide uniform removal of platen material at the low surface speed of the inner radius of the platen. Different geometries of adhesive disks could be used. Also a piece part holder already in use for normal lapping could be used to perform this function.

5. LAPPER PLATEN SPIRAL SURFACE

Problem: When lapping or grinding at high speeds of 3,000 rpm on a 12" (30.5 cm) diameter platen producing perhaps 8,000 to 12,000 surface feet per minute (sfpm) of surface lapping speed by use of wetted plastic disks coated with thin layers of diamond or other abrasive material, it sometimes is a disadvantage to have a uniform flat disk surface in flat contact with precision piece parts. This is because the fluid boundary layer of the wetting liquid has a tendency to draw the piece part down to the flat surface of the rotating platen and create large fluid adhesion forces. These fluid adhesion forces require more force to hold piece parts in combination with bigger motors and require the use of larger and heavier holding devices for piece parts. This may also create a lower rate of metal removal and the further disadvantage of the grinding debris being carried along between the abrasive disk and the work piece surface. This can produce scratching or other disturbances on the work piece surface.

Solution: A precision ground rotating platen can be fabricated with slightly raised spiral surfaces having different shapes and/or patterns, these shapes or patterns varying from the inside center of the platen toward the outer periphery of the platen. The spiral patterns would create land areas at the top surface of the platen of the various widths, shapes with areas between these land areas that are somewhat lower, perhaps from 0.002 inch to 0.010 inch (0.051 to 0.254 mm) or more. Then a thin plastic coated abrasive disk that is uniformly coated with precision fine abrasive (e.g., the 3M diamond abrasive sheet material cut into disk form) would be mounted onto the round platen and held in place by vacuum holddown holes either on a raised land surface or on the lower surface area or a combination of holes in both areas. The raised land areas could be produced by manufacturing a precision platen and acid etching or photolithographically etching land area geometry configurations. When the abrasive disk is mounted on the platen, only some portions of the disk would be in contact with the piece part being ground or lapped. The boundary layer of fluid coolant would be affected by the length of the land area under the piece part, the direction the spiral, radial or circular annular land shapes or a combination of the geometries. The effects on the boundary layer thickness would be the rotation speed of the platen, as related to the vector speed, including the direction of the surface relative speed between the two, the viscosity of the fluid, and the normal force pressure of the piece part holding it to the platen. The boundary layer thickness, which would vary over the surface of the piece part, would affect how the individual particles of abrasive (normally protruding about ⅓ of their size above the binding agent) effectively abrades a workpiece from the surface of the abrasive disk. If more liquid is applied, the boundary layer would tend to be thicker and less abrasive material removal is achieved. Thus the local pattern of the surface of the abrasive contact area can be utilized for the optimum grinding action using only one portion of the abrasive disk with the non-raised section between the land areas of the abrasive allowing free passage of grinding debris. When this surface area of the abrasive is worn, the disk can be unmounted by the vacuum chuck, rotated to a "fresh" area of the abrasive, and then grinding would be continued. The disk will remain uniform and strong throughout an extended service.

6. DOUBLE DISK GRINDING

Problem: Again, the problem to be addressed is hydroplaning, which distorts positioning of the abrasive surface and the work piece relative to each other. Especially with relatively thin or flexible work pieces (e.g., work pieces thinner than 10 cm, especially thinner than 5, 2, 1, or 0.5 cm), the worst distortion of the positioning occurs because of bending or flexing of the work piece. This is because the flexible sheet may be supported on a relatively inflexible support platen.

Solution: Two rotating platens may be provided, one each on opposite faces of the piece part or work piece. The work piece is secured against movement between the two abrasive surfaces (on the two rotating platens). The two rotating platens are rotated at the same time, in the same or opposite directions, with similar amounts of liquid applied between each platen and the work piece. The disks do not have to be rotated at the same speeds, and when this is done, the volume flow rate of liquids used need not be as similar since the respective hydroplaning forces are proportional to the speed and the volume flow rate of liquid. The relative speeds of rotation and the relative volume flow rates of water are selected so that the hydroplaning forces are fairly similar at the opposite outer edges of the work piece. With similar forces pushing against opposite faces or sides of the work piece at similar radial distances, there is no effective flexing force applied to the work piece. The increasing forces along the radial directions of each face of the work piece will be nearly equally balanced by similarly distributed increasing forces on the opposed side of the work piece. The two forces thus cancel each other out and there would be no flexing from hydroplaning. The film of liquid between the abrasive surface and the work piece would then remain essentially the same from where it was introduced to where it exits at the periphery. The speed and volume flow of the liquid would actually decrease from the central region to the exterior region at any given point along a radial line.

7. VACUUM CHUCK HOLDER

Problem: It is difficult to quickly load piece parts onto a piece part holder for use with a high speed lapping and polishing system. Also, it is difficult to generate a flat parallel system of polishing parts where 0.001" to 0.002" (approximately 0.025 to 0.051 mm) of material is removed from a surface to make the surface smooth, perhaps with variations of no more than 4 lightbands in smoothness, while the surface remains flat and parallel. Hot melt adhesives are presently used to fix piece parts onto the piece part holder. The use of these adhesives is slow and cumbersome to apply. The residue of the adhesives are also difficult to remove, and may contaminate the precision surface of the piece part for later use. Typically, the piece part holder has a gimbaled spherical ball end to freely allow the part to move about radially to self align the piece parts (one or more) with the surface of the rotating abrasive platen.

Solution: A piece part holder can be constructed out of a heavy metal such as steel which has substantial mass very close to the surface of the abrasive disk. The piece part holder unit will be allowed to move freely with the surface by the ball-end holder. A substantial hole can be made within the ball-end device which would allow vacuum to be coupled to the piece part holder. Individual part pockets will firmly hold the flat piece parts tightly against the individual tight fitting part pockets to create and maintain a good vacuum. A thin layer of oil or grease can be applied to the piece part to seal any leakage paths. By simply removing the vacuum applied by a rotary union to the drive shaft open inside diameter, the part is released, it may then be turned over. The opposite side may then be lapped to produce a high quality surface which does not damage the already lapped side because intimate part-to holder contact is not made, the parts being separated by the film of oil. The part pocket is still stiff enough for good polishing action.

8. ABRASIVE DISK WITH AN ANNULAR SHAPE

Problem: When using a diamond (or other fine and hard abrasive material) abrasive disk rotating at very high surface speeds of 10,000 sfpm, most of the abrasive cutting action takes place at the outer periphery of the disk. The inside area of the disk has low surface velocity and low cutting action and also low wear rates. When a piece part traverses the disk in a sweeping motion, to prevent wearing of tracks or grooves in the abrasive, there is uneven wear at the outer and inner surfaces of the disk. There is typically a small ¼, ½, or ⅝" (0.626, 1.27, or 1.58 cm) diameter hole at the inside of the disk. The hole is usually centered to act as a positioning means to fix the abrasive disk at the center of the platen to obtain good balance for the very high speed system. A larger diameter round section could be removed from a disk to create an annular ring of acting abrasive material somewhat larger than the piece part. This would eliminate the inactive (and raised) uneven section but then the centering registration hole for positioning the disk is lost.

Solution: A disk can be fabricated with abrasive coated or exposed on the entire surface of the disk. The inside section of the abrasive disk, toward the center of the disk, could be removed by grinding or peeling off the abrasive, leaving the backing material intact with a raised section of the abrasive in an annular outer ring. The raised area is only where the abrasive is raised above the surface of the carrier (by the coating thickness). The disk backing material is usually plastic sheet, which may be reinforced. Another way to construct an annular ring would be to punch out a center disk section (e.g., a disk of 2 to 6 inches, 5.1 to 15.3 cm) of the disk for separate use and then use a centering plug (e.g., a 5.1 to 15.3 cm thinner disk) with a small locating hole. The plug could be centered on a platen center post and the annular disk centered on the plug. When the disk or annular ring plus disk is fixed into place by the vacuum grip platen, the plug is or may be removed to enable complete freedom of movement of piece parts over an annular disk. This complete movement can be effected since the centering post may also be removed after the annular disk has been positioned and secured by the vacuum.

The process of using an annular disk element can be effected where the round sheet has an outer edge and an inner edge defining a cut-out portion and comprises an annular sheet, said inner edge having a diameter which is greater than one-third the diameter of said outer edge. The process may also be performed where said sheet is round and said round sheet has an outer edge and an inner edge defining a cut-out portion and comprises an annular sheet, said inner edge having a diameter which is greater than one-third the diameter of said outer edge.

9. VACUUM ADHESIVE HOLD-DOWN

Problem: When lapping or polishing at very high surface speed of about 10,000 surface feet per minute, it is difficult to mount piece parts onto a rotating holder. The piece part holders are used for contacting an abrasive disk mounted or constructed on a rotating platen. The parts must be held in a sufficiently rigid manner that they are not broken loose from their mount. It is also desirable to avoid a localized vibration of the typically thin flat piece part (which vibration is induced by the high speed contact with the rotating platen). Vibrations can cause patterns of uneven polishing on the surface of the precision part. It is desirable for efficiency that one or more piece parts are processed at the same time and that both mounting and unloading of these parts can be done quickly and easily to provide cost effective polishing rates of production. Furthermore, it is desirable to have a method of changing parts quickly so that one side be lapped, that part turned over and the second flat side be lapped to be very parallel to the first side. This must be done when typically 0.001" to 0.002" or less is removed from each side.

Solution: Thin piece parts of about 1"×2"×0.080" (2.54×5.08×0.23 cm) can be mounted onto an individual piece of pressure sensitive adhesive (PSA) tape and this taped piece part can then be held by a vacuum to a workpiece holder. The friction properties of the non-adhesive side of the tape would be controlled by selection of tape backing material or by surface conditioning of the backside of the tape to provide a sufficiently high degree of friction which would resist lateral dynamic forces in a plane along the surface of the thin workpiece as the nominal 14 pounds per square inch (psi's, 25 inches Hg vacuum, 6635 mm Hg) would apply a normal force holding the work piece. A large section of adhesive tape could be used to hold a number of workpieces at the same time. This would allow fast and easy installation of the workpieces by hand or robot. This flexible assembly of pressure sensitive adhesive (PS) secured workpieces could than be held in position against a precision flat surface of a workpiece holder having random vacuum holes over its surface which would all be sealed by the wide and complete expanse of tape covering the vacuum holes and at the same time firmly holding the individual workpieces to the holder. To process the other side, the group of workpieces would be removed, new tape would be applied to the lapped surface side, and the tape on the unprocessed side would be easily peeled off. The tape would not only fix the parts to the holder surface, but also would protect the precision lapped side from any scuffing action or rubbing on the holder.

10. SPRING-CENTERED WORKPIECE HOLDER—Coiled Vacuum Hose

Problem: When holding piece parts on a rotating holder in contact with a rotating abrasive coated platen rotating at a surface speed of 10,000 feet per minute, it is difficult to create a gimbaled, free wobble motion which allows the contacting surface to be continuously aligned by itself to the flatness of the rotating platen, while at the same time the contacting surface of the piece part is held stiffly enough in a nominally flat position. This is particularly true when first lowering the workpiece holder to the abrasive surface while rotating the workpiece so as not to have one comer of a workpiece contact the abrasive before other comers or surfaces. This would cause the comer to be preferentially abraded away, thereby producing an uneven workpiece surface. Vacuum piece part clamping hoses could also create problem forces.

Solution: A coiled spring can be used to apply a self correcting force between the work piece holder plate having a gimbaled spherical bearing and the rotating drive shaft of the rotating piece part holder. This spring could be made of metal or plastic material which would allow the straightening action to be applied but also would introduce vibration damping for excitation vibrations set up by the high speed, contact abrasive action. One or more solid plastic coupling bars could provide damped spring action. Also, if a vacuum hose were to be used to provide vacuum clamping of the piece part to the piece part holder through a hollow drive shaft, this type of hose could extend from the shaft and be coiled to provide a spring support action (with perhaps less than one complete turn, one complete turn or multiple turns which nominally lay flat with the upper surface of the work piece holder, which would minimize the creation of uneven "normal" turns).

11. ANGLED OR BEVELED SURFACE ABRASION

Problem: Many of the problems herein discussed for lapping with the flat surface of a platen are also encountered with beveled edge lapping, where the edges of a platen are beveled, and abrasive is on the face of the bevel. That abrasive face is then used to lap or grind another surface.

Solution: There are two fundamental ways of addressing this issue. Both involve the use of an annular abrasive sheet. The sheet has an outer edge and an inner edge (defining the inner edge of the cut-out portion of the sheet, where it is cut-out from a circular sheet, forming a central, round hole). The annular sheet should be placed on a platen, which is either a) flat, with the outer periphery bent, or beveled, b) or the inner annular section beveled, or both the inner and outer edge being beveled. The outer edge should not extend significantly beyond the outer edge of the bevel or platen (e.g., less than 1 mm, more preferably less than 0.5 mm, still more preferably less than 0.1 mm). The inner edge should in likewise dimensions likewise not extend beyond the interior edge of the bevel or the bend. If the annular disk is positioned on a flat platen, the flat platen may be bent substantially (with the same or like dimension tolerances) at the interior edge of the annular disk to form the lapping abrasive edge on the platen. The only caution which must be exercised is to assure that no folds or wrinkles appear in the annular disk. A preformed annular disk may be shaped to fit on the angled or beveled element. The element may be molded or formed to fit the shape of the platen surface (for example, by having a truncated conical sheet segment with the inner, smaller diameter hole (formed by cutting the cone) fitting the slope of the beveled edge, with the abrasive on the interior, upward facing surface of the cone (within the original cone volume as opposed to being on the external surface of the cone. The annular disk may be secured by adhesive, but the vacuum securement of the present invention is preferred.

12. ABRASIVE LAPPER

Problem: Operation of the high speed lapping devices envisioned by the present invention are at revolutionary or rotational speeds of at least 500 rpm, or at least 1,500 rpm, and preferably at 2,000 to 3,000 RPM with a fine abrasive sheet, such as the preferred 3M diamond coated abrasive disk of about 12" (30.5 cm) diameter. These sheets are normally held to a steel rotating platen by water film surface tension and positioned by a ½" (1.27 cm) diameter hole at the center of the disks. These positioning holes were used with a ½" (1.27 cm) diameter post at the center of the platen. When such a rotational speed of operation was attempted with the disk secured by water film tension, the disk lost its surface tension adhesion and was thrown off the platen while polishing a tungsten carbide piece part. The forces on the disk were such as to lift it off the ½" (1.27 cm) centering post and the whole disk was thrown off to the side of the machine opening cavity at the top of the machine post.

Solution: The ½" (1.27 cm) centering post could be made larger in diameter to perhaps 1" (2.54 cm) diameter or more. Also, the post could have a hexagonal shape or an oval shape which would prevent the disk from rotating relative to the tangential surface of the disk by having the apices of the hexagons (or other polygon) resist rotation against a similar cut hole in the sheet or disk. The post could also be made higher so the chance of the self-destructing disk climbing up the height of the post would be diminished during this type of event. Another technique would be to employ a clamp type of device to any of these round or non-round posts to clamp/hold the disk firmly to the surface of the platen at the center areas of the disk which is not used for polishing. This clamping force would be effective because of the slow lineal velocity in that sector. The clamp could consist of a spring locked washer pressed on the disk surface with a thread nut engaged with a top threaded post. Springs could also be used to control the amount of force and to evenly spread the force uniformly. Ball insert or other snap latch fixing devices could also be employed.

13. ABRASIVE LAPPER

Problem: Using round disks of minute particle coated sheets (e.g., abrasive particle sheets and especially hard abrasive particles such as diamonds) of plastic film on 1,500, 2,000 or even 3,000 RPM spinning platens provides significant difficulties. It is particularly difficult to hold the abrasive sheet in contact with the platen when the lapping apparatus is operating in contact with stationary or semi-stationary workpieces. When an abrasive disk becomes loose by breaking the conventional water filter "adhesive" surface tension between the disk and the platen, the abrasive sheet has a tendency to rip or bunch-up and wedge between the workpiece holder and the high inertia spinning platen and can easily damage a workpiece part or can destroy portions of the workpiece assembly with the possibility of great danger to the operator. This is a unique problem due to the very high rotational speeds of 1,500, 3,000 or even greater RPM with a platen of 15" (38.1 cm) diameter or more constructed of heavy steel which could generate explosive type failures or at least high velocity projectile failure. As this equipment is operated horizontally for the most part, the whole surrounding area around the machine is susceptible to this danger. A previous attempt by applicants to reduce the likelihood of this type of separation problem was to coat one side of the diamond abrasive disk with a PSA, pressure sensitive adhesive film to temporarily bond the disk to the platen. This adhesive created a flatness accuracy problem in that its normal thickness accuracy varied greatly around the disk which causes high areas of lapping contact for this super precision abrasive contact. Secondly, when a disk was removed, some sectors or pieces of transparent PSA adhesive remained in the platen and formed a bump when the next abrasive disk was installed on the platen. This then destroyed the smooth vibration free abrasive lappings at high speeds.

Solution: Use a diamond or other abrasive disks without using PSA adhesive and first position the disk at the true center of the platen by use of a center hole in the disk positioned over a post positioned at the center of the platen (or by other centering means) and then by holding the abrasive disk to the platen by use of vacuum by use of a rotating union on the hollow rotating platen shaft. The preferred area to apply the vacuum would be at the inner radius of the disk which would seal out air first as the disk is installed at the platen center. Because this inner one-fourth or so of radius is not used as much for lapping because of the slow surface lapping velocity, there would be less direct forces applied at this portion of the disk. The second most preferred vacuum area (e.g., the outermost edge region of the disk) would also not be used much and would have large holding force.

14. SUPER HIGH SPEED LAPPER

Problem: It is difficult to quickly lap hand metal or ceramic or other materials with conventional lapping techniques using disk platens which are 12" (30.5 cm) to 43" (109 cm) in diameter operating at 200 to 300 RPM using loose abrasive paste media. The amount of time used contributes to cost and time delays. Larger diameter platens are potentially dangerous at high speeds and paste could be used in extremely large amounts as it would be difficult to retain on the platen surface.

Solution: A high speed lapping system can be a sheet of abrasive material such as fixed diamond abrasive coated or plated on a disk sheet of material. These sheets or disks may be used on a rotating platen disk with a diameter of, for example, 12" (30.5 cm). When operating at 500, 1,500, 2,000 or 3,000 RPM, the apparatus gives a surface speed of about 9,000 to 20,000 feet per minute. If a larger diameter platen wheel of 15" inches is used, the RPM can be lowered somewhat to perhaps 2,500 RPM to achieve the same 10,000 (or 9,000) feet per minute (fpm). Similarly, if the wheel diameter of the platen is 18" diameter, then the speed can be further reduced to produce 9,000–10,000 fpm at the outer periphery of the disk. Any reduction of angular or rotational speed created by larger diameters is desirable because of the particular danger of a high inertia wheel creating problems if a disk or part is damaged or comes loose. The higher speeds used in the practice of the present invention, plus the controls shown for maintaining accurate address between the abrasive surface and the workpiece allows for much faster and therefore more economic lapping. Work that previously took hours, including intermediate cleanup steps, can be performed in minutes using the apparatus and methods of the present invention.

15. WATER FLOW RATE

Problem: The surface finish smoothness and flatness of hard parts made of metal or ceramic or other materials vary as a function of the work force on the piece part as the workpiece is held against the surface of a high speed 9,000 to 10,000 fpm abrasive lapping action. Unexplained variations in the quality and accuracy of the lapping action were observed.

Solution: It was found that the amount of coolant, lubricating water or liquid applied to the surface of the high speed rotating disk affects the quality of the lapping action. If a reduced flow rate of water is applied, the abrasive cutting rate is increased as the relative dimensions of the boundary layer and the total liquid thickness and dimensions between the base of the abrasive disk and the piece part are increased. This increase in the relative dimensions of the boundary layer and the decreasing of the separation of the abrasive disk and the piece part by the liquid allows the exposed diamond particles to be more active in removing material as they penetrate deeper into the surface of the material. Also, if the water flow rate is reduced and the piece part is more "flooded", then a thicker boundary layer of water or liquid builds up between the part and the surface of the disk and the piece part. This keeps the (e.g., diamond) abrasive particles away from the piece part and allows some fraction (preferably a small fraction, e.g., less than ½) of their normal penetration which results in a smoother and flatter surface on the part. One method of utilizing this performance is to have reduced water flow at the first portion of the lapping period for more aggressive material removal with an increased roughness of the surface. Subsequently the water flow is increased somewhat during the middle portion of the abrasive cycle to get better surface finish and yet have a medium material removal rate and then to substantially increase the water flow rate at the end of the cycle to produce a very smooth and flat surface with a low rate of material removal. This could be easily done with an automatic water flow rate control system. This would change the water flow rate automatically at various stages in the abrasive cycle.

The liquid (especially water) introduced as a lubricant between the platen and the work piece is normally filtered to eliminate particles which are 1 micron or larger in their largest dimension. The use of a positive displacement pump such as a gear pump or piston pump can be helpful in determining the optimum quantities of flow and charge during operation of the system, at the beginning, middle and end of operation of the lapping cycle.

16. SAFETY BOX FOR PLATEN

Problem: When performing abrasive lapping at high surface speeds of over 1000 fpm up to about 10,000 fpm on round platens rotating at 3,000 RPM with diameters of 12", 15" and 18", there is substantial danger when a piece part is broken off its holder (as it normally is held with a weaker adhesive or mounting system, and as uniquely effected in the present invention with the use of abrasive sheeting and high speed platen rotation) and the piece part being thrown off the platen or getting stuck on the platen and ripping the diamond or other abrasive disk causing further possibility of fast destruction of parts of the machine with parts thrown out and endangering an operator or others or equipment due to large kinetic energy contained in the rotating disk.

Solution: The rotating platen is round in shape with about a 12" or 15" (30.5 cm to 43.5 cm) diameter. A box is constructed which is rectangular in shape with "square" comers (4 each) and with the walls some distance away from the round platen, typically 6" or more. Also the box is desirable to be constructed of a soft plastic (or rubber) such as ½" thick high density polyethylene which would tend to absorb impact from a heavy metal part free flying, broken loose parts without ricocheting the part back into contact with the rotating disk which would reinitiate this impact action. It also prevents this reinitiated contact from damaging the part. Also, the "square" comers provide a remote area to trap the part and to contain the part as it stopped moving by being impacted in one or more rubber or plastic walls or lined metal walls. Having a distance between the flat walls and the rotating disk which is somewhat larger than the largest size of the piece part, centrifugal force would tend to drive the part off the disk radially and allowing it to roll or move tangentially to a neutral comer of the box away from the disk. At the same way, crumpled abrasive disks are collected by the neutral open comers. Having a ledge over the inside portion of the box also helps trap the parts.

The use of a safety box with at least 10% (of the diameter of the platen) clearance on each side of the platen within the safety box area is quite effective. It is more preferred to have the safety box with a clearance of 20%, 30% or even more than 50% of the diameter of the platen (on each side of the platen within the box or at least from at least one side of the platen) in the practice of this aspect of the invention. It is particularly desirable to have the workpiece holder moving assembly lift the workpiece holder out of the safety box so that the box may be cleaned without contacting the platen. A removable bottom section may be constructed on the box for bottom cleaning without having to significantly move the platen, but any openings or movable pieces may add to vibration potential in the system and is therefore not the most desirable engineering approach to the construction of the safety box.

The box may have a high center section and be angled or curved in the outer section so that any loose parts or pieces would tend to drop below the rotating platen and not be picked up by the platen and projected back toward the opening in an area above the abrasive surface of the platen (e.g., towards the operator). As liquids are used in the lapping action, a tapered bottom of the safety box area toward one or more drain holes allows the expended liquid (and any carried particulates) to be easily collected for disposal, even without opening of the safety box area. The angle of the box bottom to obtain the best flow conditions for the liquid will be selected to provide a washing action on the surface to minimize buildup of ground particles on the surface of the bottom of the safety box. Grooves to concentrate water flow or passage may also be provided.

A temporary cover may be provided over the opening of the platen top access hole to provide additional safety to the operator from projectiles and also to contain any mist formed by the high speed shearing and projection of liquids. Duct work can also be installed in the box to withdraw air born vapor and particles as well as the liquids, with reduced pressure removing the undesirable materials at a controlled rate. Filter elements may also be associated with these removal systems.

17. COUNTERWEIGHT WORKPIECE HOLDER

Problem: When a heavy workpiece holder is held up by an air cylinder and controlled to provide normal force on a workpiece against a high speed 10,000 fpm rotating disk by moving vertically up and down to load parts and lap. Then there is potential great danger if air pressure is lost due to air line leaks or electrical failure. If this load of the disk rotating motor assembly which may weigh 60 lbs. (27.2 kg), drops on the 12" (30.5 cm) heavy rotating disk operating at 3,000 RPM, there is great danger in that the abrasive disk can be torn or cut, jam up and create danger to the operator or severely damage piece parts which may have great value.

Solution: The vertically moving piece part assembly can be mounted on vertical slide and a chain or cable used with a counterweight which is perhaps 10 lbs. (4.54 kg) heavier than the 60 lb. (13.6 kg) assembly. Upon loss of electrical power which would interrupt power to the normally used suspension air cylinder or a line leak to the cylinder, the piece part assembly would simply and quickly retract to the upper position, taking it out of contact with the rotating platen and thereby reducing the chance of danger. This could also be a more assured event by using an e-stop (emergency-stop) action switch which would not require power to obtain safe action.

18. SECUREMENT OF WORKPIECES TO A SUPPORT

Problem: When lapping parts, it is typically quite difficult to hold the lapped parts in a fixture so that they are flat, stable and parallel when presented to, in contact with, and when removed from the lapping platen wheel particularly when the platen is rotating at high speeds of 3,000 rpm as compared to 200 rpm. Also a part which is fixed by mechanism clamping is subject to be loose or compliant (soft), which results in ground surface patterns or a lack of highly accurate surface finish such as (4) four light bands is not attained. It is also difficult to quickly and accurately load and unload parts. Also, for parts to be polished on both sides of the parts, the already polished surface finish adjacent to the part holder side of the mounting may be disrupted or destroyed when lapping the other side of the part.

Solution: Functional mechanical parts, which are typically 1 to 2 inches (2.54 to 5.08 cm) in diameter (or shaped other than circular cross-section, such as rectangular) which may be thin (0.010 inch, 0.254 mm) or thick (0.500 inch, 12.7 mm) can be affixed to a precision flat steel, other metal or other material plate by use of paraffin wax as a bonding agent. Here the plate or part can be coated with wax or the wax simply melted on the plate between the part and plate and the part placed on the plate, heat applied, and the two pieces would have a fully wetted surface of molten wax. The parts could be positioned by mechanical or other means of uniform pressure or force so that they lay flat with a uniform and controlled thickness of molten wax. Upon cooling the part/plate assembly, the parts would be positioned accurately and firmly for the plate ready for lapping action. Then the plate could be attached to a piece part holding device by use of a vacuum chuck or by use of a magnetic chuck if the plate were, for example, steel. The piece part holder could have a ball type pivot close to the lapping action surface. Plates could hold one or many individual parts. Upon lapping one side, the plate/part assembly could be heated, the parts removed and, if desired, the parts could be reassembled with heated wax on a plate with precise parallel alignment with no danger of damage to the lapped surface because of separation from the plate with no wax. And this way many plates could be preassembled for high production rates with a single lapper.

19. OSCILLATING WORKPIECE LINKING SYSTEM

Problem: It is desirable to have a simple drive mechanism to position a stationary or rotating workpiece on the outer periphery of a high speed rotating (3000 rpm) abrasive disk so that for most of the processing time there is a small portion of the polishing or lapping time spent at the inner radius portion of the abrasive disk where the surface speed is reduced and the abrasive action is reduced.

Solution: A simple, eccentric harmonic motion, constant speed rotation can be provided by a DC or AC gear motor hub used to drive a linkage system. This system will provide a smooth continuous motion at a workpiece with most of the time in a given hub rotation cycle being spent with the workpiece operating at the outer periphery of the abrasive disk which has the highest surface speed and also grinding action. Only a very small portion of the cycle time would be spent at the inner radius having a low surface speed and reduced grinding action portion of the disk.

20. SUPPORT OF SMALL WORKPIECES

Problem: It is difficult to hold small hard parts which are thin (typical size: 1"×1"×⅛", 2.54×2.54×0.318 cm) in such a fashion that surfaces (usually two) with flat features can be polished with a lapping action by a high speed (e.g., as high as 3000 rpm) rotating disk with a preferably diamond abrasive disk exerting substantial lateral force by the moving platen powered by a (e.g., 2 HP) motor for a 12" (30.5 cm) diameter disk when subjected to about 10 (4.55 kg) pounds of normal clamping force when subjected to surface water spray. This lateral force can separate the part from the part holder.

Solution: These small parts can be affixed to a flat surfaced piece part holder or a holder which has small shallow pocket areas just larger than the length and width of the flat part so that an exposed surface of the part protrudes away from the holder. This will allow the abrasive disk polishing action lateral force to be applied to the piece part and not separate the piece part from the holder, as it is trapped in the pocket or is held rigidly in the part holder. A medium temperature wax, or other easily removable adherent material can be melted and used to bond a rough surfaced part to the flat smooth surfaced part holder plate. The flat plate in turn can be attached to a rotating pivoting arm which is swept across a portion of the surface of the high speed rotating disk until a smooth flat polished lapped surface is generated on one side of the piece part. Then the part holder plate which would have 1 or 2 or many more parts attached to it in a fixed mounting pattern could be brought into contact with another mounting plate having a flat surface or a shallow pocketed surface pattern which matches the first part plate. A higher temperature wax (higher temperature than the first wax) could be melted at the surface of the parts already lapped and as they were held in flat contact with the new plate, the original lower melting point wax would melt and release the parts from the first plate. The parts would be transferred as a group to the second plate ready to have the rough remaining side lapped as the first plate is readily removed from this group of parts. High production rates at lapping flat parts on both sides with good parallelism could be achieved.

21. BOUNDARY LAYER CONTROL

Problem: When high speed lapping a 3000 rpm rotating flat platen with fixed abrasives attached to the platen with adhesives or vacuum, water on the rotating platen abrasive surface forms a boundary layer between the work piece and the abrasive media. The boundary layer thickness and shape effect the flatness of the work piece. The work piece must be allowed to "float" on the abrasive surface to achieve total flat contact even with this water boundary layer. This is done with a gimbal mechanism which puts pressure down on the rotating workpiece. It also allows the work piece to "gimbal" in the horizontal plane while an independent driver pin drives the work piece around the center line of the work holder shaft. The amount of down pressure also effects the boundary layer. The work piece floating on the boundary layer of water allows the abrasive media and the platen imperfections to be averaged out-high spots on the abrasive do the lapping while the low spots are filled with water allowing the lapping action to take place and produce a finished part (work piece) that is flatter than the media and platen. The work piece will only be as flat as the boundary layer. The problem is how to control or minimize the boundary layer thickness and control the shape on a work piece with a small surface area that is not large enough to float on the boundary layer with a minimum amount of down pressure, yet have enough water thickness for lubrication and cooling.

Solution: Pump water (e.g., through the work holder) into controlled orifices or jets in strategic locations that would encourage a controlled boundary layer to form between the work piece and the abrasive media. The water would also stabilize the workpiece while presenting it to the rotating platen initially and while lifting the work piece off after lapping is complete. Water is injected or otherwise directed to an inside radial area of a piece part holder which is holding a number of discrete piece parts at the same time. This could be particularly helpful when an annular distribution of abrasive is used. In this aspect of the invention, the inside portion of the water would develop a second boundary layer under the trailing portion of the piece part holder which contains a second piece part in contact with the narrow annular band of abrasive. Boundary layer water entering under the leading edge of the holder would tend to lift up that first piece part and tend to tilt the second piece part downward. This would cause a ground cone shape to form on the piece part. A second boundary layer would also develop under the second piece part at the trailing site of the holder and lift it upward, which would compensate for the tilting of the first piece part. Collectively, the whole piece part assembly would tend to lay flat as it would be supported by both boundary layers at the same time. There would be little tilting of the piece part toward or away from the platen rotational center as the parts are in contact with the (e.g., narrow) annular band of abrasive which would only effect a narrow strip of grinding action. That is, the introduction of liquid between the piece parts (along an arc [having the center of the platen as the center of the arc] connecting both piece parts which are in contact with the annular abrasive areas), reduces any tilting action which might normally occur because hydroplaning or boundary layer effects from a liquid are introduced at the relative center of the abrasive sheet only.

22. BOUNDARY LAYER PROBLEMS WITH SMALL PIECE PARTS

Problem: When lapping or grinding a multiple number of small parts or single small parts each having small surface areas and short surface dimensions in the approximate size of 0.1 inch (2.54 mm) by 0.1 inch (2.54 mm) and these parts are positioned in contact with a high speed rotating disk operating at 3000 rpm at perhaps 9000 sfpm speed, there is not enough surface length to the part to build up a sufficient boundary layer to float or support the part as it is making contact with the abrasive disk on the high speed platen. The parts tend to dig into the abrasive disk and tear the disk and prevent accurate polishing or lapping of the part.

Solution: Providing a system where an adequate boundary layer can be generated and maintained while the individual piece parts are being lapped can easily be done by adding a secondary device to the piece part holder device which would have sufficient surface area, and dimensional length to develop a desirable boundary layer. The secondary device is also ground down simultaneously with the piece parts in a sacrificial way. A typical shape of this sacrificial contact device can be a disk of metal such as brass which would be mounted on the inside annular position of a tool piece holder with the to-be-lapped piece parts mounted inboard or outboard of this device on the periphery of a round piece part holder. As the total exposed surface area is ground down, the piece parts are held suspended above the high speed moving abrasive by the large surface area of the sacrificial disk. A typical disk would be 4 inches (10.2 cm) outside diameter, 2 inches (5.08 cm) inside diameter and about 0.60 inches (1.52 cm) Thick. It could be easily attached with vacuum chucking and/or adhesive tape and could be used over and over by loading new piece parts with a partially ground disk. Other geometry sacrificial plates could be used and combinations of materials including other metals such as steel or ceramics.

23: CONTINUOUS SHEET WITH ANNULAR DISTRIBUTION OF ABRASIVE

Problem: The annular sheet provides significant advantages to the performance of many aspects of the present invention, but as with advance, other issues may develop in performance. Where annular sheets or disks are cut from sheets and applied to a flat face of a platen, particulate grit and abraded material and/or liquid lubricant can work its way under the inside edge of the annular section. Even in the small time periods when the sheet is in use, which may be as short as ten to fifteen seconds, some particles may lift an edge of the sheet and cause problems with the uniformity of the flatness of the annular sheet. This would cause undesirable effects on the lapping process and quality. Additionally, at extremely high speeds, the annular section becomes wobbly, does not sit properly on the platen, may be difficult to lay down accurately, and provide other structural difficulties in securing the annular sheet to the platen.

Solution: There are a number of ways in which a continuous sheet of abrasive material may be provided, including a flat sheet having an annular distribution of abrasive material and a continuous middle section without abrasive thereon. The most expensive way of providing such a sheet would be to coat the abrasive in an annular distribution, as by roller coating, gravure coating or screen coating of the abrasive and binder. An adhesive binder may be printed onto the backing and the surface dusted with the abrasive grit to form an annular distribution on a continuous sheet. This type of process would again require a new coating step rather than providing a means for using existing sheet material. Another less preferred method of providing an annular distribution of abrasive with a continuous sheet between the inner diameter of the annular distribution would be to cut a circular element out of the abrasive sheet material and then abrade away an interior section of only the abrasive particles (leaving the backing material) to create an annular element. This would be a waste of significant amounts of abrasive surface area, but would provide a useful annular sheet on a continuous backing.

The most preferred method according to the present invention is to cut out an annular ring of material of the dimensions that are desired and then fixing or securing a non-abrasive sheet material (hereinafter referred to as the center portion) within the cut-out portion of the annulus. In providing such a construction, the following concepts should be kept in mind. The joint between the annular sheet portion and the center portion should not extend above the average height of the abrasive particles with respect to the backing material. This can be done in a number of ways. A thinner sheet material than the backing material may be used for the center portion. This center portion does not have to provide any significant structural component to the annular ring, but it can provide advantages as noted later if the center portion is relatively stiff and strong (even stiffer and stronger than the annular sheet material section). The presence of such material, stiffened or not, does tend to make the ring easier to work with, avoids wrinkling, and makes the abrasive sheet easier to lay down on the annular work zone. The center portion clearly provides a stabilizing influence on the sheet as it is being applied to the platen. The material for the center portion may be chosen from a wide range of materials because of the minimum physical and/or chemical requirements for the material. Plastic film or paper is the easiest materials to provide for the center portion. There may be a centering hole in the middle of the center portion, or even a larger hole than is needed for centering. The larger hole adds no significant structural advantage, and should not minimize the stabilizing or edge protecting effect of the center portion, but some latitude is available in the dimensions of the center portion with respect to the entire size of the annulus without preventing some of the benefits of the present invention.

The center portion may be secured to the annular ring by any process which adheres the center portion to the annular portion. This would include, but not be limited to, butt welding, fusion of the sheet material to the annular segment, adhesive stripe between the annulus and the center portion, thermal welding, ultrasonic welding, hot melt adhesive, etc. The application of an adhesive may be the most likely to cause raised areas which could be avoided, but existing process technology makes controls over the dimensions of the adhesive very effective. Additionally, since the adhesive would be much softer than the abrasive material, some sacrificial abrading on the inner edge of the annulus could be performed to lower any edges. Therefore, some conditioning grinding or lapping at the inner edge of the annulus could be performed before the abrasive sheet is used for its primary effort at lapping.

Another method for forming such a sheet would be to cut out an annular ring of abrasive sheet and lay it over another plastic circular sheet having an outside diameter approximating that of the annular cut-out (it may be somewhat smaller or larger). This sandwich could be joined together by any method which would maintain a consistent thickness to the abrasive sheet. Since the highest quality coating methods could be used in joining these layers (the circular and annular disk), even adhesive securement is useful, where because of process limitations in the application of adhesive to the platen to secure the abrasive sheet, adhesive securement would not be desirable between the abrasive sheet and the platen. Securement might also be made between the annular ring of abrasive and a backing sheet by thermal welding, ultrasonic welding, or any other method, particularly those which seal the entire circumference of the joining line between the annular sheet and the backing sheet to prevent liquid and particles from entering the seam. A poor seam closure would allow edges to lift or pull and would be undesirable.

An annular disk provided with a natural raised outside area of abrasive could be easily used on a flat platen surface. Other structures of abrasive sheets with attached central areas, where the sheet has a height of the central area and the abrasive area relatively equally may need a platen with a raised annular area on the outside of the platen to take the greatest advantage of the annular configuration. It is to be noted that if the central area were minimally abrasive or minimally hard (or a later described, completely free of abrasive), contact between the central area and the piece part during lapping would have negligible or even beneficial (buffing) effects and the sheet could be used on a flat platen.

The annular band or sheet with an annular distribution of adhesive may be secured to the platen by a number of different means. Positioning of vacuum holes or ports or vents in the platen can be effectively arranged. For example, vacuum holes may be located exclusively inboard of the annular band to assure that no imprint of the hole is transmitted across the abrasive sheet to the abrasive surface. With the use of appropriately sized holes, this potential effect has not occurred, but this positioning of the holes allows for such a distribution of relatively larger holes or vents if desired. Rows of holes directed relatively radially through the underside of the sheet from the radial portion into or towards the center area may be used. Concentric circles of vents or ports may be located, some or all in the center area or under the abrasive annular distribution. Pressure sensitive adhesive may be used in limited areas, such as in the center area only, where there would be no possibility of adverse affects on the consistent level of the abrasive or buildup effects. The adhesive could be used alone or in combination with vacuum retention in that area or with the vacuum in areas not secured by adhesive. Pressure sensitive adhesive could be located outside the annular area of the abrasive, and thereby not affect the level or evenness of the abrasive surface. It is possible to have some adhesive under the annular ring of abrasive, but this would, of course, detract from the evenness and ease of replacing the sheets.

High friction, rough surfaces may be provided on the platen to assist in the draw-down or vacuum securement of the abrasive sheet. When an entire disk (rather than just an annular ring with no center portion), the vacuum holes or vents are sealed by the disk, particularly at the inboard portion of the sheet. It is therefore important that all holes underneath the sheet be in vacuum tight relationship with the sheet to prevent debris from entering the holes, clogging them, and providing deformities on the surface of the sheet. The debris can also grind away portions of the holes or vents, later disturbing the disk surface. The pattern and distribution of the holes can therefore be important. The best distribution to date appears to be with a completely continuous sheet (not even a centering hole) and concentric circles of holes predominating in the center area and minimized (or even absent) from the annular abrasive distribution area. A problem with the use of a centering post is related to this phenomenon, in that debris may enter underneath the sheet around the centering post and gradually cause adverse changes in the holes or platen surface. Also liquid flow variations and different volumes and sizes of particulates may be flung outwardly, underneath the sheet, if such materials enter the space between the platen and the sheet through access around the centering post.

24. VIBRATION DAMPING IN THE LAPPING APPARATUS

Problem: The motor driving the platens and/or work piece holders (if they move) apply vibration to the entire lapping system. The rotation of the platen itself provides vibration, as does the movement of the abrasive over the face of the work piece. The flow of liquid over the lapping contact zone (between the platen and the work piece), especially where there is any hydroplaning or uneven distribution of the liquid over a moving surface, also creates pressures and forces which can add vibration into the lapping system. These vibrations in the system can cause minor instantaneous variations in the relative positions of the platen and the work piece. These variations, of course, show up in reduced lapping quality in the product and are undesirable.

Solution: The weight of the frame an the individual elements (the platen and any moving or stationary work piece holder must be designed to minimize vibration. The joints between elements and attachments of moving parts must also be controlled to minimize vibration. The primary method of reducing or damping vibration is to add mass to the frame and to strategic portions of the apparatus. The frame of the system should weigh a minimum of 100 kg. Also, an energy-absorbing member or layer (e.g., a viscoelastic layer) may be present between concentric tubular structural beam members and between flat plates where the first of the two flat plates is merely a flat mass unit which tends to remain stationary in space while the second plate integral to the frame has vibration excitation induced in it. The thin elastomer layer mutually bonded to both plates and is sheared across the thickness and, due to its very high viscosity, will absorb the vibration energy and dissipate it into heat. All of the vibration damping systems would be designed for a specific portion of the machine, especially with respect to localized natural frequency, its expected amplitude multiplication (which can easily exceed fifteen times the oscillation excursion of the excitation source), the design and characteristics of the vibration damping/absorbing device, and the different multiple frequencies expected. Secondary spring-mass systems can also be utilized by positioning masses with spring supports tuned to the excitation frequency by the formula Wn=the square root of k/m where Wn equals the natural frequency in Hz, k equals the spring constant in pounds/inch, and m equals the mass in pounds, with the necessary constants required for equation units (e.g., such as gravity acceleration of weight in pounds to mass in slugs). The secondary spring mass tends to oscillate at the same frequency as the excitation frequency, but out-of-phase, so as to cancel out the excitation frequency force.

Another vibration prevention device is the use of a large, thick, heavy flat plate weighing 90 kg or more mounted horizontally in the same plane as the platen at about the same level as the platen. This mass tends to absorb any vibration due to imbalance of the platen/abrasive sheet combination assembly. This prevents the vibration motions from exciting the machine frame in such a way as to oscillate the piece part being ground or lapped. Adhesively bonding a viscoelastic layer to this flat mass plate and bonding another large mass flat plate to it can very effectively reduce the buildup of vibration oscillations.

Some other vibration excitation sources can be the platen system being out of balance, the piece part spindle being rotated when out of balance, oscillations being generated by the stick-slip conditions between the abrasive sheet and the work piece, hydrodynamic fluid-induced vibrations at the moving fluid boundary layer interface between the piece part and the platen, sudden motion of machine elements, electrical pulses, etc. Vibrations should be prevented from entering the system, wherever their source. Adding a large mass ring of heavy, dense material to the outboard diameter of a (typically) round workpiece holder in a fashion which allows the center of gravity as close as possible to the moving abrasive surface is a very effective method of minimizing vibrations in the work piece. The mass attenuates vibration excursions and oscillatory vibration forces generated at the abrasive surface contact area. The same mass will also interrupt vibrations originating from the machine motor drive, and platen imbalance (insofar as it would travel down to the workpiece support mechanism).

To minimize vibration, it tends to be more preferable that the mass of the frame comprise at least 200 kg, still more preferably at least 350 kg., and most preferably at least 500 kg., with no maximum weight contemplated except by the limitations of reasonableness. The weight of the actual intended commercial embodiment of the frame of the present invention is about 600 kg. The platen, at a revolutionary speed of 3000 rpm with a twelve inch (30.2 cm) diameter, has a natural frequency of about 50 Hz. The frame should be designed with a natural frequency above the frequency of the highest useful speed of the platen (and motor) to avoid the frame being vibrationally excited by the motor as it is brought up to specification during operation. For example, with the maximum designated speed of a lapping apparatus with 30.2 cm platen and abrasive sheeting being 3000 rpm with a frequency of 50 Hz, the natural frequency of the apparatus frame should be at least 2% above this operating frequency. Greater differences between the operational frequency (the Hz equivalent of the rotational speed of the platen) and the natural frequency of the frame would provide additional levels of vibrational avoidance at the higher speeds, so that natural frequencies more than 3%, more than 5%, more than 10% or more than 20% of the operational frequency are desirable. Operating equipment used in the practice of the present invention has been made with 3000 rpm operational speeds (50 Hz) and 76 Hz natural vibration frequency. This enables the frame of the machine to be operated at higher speeds and higher frequencies (e.g., 3600 rpm and 60 Hz, and 4200 rpm and 72 Hz) by increasing the capability of the motor, replacing the motor, but not significantly modifying the frame. If need be, weight and mass may be added to the frame after construction to improve vibration resistance. Damping material, such as elastomeric materials may also be added at strategic sites within the frame and apparatus, such as at joints, between a work frame and the main frame, over bolts and nuts (if present), between legs on the frame and the floor, etc. The purpose of these features being to mask the vibration or dampen it, as by increasing the natural vibration frequency of the frame to a meaningful level (e.g., at least 2 Hz or at least 2%) above that of the operational frequency of the lapping apparatus.

25. LAPPER PIVOT CRADLE PIECE PART HOLDER

Problem: When a piece part is ground or lapped on a high speed (e.g., diamond) abrasive disk with surface speeds of about 9,000 sfpm or higher, with a 12 inch (30.5 cm) diameter platen rotating at 1,500 rpm or 3,000 rpm or more, there can be an uneven grinding action due at least in part to the liquid boundary layer between the piece part and the abrasive surface. There can be a thinner layer at the outer periphery of the circular boundary layer due to the high relative surface speed at that outer region. The relatively much slower surface speeds at the inner radial region of the disk will conversely have a thicker boundary layer because of the slower speeds and the fact that the same volume of liquid is moving over a smaller area (the area defined by the smaller radius) at a slower speed. Typically abrasive particles at the outer radius of the rotating platen more easily penetrate the thinner boundary layer at the outer periphery of the disk and effect material removal more efficiently in that region than where the boundary layer is thicker. Therefore, the abrasive activity is affected not only by the differential in surface speeds between the inner region and the outer region, but also there is another effect because of the variation in the thickness of the boundary layer between radially related regions. Thus the abrasive particles integrally attached to the abrasive sheet may be held away from the work piece and not remove material as efficiently. This causes uneven wear and lapping on the piece part due to the boundary layer effect which has not been previously considered in this technical field.

Solution: The use of an annular ring, with the inner and outer radius of the center opening and external edge, respectively, being sufficiently close in dimensions that the relative velocity of the two surfaces, and more importantly the thickness of the boundary layer at both of these radial positions, are within a narrower variation than previously used. It is important to note that this effect is important for the high speed lapping process of the present invention, and would have had an insignificant effect at the 5–200 rpm rotational speeds common to previous grinding processes. The high rotational speeds create the dramatic boundary layer changes for which this invention is important. Even if annular disks had been used with slower speed grinding, polishing or lapping processes, the benefits of this aspect of the present invention would not have been noted, even if the benefit was provided by such lower speed annular disk usage. It would be desirable to have the boundary layer thickness approximate the average height of the abrasive materials protruding from the support surface (e.g., from at least about 0.1 micrometers, and for example from about 1 to about 100 micrometers). It is desirable that the boundary layer thickness approximate that height with a variation of no more than ±50% of the average abrasive particle height, more preferably ±30%, still more preferably ±20%, yet more preferably ±15%, and most preferably within +10% of the average protrusion of the abrasive particles from the average height of the substrate (e.g., the valleys formed by the binder). The process may be performed with two piece part holders, each rotating in a direction opposite (clockwise versus counterclockwise) from the other. Both holders may be mounted on a common pivot arm. each piece part holder would tend to stabilize the other and would also allow each of the piece part holders to stabilize the other across the width of the platen. A special wobble joint at each piece part holder would allow each to conform to the slightly uneven boundary layer on the platen. Rotating each piece part holder would provide the same amount of abrasive material removal to the exposed surfaces of the piece parts. The normal contact force, surface speed, liquid flow rate, viscosity, etc. would all be optimized in the entire assembly. The assembly pivot cradle would be oscillated to obtain even surface wear.

Figure 9:
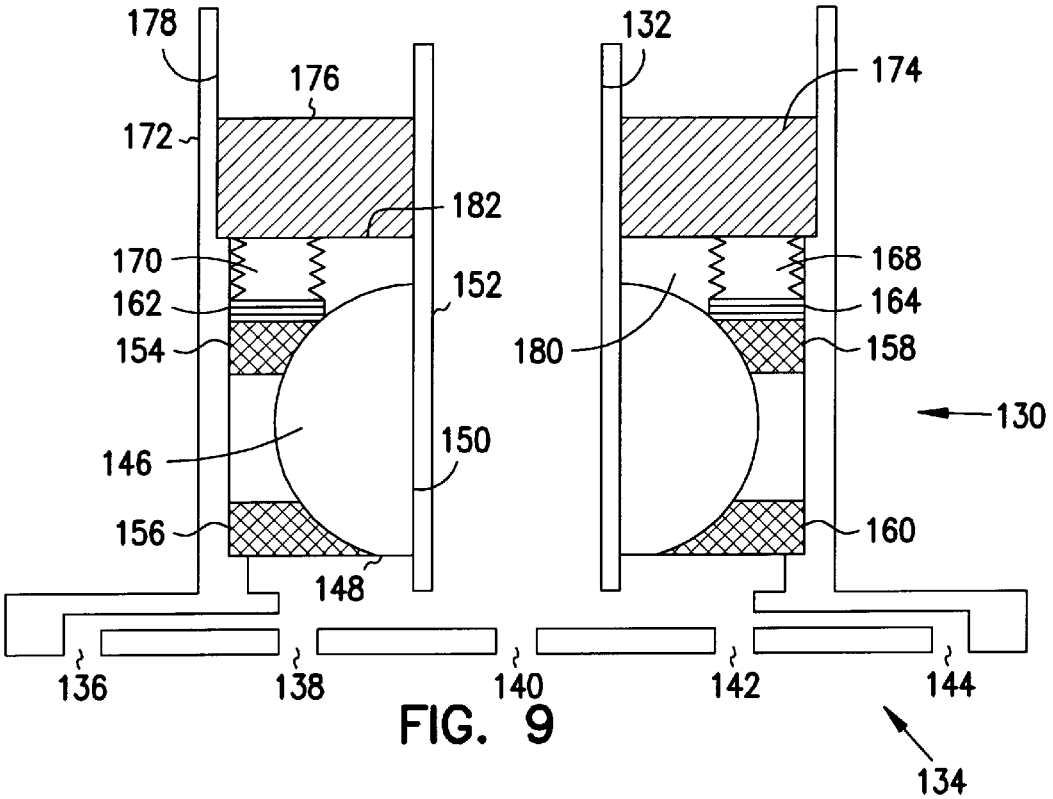
FIG. 9 is a cutaway view of a platen with a pivot connection to a rotary shaft.

This aspect of the invention can be considered with respect to cutaway FIG. 9. A lapper platen system 130 is shown which comprises a shaft 132 connected to a rotation source (e.g., an engine, not shown), a platen face 134 on which will be secured an abrasive sheet (not shown). The platen face 134 contains ports 136, 138, 140, 142, and 144 through which reduced pressure may be provided to the platen face 134. A spherical or torroidal element 146 (hereinafter referred to as the "ball 146") with a flattened or flat beveled bottom portion 148 is secured by a flat internal face 150 to the lower portion 152 of the shaft 132. The rounded outer surface of the ball 146 is supported by pairs of spherical-faced bearings 154, 156, 158 and 160, which may also be a pair of torroidal bearing elements with concave spherical faces contacting ball 146. Over said upper spherical faced bearings 154 and 158 are flexing elements 162 and 164. These may be any spring-like elements, coils, or spring washers which provide a cushioning effect or spring effect between said upper spherical bearings 154 and 158 and bearing securing means 170 and 168 which help to secure the upper bearing elements 154 and 158 against movement and provide a stabilizing and positioning force to the ball 146. A convenient securing means may be a circular nut with spanner wrench holes, with threads on the sides to fix into the platen neck 172. A cushioning material 174 and 176 are provided between the shaft 132 and the interior surface 178 of the platen neck 172. If a force is applied to the face of the platen 134 and the force is slightly uneven distributed against the face 134, the face of the platen may adjust to the force and level itself by pivoting through ball 146. The degree of pivoting is cushioned by internal resistance of the ball 146, and the elastic resistance of the cushioning materials 174 and 176. A lubricant (not shown) may be provided in any cavities 180 and 182 which exist between the cushioning material 174 and 176 and the ball 146. The lubricant may be any preferably liquid lubricant such as an oil. The cushioning material 174 and 176 may be any flexible composition, such as, but not limited to, natural or synthetic rubber, silicone or fluorine containing elastomers, spring elements, or the like. Lubricant may be provided by syringe injection into the cavity 180 and 182 or may be provided through a replaceable cap (not shown).

Figure 10:
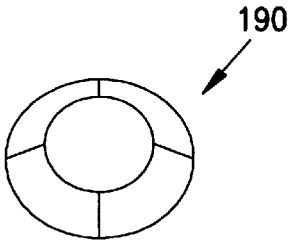
FIG. 10 is a flexing element for use in the present invention.

FIG. 10 shows a preferred flexing element for use with the present invention, a Bellview spring washer 190. This element is no more than a standard washer whose outer periphery has been bent down to form a truncated cone shape. These Bellview spring washers may be stacked to form a spring-like element.

Figure 11:
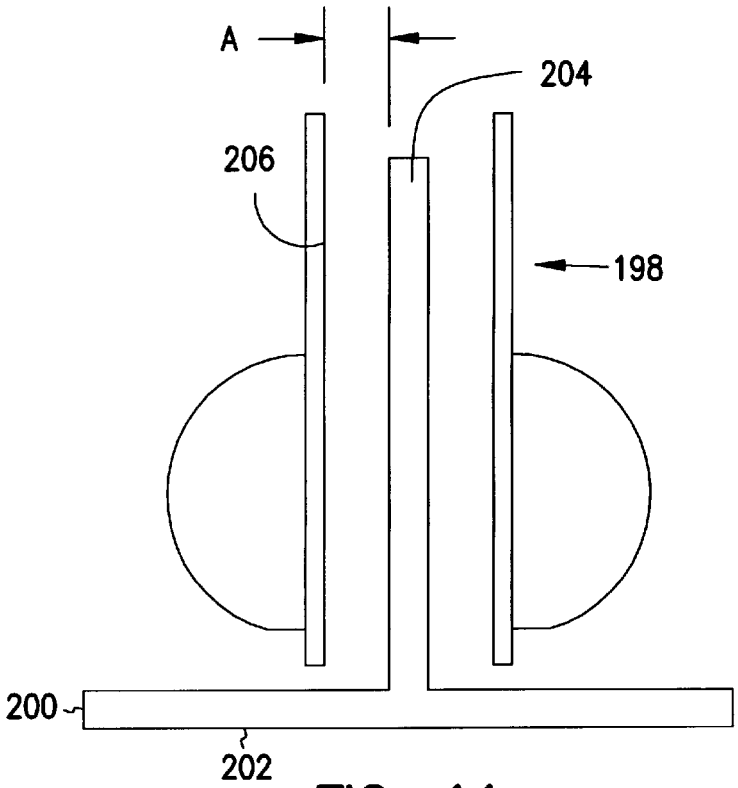
FIG. 11 is a side view of an apparatus for limiting pivoting.

It is desirable to limit the degree of pivoting which this aspect of the invention may undergo. During an emergency, a limitation on pivoting, beyond that provided by friction and the cushioning materials 174 and 176. One method according to the present invention is shown in FIG. 11. A platen-shaft system 198 may comprise a platen 200 with a front face 202 and an internal anti-pivot shaft 204. The anti-pivot shaft 204 is separated from the inside face of the platen shaft 206 by a distance of A. The platen 200 may not pivot any angle greater than that which would cause the anti-pivot shaft 204 to contact the inside face of the platen shaft 206. By adjusting the dimensions of the respective elements (e.g., the length and thickness of anti-pivot shaft 204, dimension A, etc.), the limits on the degrees to which the platen may pivot can be preset.

This aspect of the invention may be described as a pivoting lapper workpiece holder system comprising:

a) a shaft which is connected to a platen, said platen having a back side to which said shaft is connected and a front side on said platen to which can be secured an abrasive sheet;

b) a pivoting joint connected to a shaft attached to a workpiece holder, the connection of the shaft comprising a spherical or torroidal element comprising a curved outside surface, and said pivoting joint being located on the outside of said shaft, said pivoting joint having an arcuate surface area and a receding surface area of said outside surface of said pivoting joint, and said receding surface area is closest to said workpiece holder;

c) said pivoting joint having a cross section with an effective center of its area, said receding surface area of said pivoting joint being defined by a surface which has average distances from said effective center which are smaller than the average distances from said effective center to said arcuate surface area;

d) arcuate surface area of the pivoting joint is supported by at least one pair of arcuate-faced bearings, said bearings comprising at least one upper bearing and at least one lower bearing, said bearings being attached to a portion of said workpiece holder, and allowing said pivoting joint to pivot between said at least one pair of bearings;

e) said shaft being able to pivot about said pivot joint relative to said workpiece holder.

The workpiece holder system may have over said at least one upper bearing a space between said shaft and a neck of said workpiece holder, said shaft being restrained within said space by a cushioning means between said shaft and an interior surface of said neck, said cushioning means being selected from the group consisting of flexible compositions and springs.

The workpiece holder system may have said cushioning means comprise a flexible composition, and may have said cushioning means comprises an elastomeric composition, as previously described. As previously noted, said elastomeric composition preferably comprises a silicone elastomer or a fluoroelastomer. The workpiece holder system, between said flexible composition and said at least one upper bearing may have a spring element, and above said spring element and below said flexible composition may be a securing element, said securing element being capable of being adjusted in a direction parallel to said shaft to increase force upon said spring element, said force on said spring element in turn increasing force of said at least one upper bearing to press said bearing against an arcuate surface of said pivoting joint.

The workpiece holder system may have at least said flexible composition, spring element, shaft, at least one upper bearing and pivoting joint creating a cavity with said workpiece holder system. The cavity preferably contains a liquid lubricant.

To restrict non-lapping (out of plane) rotation of the workpiece holder, the workpiece holder system may have an elongate element which is associated with said workpiece holder so that movement of said workpiece holder, out of its natural symmetric rotation plane as is used during lapping, causes movement of said elongate element, said element extending from said back side of said workpiece holder through an interior channel of said shaft so that said movement of said elongate element when said workpiece holder pivots will cause said elongate element to contact an interior surface of said shaft, restricting the amount of pivoting which said workpiece holder can perform. The elongate element will contact said interior surface of said shaft when said workpiece holder is turned less than 30, preferably less than 20, more preferably less than 15 degrees, and most preferably less than 10 or 5 degrees.

The workpiece holder system may use a spring means or spring element which comprises a stacked array of truncated hollow cone elements stacked upon each other.

This system is a great advantage over a simple ball bearing type of design for a number of reasons. Fine abrasive grit can easily get into a ball bearing, while the pivot center of this design is fully enclosed. Even if some grit does enter the system, the oil can support it, wash it out, and remove it almost completely with replenishment of the lubricant. A spindle holder (or the workpiece holder shaft) is never uniformly and consistently perpendicular to the workpiece holder. A perfect ball bearing would be very loose and could cause the workpiece holder to contact the platen in a manner to cause abrasive damage from the first contact, while the cushioning material (the elastomer) used in the present invention stabilizes the workpiece holder direction and tilt within a more controllable range. The use of an elastomer is preferred over spring support of the shaft because it also provides an added measure of vibration damping.

26. ANNULAR DISK ON A RAISED PERIPHERAL PORTION OF THE PLATEN

Problem: Sometimes the extreme liquid pressures and forces can drive the liquids under an interior edge of an annular disk. Once the edge is lifted, many undesirable events can occur. The annular abrasive disk presents an uneven face, since one edge is deformed from planarity. Residue from the abrasive disk and swarf material from the work piece can embed themselves under the raised edge. Each of these distortions of the abrasive surface are undesirable and can damage the workpiece.

Figure 5:
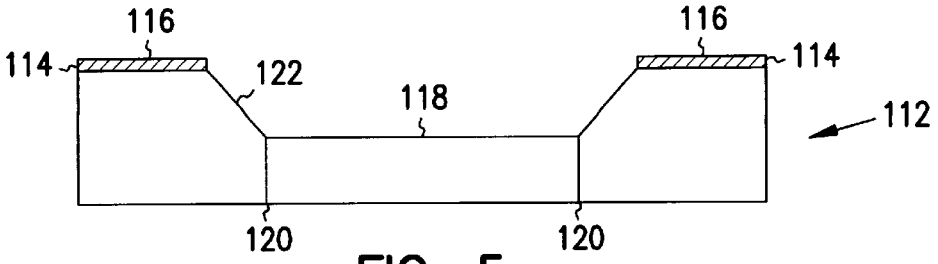
FIG. 5 is a side view of a platen with raised peripheral edge portions.

Solution: There are a number of solutions to this problem. One basic consideration is to provide an abrasive sheet which does not have any openings in its surface. This can be done by having a circular sheet with no holes therein coated with an annular ring of abrasive material. A circular abrasive sheet may have the core circle of abrasive scraped or abraded off to leave an annular distribution of abrasive on an impervious sheet backing. An annular disk with an opening in the center may be provided with a "plug" or circular piece that completely fills the central area. As shown in FIG. 5, an annular disk 112 having annular, flat support area 114 with abrasive on the upper surface 116 may have a plug 118 which abuts (and is preferably secured to) the inside edge 120 of the annular ring 112. An area 122 between the flat annular surface support area 114 and the inside edge 120 is shown with a bevel, but this is not essential. Securement between the plug 118 and the interior edge 120 may be effected by direct fusion (by heat or solvent) of the two pieces, adhesive or the like.

Figure 6:
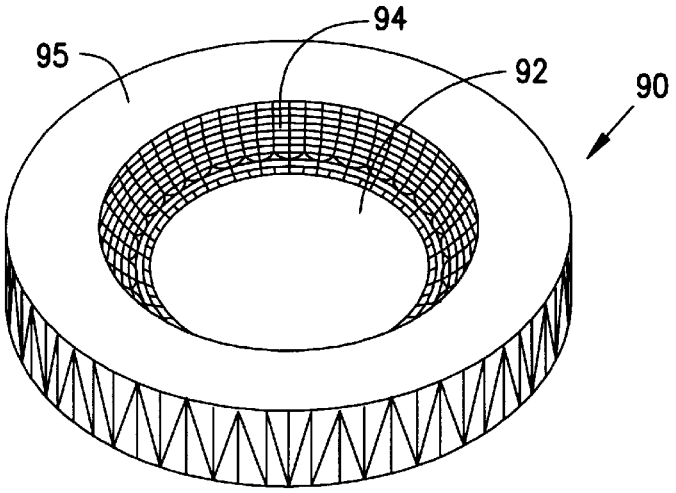
FIG. 6 is a perspective view of a platen with raised peripheral edge portions.
Figure 7:
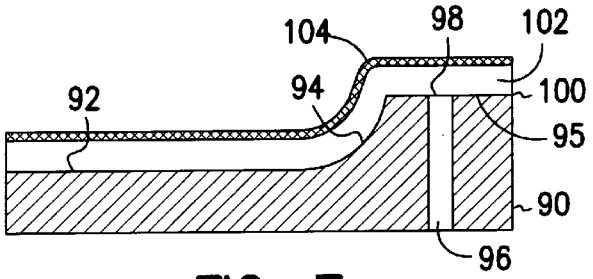
FIG. 7 is a cutaway view of a platen with raised peripheral edge portions.
Figure 8:
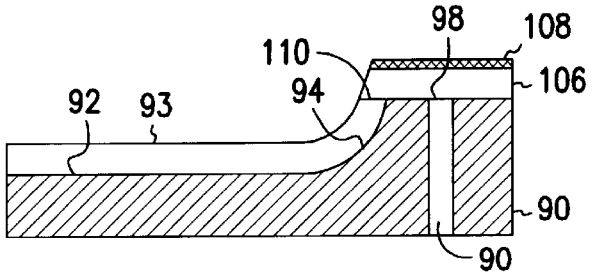
FIG. 8 is a cutaway view of a different configuration of a platen with raised peripheral edge portions.

FIG. 6 shows a platen 90 with a depressed region 92 and a wall 94 between the flat upper annular support area 95 and the depression 92. A number of means are available for providing an annular abrasive disk or annular abrasive work surface (not shown) on this flat portion 95. FIG. 7 shows one of these methods. The platen 90 has an abrasive sheet 100 on its surface. The sheet 100 comprises a backing layer 102 and abrasive material 104. A vacuum port 96 (or other securement means) retains the back surface 98 of the sheet 100 against the flat annular surface 95. The reduced pressure will be passed along the back surface 98 press the sheet 100 against the flat surface 95. The reduced pressure will also secure the sheet 100 against the wall 94 and the depressed area 92. The wall 94 is shown with an arcuate slope, but may be more sharp or smooth in the transition from flat area 95 to depressed area 92. For example, the transition may be by two right angles or by an S-shaped curve or other form. FIG. 8 shows a platen 90 with a plug 93 which is secured to the backside 98 of the annular sheet 108 with abrasive 106 on it. The location of the abutment 110 between the backside 98 of the sheet 106 and the plug 93 is shown at an approximately right angle, rather than the edge-on abutment of FIG. 5. The abutment 110 of FIG. 8 may be by means similar to those described for the joining of the plug 118 and the flat annular support 114 at the abutment 120 in FIG. 5.

27. RAPID WEAR IN PARTICULAR AREAS OF THE ABRASIVE SHEET

Problem: Abrasive sheets, even in annular form, tend to wear in a specific pattern. The precise positioning of the sheets or ring against a work piece causes the same radial portion of the abrasive surface to be in contact with the work piece. This tends to cause the abrasive surface to wear down in specific circular lines or annular areas. As the abrasive surface is not as useful where there is a discontinuity in the abrasive, the remaining sheet may have to be discarded because of the absence of abrasive over only 10–20% of the sheet work face.

Solution: Working at high rotational speeds, the centering of the sheet or annular disk on the platen was assumed to be very important, mainly because the radial forces would have been thought to be sufficient to create significant damage to the sheets, literally ripping them apart with the force, or the creation of vibrations which would effectively distort the relative face of the abrasive sheet. It has been surprisingly found that not only would the off-centering of the sheet or annular disk not create damage, but such off-centering could prolong the life of the abrasive work surface. By positioning the center of the sheet or annular disk at least 1%, preferably at least 2–5% (even up to 10–20% of the radius, off-center) of the radius of the sheet or annular disk away from the center of the platen, the work surface of the sheet or the annular disk would effectively oscillate, rather than present the exact same radial dimension to the work piece. This oscillation, since it is unlikely to repeat in a single rotation of the platen, would expose different areas of the abrasive work surface to the work piece. Abrasive material would be removed in broader (wider) annular patterns, as compared to the more narrow annular patterns that would be worn in the work surface of a perfectly centered abrasive sheet. The degree of off-centering useful or tolerable in the system is related to the rotational speed and the density of the abrasive sheet. The greater the rotational speed, the heavier (higher weight per unit surface area) the abrasive sheet, the less offcentering which may be tolerated. It is also quite useful to provide a massive (heavy) support for the work piece and platen. The heavy apparatus pieces will help to dampen vibrations that may occur by the eccentric rotation of the sheet or annular disk.

Additionally, the abrasive disk could be either intentionally repositioned at its exact original position or a different position by use of a marker system. Even a felt-tip writing implement could be used to mark on the abrasive disk and/or the platen where it was exactly located on the platen relative to the mark, or a permanent marking system on the platen. An abrasive disk may then be removed and reinstalled at nearly the identical radial and tangential position on the platen without requiring the disk to be redressed each time that it is used. Furthermore, the abrasive disk could be sequentially or progressively or randomly moved tangentially to align "low" wear areas of the disk with "high" elevation areas of the platen which would better utilize all of the expensive abrasive particles of the disk. Small increment tangential repositioning of the disk would reduce the requirement for re-dressing the disk as many of the causes which require re-dressing—platen high spots, thickness variations in the abrasive disk, etc.—tend to then be distributed in areas rather than at specific points which is more tolerable within a lapping system.

The abrasive disk can also be preconditioned so that high defect spots or areas are reduced in height to reduce the possibility of local scratching on the work piece surface. A hard material can be held stationary against the disk surface (particularly at an edge) or the hard material may be oscillated slowly and radially to knock off or wear down high spots. Another abrasive material could be rotated with its own high (or slow) velocity against the surface of the abrasive disk to remove high spots or loose materials. Any loose or weak abrasive materials at the inner or outer radius of the disk would be broken loose by this initial conditioning treatment and would be eliminated from the system prior to actual lapping of the work piece.

28. AVOIDING DAMAGE FROM FLYING DEBRIS

Problem: Because of the higher rotational speeds that can be used in the present invention, liquids, swarf, removed abrasive and the like is hurled at extremely high velocity away from the platen. With linear velocities of 20,000 feet per minute, debris is constantly projected from the surface at over 200 miles (280 km) per hour. This projectile material can cause serious damage to person around the machine, and upright box-like protective enclosures (particularly with flat upright surfaces at right angles to the path of the projected materials) are readily worn away by the projected matter, much of which can be abrasive material. Additionally, the particulate waste can accumulate against surfaces and the liquid will also run over any flat surfaces.

Solution: The platen may be enclosed in a sunken box or walled area, with significant space below the platen to a lower surface for the containment area. The surface of the platen and the surface which is contacted by the abrasive sheet should be below the upper edge of the protective walls which surround the platen. The enclosure is designed to intercept projectile material, preferably angling ricochets from the wall downwardly by angling or curving at least a part of the walls so the walls slope away from the platen as one moves in a direction down from the top of the wall. Preferably the plane formed between the work piece and the abrasive sheet should intersect the wall element at least 1 cm below the highest part of the wall. Preferably there should be at least 2 cm of such clearance, more preferably at least 4, 5 or even 10 cm of wall above that plane. The distance below that plane to the floor of the containment area should be at least 5 cm, more preferably at least 10 cm, and may be 20–50 below the plane. Abraded material may harmlessly collect in the floor area, and the area cleaned out from above (around the sides of the platen or by moving or removing the platen) or from below (by an access panel or regular drainage system). The collected materials may be more readily disposed of and collected in this manner. The walls of the enclosing elements may be metal, coated metal, composite, abrasion-resistant coated material, or sacrificially coated materials, high friction materials, or energy absorbing materials. The walls may be sloped outwardly so that impacting material may be reflected down towards the floor/collecting area. The entire enclosing structure may be removable most easily down from the bottom of the work area, there may be constant or sporadic drainage allowed through the floor area, and the like.

29. LINE CUTTING LAPPING OR POLISHING WITH AN ANNULAR FACE OF ABRASIVE

Problem: It is often desirable to control the application of the abrasive material to a substrate so that a specific pattern and particularly a straight line of lapping is effected on the work piece. This type of polishing could be done with a rotating beveled cup abrasive wheel with the beveled side edge coated with abrasive so that the abrasive action is directed against a plane parallel to the axis of rotation of the workpiece or piece part. Sheet material is not naturally thought to be applicable to such a process unless the sheet material were applied along such an outer edge. The flat front face of a platen could not create a straight line contact between the abrasive and a workpiece. Unless a beveled face as shown in U.S. Pat. No. 4,219,972 was used for the abrasive grinding wheel, there could be no such possibility for any line or flat surface lapping unless an entire surface were to be treated. That type of configuration would not be expected to be amenable to abrasive sheet material, as the potential for wrinkling in fitting the sheet to the outer edge would seem to be significant. Additionally, there has been no disclosure of the use of sheet applied materials on beveled edges of lapping or polishing materials as only flat sheets in rectangular and round facial patterns have been provided.

Figure 12:
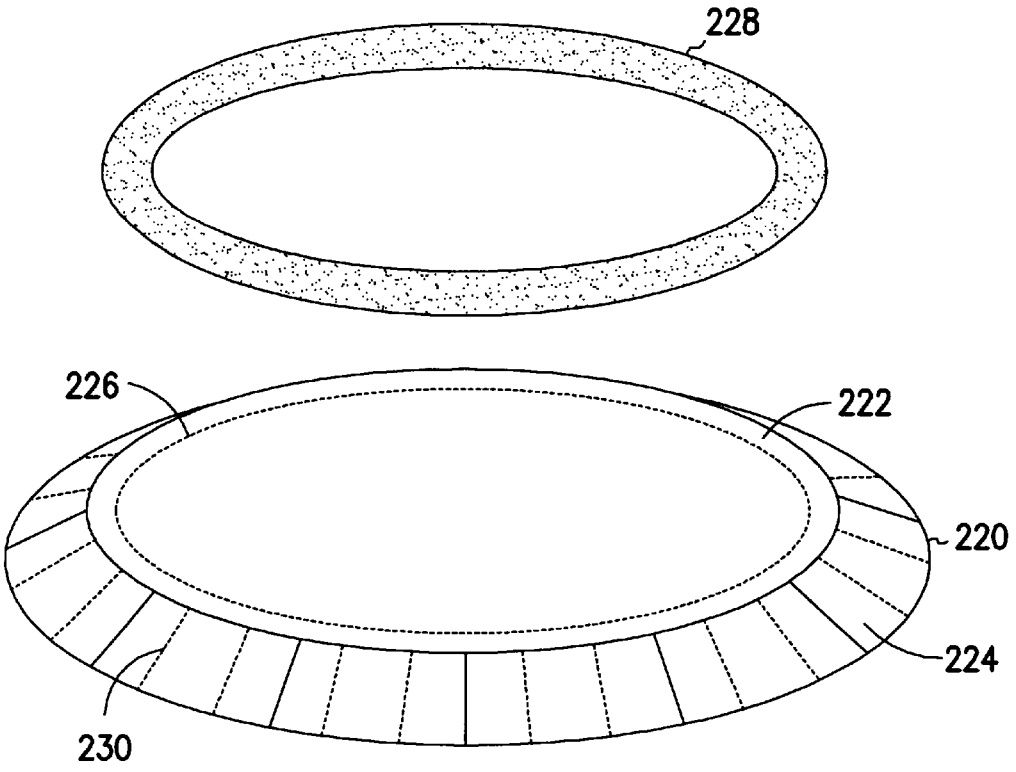
FIG. 12 is a perspective view of an annular platen with a beveled edge.

Solution: A platen 220 is provided with an upper surface 222 (which is shown in FIG. 12) as a flat surface with ports 226 for securing sheets to the surface. On the beveled side edge 224 are additional air vent ports 230 for securing subsequently applied abrasive sheet material 228 to said edge 224. A circular sheet of abrasive material (not shown) or an annular sheet of essentially two dimensional conformation 228 may be applied to the upper surface 222 of the platen 220. A flat abrasive sheet (not shown) would be secured by reduced air pressure through ports 226 on the upper surface 222 of the platen 220. It is to be noted that because of the beveling of the edge 224 of the platen 220, it is not necessary that the upper surface 222 of the platen 220 be flat. That surface may be rough, smooth, arcuate (e.g., spherical segment), or any other shape, with or without features, since the lapping surface is no longer a face of the platen but is the beveled edge 224. The edge is beveled at an angle between 1 and 89 degrees away from the top surface 222 of the platen 220; preferably the angle is between 5 and 45 degrees, more preferably between 5 and 30 degrees. When an essentially two dimensionally formatted abrasive sheet 228 is applied from above the platen to the upper face 222 of the platen, pressure (and/or heat) may be used to conform the sheet 228 to the beveled surface 224. The pressure from reduced air pressure through ports 230 may not be sufficient to form the sheet 228 and additional pressure as from a mold overlay (not shown) which match the shape of the beveled platen 220 may be needed. It has been surprisingly found that the sheet 228 may be formed over the surface without distortion of the configuration of the sheet. No wrinkles are formed in this fitting procedure. As one of ordinary skill in the art knows, normally when an annular sheet-like object in sheet form is fitted over a truncated conical form, the sheet distorts and forms wrinkles when attempting to conform to the surface. The sheet material backing on commercial abrasive sheeting has been found to be able to conform without wrinkles when pressed onto the beveled shape. This is believed to be in part caused by elastic or inelastic give in the backing material itself. What is additionally surprising is that with the stretching or reconfiguration of the backing material, the essentially uniform abrasive surface of the abrasive sheet is not adversely disrupted. This is particularly surprising since the uniformity of the distribution of the abrasive material on the surface is so important to the quality of the lapping process, and the amount of elastic conformation at the lower edge of the platen may be 10% or more.

Figure 13:
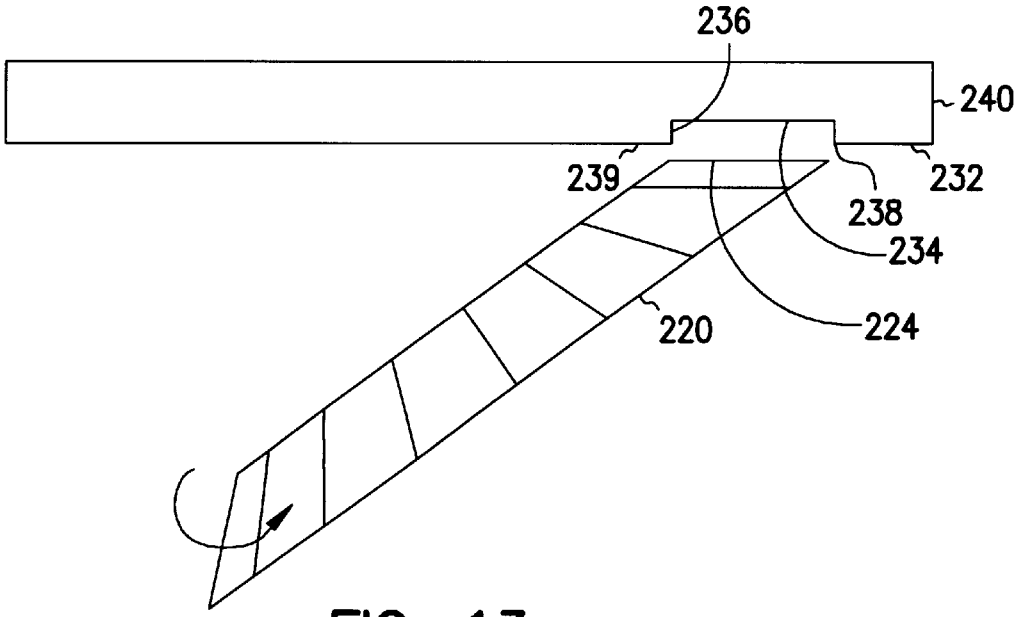
FIG. 13 is an edge view of a platen with a beveled edge and a workpiece being lapped in a linear manner by said platen.

The beveling of the edge provides a geometry to the edge that when, as shown in FIG. 13, a workpiece 240 is addressed by the beveled edge 224 of a platen 220, the beveled edge 224 is parallel to a surface 232 of the workpiece 240. Additionally, a relatively clean line contact is made between the beveled face 224 and the face of the workpiece 232 so that a relatively flat lapping contact is made. The shape of the area removed 234 by extended contact with the edge 224 of the platen would be nearly rectangular (for most purposes), and only if the lapping were used in more of a grinding fashion would an angularity in the wall 236 be noticeable while there was only a right angle configuration on the distal wall 238 of the area 234. An angularity or pitch in the wall 236 while the distal wall 238 was relatively perpendicular to the face 232 of a ground area 234 would be a fingerprint of the practice of the present invention.

The use of the annular ring with the beveled edge geometry has numerous benefits and improvements over a cylindrical section or disk element for the grinding wheel. Systems of grinding wheels with abrasive on the outside periphery of the wheel (not on the flat face) are known for systems where the abrasive is part of the wheel material itself (e.g., a grindstone) or coated onto the edge. An abrasive sheet material does not lend itself to facile application or use on such an outer edge, both for technical and mechanical reasons. There are basically three ways in which a sheet material could be applied to the outer edge of a grinding wheel: 1) coat abrasive on a cylindrical sheet and cut continuous sections from the sheet which fit the grinding wheel diameter; and 2) cut strips of abrasive sheet material and adhere them to the surface of the edge. The first method would involve a specific new manufacturing process and technique to manufacture such a continuous circular element, and the tolerances for good fit to the wheel would be quite small. It is possible to have the backing layer of the circular cut element shrinkable to fit the article more tightly to the wheel, but adhesive would have been desirable, and this leads to disuniformity. The vacuum hold-down of the present invention would have helped in this format, but the new manufacturing procedure would have still been needed.

The second manner of providing an abrasive edge to the wheel would have required that the strip be attached at its ends to form a circular element. This would require the formation of a joint or weld, which would be likely to provide a weak spot, an elevated patch, a wrinkle, or other aspect which would not lend itself easily to use in the fitting of pre-made abrasive sheeting to the end of grinding wheel.

The use of the completely beveled edge on the platen in this aspect of the present invention provides a mechanism for providing a continuous strip of abrasive sheeting made by existing technology and available as a staple in the market place as an abrasive surface on a high speed lapping system which can provide linear lapping and polishing as well as complete surface lapping. It is an attribute and fingerprint of this aspect of the present invention to provide a platen with a beveled exterior edge and a continuous strip of abrasive sheet material on at least the beveled edge. The particle distribution in the abrasive sheet may well result in a gradient of slightly lesser density of particles in the upper, smaller diameter region of the beveled face than in the lower, larger diameter beveled face. This particle density may be as slight as 1, 2, 5, or 10% depending upon the angle of the bevel and the degree to which the underlying support sheet has been shaped by the fitting process. This minor particle density variation has not been noted as providing any adverse effects on the lapping quality provided by this configuration, and the important fact is that the shaped annular disk conforms well to the beveled face and provides a very consistent and smooth orientation of the abrasive sheet upon the beveled edge.

30. UNEVEN WEAR ON THE SURFACE OF THE PLATEN WITH AN ANNULAR ABRASIVE AREA

Problem: Because of the high rotational speeds of the platen and the abrasive sheet material on the lapping face of a platen, there is uneven wear between a radial outer area of the abrasive material and a radial inner area of the material. There are differences in the linear speeds at the two areas, the amount of surface area each incremental area of the abrasive addresses, and therefore there is more rapid the wear in the abrasive surface towards the outer edges and likewise more rapid wear on the workpiece.

Figure 14:
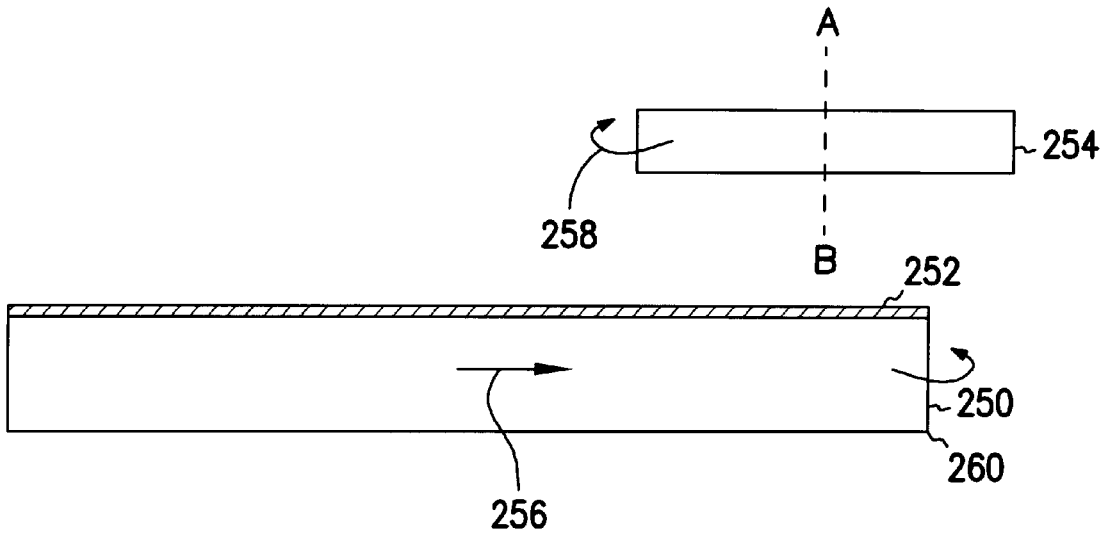
FIG. 14 is an edge view of a workpiece and a platen.
Figure 15A:
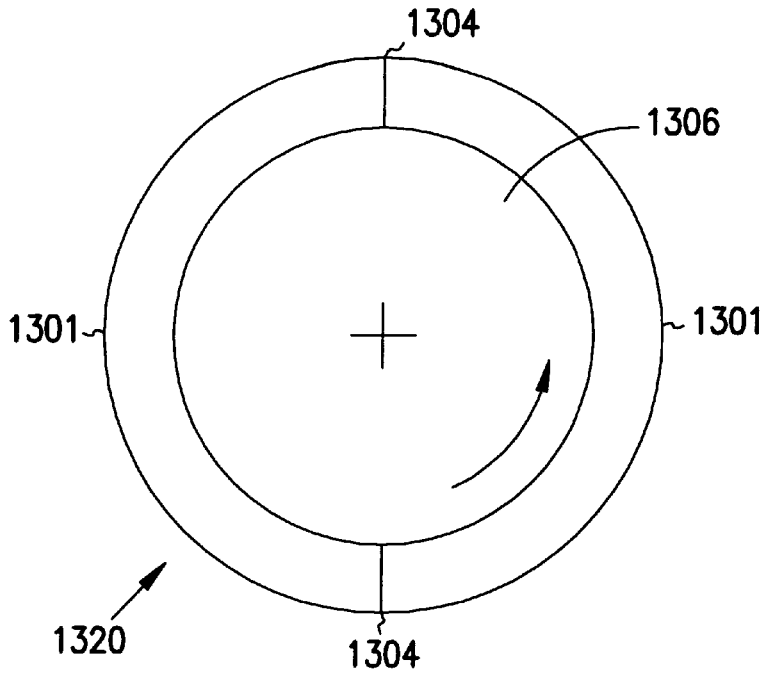
FIGS. 15*a*), *b*), *c*) and *d*) are overhead views of abrasive platens with segments of abrasive sheets thereon.
Figure 15B:
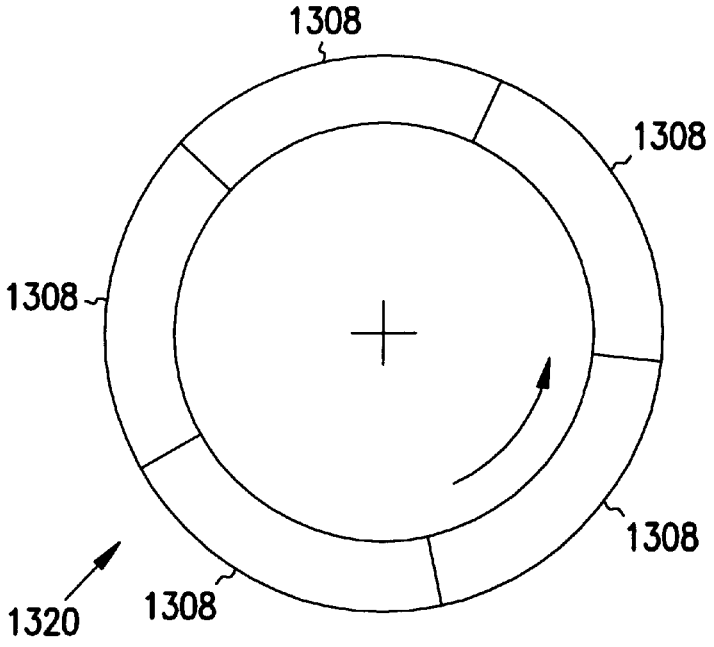
Figure 15C:
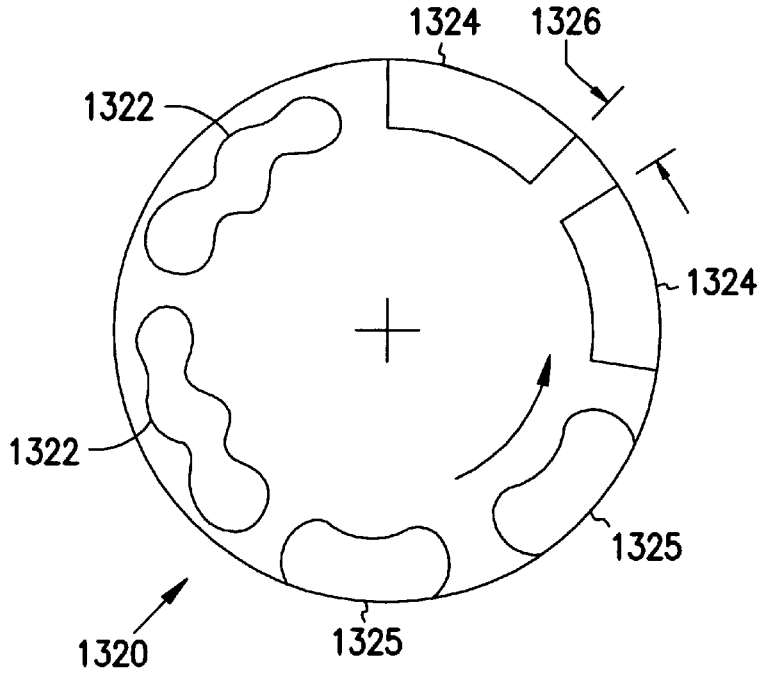
Figure 15D:
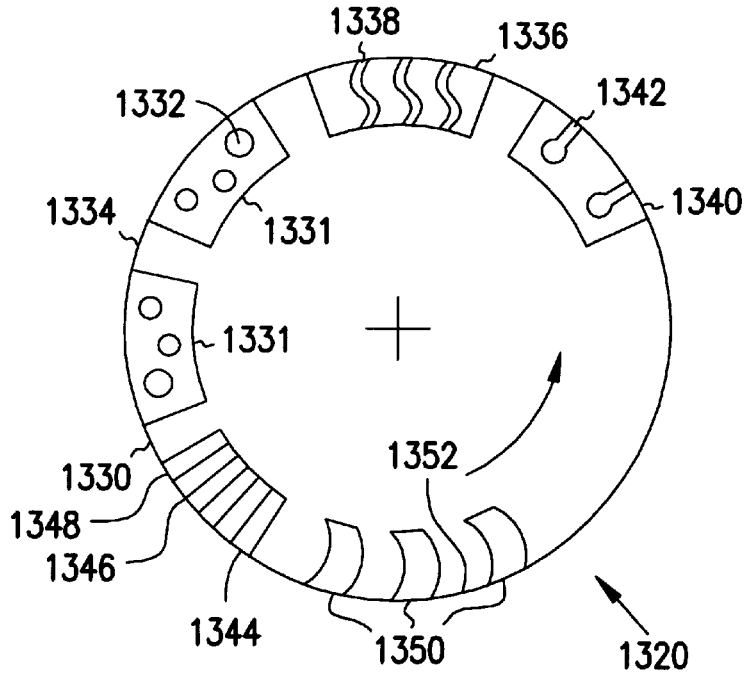

Solution: In FIG. 14, a workpiece 254 and a platen 250 with an abrasive surface 252 address each other. The workpiece 254 has an effective center line A-B. The workpiece 254 is moved so that the center line A-B spends more time inside the outer edge of 260 of the platen 250 while the abrasive surface 252 of the platen 250 and the workpiece 254 are in contact during lapping. By distributing or shifting the majority of the time of contact between the abrasive face 252 and the workpiece 254 towards this interior region, there is less wear on the outside edge 260 of the platen 250. As the most serious wear and damage to the workpiece 254 can occur with excessive wear on the outside edge (as cracking, flaking, and sharp edge features can more easily develop, this is an important improvement in the wear performance of the abrasive sheet material 252. FIG. 14 shows that the direction of rotation 256 of the platen 250 is opposite the direction of rotation 258 of the workpiece 254. This aspect of the invention works even better where the workpiece is rotated at the same time that the platen is rotated, to more evenly distribute the time and position of orientation of the workpiece and the abrasive surface. Even if uneven wear does occur, the dual rotation of the workpiece and the abrasive sheet on the platen will reduce any linear effects or artifacts on the workpiece surface. The rotations 256 and 258 do not have to be in opposite directions, but this is the preferred mode of practice.

The time when a workpiece is in contact with an abrasive sheeting is referred to as the total contact time Tc. The time when the center of the workpiece is inside (not merely directly aligned with) the outer edge of the abrasive surface must be at least 50% Tc when operating at a constant speed. That is if the speed of rotation of the platen decreases, the Tc must be weighted according to the surface area fanned or covered by the workpiece. Operating at a constant speed, it is preferred that the workpiece center be within the outer edge at least 60% of the time, more preferably at least 75% of the time, still more preferably at least 80 or 90% percent of the time, and it is most preferred and most convenient to have the center of the workpiece aligned within the outer edge of the rotating platen at least 95% and even 100% of the Tc.

The combined effect of moving the center of the workpiece inward from the outer edge and the rotation of the workpiece not only reduce uneven wear on the abrasive surface, but provides a synergistic effect in reducing the potential unevenness of lapping/polishing on the surface by both improving the consistency of the abrasive surface addressing the workpiece and reducing any linear effects that any unevenness in the abrasive surface could cause in the workpiece. Additionally, by having an eccentric or non-repetitive movement of the workpiece with respect to the radial position of the abrasive surface, there is even less likelihood of any linear uneven lapping effects upon the workpiece surface.

In the system where the center of the work piece is offset, so as to be located predominantly inside of the annular ring center line of the abrasive sheet, the lapping set-up may include multiple workpieces. As the platen carrying the abrasive sheet is rotated, a workpiece will normally cover or be in contact with only a very small fraction of the surface of the abrasive sheet. This leaves space or areas on the abrasive sheet available for additional lapidary work. It is convenient to have multiple workpieces distributed about the periphery of the platen carrying the abrasive sheet. At least one workpiece should be oriented as described above with respect to the relative position of the center of the workpiece and the annular ring center line of the abrasive sheet. Preferably more than one of the workpieces and most preferably all of the workpieces are so oriented. To increase the effect of reduced uneven wear according to the practice of the present invention, at least two of the multiple workpieces should be rotating in opposite directions with respect to each other. That is, when viewed from one direction perpendicular to a platen face, at least one workpiece will be rotating clockwise and another will be rotating counterclockwise. It is preferred that with an even number of workpieces, clockwise and counterclockwise rotation is evenly distributed and alternative between the workpieces, and with an odd number of workpieces, the numerical distribution would be n+½ and n−½ for clockwise and counterclockwise workpieces, with only one pair of adjacent workpieces rotating in the same fashion.

This format of distribution with respect to a lapping surface is useful in the practice of the present invention whether an entire platen surface is covered with abrasive sheeting or whether an annular distribution of abrasive sheeting is provided. The problem of uneven wear occurs in both type of systems, the potential for damage is present in both types of systems, although it may be somewhat magnified in the whole sheet system since there is a large variation in the radius and thus the surface speed of the disk, and so any degree of uneven wear provides greater likelihood for that uneven portion to contribute to damage to the workpiece surface. This is simply a matter of probability in that any damaged area has a greater probability of being in contact with a workpiece when it constitutes a larger percentage of the total abrasive surface area.

It is also a consideration in the operation of a lapping apparatus using the conformation of work piece positioning and the outer edge of the abrasive sheeting to assure that at least some of the contact time of the work piece and the abrasive platen positions the workpiece over the outer edge of the abrasive sheet, and if an annular distribution of abrasive, over the inner edge of the abrasive distribution. The passage of the work piece over the edges of the abrasive distribution avoids the formation of ridges on unused portions of the abrasive surface. By rotating the work piece while the platen is spinning, differing areas of the work piece are presented to areas of the abrasive sheeting. More importantly, however, buildup of ridges are avoided by the extension of the edges of the workpiece over the outer (or inner with an annular configuration) edge of the abrasive distribution. The extension should cover at least 1%, more preferably at least 3%, still more preferably at least 5%, and most preferably at least 10% of the effective diameter of the piece part. (Note that the piece part should be somewhat larger than the width of the ring, which is 100% Tc.)

Another operation which proves to be of benefit in the operation of the lapping apparatus is to precondition the outer edges of the abrasive sheeting before actual lapping of a work piece. Such sacrificial lapping on the outer edge for a brief period of time (e.g., less than 50%, preferably less than 25% or 10% of the actual Tc for the next intended work piece, e.g., for 1–5 seconds) can remove manufacturing or conversion (cutting) deficiencies in the outer edge. This has been found to assist in reducing the occasion and occurrence of particulates being dislodged in the outer area and wedging themselves between the abrasive sheet and the piece part.

31. GIMBALED WORKPIECE HOLDER

Problem: In initial work with high speed lapping systems, a gimbaled workpiece holder had been used. This provided unsatisfactory results in that relatively cone-shaped surfaces were produced. This effect was primarily due to the fact that the interior region of the lapping abrasive surface is moving slower than the outside region (radially outside) of the lapping abrasive surface. Less grinding per rotation was being performed on the interior region, less material was being removed, and so the interior region of the workpiece was higher in the relative topography of the surface, producing the cone-like structure. Hydroplaning effects of liquid between the platen and the workpiece also contributed to an unevenness in surface smoothness, as did uneven wear in the different regions of the abrasive sheet surface. The basic system of the platen covered with abrasive sheet material, rotated at high speeds (e.g., 2,000+ rpm) and a gimbaled workpiece would produce surfaces with light band uniformity of at best 4–5 light bands smoothness, and this was attainable only through constant and severe control of the system.

Solution: The combination of a platen surface with an annular ring of abrasive material (e.g., with the non-abrasive inner region comprising at least 20% of the total area of a circle defined by the outer circumference of the annular abrasive sheet) when used in combination with a gimbaled workpiece holder has been found to improve surface flatness as compared to a continuous surface of abrasive material. The light band flatness is reduced to 1–2 light bands. With the annular abrasive sheet with a gimbaled workpiece, lapping times of from 15–30 seconds at 3,000 rpm are used to with a twelve inch diameter annular disk with comparable times of 60–100 seconds at 1000 rpm.

The gimbaled workpiece holder is desired in more conventional lapping apparatus as it is difficult to align the upper workpiece holder perfectly perpendicular to the abrasive platen surface. Even if it is initially aligned, it becomes even more difficult to retain that alignment with disturbance from hydroplaning forces and other machine factors, such as uneven bearings, other dynamic forces, and the like. The combination of the gimbaled workpiece holder with annular sheets of abrasive material attenuates or substantially eliminates some of these effects and problems.

32. RIGID WORKPIECE HOLDER AND POSITIONABLE ABRASIVE PLATEN

Problem: It is desirable to be able to provide a system where only one of the workpiece and lapping platen are needed to be moved during operation of the system. There has been no effective lapping apparatus which has been able to provide the complete control over positioning of the platen face and the workpiece face during lapping which would produce high quality smoothness at high speeds. Because of the high speed component of the present lapping apparatus, the ability for accurate and fast alignment of the surfaces (lapping and workpiece) is much more important than in previous systems. The lapping process for slurries of abrasive or lower speed lapping with abrasive sheet materials (especially in combination with adhesively secured sheets) would take hours. The amount of material removed from surfaces with maximum rotational speeds of 200 rpm was very small and took a large amount of time. In the lapping process, it is often is not always necessary to replace abrasive material during the complete procedure. The abrasive had to be changed because first coarser than finer abrasive material had to be sequenced to rough grind, then polish, then lap the surface. The slow rotational speeds increased the amount of time needed for each step. The need to remove abrasive sheets secured by adhesive was especially slow and unwieldy because of the need to strip the adhesively secured sheet from the platen, remove excess adhesive, and reposition a new sheet with new adhesive. Additionally, even with adhesive removal between sheets, there was a likelihood of adhesive buildup.

Solution: A heavy support frame for the workpiece and lapping platen (including rotation engine or motor) is provided in combination with a preferably fixed workpiece holder secured to the heavy frame. The lapping portion of the system (the motor and lapping platen) is carried on a heavy frame. The workpiece support or workpiece platen (along with gearing or in combination with the motor) is positionable in three axes (the x, y and z axes). Each axis is separately controllable, with an extensive amount of positioning being capable in the axis controlling the linear spacing between the abrasive platen and the workpiece (the z axis), e.g., can be measured in full meters. However, in addition to any gross maneuverability of the workpiece platen along these three axes, there may also be a control system in place for at least the y and x axes (which define the piece part position parallel to the abrasive platen surface. The fine controls on the system would require that there be at least one hundred (100) positions available within any centimeter of movement along either axis, more preferably at least 250 positions, still more preferably at least 500 or 750 positions available within any cm of movement, and most preferably that there be at least 100, 250, 500 or 750 positions available for every millimeter of movement of the platen face along anyone of and all of the three axes of movement of the platen face. The degree of control may also be measured as with respect to the rotation of a control element. That is, there may be 36, 72, 120, 144, 180, 200, 240, 300, or 360 individual positions within a single rotation position of a control or switch. These numbers have been selected merely because of their relationship to 3600°, which is the basic unit for a rotation, but any other unit or number may be selected, as between 1 and 100,000. The actual construction the best working model of the present invention uses position control with a stepping motor having 50,000 step increments per revolution, which divides the forward motion from a single rotation into 50,000 units of travel. Units of more 5,000, more than 10,000 and more than 25,000 are particularly desirable. Each revolution of the control means may have as little movement of the directed portion of the platen (e.g., one edge moving along one axis) as less than 0.05 mm, preferably less than 0.005 mm, still more preferably less than 0.001 mm, and the like.

Positioning along these axes can be effected by any means which can move the platen face with accuracy. Screw pins and screw drives have proved easy to configure into the system because the pitch of the screw can be adjusted to control the amount of linear movement along an axis with respect to any particular amount of screw rotation. For example, with a screw drive having 1 thread per cm, a 360° turn would advance the screw and any part attached thereto by one cm. A 36° rotation would advance the screw 0.1 cm. Similarly, with 5 threads per cm., a complete rotation of the screw head would advance the screw and any attached workpieces or platens 0.2 cm., and a 36° rotation would advance the screw 0.02 cm. Thus the sharpness or fineness of the control can be designed by the threading of screws.

The mass of the frame also has a beneficial effect upon the performance of the system. As the system is subjected to vibration forces, it is desirable to minimize these forces. This can be done in a number of ways, but the easiest way to have a major impact on controlling vibration is to increase the mass of the support system and the connectors of the workpiece holders and the abrasive platen. The frame of the system should weigh a minimum of 100 kg. For a lightweight, small manufacturing model. More preferably at least 200 kg, still more preferably at least 350 kg. And most preferably at least 500 kg., with no maximum weight contemplated except by the limitations of reasonableness. The weight of the actual commercial embodiment of the present invention is about 600 kg.

The apparatus described in this section would generally be a lapper platen system comprising:

a) a shaft which is connected to a rotatable platen, said platen having a back side to which said shaft is connected and a flat front side on said platen to which can be secured an abrasive sheet;

b) a frame having a total weight of at least 200 kg supporting a work piece holder assembly and said shaft connected to a rotatable platen;

c) said workpiece holder is attached to a movable element which is capable of moving along said frame in a direction towards and away from said abrasive sheet, d) said workpiece holder assembly having control element thereon which allow for independent movement and alignment of said workpiece holder assembly along three perpendicular axes so that said flat face of said platen can move towards parallelism with said work piece to be lapped; and e) said control elements having at least 50 settings per rotation, each setting moving said workpiece holder assembly along one of said three axes by a dimension less than 0.05 mm.

33. ADDITION OF FINE SLURRY BETWEEN THE ABRASIVE SHEET AND THE PIECE PART

Problem: It desirable to increase the speed of the material removal, obtain better flatness and surface finish smoothness with a fixed abrasive disk.

Solution: A slurry of abrasive particles can be added to the lubricant, coolant (e.g., water) which can be used with the coated diamond abrasive sheets. These loose particles could be larger or smaller than the average diameter of the fixed diamond particles, and have a controlled size distribution to enhance the performance of he abrasive disk. Different types of chemical additives could also be added to the liquid composition provided between the disk and the work piece, such as surfactant, viscosity modifying (reducing or thickening) agents, or acidic or basic solutions, etc. Some selectively chosen foreign matter could also be added to the slurry mix, such as glass beads, plastic beads, fibers, fluorescent materials, phosphorescent materials (for examination of the face of the work piece by other means). The different solid or abrasive materials in the slurry could perform a surface separation effect to obtain flatter contact between the work piece and the abrasive sheeting and also additional material removal mechanism effects. The other additives would have to be considered on an individual basis as a function or relationship of the type of abrasive used in each portion of the grinding cycle and the make-up of the work piece and its compatibility with the chemical make-up of the additives. The combination of different abrasive particles with the diamond sheeting can provide unique lapping effects and intermediate effects between traditional lapping with slurry compositions and the high speed abrasive sheet grinding of the present invention.

34. LIFT MECHANISM FOR LAPPER PART HOLDER

Problem: When a piece part is brought into contact with a moving abrasive surface, the amount of material that is removed in lapping can be extremely small, perhaps only 0.1 micron (micrometer) while the typical distance the piece part is moved from a typical "start" position to the abrasive is relatively larger, perhaps 4 to 6 inches. It is desirable to traverse the travel distance for part loading or unloading rapidly in perhaps 1 to 5 seconds as the actual lapping or grinding action may last only 10 seconds after contact with the high speed 10,000 sfm abrasive.

Typically the thickness of the material abraded away during one step of a grinding or lapping process is equal to the thickness or diameter of the abrasive media particles used in the previous step. A process lapping may start with 50 micron abrasive for the initial grind and be followed with a 3 micron particle abrasive, which removes approximately 50 microns of material (although as noted above, the practice of the present invention may beneficially reduce this amount of removal to less than 90% of the abrasive particle size). Next, 9 micron abrasive will remove 9 microns of material, 1.0 micron abrasive would remove 1.0 microns of material and 0.1 micron abrasive would remove 0.1 microns of material.

Trying to control the contact of the piece part with the abrasive surface positionally through the use of geometric advancement devices such as motor driven screws is very difficult to these very small distances. A fine pitch screw system with the capability to be moved in 0.1 micron or less increments does not have the capability to be moved through large distances for initial part loading or mounting in the machine whereas many other devices which have micro motion capability such as piezoelectric actuators or thermal expansion actuators are not capable of large excursions of 4 inches.

A further problem exists with screws in that those using recirculating ball bearings with inherent large pitches of 3 to 5 threads per inch tend to have significant position errors relative to accuracies of 0.1 micron or less due to out-of-roundness of the balls and non-perfect pitch variations of the lead screws used in conjunction with the balls to advance a carriage when the lead screw is precisely rotated. These rolling balls result in low drive friction.

Use of a servo motor to drive a lead screw provides fast continuous motion of the lead screw and the carriage to which the part holder is mounted, but when the servo motor is stopped at the desired contact position it has a natural tendency to "dither" or oscillate mechanically and positionally due to its control system electronics which corrects for the position error sensed. First it will move past the target, create an error, and then move back again past the target making a new error and correction.

If a stepper motor is used to drive a screw, then very significant accuracies can be achieved with micro stepping control architecture where a motor can be moved in increments of 50,000 steps per revolution. The accuracy of these micro steppers with ball screws having typical pitches of 3–5 threads per inch of travel is marginal with respect to the requirements of lapping with 1 micron or less abrasive media.

Using linear electrical motors directly on a carriage slide device has problems in that these motors again have a limited number of magnetic poles which results in minute speed and force variations along the length of travel of the moving portion of the motor device. Also they exhibit "dither" problems at a fixed position, similar to rotating servo drives.

An inherent problem of great significance is trying to achieve a smooth analog progressive grinding event with incremental or digital movements. Material is progressively ground away from the surface of the piece part on a continuous basis as the part is brought in contact with the moving abrasive. The total amount of material removed is expected to be at a steady fixed removal rate over a period of time with a constant contact force between the piece part and abrasive. However, if a piece part is moved incrementally by a stepper motor or an "over-shooting" servo drive, the piece part will be driven into the abrasive at initial contact with too much resultant force and therefore excessive and probably low quality or harmful grinding initially will occur as the piece part is ground away during this time period when the part holder is advanced this one step. As time goes on in this period of the incremental positioning step, material is removed and the contact pressure is reduced to less than desired until another incremental step or position change is made in this positional control system. Typical CNC (computer numerical control) machine tools operate with small or fine increments of motion and a cutting tool is driven by the strong machine into the piece part along a prescribed path with the surface finish and accuracy outcome a function of the size of the incremental steps and the speed of the mill cutter. Damage of a submicron layer of the piece part is not generally a concern with a CNC positionally driven machine.

Over-aggressive grinding action on a typical lapped part for 1 second or less can cause considerable submicron damage to the grain structure of these piece parts which are usually of great hardness being of such substance as tungsten carbide, alumina, ceramics, silicones, glass, titanium, carbide and others. Interstitial grain cracking at grain boundary layers is a common effect as is localized thermal stress heat cracks.

It is critical that the pressure contact force between the workpiece and the moving abrasive surface is held at a level determined to be best for a given piece part material, abrasive type, geometry, etc. The pressure on a given piece which is defined by the total normal force divided by the surface area would be quite consistent, which means the normal force needs to be changed when the surface area size of the part is changed to achieve optimal grinding on lapping. Each piece part material would have a unique pressure force that results in faster grinding or better surface finish. This problem would change also as a function of the period of the grinding cycle. Typically a higher pressure is used early in a period for greater material removal rates and a lower pressure is used late in the period for improved smoothness.

Determining the exact position at which a new part of unknown size or thickness initially contacts a moving abrasive surface is desirable for controlling grinding process parameters during the grinding process. This initial contact position changes in a potentially significant amount each time a new sheet of abrasive is installed for a series of grinding events with progressively finer abrasive media having a different sheet thickness used for a smoother ground surface.

Also, it is very important to know how much material is removed from critical parts and the rate of material removal. The rate of material removal indicates directly the condition of the abrasive media and indirectly the expected quality of the surface finish. It is extremely difficult to successfully use an exclusively position control system to present a workpiece for contact with a high speed abrasive surface such as the abrasive sheeting used in the present invention. About 10 micrometers of material from a workpiece surface is typically removed in about 15 seconds, and machine tool component parts (such as bearings) typically have fitting gaps larger than those dimensions, and the high friction that would exist with tighter fitting components would have too high a level of friction for the smooth movement of equipment necessary for the best practice of the present invention. An excellent criteria for good grinding or lapping action is control of the pressure force (which is difficult to measure) by incremental position steps which are used to create the desired contact force.

Solution: It is necessary to provide a precise, controlled contact pressure force between the piece part and the high speed abrasive surface during the whole abrasive grinding or lapping event. Once the piece part is removed from surface contact with the abrasive, then less precise or different means can be employed to move the piece part to another more remote location on the machine. A force based design (as opposed to a purely position-based design) is preferably used within the lapper system. The contact pressure between the workpiece and the abrasive surface is controlled by force controlled (and measurable force devices) devices such as pressure controlled cylinders (as herein described) acting as a piece part slide carriage which present a workpiece to be ground to the moving abrasive.

This aspect of a process of the present invention may be summarized as follows. A workpiece holder is supported on a linearly movable support (usually vertically with respect to the abrasive surface). The workpiece is advanced into contact with the abrasive surface (while the surface is static or while it is rotating, preferably at a speed that does not cause immediate significant abrasion (e.g., less than 10 microns grinding in 15 seconds). The parallelity of the workpiece surface to be lapped and the abrasive surface is preferably adjusted at this point, as by appropriate adjustment of positioning screws or other alignment elements, particularly mechanical, position oriented, linearly oriented elements (e.g., such as those herein described with at least 50 positions settings per rotation with no more than, for example, 0.05 mm linear movement per setting, preferably no more than 0.01 mm, and more preferably no more than 0.005 mm per setting) to place the workpiece surface to be lapped in good parallel alignment with the abrading surface of the sheet. The position is indicated (e.g., a program setting, position setting, etc. is indicated within the system, as on a computer) and the workpiece is retracted and removed from contact with the abrasive surface. The workpiece is then advanced towards the rotatable surface of the platen with the abrasive sheeting thereon, with the surface rotating, preferably at the grinding speeds desired (e.g., greater than 500 rpm with a 12 inch diameter outside diameter platen). The advancement is done with a low friction carriage so that the movement of the workpiece is relatively slow (e.g., less than 0.5 m/sec., preferably less than 0.4 m/sec., and more preferably less than 0.3 m/sec. or less than 0.2 or 0.1 m/sec.) and smoothly progressing. This is best accomplished by a system of elements herein described. This system of elements basically operates in a preferred mode by providing both vertical support forces (e.g., lifting forces as by air pressure, hydraulic pressure, pneumatic pressure, electromechanical pressure, magnetomechanical pressure, etc.) and vertical downward (advancing) forces (gravity, air pressure, hydraulic pressure, pneumatic pressure, electromechanical pressure, magnetomechanical pressure, etc.). The system may also be inverted, with gravity operating as a "lifting" force with respect to the vertical movement between the workpiece and the platen (that is with the platen at a higher elevation than the workpiece and the vertical "downward" force being a vertical upward force [provided, for example by air pressure, hydraulic pressure, pneumatic pressure, electromechanical pressure, magnetomechanical pressure, etc.]). The difference between the two forces (the lifting and descending force) controls the contact pressure between the workpiece and the abrasive surface at the moment of contact and thereafter. By accurate measurement and control of these controllable (relatively controllable, as gravity will be fixed for a workpiece/workpiece holder system) forces, the contact and lapping operation pressure can be accurately controlled.

One method of solving this positioning and force application problem is to use a screw drive system to move the piece part from its remote initial mount installation position to a new position close to the moving abrasive sheet and then change the method of controlling the movement of the piece part from a position based system to a pressure or forced based system for the grinding event only. After the grinding event cycle has been completed, then the piece part would be removed from contact with the abrasive and then control would be transferred back to the position based control for a "large distance" physical move of the part while the next grinding or lapping event is being prepared. An example of this lapping event change would be to change from a 9 micron abrasive disk to a 3 micron disk to be used in the next lapping event.

The lapping machine would require a number of other functional devices (e.g., at least two distinct systems) to allow the easy transition from a positional mode to a force mode. These functional devices would be used as a part of the grinding procedure.

First System—Motor Driven Lead Screw

A motor driven lead screw would be used for the first positional mode system. The preferred type of lead screw is not a large pitch acme screw with ball bearings but rather a standard bolt type 50 pitch per inch of screw length which gives about 10 times the linear resolution as a 5 pitch (threads per inch) ball screw. Also by using a standard threaded nut with this screw, there is little or no variation in the nut-to-screw location at any position because the third contact element which creates variations, the balls, are eliminated.

Low friction air cylinders or hydraulic cylinders are mounted at one end on the screw nut assembly and are connected on the other end to the piece part holder lift mechanism. Thus the piece part holder can be put into place (e.g., into contact with the non-rotating, slowly rotating, or high speed rotating platen) by the screw drive and at that time the cylinders can be activated to lift the part holder up a small distance of ⅛ to ½ inch before significant lapping has been effected. Then the screw drive can be lowered again until the piece part is nearly touching the moving abrasive. The pressure is then appropriately reduced in one of a number of cylinders which may be used to support the piece part holder, sometimes one but usually at least two cylinders, preferably at least three or four, and up to six offer definite advantages. In this case, with four air cylinders present, pressure in three of the cylinders would support most of the weight of the workpiece carriage assembly and independent pressure to the fourth cylinder can be used to raise and lower the carriage with a nominal low force of only one fourth of the weight of the carriage. When pressure to the fourth apparatus cylinder has its pressure reduced, this allows the piece part to come into contact with the moving abrasive at a controlled rate and pressure. The cylinder pressure was changed by a voltage-to-pressure (E/P) transmitter to provide a very low initial contact force, which increased as the lapping event progressed, decreased at the end of the event, and was then changed more to lift the piece part away from the surface of the abrasive sheet. There would be a nominal weight of the piece part assembly acting down against the force of the cylinders. The force of the workpiece against the surface of the abrasive surface can be seen as a combination of three possible forces. There is a support force component (in a relatively vertical direction) provided by the force mode system (e.g., the air cylinders) and there is a gravity component (in a generally negative or downward vertical direction). There may also be a third component (either a separate supporting component or a driving, downward component) to control the force or position of the workpiece as it contacts the platen.

After the piece part is raised adequately from the surface of the abrasive sheet by the cylinders, then the driven screw lift would be raised which will allow the cylinders to be lowered to their bottom or home position without the piece part contacting the moving abrasive. Non-typical air cylinders such as AIRPEL brand cylinders with limited air leakage around rigid non-seal inside rod glass tubes provide very low sliding friction. The process may be generally described as follows: A workpiece holder with a workpiece thereon is moved from a first position to a second position which places the workpiece into a second position comprising contact with or at a distance of less than 2 mm from the surface of an abrasive sheet on a rotatable platen. This second position is registered within the system which moves or controls the movement of the workpiece holder (e.g., a computer registers the specific position of the second position). Movement towards the second position may be done with the platen fixed, the platen slightly rotating, or the platen fully rotating, but only a very small amount of material removal is allowed, such as lapping of more than 10 microns for a 50 micron average diameter abrasive particle into the surface of the workpiece should be avoided in this step. While in the second position, adjustments in general parallelity between the workpiece and the abrasive sheet on the platen may or may not be made. After the second position has been reached, the workpiece is removed from the second position to a third position. This third position may or may not be the same as the first position, but is a position which does not afford contact between the abrasive sheet and the workpiece. This distance may be essentially any distance as the second position has been registered by the workpiece moving system. The workpiece holder is then moved from the third position to a fourth position which may be selected by the operator as approximately before the second position (before with respect to the workpiece's path of movement from the third position towards the abrasive sheet surface), to the second position, or where the second position was before contact had been attained, slightly beyond the second position. The fourth position is selected so that the actual contact forces between the abrasive sheet and the workpiece have a maximum pressure of between the desired range of 0.25 and 100 psi, and more preferably within the other ranges of preferred pressures desired in the lapping process. It is again most preferred that the pressure control mode used for the movement of the workpiece into contact with the abrasive sheet surface assures that the contact pressure is within the desired range. This is effectively done by assuring that the difference in forces (between the supporting upward vertical forces and the lowering downward vertical forces is the same as or preferably less than the intended contact force. The chosen difference forces might have to be smaller than the desired contact force to avoid the additional, but temporary force that would be added because of the momentum of the workpiece and the workpiece holder. That momentum would be absorbed, in part by compressive activities, but the momentum would definitely tend to momentarily add to the contact force between the abrasive sheet and the workpiece. By carefully controlling the relative forces (e.g., the weight is a constant and the air pressure or hydraulic pressure, for example, may be measured instantaneously or controlled), the contact force, even in the initial moments of contact can be accurately controlled. The contact forces during lapping can be accurately controlled by using stress gauges or the like to indicate the level of forces that must be provided in the support or driving force system provided in the movement of the workpiece holder.

A hydraulic or pneumatic dashpot damper or snubber can be used along with the air cylinders. This device could be spring loaded to raise its plunger or cylinder rod cylinder into an up position toward the piece part lift mechanism arm. When the arm is lowered by reducing pressure to the cylinders which act against the weight of the piece part assembly, the dashpot will control the speed at which the piece part contacts the abrasive. The dashpot can be adjusted for fast or slow travel. This can be used to control the momentum in the moving piece part and piece part holder.

Force sensors can be mounted on the end of the lifting cylinders (e.g., the air cylinders, hydraulic lifters, electronic or electrostatic lifters, etc.) and also be attached to the piece part assembly arm. As the force sensors are mounted in series with the air cylinders, they would sense and indicate the actual pressure that the piece part arm is experiencing. If the cylinders are deactivated, the sensor would still indicate the force that the arm is experiencing directly from the screw drive. These force sensors are typically strain gauges mounted on bending beams but may also be piezoelectric or other type devices. The force gauges may be integrated with the force control and position control devices through a computer with a program set up to perform specific levels of contact pressure during each, every or any lapping stage.

This same force sensor can be used to sense the force between the piece part and the abrasive disk. As the piece part arm is lowered onto the moving disk some of the force supplied by the driven screw on the air cylinders supporting the piece part assembly is now supplied by the contact force. The net result is a reduction in the force on the sensor. If all of the weight of the assembly were on the abrasive, the force gauge would read zero.

If an additional force were to be applied downward for extra high grinding force, then the sensor would change signs (if the sensor were initially in a tension mode) and the total force would be the weight of the assembly plus the new applied force. This additional force could be used where the differential between the lifting (supporting) force and the downward force were intentionally kept small so that the amount of contact force could be actively controlled by a driving force applicator. This driving force applicator would be any system which could apply a downward vertical force in controlled amount onto the workpiece holder. Electric, electronic, hydraulic, magnetic, air pressure or any other force supply could be used.

The force sensor can be used to establish the location or position of the piece part as it just makes contact with the abrasive disk. Here, the abrasive disk is stopped (and if desired, a piece of paper, etc. of known thickness is laid on the stationary abrasive) and the piece part assembly is lowered until it is just in contact, at which time the force sensor will change its reading to correspond with the amount of force now being applied to the piece part. Contact is now used as a mechanism to establish the position by use of a precision position scale attached to the piece part slide arm, or by programming into computer operated controls on the system.

The force sensor can be a single readout device or multiple units. Use of multiple units increases the reliability of accuracy in the sense that each of the sensors should give the same reading for a given equally shared load, so one bad sensor should give a different reading which can trigger a sensor accuracy review. Using three sensors mounted in a tripod arrangement gives a "three-point" natural contact for equal loads to each device. Also, any defective device would disagree with two others which increases the redundant reliability factor. The part contact force can be easily read out by "taring out" the weight of the part holder assembly. Three force sensors reduce the offset deflection of the bending beam used for mounting an electrical strain gauge sensor A linear encoder device such as a Hindenhain brand scale or a LVDT (linear variable differential transformer) can be used to establish the position of the piece part as it is processed by the machine during the lapping process. The position sensor allows control of the amount of material removed by the grinding process by comparing the position of the piece part assembly relative to its fixed height slide mount to the changing position as the piece part is ground or lapped. The Hindenhain brand linear encoder has the ability to determine position changes of 0.1 microns or less, and therefore is quite useful within the objectives of the invention. Another device which could be used to accurately determine position as an alternate to the Hindenhain device is a LVDT device.

An edge finder device used by machinist to physically locate the edge of a part to be machined for reference input for a CNC machine controller or for manual machining control may be used to determine that the air cylinder has lifted the assembly off the bottom home position. Another similar unit may be used to confirm that the assembly is in a fully raised position. These units typically are able to locate within 0.001". An edge finder switch can be used to sense liftoff of piece part contact with abrasive establishing the "second position".

As an auxiliary cylinder, small pneumatic or hydraulic cylinders can be used either to independently counteract part of the weight of the work holder assembly or be adjusted to exactly counteract the weight of the assembly or to provide more lift than the assembly. This last arrangement would then require a downward force to push the workpiece against the abrasive table.

A pressure sensor, such as an electronic pressure sensor can be used with the force lifting mode (or the position sensing mode) such as with the air cylinders to be used to calculate the theoretical lifting force of the cylinders.

A variety of slides can be used, including Thompson brand balls on single rods, Daedal balls on four small rods, and air bearing slides to obtain low friction forces which act against the piece part holder. Friction slide forces of typical slides are generally greater than the desired grinding contact forces which can be very low, in the 1 to 20 lbs. range for most parts.

A second method of providing pressure force control during lapping or grinding would be to use a linear motor operated in a position mode control for moving the piece part about the machine and then changing the mode of the motor control just before the part makes contact with the moving abrasive. As the motor current on a direct current DC motor represents force for a linear motor (or torque for a rotating motor) the control mode change can be made very quickly by modem controllers.

The linear motor position mode system would be used with other functional devices much the same as for the first method using a screw drive system.

Of particular note is the above described precision position scale which can be used to establish the position of a piece part starting the lapping or grinding process and to follow the size change as material is removed. Here, the initial position of the piece part in contact with the abrasive wheel can be determined by observing a change in the current of the linear motor upon making contact between the piece part and the abrasive platen as less force is required to sustain the weight of the workpiece assembly when part of the weight is borne by the contact force.

Other combinations of devices may be utilized such as a lead screw; air cylinders both of traditional design and AIRPEL low friction design; a dashpot to control descent speed; a force sensor system; or an edge finder switch; or auxiliary lift cylinders.

A third method that can effect a solution is the use of hydraulics to both move the piece part precisely to different positions and also to effect a pressure or force based contact with the moving abrasive media. A single low friction cylinder would be used which would have a number of common input fluid sources which are coupled or decoupled with the use of solenoid valves. The cylinder would be either connected directly to the work holder lift assembly or connected in series with a force sensor.

The cylinder and work holder assembly would be positioned very accurately by the use of high pressure low leakage gear pumps such as those with the Zenith brand name. The nominal pressure would typically be less than 100 psi even though the pumps would have the capability of generating more than 1,000 psi. A large capacity gear pump would be used for fast travel and a very small gear pump would be used to make precise minute incremental changes in position. Here, the gear pump would be operated by use of a stepper motor which will allow a fixed increment of fluid to be injected into the cylinder which would raise in proportion to the surface area of the cylinder piston. Generally, a 1 inch (2.54 cm) diameter cylinder would be used with a pump which has a volume output of 1 cc or less per revolution and a step motor which has 50,000 incremental steps per revolution to obtain very small changes in position per step increment.

When a desired position is reached, then the solenoid valves are closed, which prevents leakage back through the pumps and holds the part holder assembly in place.

A precise position measurement device such as a Hindenhain scale or a LVDT is used to indicate position of the assembly. In the event of significant leakage of hydraulic fluid past the cylinder rod end cup seals, a change of position is sensed and a corresponding corrective amount of fluid is injected into the cylinder by an activated gear pump. Large diameter cylinders preferably would be used to reduce cylinder friction so that the cup seal lips are not held too firmly against the cylinder wall because the hydraulic pressure is low due to the large surface area providing adequate lifting force to raise a typical work holder assembly weighing, for example 30–100 pounds, such as approximately 60 lbs.

To apply a controlled downward pressure to hold the piece part to the abrasive surface, the downward force may be controlled by an air/oil (pneumatic pressurized oil container) source. After the piece part is positioned very closely above the abrasive surface, perhaps only 0.050 inches away, the solenoid valves are controlled so that the hydraulic pressure applied to the cylinder is from an air/oil source. The air pressure is reduced and the cylinder starts to drop but the speed is held in control by a separate adjustable dashpot or by orifice flow restrictors. Contact abrasive pressure during the grinding event is then controlled by an E/P voltage controlled pressure transmitter such as supplied by Wats Co. or Rosemount Co. to change it as desired over the duration of the grinding cycle event. After the grinding event, the air/oil device can be used to lift the piece part from the surface of the abrasive and then through the use of solenoids, transfer can be made back to the gear pump based position control system.

A ball check valve can prevent formation of fluid bubbles when a vacuum is generated by reversing a gear pump when a cylinder is bottomed out and can't move. Mechanical stops can be used to limit the motion of the cylinder. A load cell force sensor system can also be used in series with the cylinder to obtain an independent reference of the force which can be compared with a calculated force based on the pressure readout device sensor which gives the pressure of the fluid in the cylinder at all times.

35. POSITIONING HOLES ON THE DISK OR SHEET

Problem: When using disks of abrasive coated material in lapping or grinding operations, especially when using thin disks of diamond coated plastic which are round (e.g., circular or annular in shape), there is a problem of positioning and maintaining the position of the disk, especially during high speed operation (e.g., at perhaps 2,000 to 3,000 revolutions per minute). In the past, these disks have been either positioned with a casual surface tension bond of a water film or also by use of an aggressive or nonaggressive PSA (pressure sensitive adhesive) layer which allows disks to be removed and used again. In the probable event that the disk would be installed even slightly off-center on the rotating platen when it is stationary, there would be mass out of balance. This would be a significant problem with high speed rotation of the disk due to the center of gravity not being positioned at the exact center of the rotating platen. When the platen is increased in angular velocity, the eccentric centrifugal force due to out of balance mass is progressively increased by the square of the rpm speed. This force would have a tendency to move the abrasive disk sheet even further out of balance with the ultimate possibility of the disk setting up vibrations which would affect product surface quality or perhaps leaving the platen with potential operator danger.

Solution: The disk needs to be positioned initially accurately on the platen when installed and then maintained in that position by at least one mechanical means. One technique for initial accurate positioning would be to punch a small or larger hole at the center of the disk and have a corresponding pin or post located at the center of the platen. By placing the disk on the pin or post, the disk would be centered and restrained at its true balance position. The disk could be easily prebalanced with respect to the hole without the necessity of placing it on an active platen. The existence of a pin or sub post would not materially affect the use or utilization of the expensive disk or affect the processing techniques of lapping or polishing as the linear velocity vector at the center of the disk area is quite small. The center of the disk is seldom, if ever, actively used in polishing. Competitive techniques using slow rpm (approximately 200 rpm) methods employ platens with large holes at the inside center and radius. Larger holes, e.g., greater than 3 cm, may actually be used also. Another technique for proper initial positioning would be to use a slightly raised outside edge about the thickness of the disk at the outer periphery to capture the disk and position it. In both cases, water or water plus PSA or PSA can still be used to temporarily secure the disk to the platen surface.

36. LIVING HINGE ALIGNMENT OF THE PIECE PART HOLDER

Problem: The alignment of the part holder with the rotating platen is critical to achieve precision flat and parallel grinding of piece parts which are vertically positioned in contact with the abrasive and moved laterally in "x", "y" patterns along the surface of the rotating abrasive.

Solution: A simple, inexpensive, stable and adjustable mechanism is to mount the vertical piece part assembly mounting plates, each of which has a "a living hinge" on one end and 1 or 2 adjusting screws on the "free" end. The adjusting screws allow the free end of the plate to be pivoted nominally in a pure axis rotation about the semi-fixed hinged end which creates the ability to adjust the position of a mounted apparatus in one axis. The use of a second similar living hinge plate mounted at a position 90 degrees to, but flat to the first plate, allows the nominal adjustment of the plate about the second axis perpendicular to the first. By adjusting both plates independently and together as a system, it is possible to easily align an apparatus precisely perpendicular to a reference plane. Simple mechanical screws could be used, differential thread mechanical screws could be used for fine adjustment, wedge slide blocks could be used, as well as could thermal expansion bolts or other similar devices. In all cases the flat plates remain flat but some twist out-of-plane could be effected by independently adjusting two bolts at opposed ends of the free end of the plate. Adjusting could be done mechanically by hand or by motor driven screws, electrical heat supplied to thermally expanding bolts or piezoelectric actuators. Adjustments could be made to achieve precision flatness or perpendicularity or to provide slight contact angles to create unique grinding efficiencies by closed loop controllers, also.

37. INCREASED SIZE OR MODIFIED CIRCULAR SHAPE OF A CENTERING POST TO STABILIZE THE SHEET

Problem: Operation of the lapper of the present invention is typically at 3,000 rpm with a 3M Diamond Coated Abrasive disk having a twelve inch diameter. The disk is held to the steel rotating platen by water film surface tension and positioned by a 0.5 inch (1.27 cm) diameter hole at the center of the disk used with a 0.5 inch (1.27 cm) diameter post at the center of the platen. At the high speeds, the disk lost its surface tension adhesion and was thrown off the platen while polishing a tungsten carbide piece part. The forces on the disk were such as to lift it off the centering post, and the whole disk was thrown off to the side of the machine, opening a cavity at the top of the machine post.

Solution: The 0.5 inch (1.27 cm) centering post was made larger in diameter to a 1 inch (2.54 cm) diameter or more post. Also, the post could have a non-circular shape with at least one surface positioned against a center post which would resist rotation, such as a hexagonal shape or an oval shape which would prevent the disk from rotating relative to the tangential surface of the disk. The post could also be made higher so the chance of the destructing disk climbing up the height of the post would be diminished during this type of event. Another technique would be to employ a clamp type of device to any of these round or non-round posts to clamp/hold the disk firmly to the surface of the platen at the center area of the disks which is not used for polishing because of the slow lineal velocity in that sector. The clamp could consist of a spline locked washer pressed on the disk surface with a thread nut engaged with a top threaded post. Springs could also be used to control the amount of force and to evenly spread the force uniformly. Ball detent or other snap latch fixturing devices could also be employed. As previously noted, since this section of the abrasive sheet would not be in lapping contact with a workpiece, adhesive could be used in this area to secure the sheet while vacuum was used in the other area to improve planarity.

38. DISTRIBUTION OF VACUUM ON BACK SURFACE OF THE SHEET

Problem: Round disks of minute diamond particle coated sheets of plastic film on 3,000 rpm spinning platens are difficult to hold in contact with the platen when running in contact with stationary or semi-stationary workpieces. When an abrasive disk becomes loose by breaking the water film "adhesive" surface tension between the disk and the platen, it has a tendency to rip or bunch-up and wedge between the workpiece holder and the high inertia spinning platen and can easily damage a workpiece part or can destruct portions of the workpiece assembly with the possibility of great danger to the operator. This is a unique problem due to the very high rotational speeds of 3,000 or greater rpm with a platen of 15 inch diameter (38 cm) or more constructed of heavy steel which could generate explosive type failures As this equipment is operated horizontally for the most part, the whole surrounding area around the machine is susceptible to this danger. One method to reduce the likelihood of this separation problem is to coat one side of the diamond abrasive disk with a PSA (pressure sensitive adhesive) film to temporarily bond the disk to the platen. This adhesive creates a flatness accuracy problem in that its normal thickness accuracy varies greatly around the disk which causes high areas of lapping contact for this super precision abrasive contact. Secondly, when a disk is removed, some sectors or pieces of transparent PSA adhesive remains on the platen and forms a bump when the next abrasive disk is installed in the platen which then destroys the smooth vibration free abrasive lapping at high speeds.

Solution: Use diamond or other abrasive disks without using PSA adhesive and first position the disk at the true center of the platen by use of a centerhold in the disk positioned over a post positioned at the center of the platen (or by other centering means) and then hold the abrasive disk to the platen by use of vacuum by use of a rotary union on the hollow rotating platen shaft. The preferred area to apply the vacuum would be at the inner radius of the disk which would seal out first as the disk is installed at the platen center and also because this inner one fourth or so of radius is not used much for lapping because of slow surface lapping velocity. The second most preferred vacuum area would be the outer ½ inch (1.27 cm) of disk radius at the periphery of the disk as this would also not be used much and would have large holding force.

39. INDEX LOCATION MARK ON ABRASIVE DISK

Problem: Fast removal, remounting of disks (10–15 second intervals of typical use) need to be replaced in the "original" position. When a disk is installed on a platen it can be held by double stick adhesive tape or by vacuum. A typical disk is a thin layer of plastic film which is coated with abrasive diamond or other ceramic type coatings which wear off with use—presenting new fresh sharp material for fast accurate material removal. Also diamond particles are captured with metal plating on a film and an additional backing material is adhesively bonded to this plated film. If the finished product abrasive disk is attached to a rotating platen with adhesive, the adhesive is usually coated on both sides of another thin film, all of which have dimensional tolerances so one area of a disk may be thicker than another and result in non-uniform abrasive wear. All the variations in thickness of the sticky adhesive can be eliminated by use of the vacuum draw-down or vacuum securement holes of the platen.

Solution: When either the platen or the disk is uneven, only the high spots of the abrasive disk will wear down first. When a disk is removed after typically 15 seconds usage (because 10,000 sfpm abrasive cutting is 20–30 times faster than conventional grinding) and a new finer grit disk is used, there needs to be a method to accurately relocate the disk the next time it is used. A disk typically can be used ten to hundreds of times.

By marking a disk with color pen or mechanical cut-outs, notches, etc. and positioning this disk mark on a corresponding mark on a platen, a disk is re-installed at a location where it "fits" and does not have to be reground to size for the next operation, saving time and disk wear costs.

40. ANNULAR DISKS

Problem: Using vacuum holes, adhesive annular disks at the outer periphery platen of a high speed rotating platen have special problems of lifting at the inner radius due to surface water and grinding particles being driven under the annular film disk by the high rotational speeds. Once lifted slightly, the raised edge gathers even more water/debris which raises the edge further and presents this structurally weak disk edge to a stationary piece part having a typical sharp edge—which has a tendency to catch or cut the disk edge. Because of the high speed of the platen, running at from about 1,000 to 10,000 surface ft/min, the disk can become damaged and crumpled and tear and then either be thrown off the platen or wedge between the platen and the piece part holder which can create large dynamic forces which result in dangerous flying shrapnel. If a vacuum hold-down is used, the vacuum would have a tendency to suck the abrasive debris particles into the vacuum holes, eroding the hold edge and enlarging them, which would locally distort the working surface of the abrasive disk. Also centrifugal force from the 500 to 3,000 rpm 12 inch (30.5 cm) diameter disk would have a tendency to curl or raise up the inside disk edge.

Solution: It is desirable to provide a full circular disk with a method of "raising" the outboard annular section so water and debris particles can't get under the inside radius to start the curl-up. A uniform disk with no annular cutout or even an inner radius hole would be best because no water or debris can get under the disk. Because of the high costs of the disk material, an annular ring of abrasive disk could be adhesively bonded to another uncoated circular (not annular) disk. This could be done by adhesive securement at the meeting edges of the central disk and the annular disk, butt welding, sonic welding and any other form of attachment between the two sheets that provide a barrier for water or abrasive grit flow under the annular sheet. The inboard circular disk would be thinner than the outboard annular abrasive sheet disk.

41. Simplified Drive Motion

Problem: It is desirable to have a simple drive mechanism to position a stationary or rotating workpiece on the outer periphery of a high speed rotating (approx. 3,000 rpm) disk abrasive for most of the processing time with a small portion of the polishing or lapping time spent at the inner radius portion of the abrasive disk where the surface speed is reduced and the abrasive action is reduced.

Solution: A simple, eccentric harmonic motion, constant speed rotation as provided by a DC or AC gear motor hub can be used to drive a linkage system. This will provide smooth continuous motion of a workpiece. Most of the time in a given hub rotation cycle will have the workpiece operating at the outer periphery of the abrasive disk, which has the highest surface speed and highest grinding action. A very small portion of the cycle time for the work piece will be spent at the inner radius, where there is a relatively low surface speed, and there will be reduced grinding action on the contacted portion of the disk.

42. BELLOWS SANDWICH BALL PIECE PART HOLDER

Problem: Initially, a piece part may need to be ground roughly flat, which requires a rigid (non-pivoting) piece part holder, but then may need to be processed on a spherical ball piece part holder to achieve extreme flatness of 1 to 2 light bands or less. It is desirable to do this on one single machine using coarse grinding media of 40 micron particle on the rough finish using the rigid holder and 3 micron particles using the pivot holder.

Solution: A precision rigid piece part spindle piece part holder system can be constructed with vacuum holding of the piece part for rough grinding the piece part flat. Then a flat sandwich construction spherical ball pivot piece part holder can be constructed with an internal vacuum chamber to allow the piece part to be held or mounted with the same vacuum source and utilize an internal spherical ball for allowing the piece part to "float" on the abrasive surface rotating in contact with the piece part holder.

43. LAPPER PLATEN

Problem: Constructing a high speed lapper platen rotating at 10,000 SFM velocity or 12 inch (30.5 cm) diameter wheel at 3,600 RPM is difficult where the annular edge of an abrasive disk is raised for use with an annular ring of abrasive disk. It is necessary to avoid water or debris getting under the inboard radius. Also when abrasive particles are drawn into the vacuum holes on the platen, they tend to wear the edges of the holes and enlarge them, which results in distortion of the flexible abrasive disk sheet at the hole locations.

Figure 17A:
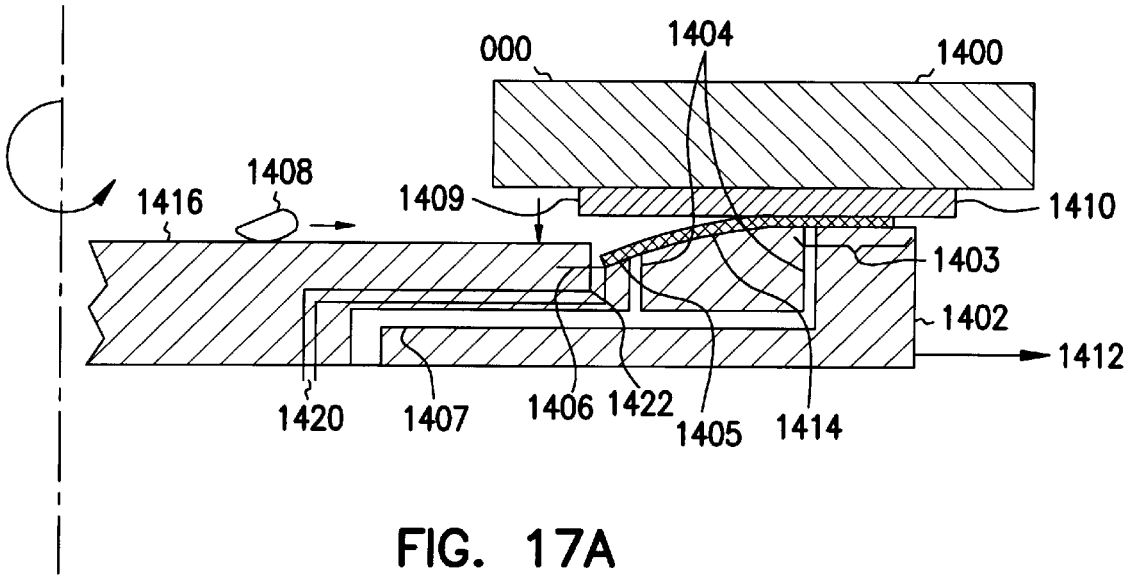
FIGS. 17*a*) and *b*) show a platen with abrasive sheeting thereon with special surface features to improve performance.
Figure 17B:
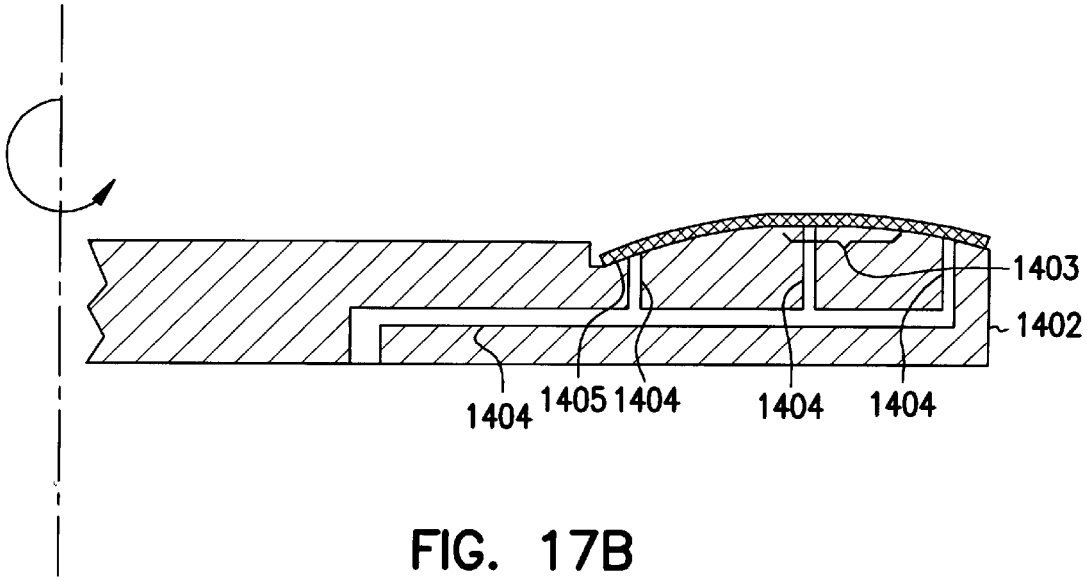

Solution: The platen can be constructed with an outboard raised circular land area and have a lower inboard area to avoid contact with the piece part but yet have a further recessed (depressed) lip or edge so the inner radius of the annular abrasive disk is below the inboard area of the platen so that water or debris on the surface of the platen travels above or on the top surface only of the abrasive disk and does not raise the inner radius. This is shown in FIG. 17, with platen 1402, abrasive sheet 1405, inboard area 1404, and the distance of the inner radius of the annulus below the inboard area shown as 1406. It is desirable to make the platen out of hardened stainless steel about Rockwell "C" hardness 40 minimum or plate with a hard chrome of Rockwell C 65 or harder on steel to reduce the wear of the vacuum holes.

44. PIVOT BALL SANDWICH

Problem: For high speed lapping, it is desirable to quickly convert from lapping with a rigid piece part holder to a pivot type holder, particularly when utilizing a vacuum to hold the piece part to the holder for both the rigid mount and the ball pivot mount.

Solution: A piece part holder can be constructed as a sandwich of two flat surfaced plates with a single ball at the center. This ball will transfer downward abrasive contact pressure force to the piece part and yet allow the surface of the piece part to move freely in contact with the moving abrasive surface so that it is in alignment with this non-perfect perpendicular mounting between the holder axis and a normal right angle with the platen surface.

The vacuum present at the surface opening port holes of the rigid spindle holder can be transferred through sealed internal passages in the sandwich holder to the piece part contact surface simply by clipping a flat pancake sandwich holder to the rigid holder. Because both the rigid holder surface and the matching piece part surface is very flat and smooth, an effective vacuum seal is effected between the two surfaces upon contact. Surfaces need to be cleaned to obtain a good seal. The ball can be sealed with RTV (room temperature vulcanizing rubber), sealants, grease or other material. Two concentric rings of plastic or elastomer can be positioned so as to form a passageway for vacuum transfer from one surface to another and yet seal the passageway from leakage to outside the sandwich. The outer ring can be attached to the sandwich by adhesive or other mechanical or cast-in-place means. The elastomer can flex with a controlled stiffness to allow angular motion centered about the ball. Both sandwich plates can be precision aligned perfectly parallel to each other before attaching the elastomer rings and they would tend to maintain this parallelism for presenting the piece part to the abrasive surface. Radial pins in a controlled slot length will prevent over travel on the spherical ball pivot and also prevent tangential rotation of one sandwich disk relative to the other for torque input to the holder unit.

45. BREAK-UP OF THE BOUNDARY LAYER AND HYDROPLANE PREVENTION

Problem: Piece parts tend to hydroplane when they are held in contact with high speed platens using a water film that develops a boundary layer between the platen and the piece part. The resultant piece part is not ground flat because the boundary layer pressures tip the part upward at the leading edge.

Solution: It is desirable to break up this boundary layer by having abrasive disks coated in striped patterns such that only short land areas, as measured perpendicular to the direction of travel, with grooves or spaces in between these land areas are present to relieve this hydrodynamic pressure. The land areas could be formed by spiral patterns, by islands of abrasive or other patterns.

46. ESTABLISH RELATIVE POSITION BETWEEN PIECE PART AND MOVING ABRASIVE IN LAPPING

Problem: It is difficult to establish the precise distance for moving a partially ground piece part down to contact the moving surface of an abrasive disk of unknown thickness when initially starting to process a piece part or when changing to a new abrasive disk of finer grit without damaging the piece part or approaching too slow. When using coarse abrasive, a few mils are removed in 10 seconds but when using fine 3 micron abrasive, only a few microns are removed in 10 seconds. The speed of contact used to start new grinding with a finer grit abrasive is important, so as not to lose set-up approach time.

Solution: A piece part can be processed, the abrasive disk changed and the piece part brought into close proximity to the moving abrasive disk, perhaps 1 to 10 mils (0.001 to 0.010") away. At that time, an excessive amount of water lubricant can be applied to the surface of the disk which would tend to hydroplane the piece part without having contact with its abrasive particles. A force sensing device can indicate when this physical contact has been made with the water wetted surface. A correlation can be established with the amount of force sensed and the exact water flow rate to determine the precise distance between the piece part and the abrasive sheet. Then the water flow can be reduced progressively while the piece part is lowered to the abrasive part surface until grinding or lapping action starts to take place. In this way the water film would act as a protective barrier at first contact and allow an algorithm estimate be made of the necessary vertical action required to remove very limited amounts of piece part material, perhaps 0.1 micron per second or less. This whole procedure could be automated and computer controlled with the parameters of force, flow rate, rotational speed (or any combination thereof needed) correlated to separation distance.

47. ADHERENCE OF PIECE PARTS BY NON-AGGRESSIVE ADHESIVE

Problem: When lapping parts, it is typically quite difficult to hold the lapped parts in a fixture so that they are flat and parallel when presented to and in contact and when removed from the lapping platen wheel, particularly when the platen is rotating at high speeds of 3,000 rpm as compared to 200 rpm. If a part is fixtured by mechanical clamping it is subject to being loose or compliant and patterns or lack of highly accurate surface finish such as (4) four light bands is not attained. It is also difficult to quickly and accurately load and unload parts. Also the surface finish of the part holder on the mounting side may disrupt or destroy the surface already polished when lapping the other side.

Solution: Individual parts, typically 1 (1.27 cm) to 2 inches (5.08 cm) in diameter or rectangular which may be thin (0.010 inch, (0.0254 cm)) or thick (0.500 inch, 1.27 cm) can be fixtured to a precision flat steel, other metal, or other material plate by use of paraffin wax as a bonding agent. Here the plate or part can be coated with wax or wax simply melted on the plate between the part and plate and the part placed on the plate, heat applied and the two would have a fully wetted surface of molten wax. The parts could be positioned by mechanical or other means of uniform pressure or force so they lay flat with a uniform and controlled thickness of molten wax. The mechanical alignment pressures should equal or exceed the pressures to be encountered during lapping to assure that there is no movement under the lapping pressure. Upon cooling the part/plate assembly, the parts would be positioned accurately and strongly to the plate ready for lapping action. Then the plate could be attached to a piece part holding device by use of a vacuum chuck or by use of magnetic chuck if the plate were steel. The piece part holder would have a ball type pivot close to the lapping action surface. Plates could hold one or many individual parts. Upon lapping one side, the plate/part assembly could be heated, the parts removed and if desired, the parts could be reassembled with heated wax on the plate with precise parallel alignment with no danger of damage to the lapped surface because of separation from the plate with the wax In this way many plates could be preassembled for high production rates with a single lapper.

48. SUPPORT OF THIN WORKPIECES IN POCKETS

Problem: It is difficult to hold small hard parts which are thin (typical size: 1×1×⅛ inch, 2.54×2.54×0.32 cm) in such a fashion that both surfaces of the flat part can be polished by lapping action by a high speed 3,000 rpm rotating disk with a diamond abrasive disk exerting substantial lateral force by the moving platen powered by a 2 HP motor for a 12 inch (28.5 cm) diameter disk when subjected to about 10 lbs. (4.3 kg) of normal clamping force when subjected to surface water spray.

Solution: These small parts can be fixtured to a flat surfaced piece part holder or a holder which has small shallow pockets, just larger than the length and width of the flat parts so that the exposed surface of the part protrudes away from the holder. In this way, the abrasive disk polishing action is applied to the piece part and not the holder. A medium temperature wax can be melted and used to bond a rough surfaced part to the flat smooth surfaced part holder plate. The flat plate in turn can be attached to a rotating pivoting arm which is swept across a portion of the surface of the high speed rotating disk until a smooth flat polished lapped surface is generated on one side of the piece part. Then the part holder plate which would have 1 or 2 or many more parts attached to it in a fixed mounting pattern could be brought in contact with another mounting plate having a flat surface or a shallow pocketed surface pattern which matches the first part plate. A higher temperature wax (than the first wax) could be melted at the surface of the parts already lapped and as they were held in flat contact with the new plate, the original lower temperature melting point wax could release the parts from the first plate and upon cooling somewhat, the parts would be transferred as a group to the second plate ready to have the rough remaining side lapped as the first plate is readily removed. High production rates of lapping flat parts on both sides with good parallelism could be achieved.

49. VACUUM CHUCK HOLDER

Problem: It is difficult to quickly load piece parts on the piece part holder for use with a high speed lapping and polishing system. Also it is difficult to generate a flat parallel system of polishing parts where 0.001 to 0.002 inch (0.025 or 0.05 mm or so) material is removed from a side to make them smooth, perhaps to 4 light bands, flat and parallel. Much of the time, hot melt adhesives are used which are slow and cumbersome to apply and also difficult to remove because of contaminating the precision surface of the piece part for later use of the part. Typically the piece part holder has a gimbaled spherical ball end to freely allow the part to move about radially to self align the piece parts (one or more) with the surface of the rotating abrasive platen.

Solution: A piece part holder can be constructed out of a heavy metal such as steel which has substantial mass very close to the surface of the abrasive disk. The unit will be allowed to move freely with the surface by the ball-end holder. A substantial hole can be made within the ball-end device which would allow vacuum to be applied or coupled to the piece part holder individual part pockets to firmly hold the flat piece parts up tightly against the tight fitting pocket. To create and maintain a good vacuum, a thin layer of oil or grease can be applied to the piece part to seal any leakage paths. In this way, by simply removing the vacuum applied to a rotary union to the driven shaft open inside diameter, the part is released, can be turned over and the opposite side lapped to produce a high quality surface not damaged on the already done side because intimate part-to-holder contact is not made because of separation by the film of oil, yet is stiff enough for good polishing action.

50. ABRASIVE DISK ANNULAR SHAPE

Problem: When using a diamond (or other) abrasive disk rotating at very high surface speeds of 10,000 fpm, most of the abrasive cutting action takes place at the outer periphery of the disk. The inside area of the disk has low surface velocity and low cutting action and also low wear rates so that when a piece part traverses the disk in a sweeping motion to prevent wearing of tracks or grooves on the abrasive, there is uneven wear between the outer and inner surfaces of the disk. There is typically a small ½ inch (1.27 cm) diameter hole in the inside of the disk at the center to act as a positioning agent to apply the abrasive disk at the center of the platen to obtain good balance of this very high speed system. A larger diameter round section could be removed from a disk to create an annular ring of active abrasive material somewhat larger than the piece part which eliminates the inactive (and raised) uneven section but then the centering registration hole for positioning the disk is lost.

Solution: A disk can be fabricated with abrasive coating covered on the whole surface of the disk. Then the inside section of the abrasive toward the center of the disk could be removed by grinding or peeling it off leaving the backing material intact with the centering hold. Here the piece part could be in contact with the raised section of the abrasive on an annular outer ring only as the abrasive is raised (by coating) from the disk backing material (usually plastic sheet). Another way would be to punch out the center ring of the disk for separate use and then use a centering plug with a small locating hole so the plug could be centered on a platen center post and the annular disk centered on the plug, become fixtured by the vacuum grip platen and the plug removed for complete freedom of movement of piece parts over a disk as the post could be removed from the platen also.

51. LAPPER WOBBLE PLATE FREE BALL

Problem: When a wobble plate is used for polishing, grinding or lapping, a piece part must be presented exactly parallel to the moving abrasive surface without a leading edge hanging down where it will be the first section to contact the abrasive. This could tend to jam the piece part into the abrasive and damage the outside edge of the piece part. This problem is made worse by having a heavy piece part mounted off-center with the mass center of gravity outboard of the center axis of the wobble plate. This would tend to dip the heavy side down and create an out-of-parallel presentation to the moving abrasive. Also any friction on the wobble plate ball or an out-of-balanced spring center system will result in dipped edges of the part.

Solution: A ball is used to support the applied contact force of the wobble plate. The ball is constrained in a cylindrical hole such that the ball is free to fall loose with the weight of the lower movable section of the wobble plate and the weight of the piece part combined. There may be 3 adjustable screws at 120 degrees apart which act as parallel location stops to hold the lower piece part parallel to the wobble plate spindle bottom flat surface. This results in the piece part being parallel to the moving abrasive surface. The loose ball will allow the free lower section of the piece part and holder to be held accurately by the 3-point screws. Then when the piece part is lowered into contact with the moving abrasive, flat contact is initially made but the free motion slack in the ball holder is then taken up (perhaps 0.010 inches, 0.25 cm) so that the wobble plate is free to move in an angular fashion and the ball surface is in contact with a hard flat surface which results in very low friction. An anti-rotation leg is used also. One, two or three legs can be used for anti-rotation with clearance for gimbal wobble angle action.

52. HIGH SPEED SUPER ABRASIVE

Problem: It is difficult to quickly lap hard metal or ceramic or other materials with conventional lapping techniques using disk platens which are 12(28.5 cm) to 48 inches (114 cm) in diameter operating at 200 to 300 rpm using loose abrasive paste media. Larger diameter platens are potentially dangerous at high speeds.

Solution: A high speed lapping system can use fixed diamond abrasive coated or plated on a disk sheet of material and be used on a rotating platen disk with a diameter of 12 inches (28.5 cm) when operating at 3,000 rpm which gives a surface speed of about 9,000 feet per minute. If a larger diameter platen wheel of 15 inches (38.1 cm) diameter is used, the rpm can be lowered somewhat to perhaps 2,800 rpm to achieve the same 10,000 (or 9,000) feet per minute (fpm) and if the wheel diameter is 18 inches (47.7 cm) diameter, then the speed can be further reduced to produce 9,000–10,000 fpm at the outer periphery of the disk. Any reduction of rotational speed for large diameters is desirable because of the potential danger of a high inertia wheel creating problems if a disk is damaged or comes loose.

53. WATER FLOW RATE

Problem: The surface finish smoothness and flatness of hard parts made of metal or ceramic or other materials vary as a function of the work force on the piece part as the workpiece is held against the surface of a high speed 9,000 to 10,000 fpm abrasive lapping action.

Solution: It was found that the amount of coolant and lubricating water or liquid applied to the surface of the high speed rotating disk affects the quality of the lapping action. If a reduced flow rate of water is applied, the abrasive cutting rate is increased as the boundary layer of water is decreased between the piece part and the rotating disk, better allowing the tips of the exposed diamond particles to be in more direct contact with the piece part and thus are more active in removing material as they penetrate deeper into the surface of the material. Excessive water covers the abrasive particles and keeps the abrasive from contacting the piece part surface. Here if the water flow rate is increased and the piece part is more "flooded", then a thicker boundary layer of water or liquid builds up between the part and the surface of the abrasive disk. A moderate amount of water will tend to keep the diamond abrasive particles away from the piece part some fraction of their maximum penetration which results in a smoother and flatter surface on the part. One method of utilizing this performance is to have reduced water flow at the first portion of the lapping period for more aggressive material removal, but with a resultant increased roughness of the surface. Then the water flow is increased somewhat during the middle portion of the abrasive cycle to get better surface finish and yet have a medium material removal rate. Finally the water flow rate is substantially increased at the end of the cycle to produce a very smooth and flat surface with a low rate of material removal. Changing of the water flow rate to alter the material removal rate and to change the surface smoothness could be easily done with an automatic water flow rate control system which varies the flow rate during an abrasive cycle.

54. EXTENDED PLATEN BOX

Problem: When doing abrasive lapping at high surface speeds of 9–10,000 fpm on round platens rotating at 3,000 rpm with diameters of 12, 15 and 18 inches (28.5, 38.1 and 47.7 cm), there is substantial danger when a piece part is broken off its holder (as it normally is held with a weaker adhesive or mounting system) and the piece part being thrown off the platen or getting stuck on the platen and ripping the diamond or other abrasive disk causing further possibilities of fast destruction of parts of the machine with parts thrown out and endangering an operator or others or equipment due to large kinetic energy contained in the rotating disk.

Solution: The rotating platen is round in shape with about a 12 or 15 inch (28.5 or 38.1 cm) diameter. A rectangular comer box is constructed as described earlier to deflect explosively propelled pieces downward into a collection area. The deflection may be from a vertical surrounding surface coupled with a lip or partial cover which reduces the amount of shrapnel which can move vertically out of the work area, as described above. The box is desirably constructed of a soft plastic (or rubber) such as ½ inch (1.27 cm) thick high density polyethylene which would tend to absorb impact from a heavy metal free flying broken-loose part without ricocheting the part back into contact with the rotating disk which prevents it from being thrown again or damaging the part. Also, the "square" comers provide a remote area to trap the part and to contain the part as it stopped moving by being impacted on one or more mutual walls. Having a distance between the flat walls and the rotating disk which is somewhat larger than the largest size of the piece part, centrifugal force would tend to drive the part off the disk radially and allowing it to eventually roll or move tangentially to a neutral comer of the box away from the disk. In the same way, crumpled abrasive disks are collected by the neutral open comers. Having a ledge over the inside portion of the box also helps trap the parts.

55. COUNTERWEIGHT WORKPIECE HOLDER

Problem: When a workpiece holder is held up by an air cylinder to provide normal force on a workpiece against a high speed 10,000 sfpm rotating disk by moving vertically up and down to load parts and lap them, there is potentially great danger if air pressure is lost due to air line leaks or electrical failure. If this load of the disk rotating motor assembly, which may weigh 30 lbs. or more, drops on the 12 inch (28.5 cm) heavy rotating disk operating at 3,000 rpm, there is great danger in that the abrasive disk can be tom or cut, jam up and create danger to the operator or severely damage piece parts which may have great value.

Solution: The vertically moving piece part assembly can be mounted on vertical slides and a chain or cable used with a counterweight which is perhaps 10 lbs. (4.6 kg) heavier than the 30 lb. (13.8 kg) assembly. Upon loss of electrical power which would interrupt power to the normally used suspension air cylinder or a line leak to the cylinder, the piece part assembly would simply and quickly retract to the upper position, out of contact with the rotating platen and thereby reducing the chance of danger. This would also be more assured when using an E-stop (Emergency Stop) action switch which would then not require power to obtain safe action.

56. VACUUM ADHESIVE HOLDDOWN

Problem: When lapping or polishing at very high surface speeds of about 10,000 surface feet per minute, it is difficult to mount piece parts to a rotating holder for contact with an abrasive disk surfaced rotating platen in a way to hold the parts rigid enough so that they are not broken loose from their mount. Also, it is desirable to avoid a localized vibration of the typically thin flat piece part (which vibration is induced by the high speed contact with the rotating platen) as patterns of uneven polishing takes place on the surface of the precision part if it vibrates during grinding. It is further desirable that one or more piece parts be processed at a time and that unloading these parts and remounting new parts is done quickly and easily to provide cost effective polishing rates of production. Additionally, a method of changing parts quickly so that one side of a piece part can be lapped, the part turned over and the second flat side be lapped to be parallel to the first side. Typically 0.001 inch (0.025 mm) to 0.002 inch (0.050 mm) or less is removed from each side.

Solution: Thin piece parts of about 1×2×0.080 inches (2.5×5.1×0.16 cm) can be mounted on to an individual piece of pressure sensitive adhesive (PSA) tape and this taped piece part can then be held by a vacuum to a workpiece holder. The surface characteristics of the nonadhesive side of the tape would be controlled by selection of tape backing material or by surface conditioning to provide a high friction which would resist lateral dynamic forces in a plane along the surface of the thin workpiece as the nominal 14 psig (25 inches Hg vacuum) would apply a normal force holding the workpiece to a rotating holder. A large section of tape could also be used to hold a number of workpieces at once which would be fast and easy to install by hand or with a robot.

This flexible group assembly of PSA bonded workpieces could then be held into position against a precision flat surface of a workpiece holder having random vacuum holes over its surface which would all be sealed by the wide and complete expanse of tape covering all the vacuum holes and at the same time firmly holding the individual workpieces to the holder. To process the other side, the group would be removed, tape applied to the lapped surface side and the tape on the unprocessed side would be easily peeled off. The tape would not only fixture the parts but would protect the precision lapped side from scruffing action of rubbing on the holder.

57. SPRING CENTERED WORK PIECE HOLDER COILED VACUUM HOSE

Problem: When holding piece parts on a rotating holder in contact with a rotating abrasive coated platen rotating at a surface speed of 10,000 sfpm, it is difficult to create a gimballed, free wobble motion so the contacting surface can continuously align itself to the flatness of the rotating platen and yet be held stiffly enough in a nominally flat position when first lowering the workpiece holder to the abrasive surface while rotating so as not to have one comer of a workpiece contact first and be preferentially abraded away thereby producing an uneven workpiece surface. Vacuum piece part clamping hoses could also create problem forces.

Solution: A coiled spring can be used to apply a self correcting force between the workpiece holder plate having a gimbal spherical bearing and the rotating drive shaft of the rotating piece part holder. This spring would be made of metal or plastic material which would allow the straightening action to be applied but also would introduce vibration damping for excitation vibrations set up by the high speed contact abrasive action. One or more solid plastic coupling bars also could provide damped spring action. If a vacuum hose were to be used to provide vacuum clamping of the piece part to the piece part holder through a hollow drive shaft, this type of hose could extend from the shaft and be coiled with perhaps one or less on multiple turns which nominally lay flat with the upper surface of the workpiece holder which would minimize the creation of uneven "normal" direction workpiece contact forces as the workpiece holder turns.

58. LAPPER PERPENDICULAR ALIGNMENT OF UPPER PIECE PART HOLDER AND PLATEN—PIVOT POST ADJUSTMENT

Problem: It is difficult to adjust the small diameter upper piece part holder surface to be precisely parallel to the platen large diameter surface and thus the finished ground piece parts may have a coned surface if outside edges of the piece part are ground more than inboard areas.

Solution: The abrasive sheet carrying platen is mounted on a thick heavy steel support plate with leveling jack screws on the four (or three) outer comers to get a nominal axis alignment of the platen with the axis of the piece part holder to be coincident with the axis of the platen abrasive spindle. Then a swing arm is mounted on the piece part holder which is rotated slowly about the stationary platen. The swing arm is extended out to the surface of the platen. This measurement indicates the "z" axis error perpendicular to the surface of the platen at different "x" and "y" coordinate positions on the horizontal surface of the platen. Adjustments are then made to align the lower platen mounting plate to the upper piece part axis. An upper frame can also be constructed for the pivot arm lapper by attaching the bottom portion of the stiff pivot vertical post to a round solid steel rod which in turn is attached to the base of the machine frame. Then two long arms are attached to the upper portion of the post at 90 degrees to each other, aligned with the "x" and "y" axis. These arms can be fixtured with threaded screws on the outer ends and both "x" and "y" can be adjusted independently with these screws which are in effect bending this rigid post at the base. Mechanical clamps hold the post in place after adjustment. This alignment adjustment could be automated with stepper motor driven screws, piezoelectric actuators, etc.

There are a variety of different adjustment actuators which can be used. These include, but are not limited to a threaded bolt, motor driven threaded bolt, piezoelectric actuator, and a thermal expansion bolt (e.g., electrically heated thermal expansion bolt). A stepper motor, servo motor, DC or AC gear motor, and the like can be used motor to drive the alignment arms to different positions and make corrective adjustments to align both axis of piece part and platen as indicated, for example, by an out-of-plane gap sensor.

59. ANNULAR ABRASIVE DISKS

Problem: When flat circular disks having diamond or other abrasive media are used on a high speed platen rotating at 3,000 rpm or more to produce surface speeds of above 2,000 sfpm and even about 10,000 sfpm, the outer periphery of the abrasive sheet at the outside diameter has a high speed with good abrasive action but the inner diameter of the disk has a lesser velocity proportional to the radius and less abrasive action. Most of the abrasive grinding or lapping material removal from a piece part is removed by the outer diameter of the disk which tends to wear down the abrasive media at the outer diameter more than the inner radius which results in an uneven flatness of the abrasive disk. It typically is a cone shape with a higher section at the circle center of the disk which prevents a piece part from being ground or lapped flat across its surface which is critical to part surfaces having good enough surface flatness or surface roughness finish for pump seals, computer chips, hard disk computer components and for other parts. The unworn inside of a disk is not utilized and therefore there is inefficient use of the abrasive sheet material which is quite costly.

Solution: An annular ring disk can be used on a flat rotating platen which is made from the original circular disk of abrasive media by cutting out these rings in a cookie cutter fashion. Typical rings may be 18 inch OD (47.7 cm)×15 inch (38.1 cm) ID; 15 inch (38.1 cm) OD×12 inch (28.5 cm) ID; 12 inch (28.5 cm) OD×8 inch (20.3 cm) ID. A piece part which is presented in contact with the rotating ring abrasive disk typically would be swept across both the inside diameter portion of the disk progressively to past the outer diameter of the annular ring where both the inner and outer radius of the disk would have diameters and surface speeds and abrasive action and disk wear, fairly constant across the full surface of the disk ring thereby reducing the cone effect wear on a given disk which would produce better flatness and more uniform roughness surface finish on a piece part. In this way, expensive diamond particle type of abrasive disks can be fully utilized for good cost savings and efficient use of the abrasive media. A pivot arm could be used to sweep the work holder back and forth across the annular abrasive disk ring with a preferred contact to occur in a quadrant of the abrasive sheet which provides a stabilizing friction contact force directed away from the rotating axis of the pivot arm. Also an x-y table can be used to sweep the width of the annular ring. A single solid circular disk could be cut into multiple annular rings and the core center circle could also be all sold and used as separate units with no manufacturing waste. The disks could also be cut into ellipse or oval shapes with an annular ring shape where the outer and inner edges of the disk would be "moving" relative to the piece part and not have a tendency to produce nonuniform abrasive wear tracks on the piece part as much as a true circular abrasive disk.

To increase the efficient use of the annular rings, the piece part is also rotated as it is presented to the abrasive sheet surface and is being lapped. This assures even lapping address by the surface of the piece part to various radial portions of the annular abrasive distribution.

60. ANNULAR RING DISKS VACUUM SEALS

Problem: When using annular ring disks of various sizes on a given circular high speed rotating platen having a vacuum draw-down or vacuum securement system, any inboard vacuum holes are exposed or non-sealed for large sized ring disks and thus the vacuum system doesn't work. The same is true for using smaller ring abrasive disks with exposed outer vacuum holes.

Solution: If an 18 inch (47.7 cm) or smaller platen is constructed with concentric paths of vacuum holes spaced at various radius of the platen, or if scattered holes are positioned to not create a circular track and to avoid making abrasive "track" patterns, the exposed holes would be sealed with a pressure sensitive adhesive thin plastic film on either or both the inside or outboard portion of the vacuum holes left exposed when applying the nonadhesive backed abrasive disk material having an annular ring shape with an inside and outside radius, either circular, oval or other shape. This adhesive backed sealing disk or ring can be left on the platen for a duration of time and it can be used to register or accurately position guide the annular abrasive disk onto the true center of the platen for achieving good dynamic balance of the very high speed rotating assembly operating at perhaps 3,000 rpm or 10,000 surface feet per minute. Safety is very much enhanced by good balance and the quality of surface grinding or lapping is also enhanced by good circular location and strong reliable vacuum securement of the abrasive disks which may be constructed using fine diamond particles or other media. The inboard non-abrasive disks described above to reduce lifting of the annular abrasive sheet by grit, slurry or water would also solve this problem.

61. ANNULAR RING DISKS ANGLED CONE SURFACE

Problem: Some specialty grinding techniques can be improved by having an abrasive media disk with a slightly angled surface relative to the normal typical flat plate surface for high speed (e.g., above 500, above 1000 or about or above 3,000 rpm, e.g., up to and beyond 10,000 sfpm) use of abrasive sheeting such as fine abrasive particle coated disks such as diamond coated disks.

Solution: Annular rings of diamond or other media coated abrasive disks are generally fabricated in thin disks with thin metal or plastic 0.005 inches (0.12 mm) thick, more or less, that is locally elastically conformable to a hard surface. A flat rotating platen can be constructed with a portion of the surface raised somewhat from the flat circular surface and a cone angle created on this surface to which an abrasive annular ring is adhesively bonded or held in position by vacuum holes to this angled raised ring. A piece part can then be presented to this cone shaped surface at an angle to the platen perpendicular which is approximately the same as the abrasive disk cone angle. The piece part presentation angle may either be more or less than the abrasive angle to control the portion of the piece part surface that is in contact with the rotating abrasive for optimized grinding/lapping action.

62. HIGH SPEED LAPPING IN A MILLING MACHINE

Problem: Achieving ultra flat and smooth surfaces in a milling machine operation process without subsequent grinding and lapping type steps.

Solution: In a milling machine, CNC horizontal or vertical, a conventional milling cutter can produce a relatively flat surface with a 16 rms finish. A special media holder can be clamped in the spindle which has a flat precision surface perpendicular to the machine spindle centerline. A flat abrasive with a pressure sensitive adhesive would be attached to the special media holder The abrasive could be die cut into an annular ring, for example 6 inch (14.3 cm) OD and 4 inches (10.2 cm) ID. With the spindle running at, for example, 6,000 rpm and about 9,000–10,000 sfpm, the surface of the machined part can be "high speed lapped" with the special holder and abrasive media. The abrasive should be in contact with the work piece. The machine table moved in a crossing pattern to evenly distribute the lapping action. A supply of coolant fluid should be used to keep the work piece cool. It could be pumped through the spindle and special holder if available. A typical material removal piece pass would be 0.0001–0.0003 inches (0.025 mm to 0.076 mm) in the "z" direction. Using this technique and starting with 125 micron diamond abrasive media and stepping down to lapping films, 1 micron for example, surface finishes and flatnesses of very high quality can be achieved in one machined part set-up, eliminating subsequent grinding and lapping operations with a substantial part handling and cost savings.

63. FLEXIBLE PIVOT TOOL HOLDER

Problem: When grinding or lapping single or multiple piece parts held by a tool holder with a typical diameter of 4 inches (10.2 cm) held by a center post and the tool holder is rotated slowly (or quickly) as it is presented down vertically to uniformly contact an abrasive surface platen rotating at the high speeds of the present invention, it is important that the piece part holder be "flat" so that the piece parts which contact the abrasive first are not damaged because the holder has one edge lower than another. Further, with this type of lapping and grinding it is important that the piece part holder assembly be held by a ball pivot type of device located as low as possible (as close as possible so that the central point of rotation of the pivot is as close as possible to the abrasive sheet surface when contact is made. It is also best to align the total piece part assembly so all the individual parts are floated equally by the thin boundary layer of coolant fluid on the surface of the disk which may be less than 0.001 inch (0.025 mm) in depth. With this type of gimbal pivot, this boundary layer thickness has a tendency to remain uniform even with slight out-of-perfect-perpendicular alignment between the vertical piece part holder shaft and the high speed abrasive platen. Foreign debris contaminates pivot joints and creates unwanted friction. It is also important to control the water boundary layer thickness and shape between a workpiece surface and the abrasive surface for a small workpiece with a correspondingly small surface area that is not large enough to be positioned flat on the abrasive surface with a minimum amount of down pressure.

Solution: A work holder is created with the use of a spherical ball attached to a shaft which provides a pivot action close to the bottom of the workpiece holder assembly. A sandwich of washers (between the piece part holder housing and the ball) act as a rigid base to transfer polishing normal force downward on the vertical shaft to push the piece parts onto the abrasive platen. The washers apply only a small pressure or force to prevent slack between the ball and the holder, or the resultant ball friction would prevent free pivot action on the ball. The pivot action is restrained by encapsulating the whole assembly (the ball post, ball washers and ball socket) with RTV silicone rubber which seals the unit from debris and also provides the function of an elastic restraint that self centers the disk type part holder perpendicular to the axis of the support shaft, yet the elastic spring which centers the unit is weak enough to allow conformal pivoting of the assembly during the lapping action. Thus when little side load is present, as when lowering the piece part assembly, the unit is flat aligned, but when subjected to a normal force, the unit is free to pivot. A piece part holder with the ball stem and RTV was constructed and used for lapping of a piece part assembly for optical connector devices and appeared to function well.

64. BOUNDARY LAYER CONTROL

Problem: When high speed lapping, a rotating flat platen with fixed abrasives attached to the platen with adhesives or vacuum, water on the rotating platen abrasive surface forms a boundary layer between the work piece and the abrasive media. The boundary layer thickness and shape effect the flatness of the work piece. The workpiece must be allowed to "float" on the abrasive surface which is partially covered with a boundary layer of water.

Solution: The work piece must be allowed to "float" on the boundary layer. This is done with a gimbal mechanism which puts pressure down on the rotating work piece. It also allows the work piece to "gimbal" in the horizontal plane while an independent driver pin drives the work piece around the centerline of the work holder shaft. The amount of down pressure also effects the boundary layer. The work piece floating on the boundary layer of water allows the abrasive media and platen imperfection to be averaged out, so high spots on the abrasive do the lapping while the low spots are filled with water, allowing the lapping action to take place and produce a finished part (work piece) that is flatter than the media and platen. The work piece will only be as flat as the boundary layer.

Water is pumped through the work holder and into controlled orifices or jets in strategic locations that force a boundary layer to form between the work piece and the abrasive media. The water stabilizes the work piece while presenting it to the rotating platen initially and while lifting the work piece off after lapping is complete.

65. LAPPER SACRIFICIAL DISK

Problem: When lapping or grinding a multiple number of small parts or single small parts each having small surface areas and short surface dimensions in the approximate size of 0.25 inch by 0.25 inch (0.63 cm) and these parts are put in contact with a high speed rotating disk, there is not enough surface length to the part to build up a sufficient boundary layer to float or support the part as it is making contact with the abrasive disk on the high speed platen and the parts tend to dig into the abrasive disk and tear the disk and prevent accurate polishing or lapping of the part. This problem is again uniquely felt in the high speed lapping process of the present invention with abrasive sheets secured to the platen.

Solution: A system is provided to effectively extend the too short surface contact length dimensions of the piece parts to allow them to be presented flat to the abrasive surface. Here an adequate boundary layer is generated and maintained while the individual piece parts are being lapped by adding a secondary device to the piece part holder device. This sacrificial device, which would have sufficient surface area and length would be mounted outboard of the piece part on the piece part holder device. It would also be ground down simultaneously with the piece parts in a sacrificial way. A typical shape of this can be a disk of metal such as brass which would be mounted on the outside annular position of a tool piece holder with the to be lapped piece parts mounted inboard of these on the periphery of a round piece part holder. The sacrificial piece should have a susceptibility to grinding which is within about 50% of the workpiece (either greater of lesser, preferably lesser) to assist in more uniform grinding. The susceptibility to grinding can be readily measured by grinding identical surface areas of the materials, with similar initial roughness, for the same period of time, at the same speeds and pressures, with the same abrasive sheeting and comparing the amount (e.g., weight) of material removed from each sample by the lapping. As the total exposed surface area is ground down, the piece parts are held in suspension above the high speed moving abrasive by the large surface area of the sacrificial disk. As the sacrificial device lays outboard of the piece part, it is contacted first by the abrasive when the piece part is tilted and initially brought into contact. Contact with the piece part is prevented until the entire assembly lies flat. A typical disk would be 4 inches (10.1 cm) outside diameter, 2 inches (5.1 cm) inside diameter and about 0.060 (1.58 mm) inches thick. It could be easily attached with vacuum chucking and/or adhesive tape and could be used over and over by loading new piece parts with a partially ground disk. Other geometry sacrificial plates could be used and combinations of materials such as steel, ceramics.

66. PLATEN FLATNESS GRINDING

Problem: When a high speed rotating abrasive platen is manufactured and after repeated usage of the machine, the platen is not perfectly flat as it had been originally machined or ground (having been damaged by wear or impact) to a required or desired flatness of less than 0.0005 (0.00127 mm) inch at the outer periphery with a need for the best performance to reach 0.0001 inch (0.00065 mm) as measured by a dial indicator placed at the outside diameter and the disk rotated by hand for one revolution to measure the maximum excursion. Any deviation acts either as a "valley" where the abrasive does not contact the piece part or a "high spot" which is the only area that contacts the piece part. When the disk rotates at its normal high speed, each high spot will have a tendency to hit the piece part and set up a vibration which will reduce the smoothness of the lapping abrasive action. Localized distortions of the platen surface will also have a tendency to penetrate the boundary layer of liquid between the platen (covered with a thin sheet of diamond or other coated abrasive) and the piece part and produce a localized scratch or track on the piece part surface. Surface defects on the platen structure may be generally transmitted through the thin abrasive disk and produces a bump or high spot on the disk.

Solution: An existing platen can be "dressed" on a machine by bringing it up to full speed rpm and lowering a heavy flat abrasive coated piece unit directly onto the bare rotating platen and grinding or lapping off the bumps, and high spots. Even full out-of-flatness surface variations can be removed by first using a coarse abrasive and progressively using finer abrasive or lapping abrasive media. The platen, in effect, becomes the workpiece and the workpiece becomes an abrasive surface or sheet. The typical first abrasive may be 40 micron metal bonded diamond and ending up with 3 micron or less diamond or ceramic abrasive depending on if the platen surface is chrome plated, stainless or bare steel. It is important that the surface area of the abrasive lapper disk be large enough to cover the total area of the platen with a slight overlap and it could be oscillated back and forth across the platen, could be stationary or rotating at either slow speed or rotating at very high speed, so the tip speed of the grinding disk will provide uniform removal of platen material at the low surface speed of the inner radius of the platen. Different geometries of adhesive disks could be used. Also a piece part holder already in use for normal lapping could be used to perform this function.

67. ABRASIVE METAL POLISHING MACHINE

Problem: The surface of metal objects are polished for many reasons including the optical examination of metallurgical characteristics, to create a smooth low wear tight hydraulic or fluid seal and other uses. Usually this polishing is done on low speed 5–200 rpm or so rotating flat platen disk wheels of various types of construction may be used, such as aluminum, steel, plastic, composite, cloth and other materials. The wheel surface is very flat and the workpiece to be polished is held with controlled pressure by hand or work holder against the rotating wheel with water or other fluid wetted abrasive particles introduced as a slurry or disks of fine abrasive sheets "stuck" or bonded to the rotating wheel. This process slowly produces an accurate, highly polished surface and it is labor intensive and expensive if not automated. An inaccurate platen, shaft machining, loose bearings or weak machine structure frameworks may cause polishing accuracy problems.

Solution: It has been found that very high quality polishing can be achieved at a fraction of the expended time by using microabrasive sheeting, such as 3M brand microabrasive disk sheets for polishing at the very high speeds of this invention described above. The process is especially useful with disks about 8 to 10 inches (20.3 cm to 25.4 cm) in diameter. However, it is critical that the rotating platen disk run very "true" and flat at the operating speed range to provide a mechanically stable moving surface against which the to-be polished workpiece is held stationary at a controlled normal force or pressure (against the fine particle wetted abrasive). Options also may change the contact pressure (between the abrasive sheet and the workpiece during lapping) as a function of process time or the workpiece rotated to distribute polishing across the surface. A unique method to provide a very "flat" and accurate stable rotating platen disk surface is to mount the platen to a "weak" shaft which allows the rotating disk mass to seek a true "smooth" center above its first rotating natural frequency. The motor drive speed would be increased above the natural frequency of the rotating platen with abrasive sheeting thereon, the workpiece part presented in contact for polishing, then removed from contact prior to reducing the disk rpm.

68. LAPPER PLATEN SPIRAL SURFACE PROBLEM

When lapping or grinding at high speeds producing as much as perhaps 5,000 or even at least 8,000 to 10,000 sfpm of surface lapping speed using plastic disks coated with thin layers of diamond or other abrasive material, it is sometimes a disadvantage to have a uniform flat disk surface in flat contact with precision piece parts. This is due in part because the fluid boundary layer has a tendency to draw the piece part down to the flat surface of the rotating platen (by the effects of Boumoulli's principle) and create large fluid adhesion forces requiring more force to hold piece parts (e.g., with bigger motors) and the need for larger and heavier holding devices for the piece parts, and the need for more frequent variations in the holding forces because of the variations in the adhesion forces from fluid flow rate changes. This may also result in uneven material removal resulting in non-flat parts. Furthermore, when a liquid boundary layer builds up, it has a tendency to increase in thickness along its length, which has the effect of tilting the surface of the piece part relative to the abrasive.

Solution: A precision ground rotating platen can be fabricated with slightly raised spiral surfaces having different shape patterns from the inside center of the platen toward the outer periphery of the platen. These spiral patterns would create short land areas at the top surface of the platen of varying widths and shapes with areas between these land areas that are somewhat lower, perhaps from 0.002 inch (0.05 mm) to 0.010 inch (0.25 mm) or more. Then a thin plastic coated abrasive disk that is uniformly coated with precision fine abrasive would be mounted to the round platen and held in place by vacuum holes either on the raised land surface or on the lower surface area or a combination of holes in both areas. The raised land areas could be produced by manufacturing a precision platen and acid etching the land area geometry configurations of the lands. When the abrasive disk is mounted on the platen, only some portions of the disk would be in contact with the piece part being ground or lapped. The boundary layer of fluid coolant would be effected by the length of the land area under the piece part, the direction of the spiral or radial or circular annular land shapes or a combination of these geometries. The effects on the boundary layer thickness would be the rotating speed of the platen, as related to the vector speed, including direction for the surface relative speed between the two, the viscosity of the fluid, the normal force pressure of the piece part holding it to the platen. The boundary layer thickness, which would vary over the surface of the piece part, affects how the individual particles of abrasive appear to the surface to be ground (the particles normally sticking ⅓ of their size about the bonding agent, either metal plating or plastic bonding, surface of the abrasive disk). If more liquid is applied, the boundary layer would tend to be thicker and less abrasive material is exposed to the surface to be ground and less removal of material is achieved. Thus the local pattern of the surface of the abrasive contact area can be utilized for the optimum grinding action using only one portion of the abrasive disk with the non raised section between the land areas allowing free passage of grinding debris. When this surface area of the abrasive is worn, the disk can be unmounted by the vacuum chuck, rotated to a "fresh" area of the abrasive and grinding continued. The disk will remain uniform and strong through service. This can be done in at least two different ways. A grooved pattern with a preselected distribution of islands on the surface of the platen is created by molding, etching or the like. When a thin backing abrasive sheeting (as used in aspects of the present invention) is applied and secured to this textured platen, the backing of the sheet conforms to the pattern. Continuous boundary layers will be broken up by the predesigned variations in the surface of the conforming abrasive sheet, which is very desirable. Since the pattern is chosen (with the highest areas on the platen being fairly uniform and constant), a planar area of contact between the abrasive and the workpiece can be maintained, with areas of non-contact or light contact provided which will break up the boundary layers. It is better to have a flat platen with a groove pattern existing on the abrasive sheet or by using segments of abrasive sheet, as described herein. Abrasive sheets, even with diamond abrasive, are now available from 3M with abrasive islands (e.g., diamonds within a matrix) having paths where swarf, liquid and the like may flow between the islands without disturbing the contact between the workpiece and the abrasive on the sheet.

69. LAPPER PIVOT CRADLE PIECE PART HOLDER

Problem: When a piece part is ground or lapped on a high speed diamond or other coated abrasive platen rotating at high surface speeds, there is an uneven grinding action due in part to the boundary between the piece part and the abrasive surface being uneven with a thinner layer thickness at the outer periphery being thinner due to the high surface relative speed at the outer diameter and much less at the inner radius of the platen which is subjected to liquid water or other fluids. Typical abrasive particles at the outer radius of the rotating platen penetrate the thinner layer of the boundary layer and provide material removal quite aggressively there. At the inner radius, the boundary layer is thicker, and the abrasive particles don't penetrate as well through the boundary layer which "floats" or hydroplanes the piece part. This results in significant material removal at the outer radius of the platen and reduced removal at the inner radius. This produces uneven wear on the piece part which is subjected to both extreme areas of the platen radius and the piece part is not flat or the surface is not uniform in surface damage.

Solution: An annular ring of abrasive mounted on a platen is used so the relative surface velocity at both the inner and outer radius is close enough that the boundary layer is about the same relative to the height of the coated abrasive (from above 0.1 or from about 1 to 100 microns). There may be two or more piece part holders, both rotating in reversible directions if desired for special grinding effects, with both mounted on a common pivot arm (either straight with two piece part holders or branched with three or more piece part holders. Each piece part holder would tend to stabilize the others across the platen. A spherical wobble joint at each piece part holder would allow each to conform to the slightly uneven boundary layer on the platen. Rotating each piece part holder would provide the same amount of abrasive material removal to all the exposed surfaces of the individual piece parts. The normal force, surface speed, liquid flow rate, viscosity, etc. could all be optimized The whole assembly pivot cradle could be oscillated to obtain even surface wear.

70. ABRASIVE HIGH SPEED LAPPER

Problem: It is often desirable to have a narrow annular ring of abrasive material on the outside periphery of a rotating platen to effect fast high quality lapping action. Production of a narrow annular abrasive disk as a continuous ring of material from a linear web results in removal of the inner diameter disk of a large diameter which is very expensive. This inner disk of material, for example, may be 8 inches (20.3 cm) in diameter when producing an annular ring with an ID of 8 inches (20.3 cm) and an OD of 12 inches (30.5 cm) The annular disk may be constructed of the same web coating of fine diamonds or other expensive abrasives. These smaller disks are not readily sold in the marketplace.

Solution: Cut annular segments having circular curvature from a web and join these end-to-end in a pattern to form a continuous annular ring. These annular segments can be adhesively attached or, even better, fused to a common base material of strong plastic such as polyester or other materials such as hard thick plastic or metal disks. The long ends of these segments can be butted directly adjacent to each other, butt welded together or prescribed gaps can be left between the ends of the segments to allow water/lubricant to better carry away swarf. Different shapes can be given to the annular rings which may promote the abrasive lapping such as serpentine shapes or curved radial segments. All of these shapes can be cut out of linear web material with very little yield loss or throw away. Short or long segments can be used.

71. ACOUSTICAL SENSOR PIECE PART CONTACT SENSING DEVICE

Problem: It is difficult to determine if a piece part has been brought into contact with a high speed moving abrasive surface when it is initially presented for grinding as it is not easy to calculate positionally when this would occur when first using an unknown sized (thickness) part and when using abrasive disks of unknown thicknesses and other machine variables.

Solution: The apparatus can have Fast Fourier Transformation spectrum analysis pattern recognition controls used with an annular ring of abrasive. These characterize vibration by amplitude as a function of frequency. It has been found that when piece part materials such as ALTIC (aluminum tungsten carbide or aluminum titanium carbide) are brought in contact with high speed platens using the abrasive sheeting (such as the 3M diamond abrasive disks) operated at high surface speeds, especially such as about 10,000 sfpm, that a characteristic significant sound is produced which is quite audible to the human ear at the very first contact between the piece part and the abrasive surface. At the time of the onset of this audible sound, it is possible to very precisely determine the relative location of the piece part to the machine frame with the use of a Heidenhain linear scale and then to commence to remove a fixed amount of the piece part surface of about 0.005 inches (0.0064 mm) by motor driving a threaded screw actuator device which forces the piece part into contact with the abrasive surface. The audible signature allows the piece part to be moved quite rapidly up to the surface of the abrasive and then to be slowed or stopped for restart to allow a very slow, controlled motion approach by driving the piece part into the moving abrasive surface at a slow prescribed rate with optimized controlled flow of lubricants for a specific abrasive particle size over a fixed period of time. With this technique, a piece part surface will not be damaged by too sudden contact due to excessive heat generation or impact.

It is difficult to determine if a piece part has initially made contact with a highspeed abrasive moving platen surface and also to control the normal (right angle) pressure between the piece part surface and the abrasive surface to optimize the removal rate of grinding. The goal of producing a smooth ground surface with 2 lightbands or less flatness is difficult to accomplish. A square piece of ALTIC material about 2×2 inches (5.1 by 5.1 cm) was stepper motor driven in small increments to where the contact force between the workpiece and the abrasive moving, at 3,000 RPM for a 12 inch (30.5 cm) diameter platen with about a 1.5 inch (3.77 cm) wide ring of annular shape had an initial contact force of about 2–20 pounds (0.9 kg to 9 kg), usually around 9 lbs (4.1 kg). The first portion of the grinding period of about 1 minute removed surface material quite rapidly, but as time went on, the force sensor showed a progressive decrease in contact force with an unchanging machine incremental position. Also the swarf of ground debris visually was quite heavy, but decayed in some proportion to the contact force. A typical amount removed was about 0.005 inches (0.13 mm) over this 1 minute period. The finished surface of the part was very smooth in surface roughness, producing a mirror finish and the flatness was better than 1 lightband as measured by a green optical light flatness measuring instrument. As the machine was not advanced during this period, the spring compliance of the machine members produced this very successful fast initial removal of ground material with a proportional or exponential decay of force which resulted in a progressively more gentle contact at the last portion of the period, resulting in the desired surface.

72. LAPPER PART HOLDER

Problem: When a piece part is initially brought into contact with a high speed rotating (or linear) high speed moving abrasive surface, there exists the possibility of one portion of the piece part contacting the surface of the abrasive in such a way that it will get caught or impact the high speed abrasive and either harm the piece part due to uneven grinding or jam it into the moving abrasive surface which generally has very high inertia and momentum which can then cause a virtual explosion with fracture of the piece part, the holder, and the abrasive media, either in sheet form or bonded abrasive. This can result in great danger to the machine operator or significant damage to expensive parts being precisely ground to size, finish or flatness. Also perfect alignment between piece part and the moving abrasive surface is difficult to achieve.

Solution: A multiple piece part holder can be constructed such that the piece part is held rigidly and precisely on a flat surface by vacuum or other means such as adhesive, melted wax or be established by mechanical measuring equipment and process techniques so the piece part can be lowered (vertically) so it is just barely within 0.001" of the moving abrasive surface and then when contact is made by further motion, the piece part holder then is allowed to move freely by use of weak springs which allows perfect flat alignment between the piece part surface and the grinding surface. For rigid grinding to obtain initial flatness of the piece part surface, small air cylinders can be used to clamp the piece part mechanism by driving a lower wobble plate portion of the piece part (workpiece) holder against adjustable mechanical stops. These stops align the piece part adequately parallel for the initial grinding contact and/or activity. These small air cylinders are strong enough to overcome the weak springs. The weak springs are used primarily only as the wobble plate is allowed to pivot. The air cylinders prevent the wobble plate from pivoting. In this way the "floating" piece part holder device can be used to initially rough grind a piece part by cylinder clamping and then use the floating springs to continue grinding or lapping to produce typical mirror finishes with flatness better than 1 or 2 light bands. The air (or hydraulic) cylinders are only activated during rigid grinding but they could also be used to apply a varying pressure to hold the piece part against the abrasive depending on the grinding process cycle events.

73. LAPPER PIECE PART HOLDER

This entire section relates to a combination piece part holder which allows spherical pivoting (for finish grinding) and is also able to be supported in a rigid position (for initial grinding). The piece part does not have to be changed, so there is no set-up time needed for changing from these grinding modes.

When the pivot workpiece holder is used for rigid grinding of a part, the free moving spherical section is moved against mechanical stops which rigidize the unit. Moving this portion of the pivot part (workpiece) holder can be effected, for example, by a variety of devices which include (but are not limited to) springs, flash cylinders, electric solenoids, linear electric motors, thermal or electrical screw devices, and the like. The important function is to hold the piece part holder against local stops to rigidize it, and then the entire rigidized assembly is lowered to present the piece part in rigid contact (non-pivotable contact) with the abrasive surface (e.g., the abrasive sheet on the platen). This rigid piece part holder can be rotated axially, but does not have a spherical pivoting action at this time. When a piece part has been initially ground, it can then be followed by conformational spherical grinding without changing to a different lapping apparatus. It is very important with these relatively thin sheets of coated abrasive material that the piece part be presented to and contact the abrasive with controlled pressure and force rather than attempting just a position controlled presentation. The following equipment and procedures may be used to effect this result.

A center slide (may be spring retained or activated by a cylinder or an electric solenoid). Pressurize bottom of cylinder to lock part holder "up" against all for rigid grinding. Spherical joint for cylinder Can use frictionless "air pot" brand cylinders with small air or oil gap between cylinder wall and piston which allows fluid leakage but no stick (friction break away). Center ball—can be held in a fixed position or allowed to slide vertically. Multiple metal flex bellows with vacuum applied to draw "up" against ball stud for initial grinding to flatten piece part parallel or to initiate presentation of piece part to abrasive platen. Hollow metal of plastic flexible disk bellow stack. Bellows can also be given a positive pressure to hold piece part flat against the abrasive platen surface with controlled contact force or pressure. Metal bellows disk can be single annular unit or a multiple number such as three each at 120 degree increments.

74. LAPPING MACHINE AND PROCESS PROCEDURES

Problem: When lapping at high speed with a rotating platen it is very difficult to align the rotating piece part holder precisely perpendicular to the platen abrasive surface and to accurately bring a piece part into contact with the high speed moving abrasive without impact.

Solution: Construct a lapping machine which has the possibility to micro-align the axis of the piece part holder mechanism and the abrasive lapper platen. Also use a fine pitch (40 threads/inch) screw to move the piece part down into contact with the abrasive with a stepper motor having 50,000 steps per revolution. Further, the screw is attached to an in-line force gage which senses when the piece part comes in contact with the abrasive surface and this position is sensed very accurately with a precision linear encoder device. A linear actuator with a stepper or other motor is used to position the piece part holder on the annular ring of abrasive of the platen in the quadrant of the platen where the grinding or lapping force action is the most stable depending on the direction of the platen rotation.

SET-UP PROCEDURE FOR IMPROVED ALIGNMENT

One method is to first align the platen baseplate with 4 comer jack screws then align the pivot post, then align the pivot arm.

PIECE PART PROCEDURE

Then mount the piece part, find its contact position with stationary abrasive platen, grind flat, finish lap with wobble plate.

75. LEVEL INITIAL PIECE PART CONTACT WITH PLATEN PIECE PART DOWNWARD PRESSURE

The use of a sacrificial outer ring, square, segment pieces or ring with water inlet/outlet slots, with the sacrificial parts made of various different materials: plastic, metals, ceramics and metal/other composites, combinations, can assist in assuring that the initial piece part contact with the platen is level. By having the sacrificial parts at a higher elevation with respect to the approach path to the platen abrasive surface (usually by being outboard of the piece part), the sacrificial material will contact the abrasive surface of the platen before the piece part. This initial contact with the sacrificial part will level out the workpiece while the sacrificial part is being lapped, without any damage to the workpiece. This causes a touch down on the outer ring of sacrificial material first, to "level" the workpiece part. Examples of sacrificial material could be substantially anything that would not interfere with the lapping (e.g., explosive materials, highly abrasive material that would destroy the abrasive surface, etc.), such as porous material filled with lubricant. This technique may be used rigid mounts or spring mounts on the piece part holder.

Flooded Wedge Angle: One can also present the piece part at an angle tipped to raise an edge toward incoming abrasive and water. Water will develop a high pressure under the back (downstream) portion of a flat workpiece and lower the workpiece flat. This will keep the piece part from being presented with the leading edge contacting first and "camming in" due to friction or water pressure which destroys the leading edge as the piece part is ground or lapped.

Boundary Layer Lifting: The use of a finite element dynamic fluid flow computer program (FIDAP, by Fluent Company) shows that where a boundary layer of water is uniformly flat under the full downstream length of the piece part, there is little tilting force on the piece part. However, if excess water pushes up to form a "dam" at the leading edge of the piece part, a dynamic pressure head is created under the first portion of the piece part which tends to tilt the part on the abrasive surface. A leading ramp knife edge can be used to reduce the dam pressure build-up effect. Large leading edge pressure head lifting results if there is a raised front edge or a big dam head of water on front leading edge of the piece part.

The tapered ramp knife edge is used at the front to cut off the water dam by lifting it up (as with a snow plow), forcing the front of the piece part down due to reactive forces. The best procedure is to only use enough lubricant to wet the valleys in abrasive mountains plus a little extra.

Change Down Pressure: By using speed control, downward normal force is a function of surface speed, with greater downward force being used with greater speeds to counteract the lifting or tilting force of hydroplaning of piece part.

One should use very small down pressure at first contact, then increasing the pressure after contact has been made, then again reducing the pressure very fast with lift off from the moving platen.

Stationary Platen Start-Up: The platen is started only after the piece part is in contact with the abrasive sheet surface, using a start slow acceleration, then a quick ramp up to full speed. The platen would normally be brought from a stationary position (zero speed) to a full 3,000 rpm in about 15 seconds, or at least about 100 or 200 rpm/sec. acceleration.

Option 1: Have the piece part stationary until some minimum platen speed (e.g., at least 200 rpm) is reached.

Option 2: vary the speed of piece part rotation before the platen start-up and also during processing of grinding event. The piece part could be rotating or stationary at the time of the piece part removal. Removal could be made with platen at full speed, partial speed or slowed to a stationary state. The piece part will tend to stay conformed, flat to the platen at low speeds or stationary and therefore it will not damage the leading edge of the workpiece.

Water or lubricant can be varied during the process, with large excess amounts used during start-up initial contact or during removal at low platen speeds or stationary platen. In the case where it is desired to intentionally tilt the piece part spindle relative to the abrasive platen to produce a slight cone shape on the piece part surface, the platen can also be started from a stationary position after the piece part is placed into contact with the abrasive. An initial "motor mat" tilt angle can also be used with stationary start-up or lift off.

Add a loose material as a contact initial barrier such as powdered plastic, abrasive particles or other materials. These would be used either as pre-coating on piece part surface or as constant flow input with water lubricant source during initial contact, but stopped or eliminated during normal grinding. Their addition can be restarted prior to lift off to develop a film or layer between the piece part and platen. The material could also be a thick liquid, such as a polymer solution, grease, etc.

76. PIECE PART DOWNWARD PRESSURE

Problem: It is desirable to prevent tipping of the piece part of a wobble pivot part holder as it first contacts the abrasive which grinds of the leading edge of the piece part.

Solution: Use a sacrificial contaminant ring surrounding piece part so that the outboard sacrificial ring makes the first contact with the abrasive. Also the piece part could be potted in an adhesive, epoxy-like device which encompasses the piece part.

Piece part pressure from high speed air jets across the top surface directed under the surface to create an air film under the piece part. Water jets impinging around the piece part on top of the piece part surface to provide uniform pressure across the piece part surface to form a water film under the piece part.

A stationary hollow holding ring can be held in a fixed position above the abrasive surface and a piece part which matches the ring opening can be dropped into the ring to be in contact with the abrasive.

A dead weight may be placed on the piece part top surface. A dead weight with spring between weight and top surface may be used. One may also use a dead weight with resilient spring material which is filled with vibration damping material to reduce vibrations. Damping can be from liquid in foam or from motion induced shear action within foam material itself where high local velocities from vibration of piece part introduced by unstable hydrodynamic forces are alternated by local damping. It is also possible to use diaphragm pressure on vacuum pistons to produce uniform pressure across free weight by use of conformal diaphragm membrane in contact with piece part top surface.

77. FLOATING PIECE PART HOLDER

It is desirable at times to use a heavy or light piece part ring with open center hole to mount piece part(s) and have an extended outer portion with a low outboard bearing contact ring having a spherical shape. Two or more stationary standard roller bearings would be mounted to contain the piece part ring as it is forced against the bearings by the forces induced by the moving water coated abrasive. The low position of the extended spherical portion results in reactive forces kept low toward the abrasive surface and minimizes upward tipping forces on the piece part. A spherical surface on the extended portion assures only point contact with the outer-flat surfaces of the support bearing.

Another variation is to use support bearings with spherical surfaces to get point contact. This point contact feature minimizes lifting or tipping forces on the piece part ring. Gear teeth can be used on the outer edge of the piece part ring so the ring can be turned by a motor driven gear matching contact with the ring gear. Other mechanical ring rotation drive mechanisms can be employed such as engagement pins with contact "dog" arms, universal joints, magnetic couplers, roller drive wheels, air or fluid contact impingement jets, inductive magnetic electrical fields. Another drive mechanism is the differential speed of the outer periphery of the rotating platen abrasive having a greater contact force than the inner radius abrasive contact thereby setting up a relatively slow differential rotating velocity of the piece part ring.

78. LAPPER ABRASIVE PATTERN

Problem: When a piece part is ground or lapped using an annular ring which is less wide than the piece part, there is a center portion of the piece part which is in constant grinding contact with the abrasive, while other parts of the piece part are not in contact with an abrasive surface. This central area receives more grinding action than the outboard portions of the piece parts (which are typically rotated) that leave contact with the abrasive. This center section typically has a circular shape as the piece part is rotated. If the piece part is not rotated, then a groove would be ground into the piece part and it would have a width equal to the width of the annular ring. The heat which would be generated by the friction contact force with the abrasive is at a greater amount at the inside circle, and this also tends to swell and raise this circle due to greater thermal expansion in the inboard (central) area than in the outboard areas which leave contact with the abrasive and are water cooled. When the raised, thermally swollen surface is ground level and cools off and shrinks, the circle will be a "low" spot on the piece part.

Solution: The annular ring can be changed from an essentially uniform (evenly distributed particles over any given significant area) surface to one of smaller, parallel, concentric rings with free space grooves between the raised abrasive which is flooded with water coolant. All portions of the piece part then would leave contact with the raised abrasive as it is rotated. The annular ring could be made with raised tangential abrasive segments with gaps between staggered adjacent inner concentric rings to grind-cool-grind a given area. Also the piece part rotating axis can be moved sideways during the grinding so that a selected area can be moved out of contact with the abrasive surface.

79. LAPPER PIECE PART WOBBLE GIMBAL PLATE

Problem: When a lapper wobble spherical ball gimbal pivot plate is used to hold a piece part in intimate flat contact with a high speed rotating abrasive surface to compensate for small minute misalignment between the piece part support rotating shaft and the platen shaft (collectively called the spindles), there is generally sufficient friction in the antirotation mechanical device used to keep the lower part holder portion of the wobble plate from torsionally rotating relative to the upper portion which is attached to a spindle. As these two portions of the piece part wobble plate must move freely in a spherical pattern, rotating about the spindle center, any friction from an outboard antirotation device will impede the free spherical movement of the piece part as it attempts to align itself perfectly flat to the abrasive surface with a small nominal downward contact pressure force which holds the part surface to be ground in flat contact with the moving abrasive. A typical piece part is ½ to 8 inches in diameter, typical downward contact force is 0.5 to 20 lbs. and more, and the amount of ground off material is typically 0.0001 (0.0025 mm) inch to 0.003 inch (0.0077 mm) to obtain a flatness of typically 1 optical lightband or less. Usually a post with a stationary ball on one end is used where the ball spherical surface is in rubbing contact with a flat surface and the frictional contact force between the ball and the flat surface increases with increasing piece part rotational torque. This friction prevents easy movement of the ball against the flat surface which is required to allow the spherical movement of the piece part, and this friction is further increased when the flat wall is contaminated by grinding debris or swarf.

Solution: The stationary ball post is replaced with a roller bearing, either a low friction needle bearing, ball bearing, roller bearing or air bearing and this bearing is constrained between two round stationary posts mounted on the opposing plate which act on either side of the bearing so the piece part can be torsionally rotated in either direction. The outer cylindrical surface of the bearing will be self cleaning as there is only point contact between the bearing surface and the posts during sliding oscillations of each piece part revolution.

80. WOBBLE PLATE ANTIROTATION DEVICE

Problem: A wobble spherical pivot plate that is made in two plate sections attached to each other by use of a free floating trapped spherical ball needs to be restrained or have the two plate sections coupled to each other to transmit rotational torque from the upper plate to the lower plate. A typical "dog" type of system where a post on one plate contacts a surface on the other provides rotational torque, but has the disadvantage of having sliding friction on the ball post to flat surface area which impedes the free pivoting action of the wobble plate which is moving in an oscillating motion to maintain the wobble plate piece part surface flat to the moving abrasive surface as the wobble plate is rotated during a grinding or lapping action. This friction can create undesirable patterns of uneven ground surfaces in the piece part, as the spherical pivot action will tend to stick, break loose or stick again due to changing from the high forces of static friction and lower forces of dynamic sliding friction which occurs at each piece part revolution.

Solution: A linkage bar with pin pivots at each end can be used to couple the upper plate with the lower plate to obtain good torsional coupling with free motion of the spherical pivot action of the wobble plate. The pins would be solid with a small diameter which are periodically lubricated or they may have ball, roller or sliding bearings at the pivots. The longer the bar and the more horizontal the bar, the less incremental rotation of the lower plate relative to the upper plate with the pivot action. Another method to accomplish the reduction in "stiction" jumpy dynamic friction) is the use of a hinge linkage system or a living hinge solid flexible spring that is wide to be stiff for rotational forces but weak for spherical pivot.

Figure 3:
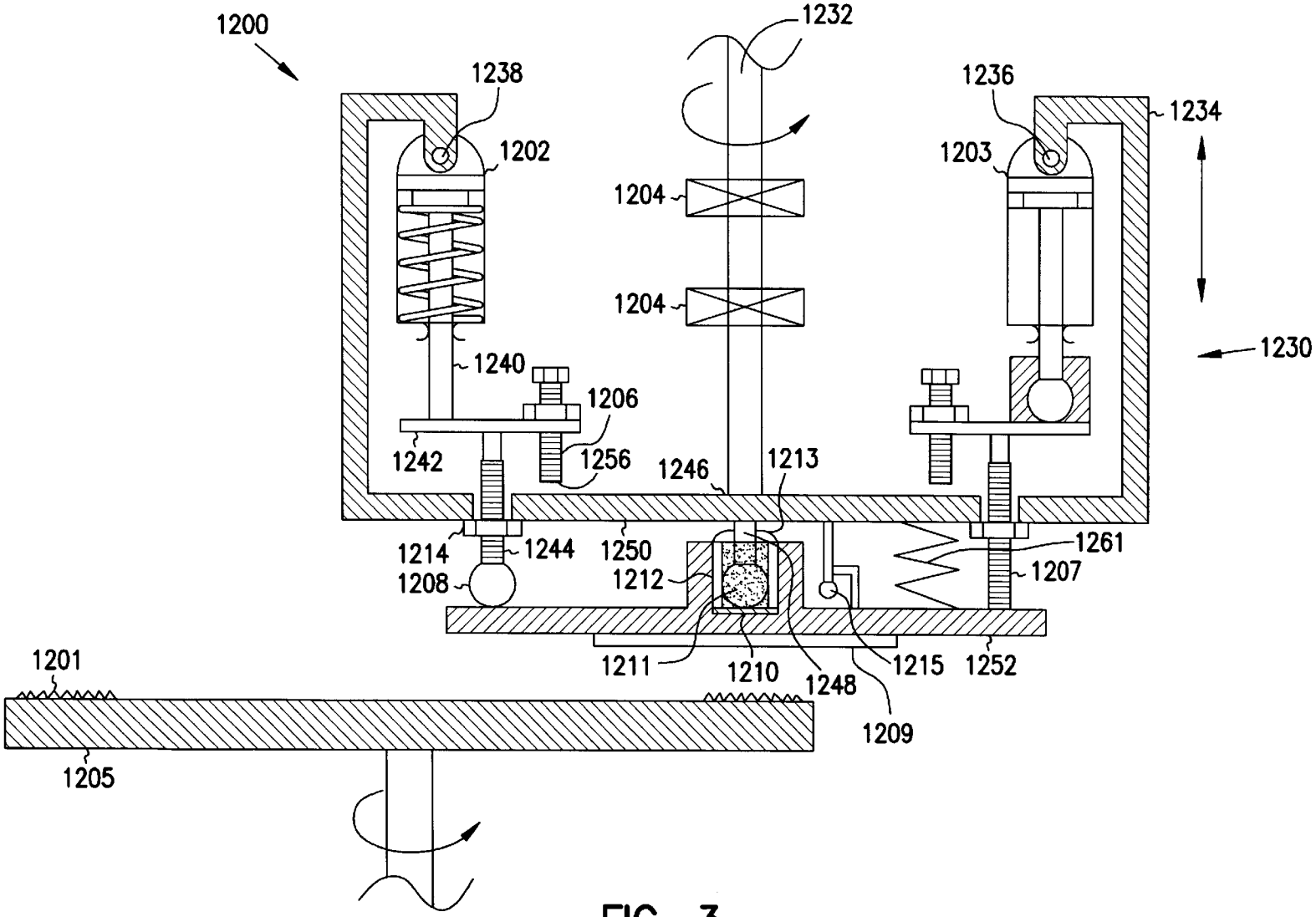
FIG. 3 is a cross-section of a lapping system according to the present invention.

FIG. 3 shows some of the features of apparatus of the present invention in a segmented view of the apparatus 1200. This apparatus 1200 comprises a rotatable platen 1205 with an annular ring of abrasive 1201 located on an upward face of the platen 1205. The workpiece holder assembly 1230 comprises a rigid shaft 1232 and an assembly housing 1234. Two of three air cylinders 1202 and 1203 (the third is removed by the segmentation of the figure) are attached to the housing 1234 by pivoting connections 1236 and 1238. The air cylinder 1202 is shown by further segmentation to be a spring air return cylinder. The cylinder 1202 is connected through a shaft 1240 to an intermediate plate 1242. An "up" stop screw 1244 with a ball end 1208 is positioned below the intermediate plate 1242. A "down" stop screw 1206 is positioned at another position on the intermediate plate 1242. The rigid shaft 1232 which is driven by shaft bearings 1204 is rigidly attached to the inside surface 1246 of the housing 1234. A second rigid shaft element 1248 is rigidly connected to the underside 1250 of the housing 1234 to slide or telescope within the first rigid shaft 1232. This creates a rigid connection from above the housing 1234 to the pivot ball sleeve bearing 1212 below the housing 1234. A sleeve bearing 1212 for a pivot ball 1211 radially restrains the second rigid shaft element 1248. The sleeve bearing 1212 is connected to or at least associated with a piece part holder 1252. The ball nut 1214 is adjustable to allow the telescoping gap distance to be set. This connection or association may be accomplished in many different ways, the requirement being that the piece part holder 1252 spherically rotates around the pivot ball 1211. A piece part 1209 is fixed on the bottom of the piece part holder 1252. There is preferably an antirotation ball pin and stop 1215 limiting the ease of rotation of the piece part holder 1252 with respect to the bottom surface 1250 of the housing 1234. A spring element (not shown) may be used with the ball nut 1214 to control the axial gap movement. A segment of a spherical mass of elastomeric material 1213 such as a room temperature vulcanizing rubber can effectively perform the function of sealing the ball joint from grinding debris and also seal in a ball lubricant. This configuration allows for the solution of a uniquely difficult problem in alignment of the lapping apparatus 1200.

To be optimally effective in performing the function of proper alignment of the workpiece or piece part 1209 to the abrasive annular ring 1201, the piece part holder 1252 must first act in a wobble or adjustable mode to place the piece part 1209 into alignment with the abrasive ring 1201. To assure the best high speed lapping, during the actual lapping process, the piece part 1209 is best held in a more rigid alignment with the abrasive annular ring 1201. When the piece part 1209 is placed into contact with the abrasive annular ring 1201 in a non-lapping contact according to a preferred method of the practice of the present invention, the initial contact is made between the piece part 1209 and the abrasive annular ring 1201, the force on the top surface of the piece part holder 1252 is provided by the two air cylinders 1202 and 1203 and the "up" stop screws 1207 and 1244 with the ball end 1208. These "up" stop screws 1207 and 1208 (the third or more is not shown because of segmentation of the drawing) are able to move independently to allow the piece part holder 1252 to wobble or move spherically about pivot ball 1211 with the air cylinders 1203 and 1202 mount pivoting connections 1236 and 1238 and find proper alignment with the abrasive annular ring 1201. The pressure on the contact is minimal as the air cylinders 1202 and 1203 are precisely controlled. When this first, non-lapping contact controlled by the "up" stop screws 1207 and 1208 is made, further force is applied to the housing 1234 by lowering shaft 1232 so that it drops further. The piece part holder 1252 moves towards the bottom surface 1250 of the housing 1234. Contact is made between the end of the ball 1208 and the piece part holder 1252. The bottom end 1256 of the "down" stop screw 1206 makes contact with the top surface 1246 of the piece part holder 1252 to equal the axial gap between the pivot ball 1211 and the ball nut 1214. Each individual "down" stop screw (e.g., 1206) is adjusted so that in this static position of contact between the piece part 1209 and the abrasive annular ring 1201 in a non-lapping contact, the "down" lock screws 1206 are in the exact alignment position desired when the piece part 1209 is eventually brought into contact with the abrasive annular ring 1201 during lapping. Therefore, the initial contact between the piece part 1209 and the abrasive annular ring 1201 during the lapping process, when the platen 1205 is rotation at greater than 500 or more revolutions per minute and at high surface feet per minute speeds, the piece part holder 1252 will be rigidly held in place in proper alignment by the rigid support between the bottom 1256 of the "down" stop screw 1206 and the top surface 1246 of the housing 1234 as the housing 1234 is pushed down by the air cylinders 1202 and 1203. If the air cylinders 1202 and 1203 are deactivated, then the piece part holder 1252 is allowed to wobble with the pivot ball 1211 in contact with a hardened contact plate 1210. Vibration of the piece part 1209 is prevented by insertion of a vibration damping agent or damping device 1261 which provides a connection between the piece part holder 1252 and the housing 1234. In this manner, the apparatus will be able to shift from a wobble or floating mode to a rigid lapping mode during the rapid operation of the equipment. This configuration is best performed with three sets of "up" and "down" stop screws and three sets of air cylinders. Two, four or more can be used, but three has been found to provide the best results to date.

Another issue which may have to be addressed is the fact that when annular rings are cut from round sheets of abrasive disks, there can be significant waste of material from the central round area cut from this disk. This is one reason why printing of patterns of abrasive on a sheets is desirable. However, because the sheets of abrasive are most commonly available in round sheet form, the cutting out of annular rings is the most likely source of the annular rings. For this reason, this invention also describes an annular distribution (to be included within the meaning of the term "annular rings") of abrasive sheet material which can use the residue of the process where a single piece, continuous annular ring was cut from a round sheet of abrasive. As shown in FIG. 15, segments or pieces of abrasive sheeting may be lain in an annular distribution within the abrading surface area of a rotating platen. In FIG. 15(*a*), two segments 1301, each of which is a half of an annulus, have been cut from the remaining material from the original round sheet of abrasive material (not shown) and then placed end to end to form the annular shape. The vacuum securement of the platen (not shown) can secure the individual piece 1301 into a secure position onto platen 1320. The individual pieces 1301 may be secured together at their intersection 1304 by adhesives, fusion, butt welding or the like. The center area 1306, as with a single piece annular ring, may be left open or may be filled with a central round sheet (which may also be physically joined to the two segments 1301 to prevent flow of material under the segments 1301 and add support. FIG. 15(*b*) shows a multiple number (5) of arcuate segments 1308 aligned around the platen 1320 in an annular distribution. Any number of segments may, of course be used, but the fewer the number of segments, the less work is needed to align them.

FIG. 15(*c*) shows a number of distinctly different shapes of abrasive sheet segments on a platen 1320. There are three sets of abrasive materials, each with distinct shapes, grouped as multiple wave forms 1322, kidney shaped 1325 and smaller arcuate 1324. An important feature of this configuration is the fact that there are physical gaps 1326 between one of the pairs of segments 1324. One of the problems previously discussed was the effects of removal and passage of detritus, swarf and liquids away from the lapping contact area, especially the problems associated with boundary layer thickness changes, channeling of liquid flow (with or without swarf included), and other effects on the alignment or pressure or exposure of particulate abrasives to the workpiece. This FIG. 15*c* shows another benefit of the use of non-butted and non-smoothly joined segments form a residual cut-out sheet. Because the segments allow spaces 1326 to exist between the abrading or lapping surfaces (e.g., 1324), natural run-off areas are provided which can carry away material without its moving completely within the lapping contact area (e.g., on the surfaces of the segments 1322, 1324 and 1325). The dimensions of this gap 1326 are defined by the surface of the platen 1320 and the height of the segments (e.g., 1324).

FIG. 15(*d*) shows other configurations of segment areas which provide fluid or swarf removal capability. The platen 1320 may have many various configurations of abrasive sheet segments on the platen 1330. For example, segments 1331 have holes 1332 in them which can trap material, rather than just letting it flow away in the gap 1334. Segment 1336 has serpentine paths 1338 without abrasive thereon to form the flow paths. Segment 1340 has both central open areas and an outlet area 1342 in a single design. This enables both some collection and a flow path for material. As the most significant area of potential damage from material on the surface of segments (e.g., 1340) is on the outer areas, this configuration is very efficient. Segment 1344 has straight open lines 1346 between the areas of abrasive 1348. The segments radially curved 1350 are smaller arcuate pieces which provide a significant flow area 1352 between the arcuate pieces. It is to be noted that the segments may be touching (as in FIG. 15(*a*)) or not touching (as in FIG. 15(*d*)) or combinations of these may be used. By having non arcuate segment elements such as segments 1336 and 1340 contact each other, flow passages which allow the movement of material from the center of the equivalent annular abrasive ring to the outside of the ring would be provided.

Figure 16:
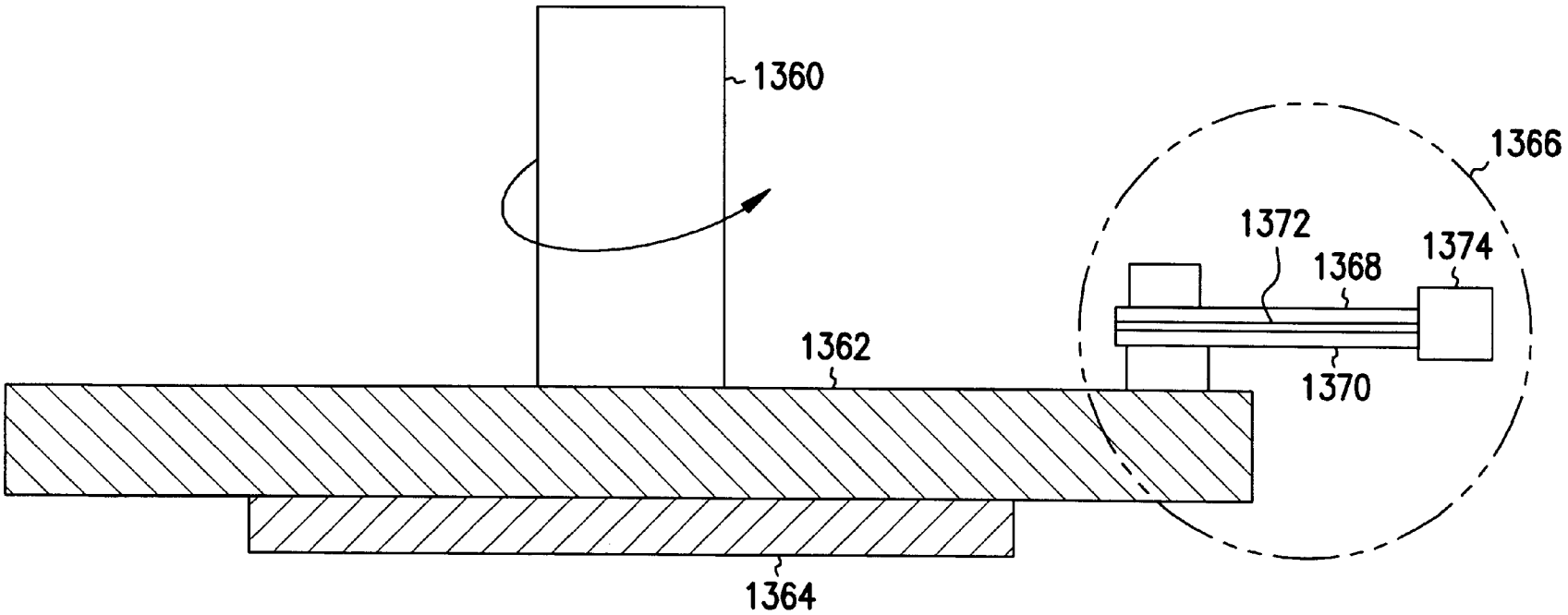
FIG. 16 shows a workpiece holder with a vertical vibration damping element on it.

Another significant problem in the design of the equipment is the effect of vibration on the workpiece holder and workpiece. As the finished piece part dimension specifications desired for the lapping process are so small, anything which dynamically moves the abrasive sheet, the platen, the workpiece or the workpiece holder, or shifts their relative positions is undesirable. As the platen is quite massive, there is seldom any significant vibration in that element (especially since designing the weight and construction of the assembly have made considerations for that problem). However, the workpiece may vary from job to job, the workpiece and workpiece holder do not have as great a mass as does the platen and its housing, and vibration is much more likely to occur with the workpiece holder, especially when in contact with the abrasive material rotating at the high speeds of rotation of the present invention. FIG. 16 shows mechanisms for reducing vibration on the workpiece holder and consequently the workpiece. A shaft 1360 is shown attached to a workpiece holder 1362 with a workpiece 1364 attached thereto. A vertical vibration damping assembly 1366 is shown on the workpiece holder 1362. A leaf spring 1370 comprising a sandwich dual spring 1368 with a viscoelastic damping layer 1372 is shown. A mass 1374 is on the outer edge of the vertical vibration dampening assembly 1366. The natural frequency of the unwanted natural frequency vibration can be ascertained and a secondary spring mass vibration absorber can be designed and installed to combat these vibrations. In FIG. 16, a spring constant for the leaf spring vibration damping assembly is designed and installed to combat these vibrations. The spring constant is selected to be matched with the discrete mass 1374 so that its natural frequency, as described by $$Wn=(K/M)^{1/2}$$

is equal to the undesired natural frequency oscillation, wherein Wn is the natural frequency, K is the spring constant, and M is the mass. This secondary spring-mass will vibrate 180 degrees out of phase with the unwanted natural frequency of the workpiece holder in a direction which is perpendicular to the abrasive surface (this is why it is referred to as a vertical vibration dampening element) and will not be affected by the rotation of the workpiece holder. This is because when a flat spring is used, it flexes in only one direction, which is substantially perpendicular to the abrasive surface. It is desirable that at least two, preferably three, and possibly more of these units would be installed, most preferably approximately symmetrically around the piece part holder circumference. When the most preferred arrangement of three vibration dampening elements are used, they would be installed circumferentially with about 120 degree spacing between the elements. The most preferred element construction, primarily from a cost and convenience standpoint, is the use of two metallic layers (e.g., lead spring layers) with a vibration dampening material (e.g., a viscoelastic material) acting as a dampening agent between the two springs.

FIG. 17 shows a configuration, previously discussed herein, for reducing swarf, detritus and liquid movement problems within the system while it is lapping at the high speeds of the present invention. A lapping system 1400 is shown which comprises the workpiece holder 1401, a workpiece 1410 and the high speed rotatable platen 1402 with an abrasive sheet 1405 secured onto the platen 1402. The abrasive sheet 1405 makes contact with the workpiece 1410 in a narrow region of contact 1403. The surface of the platen 1414 after a significant flat area of contact 1403 has been effected, slopes away from this contact area to a lower region 1422. This lower area 1422 has a ledge indentation distance 1406 which is the difference between the level of the lowest point 1422 and the interior surface 1416 of the platen 1402. The abrasive sheet 1405 is shown to be secured to the platen 1402 by vacuum passages 1404. Debris and liquid 1408 move over the interior surface 1416 towards the contact area 1403 between the abrasive sheet 1405 and the workpiece 1410. The level of this surface 1416 is preferably lower than the height of the surface of the abrasive sheet 1405 and more preferably below the height of the platen 1402 within the contact area 1403. The liquid and debris 1408 move radially over the surface 1416, but are propelled, due to centrifugal forces, to jump over the ledge indentation's distance 1406 gap and continues on radially to contact the top surface of the abrasive sheet 1405 and thus avoid the inside radial edge of the annular abrasive sheet 1405 and prevent lifting of this inside radial edge of the abrasive sheet 1405. Even the high centrifugal forces will not force the liquid and debris between the abrasive sheet 1405 and the platen 1402. FIG. 17 shows a sharply stepped ledge indentation distance 1406 which prevents liquid and debris from being forced by centrifugal action under the abrasive sheet 1405. FIG. 17 shows how contact with the inside radius cuts off the annular abrasive sheet 1405 which potentially has loose particles from the platen. The center of the surface area of the workpiece does not align with the geometrical center of the curved annular segment of the abrasive which contacts it. However, the vacuum removal passage 1420 is a desirable assurance against such movement.

Because of the use of an annular distribution of material on the rotating platen, previously unknown geometrical effects have been introduced into the system which have been first addressed in the practice of the present invention. When a workpiece is being lapped, it is natural to place the geometric center of the workpiece within the center of the rotating abrasive surface. It has been found in the practice of the present invention that this natural positioning is somewhat less preferred than another orientation. Because of the arcuate nature of the annular ring of abrasive where the portions of the annular section which in contact with the piece part surface "break away" to the center of the platen, the center of the surface area of the workpiece does not align with the geometric center of the curved annular segment of abrasive which contacts it. Because these two centers are not perfectly aligned and a contact force is applied to bring them together for lapping, there is a subtle tendency for the piece part to tilt out-of-flat-contact to the radial outside of the platen. This happens because there is less contact area support under the workpiece at the outside portion and more contact area on the inside portion. This deficiency can be corrected by a slight radial repositioning of he workpiece area center relative to the center line of the annular ring. It is therefore desirable to shift the position of the workpiece towards the inboard area of the annular abrasive sheet. This shift of the geometric center of the workpiece should be at least 1%, preferably at least 3%, more preferably at least 5% of the theoretical matching radial dimension location of piece part area center and the area center of the contacted segment of the annular abrasive sheet dimension of the workpiece which addresses the abrasive sheet surface. The exact percentage of shift of the geometric center of the workpiece can be precisely calculated by simple arithmatic means, but has not been done so here as it would have to be done for each annular shape (e.g., ID and OF considerations). The speed of rotation does not by itself affect this calculation.

Another factor in the movement effects of the workpiece holder (and consequently to the workpiece) shifting during the high speed lapping of the present invention is the forces being applied to the workpiece (and consequently to the workpiece holder) by the high rotational speeds of the workpiece holder. The forces caused by debris and liquid flow under the workpiece also contribute to this effect. These forces can cause the workpiece holder to want to swivel about the ball pivot joint, or other pivoting joint, which secures the second rigid shaft member to the workpiece holder. This problem is again unique to the high speed rotation of the lapping system, particularly in combination with the abrasive sheet which is less forgiving to shifting of the workpiece than a liquid slurry on a slower speed rotating platen. The extent and seriousness of the problem can be reduced by making at least one geometric reconfiguration of the relationship of elements. It has been found that to correct for out-of-balance swiveling of the workpiece holder due to rotation of the workpiece holder with a mass center of gravity located below (or above) the pivot can be reduced by moving the center of the pivot joint closer to the center of gravity of the workpiece holder. It has been found that to correct for out-of-alignment problems due to the dynamic abrasive contact friction forces on the surface of the workpiece that it is desirable that the location of the workpiece gimbal axes be located as close as possible to the surface of the abrasive sheet.

Figure 18A:
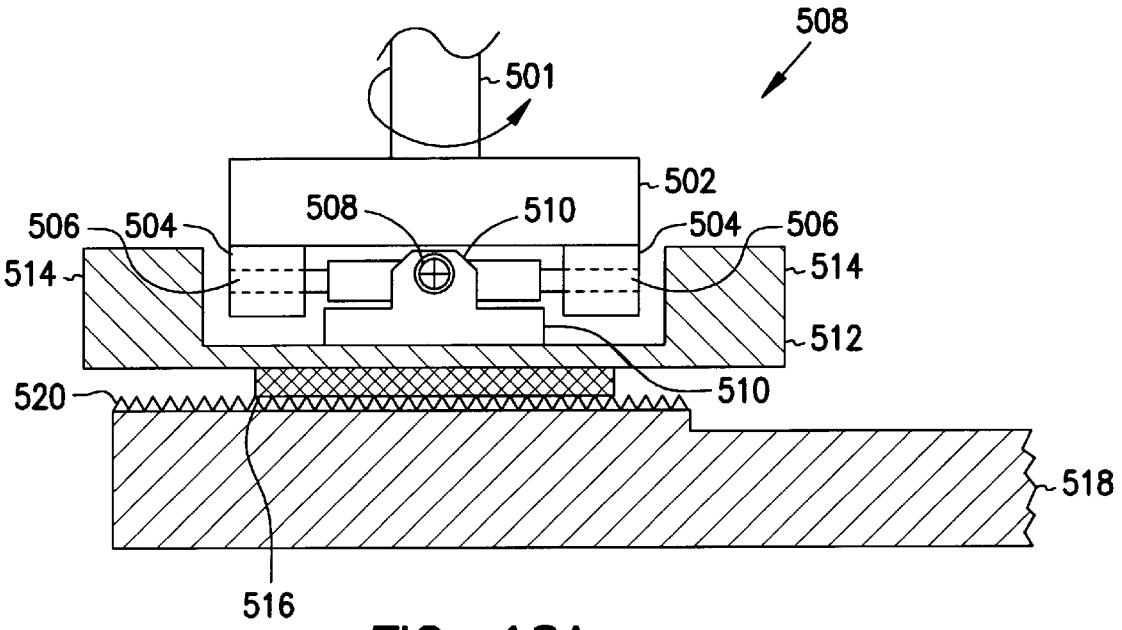
FIGS. 18*a*) and *b*) show a workpiece holder with various orientations of gimbals to reduce tilting torque on the workpiece holder under high speed lapping.
Figure 18B:
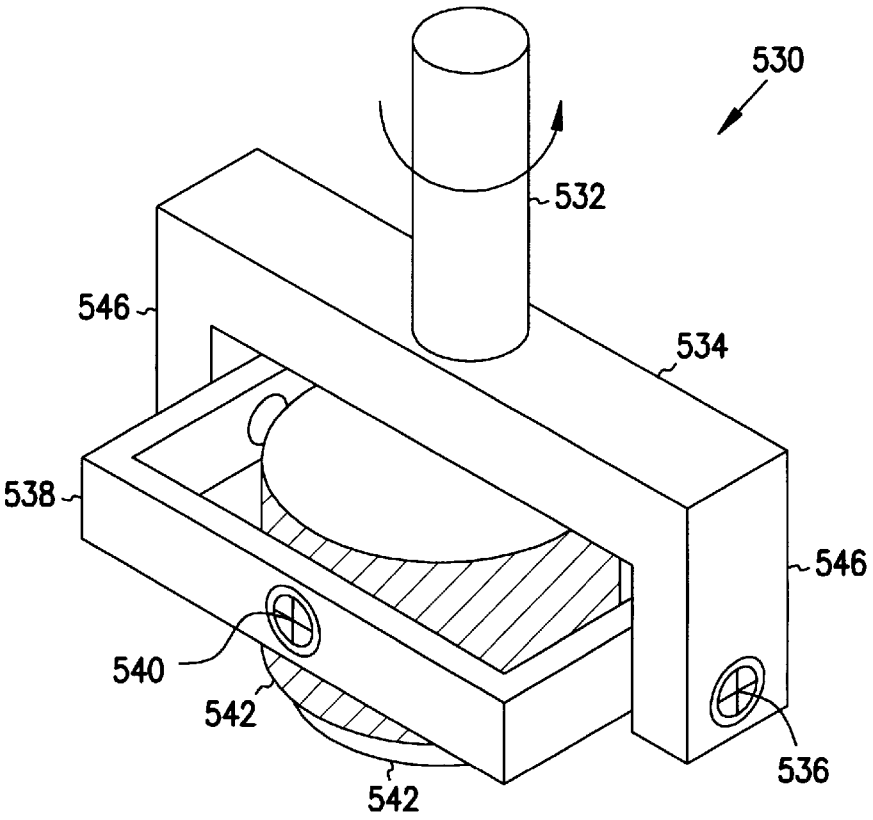
Figure 19:
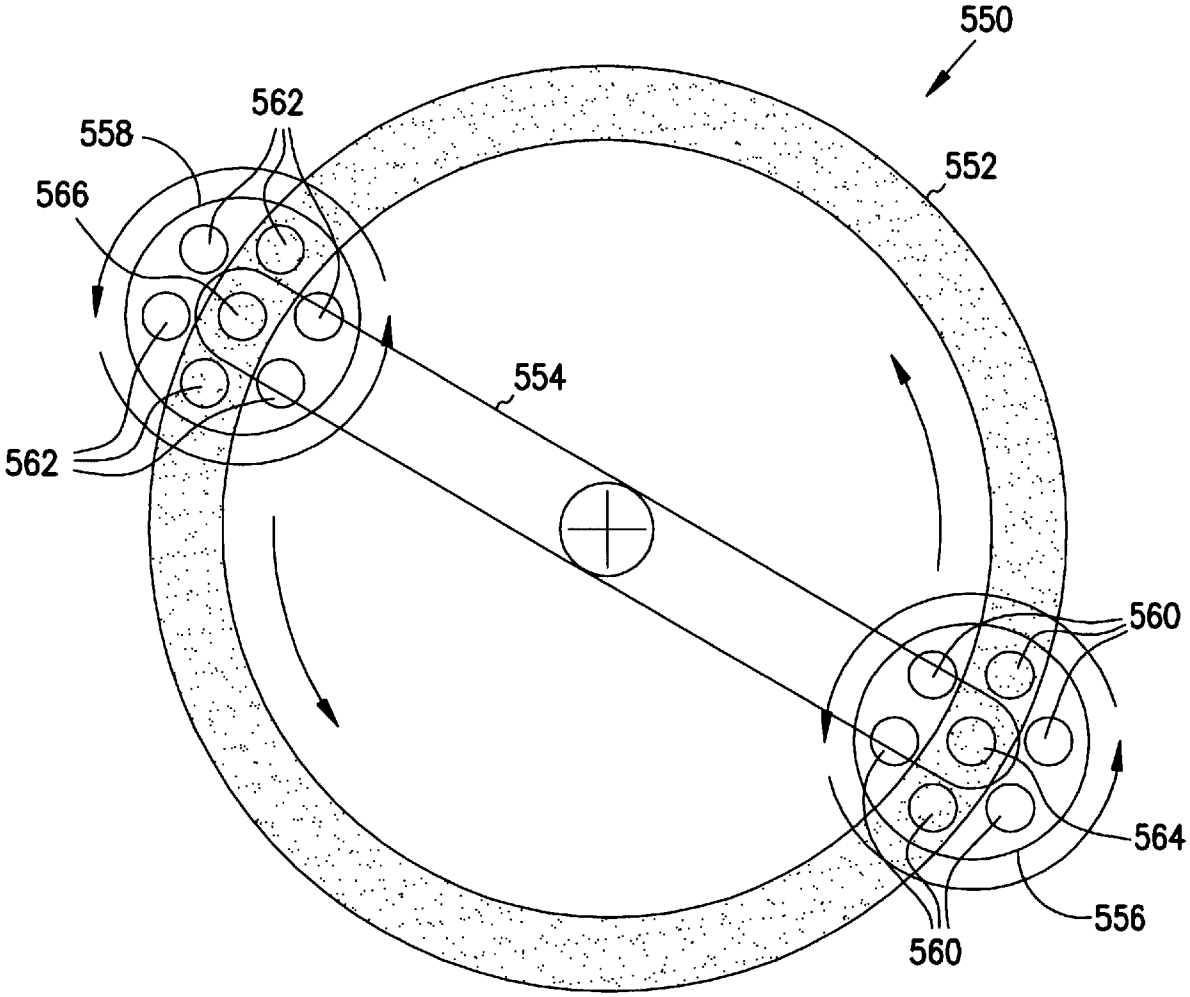
FIG. 19 shows an overhead view of a platen and multiple part workpiece holder according to one aspect of the present invention.

FIGS. 18 and 19 show constructions which address solutions to this problem and which move the center of gravity of the workpiece holder closer to the rotational center of the pivot connection to the shaft. FIG. 18 shows a lapping assembly 500 which addresses this problem. The shaft 501 is connected to a primary support plate 502 having x and y axis pivoting connections such as gimbal bearings and pivot shafts 506 and 508 connected to downwardly extending arms 504 on the primary support plate 502. A pivoting second support plate 510 is connected to the workpiece holder 512. The workpiece 516 is connected to the workpiece holder 512 and is in contact with the abrasive sheet 520 on the rotating platen 518. The abrasive sheet 520 happens to be shown in this configuration larger than the workpiece 516, but that is not required. In many instances the abrasive sheet 520 may be the same or smaller in the radial dimension or radial direction (with respect to the platen) than the workpiece 516. The workpiece holder 512 is shown with arms 514 which carry mass upwardly, even beyond the line of the pivot shafts 506 and 508. This mass distribution keeps the center of gravity closer to the plane of the gimbal bearings 506 and 508 than using a workpiece holder which was flat on all sides (e.g., a slab with rectangles on all sides). Another configuration that would work is shown in perspective in FIG. 18*b*. In this configuration, the lapping assembly 530 is shown with a shaft 532 attached to a first external gimbal arm 534. The first external gimbal arm 534 is attached through gimbal bearings and pivot shaft 536 to a second external gimbal arm 538. This second external gimbal arm 538 is connected through gimbal bearings and pivot shaft 540 to a piece part holder 542. The piece part holder 542 holds the workpiece 544. By having the piece part holder 542 sitting within a volume of space created by the combination 546 or 534 of the first external gimbal arm 534 (and the second external gimbal arm 538), the center of gravity of the piece part holder is maintained in a position which is relative close to the line of rotation of the gimbals 534 and 538 through the gimbal bearings 536 and 540 to reduce tilting of the workpiece holder 542 due to the rotating speed of the workpiece 544. In addition, this configuration also demonstrates a method for lowering the plane of the axes of the pivot gimbal running through the gimbal bearings 536 and 540 close to the abrasive contact surface of the workpiece 544. This geometric orientation reduces the tilting torque on the workpiece 544 and assists in the maintenance of proper alignment within the lapping system.

Another benefit of the present invention, particularly with the use of annular rings, is the ability to lap multiple pieces and even use multiple piece part holders at the same time. FIG. 19 provides a description of this aspect of the invention. A lapping system 550 is shown with an annular abrasive sheet 552, an arm 554 carrying two piece part holders 556 and 558. Each of the piece part holders 556 and 558 support a multiplicity of piece parts 560 and 562. The piece part holders 556 and 558 rotate so that the individual piece parts 560 and 562 are exposed to the abrasive sheet 552. Each of the piece part holders 556 and 558 are aligned on wobble plates (not shown) and are operated by the processes described above in the practice of the present invention. The arm 554 may also have alignment mechanisms associated with it to assure proper alignment with respect to the annular ring 553 and the rotatable platen (not shown). In this system, the different piece parts 560 and 562 do not even need to be of the same size or cross section. For example, one set (e.g., 560) could be round, and the other set (e.g., 562) could be square or triangular in cross-section. It is equally useful to have a three arm central support piece for three separate workpiece holders. It is desirable to process each piece part for an equal amount of time to make the surface treatments equivalent. Therefore, piece parts located at the center of the piece part holder, such as piece parts 566 and 564 may be eliminated in this grouped set-up of piece parts. If this were not done, piece parts 566 and 564 would be continually lapped over the process, while other parts located in a ring, such as shown for parts 560 and 562 would be processed only intermittently.

Figure 20A:
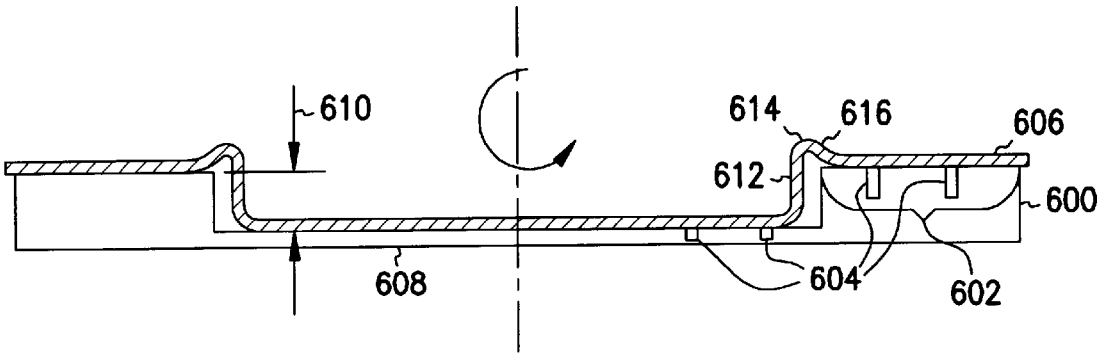
FIGS. 20*a*), *b*) and *c*) show cross-sections of platens of an earlier but workable form (a) of the present invention, and two improved configurations (b) and (c) according to the present invention, and 20*d*) shows multiple piece parts on an annular ring of abrasive.
Figure 20B:
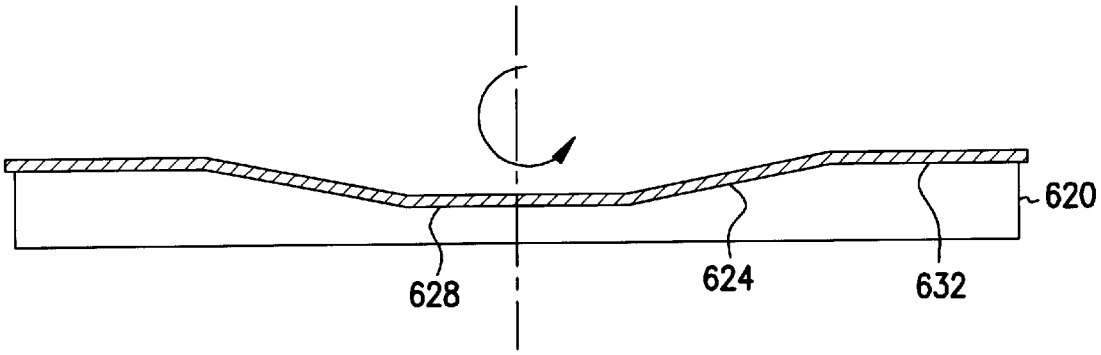
Figure 20C:
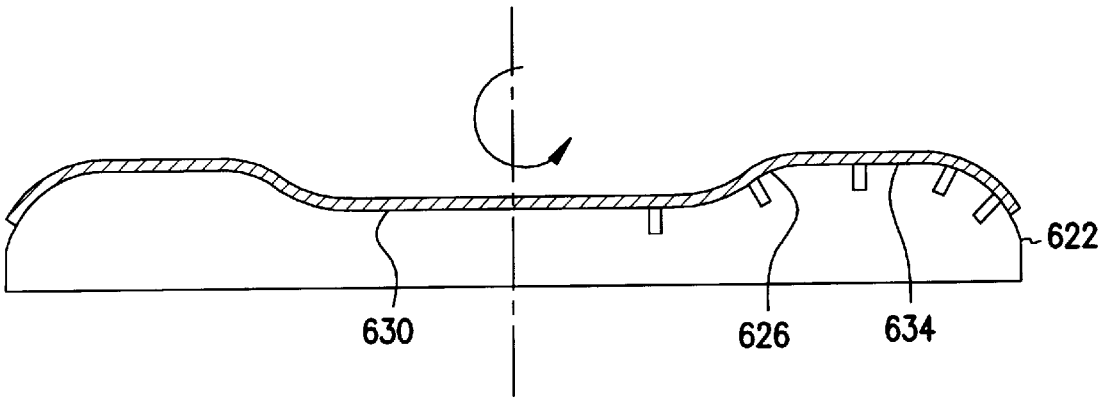

In positioning an abrasive sheet of material in a platen with an annular raised area on the outboard edge of the platen, it is often convenient to use a sheet with larger dimensions (especially with respect to the radius) than the raised annular area. When the support layer (and even when it is a continuous sheet of abrasive with polymeric or other binder) is position over the flat central area of the platen (or a part thereof) and then fitted over the annular raised area, the sheet of abrasive shows a tendency to crinkle and lift at the transition from the central area to the annular area. This is shown in FIG. 20(*a*), shown with the platen 600, raised annular area 602, vacuum holes 604, abrasive sheet 606, and central area 608. As the abrasive sheet 606 moves up the step-up distance 610 with section 612 of the abrasive sheet 606, a crinkle or fold 614 forms at the point 616 at the raised annular area 604. FIGS. 20(*b*) and (*c*) show alternative platen shapes 620 and 622 which provide sloped transitions 624 and 626 from the central areas 628 and 630 to the flat raised areas 632 and 634. The slopes should never present an angle that would bend the abrasive sheet past an angle of 65 degrees (e.g., forming an apex of less than 65 degrees by bending it more than 25 degrees away from horizontal), preferably not past an angle of 70 or 75 degrees, and most preferably not past an angle of 75 or 80 degrees, or more than 85 degrees. By reducing the angle that the abrasive sheet must be bent, the possibility of any crinkling is avoided. As the placement of abrasive sheets over an annular raised area is another unique aspect of the invention, this solution is unique to the field of the invention.

In FIG. 3, two separate supports 1234 (the housing) and 1252 form the substance of the wobble plate. To further reduce vibration, a cushioning, compressible element 1261 is provided between the wobbling piece part holder 1252 and the bottom 1250 of the housing 1234. The compressible element 1261 should make contact between both the wobbling piece part holder 1252 and the bottom 1250 of the housing 1234. Viscoelastic material, springlike elements, elastomers, rubbers, and layered structures may be used. In the FIG. 3, a double sided polymer backed adhesive tape was rolled into a tube and cut to the proper length. The tube was placed between the wobbling piece part holder 1252 and the bottom 1250 of the housing 1234. As they are brought together, the two surfaces compress and flatten the cushioning, compressible element. This element assists in reducing the vibration within the wobble plate element and the piece part assembly.

In the movement of the workpiece holder and the workpiece towards and into contact with the rotating abrasive sheet covered platen, the contact force application has been repeatedly identified as a desirable focus of control within the practice of the invention. An additional aspect of this control is the speed with which the workpiece (and the workpiece holder) approaches the rotating platen. As initial contact forces tend to be higher because of momentum, reactive forces from the stationary surface, and elastic forces, control of the speed of the movement of the workpiece and work piece holder are desirable ways of controlling or moderating the initial contact force. Thus, as generally mentioned herein, velocity control devices, such as fluid dampers (oil dampers preferred, but other fluids, including gases) may be used. These velocity control devices may be used with the cylinder contact force system to prevent the workpiece from 'slamming' into the abrasive at a speed which would cause an undesirable level of contact force initially. Therefore, a somewhat distinct or auxiliary speed control or speed dampening system should be overlaid on the cylinder contact force system to provide a second aspect of control to the contact force aspects of the present invention. This speed control or speed dampening system may also be used to lock the workpiece holder at a desired vertical position at any time during the process (as for example after the removal of the workpiece from contact with the abrasive sheet and platen element).

While the abrasive sheet and platen are rotating at the high speeds of the present invention, it has also been found to be desirable to rotate the workpiece (usually by rotation of the entire workpiece holder, although with multiple workpieces in a group holder, the individual workpieces may also be easily rotated). It is desired and has been proven to be beneficial to the flatness and especially the smoothness of the work piece to have the workpiece rotated during the lapping process. The workpiece should be rotated at least 1 or 2 full rotations during 10 seconds of active grinding, especially at the point where the finer abrasive particles are being used. The workpiece may be rotated at a rate of at least about 100 rpm, preferably at least 150 rpm, and more preferably at least 200, at least 300 rpm, which, for a 30.8 cm diameter disk at 500 rpm, there should be at least 3 to 4, and preferably more than 4 rotations of the workpiece during 10 seconds of lapping. It is preferred that the workpiece be rotated at least 3 or 4 times in a 10 second interval during lapping in the practice of the present invention. The work piece may be rotating as it is brought into contact with the abrasive sheet surface.

As has been previously noted, it is desirable to only fill the valleys between the peaks of the abrasive particles (the peaks protruding from their binder support on the backing sheet) by from 50% of the protruded height to perhaps 110 to 150% for an abrasive sheet with an essentially continuous (uniform) coating or covering of abrasive particles. However, where the provided abrasive sheet is provided with island areas of abrasive or other broken or less continuous or less uniform distribution of abrasive particles, then part of the water or coolant flow will lie in the river valleys which are relatively lower than the protruding mountains of the abrasive islands. The water will therefore be much deeper (a thicker boundary layer) than with a continuous and uniformly coated abrasive sheet, and the piece part will not hydroplane. In fact, the more water that is present, the better is the grinding, as more heat is also carried away by the larger volume of coolant water.

81. PROBLEM

When a gimbal mechanism is constructed with the use of cylindrical grooved arc housings, it is important to reduce the number of bearing elements that travel in that groove to effect a workpiece holder for grinding or lapping. It is important that the bearing and also the groove not become contaminated with grinding debris which would increase sliding friction, promote wear and create vibration across wear gaps in the bearing. Also, a method is required to prevent axial motion of the bearings. The bearing must be located above the surface of an abrasive platen.

SOLUTION

A single cylindrical groove can be machined into a gimbal bearing housing segment. Two roller bearings can be inserted into this groove with their bearing shafts extending to a gimbal yoke which has a pivot center located some distance below the gimbal bearing mechanism. An alternative bearing could be a close fitting cylindrical segment of porous structural material which would act as an air or liquid fluid bearing. Fluid injected into the porous bearing would tend to self clean the bearing contact surfaces. Use of triangular shaped or spherical surfaces on a sealed mechanical needle bearing or on the grooved track would provide self cleaning of the bearing surface. An independent bearing element can be used to limit axial motion of the gimbal yokes. If the abrasive contact friction force is directed at the center of gimbal rotation there will be no tipping torque imparted to the workpiece. Also can apply suction to porous segment to act as brake and control gap position.

82. INVERTED SPHERICAL WOBBLE PLATE

When a workpiece, mounted on a gimbal (or spherical pivot) workpiece device is attempted to be held flat in contact with a rotating platen having a annular ring of abrasive, a tipping torque acts on the workpiece due to abrasive contact friction force. This abrasive contact friction forces, is typically present as a torque which tends to drive the leading edge of the workpiece down into the abrasive and also, to tip the trailing edge up away from the abrasive. As the abrasive contact surface is located at an offset distance away from the bearing axis, in the preferred constructions of copending application Ser. No. 09/036,126, filed Mar. 6, 1998, as a pivot spherical bearing axes, this tipping torque is equal to the contact abrasive friction force multiplied by the offset distance acts on the workpiece holder. This torque force tends to tip the workpiece away from being parallel to the abrasive surface, which results in the grinding of non-flat cone shapes of the workpiece surface. When the platen is operated at very high rotational speeds of, for example, at least 3,000 RPM, to produce surface speeds of 8,000 SFPM or more, the grinding rates are very high and an expensive workpiece can be quickly ruined.

One way to minimize or eliminate this tipping action is to design a gimbaled workpiece holder, which has outboard arms with lowered pivot bearings. The use of lowered bearings, that is lower with respect to the approximate plane of contact with respect to the workpiece and the abrasive surface, reduces the torque forces acting to tip the workpiece. These bearings position the bearing axis to be as nearly coincident with the plane of the active abrasive surface, e.g., where used with an annular shape, coincident with the elevated abrasive plateau surface of the platen. Locating the workpiece gimbal bearing axes coincident with the plane of the abrasive annular ring surface reduces or eliminates the tipping torque as the offset distance is eliminated.

Another method of reducing the tipping torque is to use a workpiece holder having a large split diameter spherical bearing mounted above the platen abrasive surface. This split bearing is the spherical segment workpiece holder discussed earlier. Here, the spherical radius of this large bearing, which is a spherical bearing split roughly in half or less, is selected so that the combination of the distance from the exterior face (or working face or work surface) of the work piece to the effective or virtual surface of the sphere (from which the spherical segment has been effectively cut, measured towards the surface within the workpiece holder direction) is approximately equal to the radius of rotation of the spherical segment element (e.g., the radius of the sphere). If the split movable spherical portion of the bearing (the spherical segment element) is designed and proportioned correctly for a particular work piece, it is possible to eliminate any offset distance. For instance, a thin workpiece can be mounted to this split half section in such a fashion that the center-of-rotation of the sphere-half is located exactly at the plane of the abrasive contact surface. As there is no offset distance (the difference in the distance between the center of rotation of the spherical segment element and the contact point of abrasive contact between the work piece work surface and the abrasive layer), the tipping torque is also eliminated. For a thicker workpiece, the design of the sphere-half can be modified to embed the workpiece up into the pivoting workpiece holder, or to have the workpiece thickness sufficiently reduced to enable the thickness of the workpiece to extend the effective point of contact between the working surface of the workpiece and the abrasive surface to the center of rotation. This can be done by creating a spherical segment or split bearing workpiece holder which is hollowed out with the spherical pivot surface left intact. Then, the workpiece is mounted up within the split-half with the result that only the surface of the workpiece extends down out of the holder to be in contact with the moving abrasive surface at or about the center of rotation point of the spherical segment bearing element. Again, the offset distance is eliminated and the tipping torque does not exist or is reduced.

This split spherical bearing workpiece holder could be constructed such that a vacuum chuck can be used to hold the workpiece to the spherical bearing holder. The spherical bearing holder may be an air or fluid bearing device which has low pivot friction and which could be separated from the spherical cavity workpiece holder for mounting workpieces. The spherical segment bearing element may be supported within the support for the workpiece holder by a vacuum and may have a groove therein (e.g., along the line of rotation of the spherical element, aligned with the approximate direction of movement of the workpiece along an abrasive surface) for a support pin from the support element to restrain the spherical segment work piece holder from dropping out of the support. The use of a fluid flow between the spherical segment element and the support is effective in assisting cleanout of swarf, grit, detritus and other material which may enter the system.

A spacer plate can be used to position the contact surface of thinner workpieces on the abrasive surface to be coincident with the plane of the abrasive surface. The workpiece would be mounted on the workpiece holder so that the centroid or surface area center of the surface area of the workpiece is located on or about the axis of rotation of the driven workpiece holder shaft. This axis of driven rotation would also pass through the equivalent center of rotation of the gimbaled spherical rotation of the workpiece "wobble" spherical pivot device.

A third method of placing the center of rotation near the plane of contact of the abrasive material and the work surface of the workpiece is to create a split spherical bearing is to use a spherical bearing where the movable sphere center is separated from the spherical receptor housing by roller ball bearings. The balls would be held, nominally in position, by a ball cage. The radius of the spherical receptor would be larger than the radius of the movable inside sphere by an amount equal to the diameter of the balls. As only a half portion of a true spherical bearing exists in this configuration, the movable split sphere half (the spherical segment work piece holder) would be prevented from falling away from the sphere receptor housing by a restraining stop system. The restraining stop would allow a linear separation of the two components of up to 0.020 inches (0.51 mm) and yet maintain the capability to allow a spherical pivoting angle of the work piece of up to 10 degrees from center. A number of designs can be employed to create an effective restraining-stop system. They can be based on a combination of leaf and coil springs used with mechanism levers or simple stop arms. The spherical gap between the two sphere halves can be kept free from grinding swarf by periodic or constant flow of water injected into the bearing center which would flush out the ball gap area. Also, a flexible seal boot could be used at the periphery of the annular sphere gap to keep the gap free from foreign material.

Figure 21:
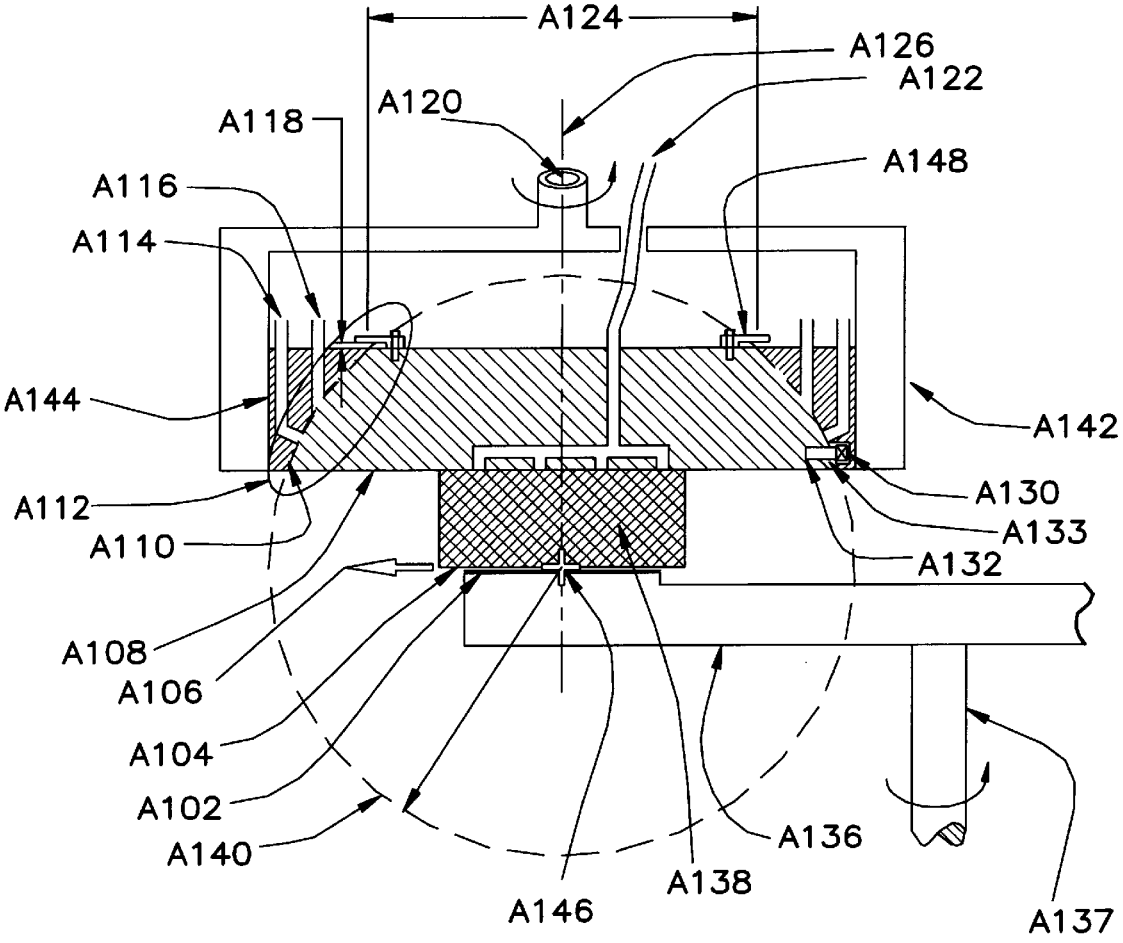
FIG. 21 shows the positioning of air bearings on the work piece slide assembly to reduce slide friction.
Figure 22:
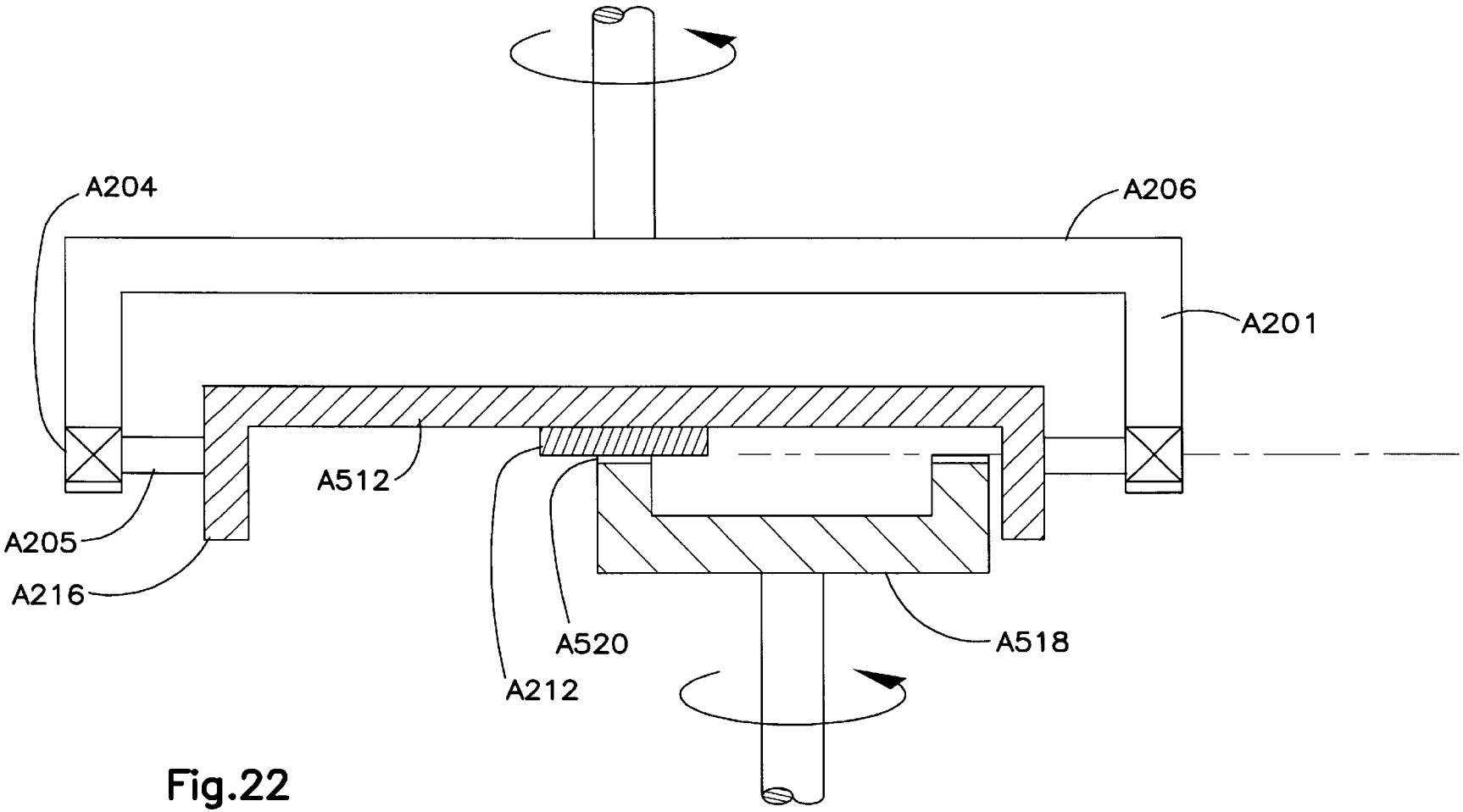
FIG. 22 shows a gimbal mechanism that has two guide pins running in a cylindrical groove which employs a rigid ball support on one side and a spring loaded compression device to create rotational damping friction.

FIGS. 21, and 22 show constructions which address solutions to this problem and which move the center of rotation of the workpiece holder close to the surface of the moving platen abrasive.

FIG. 21 shows a lapping assembly A142 which addresses this problem. The spherical gimbal movable workpiece part holder A108 is restrained by a spherical receiver block A144 and separated from the spherical block A144 by a air or liquid film A110 to provide low friction spherical pivot motion to the workpiece A138. The workpiece A138 is attached to the workpiece holder A108 by a variety of means such as cements, hot melt adhesives, heated wax, mechanical clamps and/or by a vacuum partholder clamping system A122. Rotational motion is provided for the workpiece A138 as it contacts the platen abrasive annular ring A102 by a workpiece part holder shaft A120.This shaft A120 may either be solid or it may hollow to act as a vacuum source for the vacuum partholder clamping system A122. A platen A136 consists of a flat circular plate mounted to a rotating paten shaft A137 and the platen A136 may be rotated at slow speeds of 200 RPM or less or may be rotated at high speeds of 1000, 2000, 3000, 4000, 5000 and more RPM to produce surface abrasive grinding or lapping speeds of up to 8000 to 15000 surface feet per minute (SFPM). A raised plateau ledge is shown on the platen abrasive annular ring A102 but this could also be a flat surfaced platen and a sheet of abrasive used with it that has a raised annular ring of abrasive. It is desired to select the radius A140 of the moveable spherical segment part holder A108 to be large enough so that the spherical center A146 of the spherical part holder A108 with a given configuration workpiece A138 is positioned exactly at the contact surface of the platen abrasive annular ring A102. Then the abrasive contact force A106 is directed through the spherical center A146 and the offset distance between the contact force A106 and the spherical center is minimized or eliminated and this force does not create a torque which would tip the leading edge of the workpiece A138 into the abrasive and result in a non-flat part from being ground. The abrasive contact force A106 is aligned with the plane of the ground surface of the workpiece A104 and it is desired that the vector of this contact force A106 pass through the spherical center of the spherical part holder A146. Also it is desirable that the centerline of the part holder shaft A126 pass through the spherical center of the spherical part holder A146. Most of the force which has to be resisted by the fluid spherical bearing lies in a plane, which is parallel to the surface of the platen annular abrasive ring A102, therefore the fluid separation pressure in the vertical portion of the walls of the spherical bearing area. As there are very small forces which are required to hold the workpiece down against the moving platen abrasive annular ring A102 then it is desirable to remove the upper portion of the spherical bearing as designated by the void area distance A124 to decrease the amount of downward force applied by the fluid pressurized film A110 acting down against the abrasive annular ring A102 while this same pressure is sufficient to resist the abrasive contact force A106 which acts perpendicular to the downward force. The radial surface area A112 which resists all of the abrasive contact forces on the spherical pivot where the fluid film A110 separates the movable spherical holder A108 from the spherical receiver block A144 is shown by the cross-sectional view. A pipe opening pressurized fluid source A114 provides fluid at a controlled pressure to the spherical fluid bearing contact surface area A112 at a sufficient pressure to overcome the load forces on the bearing to prevent contact of the two bearing components A108 and A144. When a higher viscosity fluid such as water or oil is used, the volumetric flow rate of the fluid required to sustain the fluid film A110 will be small as compared to the flow rate required for a low viscosity fluid such as air. A vacuum pipe source A116 can be used with the same spherical bearing used for pressurized fluid to enhance the operational usefulness of the spherical bearing lapping assembly A142. Here, vacuum can be applied to the spherical bearing at the same time that pressurized fluid A110 is injected into the bearing joint or the vacuum can be applied only when the pressurized fluid A110 is not being injected. A retainer stop device A148 is required to prevent the movable spherical part holder A108 from falling away from the spherical receiver block A144 as the bearing is nominally split in half and only restrains the movable half when force is applied upward in a direction to hold the two components A108 and A144 together. If a traditional spherical bearing would be used in this application, the movable spherical bearing component would be fully restrained for three-dimensional axial movement, yet allow three-dimensional rotational motion, and thus the movable portion would not free-fall away from the support housing. However, it would not be possible to employ this type of traditional configuration spherical bearing here, as the spherical pivot center of rotation of the bearing would be located a substantial distance above the abrasive surface and resulting in undesirable tipping torque applied to the workpiece. The spherical retainer stop A148 serves two functions. The first function of the retainer stop A148 is to limit the gap distance that the movable spherical component A108 can free fall away from the spherical support receiver housing block A144 to a maximum of 0.010 inches but preferably 0.005 inches and more preferably 0.001 inch or less. The smaller the adjustable retainer stop gap, the better the parallel alignment of the workpiece A138 surface with the platen abrasive A102 can be achieved prior to the workpiece making initial downward contact with the platen abrasive A102. The second function of the retainer stop A148 is to limit the angular pivot of the spherical movable workpiece holder A108. Any initial non parallel alignment can result in initial cone-shaped grinding of the workpiece A138 surface until the workpiece A138 is held firmly, and flat, against the platen abrasive A102 after which the grinding must continue an extra amount of time to first remove the undesirable cone-shaped material. Depending on the design features of the retainer stop A148, the amount of angular freedom of pivoting motion of the movable spherical workpiece holder A108 can also be intentionally limited by adjustment of the retainer stop gap A118. The lapping system described here is generally designed with the component workpiece lapping assembly A142 traveling in a vertical direction with the feature of using gravity to establish and maintain the parallel alignment of the workpiece A138 surface with the surface of the platen abrasive A102. However, it is intended that this same system can be used with a system where the workpiece lapping assembly A142 holder moves at a angle with the vertical and even be applied where the travel is 90 degrees with vertical to provide horizontal travel. The spherical receiver block A144 can be fabricated from solid materials such as aluminum, steel, stainless steel or an engineering grade plastic such as Delrin or from porous materials such as sintered bronze or porous graphite. Some of these materials may be hard coated with spray-on wear resistant such as those provided by Plasma Coatings, Inc which are Stellite based hard coatings that are surface impregnated with Teflon which result in very hard low friction surfaces. Other coatings such as TIN (titanium nitride), or hard-coating which is anodized and that is preferably Teflon impregnated can be used on aluminum. Additives, which are chemical or mechanical such as microspheres made by 3M Company, can be added to the pressurized air or liquid fluid A110 and A114 to reduce friction between the spherical pivot joint movable part holder A108 and the spherical receiver block A144. An anti-rotation pin A133 can be attached to spherical movable part holder A108 with the free end of the pin A133 captured in a anti-rotation pin slot A132 in the spherical receiver block A142 which allows the movable spherical part holder A108 to have spherical pivot motion but restrains the movable part holder A108 from simple rotation about an axis aligned with the centerline of the part holder shaft A126. In this way, the workpiece A138 can be driven at defined speeds to rotate about an axis aligned with the centerline of the part holder shaft A126. The anti-rotation pin A133 can have a low friction porous or solid bearing A130 mounted on the free end to reduce rubbing friction as the free pin end travels along the surface of the pin slot A132.

FIG. 22 shows the workpiece imbedded up into the spherical workpiece holder, here with a gimbaled workpiece holder. The shaft A212 is connected to an over-hanging yoke primary support plate A206 having x and y axis pivoting connections such as gimbal bearings and pivot shafts connected to downwardly extending arms A202 on the primary support plate A206. A pivoting second support plate is connected to the workpiece holder A512. The workpiece A212 is connected to the workpiece holder A512 and is in contact with the abrasive sheet A520 on the rotating platen A518.

83. FLUID SPHERE WOBBLE PLATE ABOVE CENTER

For high speed, e.g., 8,000 SFPM grinding or lapping and for low speed, e.g., 200 RPM grinding or lapping, it is difficult to prevent a workpiece mounted on a spherical pivot workpiece holder from being shifted, rotated or revolved by torque to a position that is non-flat or nonparallel relative to the moving abrasive surface. This is the result of the spherical center of rotation of a workpiece holder, especially a gimbaled workpiece holder typically being located significantly above the contact surface of the abrasive. There is an abrasive contact shearing force which is generated in a plane which is coincident with the surface of the annular ring of abrasive located on a rotating platen. The abrasive contact friction force acts across an offset distance (measured from the contact point between the workpiece and the abrasive surface to the spherical center of rotation of the pivoting wobble plate workpiece holder) to create a torque. This torque is equal to the contact force times the torque arm offset distance which tends to tilt the workpiece surface away from laying flat to the moving abrasive. The abrasive contact friction force tends to tilt the leading edge of the workpiece down into the abrasive surface.

Another associated problem that occurs, which causes the workpiece to tip away from being flat on the abrasive surface originates from hydroplaning effects. This hydrodynamic torque tipping effect acts in the opposite direction of the abrasive contact friction force in that it tends to lift the leading edge of the workpiece, whereas the contact friction force tends to push the leading edge down into the abrasive. When the abrasive is flooded or has excess water lubricant on the surface during the grinding or lapping process, this excess water lubricant tends to build up a "dam bank" at the leading edge of the workpiece. At the leading edge of the workpiece, free water is traveling at great velocity with the moving abrasive and it is suddenly decelerated when it contacts the workpiece, thereby creating a large hydraulic pressure within the dam bank. Also, this high-pressure water has a tendency to be driven under the leading edge of the workpiece by liquid shearing action of the hydraulic boundary layer. Here, a very thin film of water is carried under the workpiece by the rough surface of the abrasive sheet and the high water pressure at the leading edge of the workpiece tends to tip this portion of the part or workpiece up away from the abrasive. The result of this tipping is that the downstream portion of the workpiece is forced down into the abrasive by the vertical movement of the workpiece holder. When the downstream side is preferentially ground off and the upstream side is left untouched or normally ground while the workpiece is rotated, a shallow cone shape is produced on the ground surface of the workpiece. Furthermore, when the leading edge of the workpiece is lifted somewhat from the surface of the abrasive, the water is driven into this wedge opening and an even greater amount of lifting pressure is developed. This then makes the tipping problem even worse.

To counteract the lifting of the leading edge of the workpiece by the hydrodynamic effect of the water lubricant, a corrective torque can be employed. The workpiece can be held down at its leading edge by constructing a fluid bearing spherical wobble plate workpiece holder with its spherical center of rotation located some distance above the plane of abrasive surface. The torque produced by the abrasive friction contact force acting on an offset distance where the gimbal axis is located slightly above the abrasive surface will tend to hold the leading edge of the workpiece down against the hydraulic lifting force. To achieve a neutral balance on a given workpiece process set-up, the correcting torque force can be increased by increasing the abrasive friction contact force which can be changed by varying the downward contact holding force which holds the workpiece down to the moving abrasive. The abrasive friction contact force can also be changed by varying the water flow rate, the abrasive SFPM rotational speed, the type of abrasive used and other machine and process parameters such as water lubricant additives or induced vibration of the workpiece holder. Also the offset height which the spherical center is located above the abrasive contact surface can be changed, also, the workpiece may have its position adjusted on the workpiece holder (especially where the workpiece holder is inset into the workpiece support) to adjust the contact point between the abrasive surface and the workpiece relative to the center of rotation of the spherical segment workpiece holder. In this way, the amount of leading edge correcting torque force can be optimized throughout the grinding or lapping process for individual parts of unique materials or geometric construction. The technique employed to correct the hydraulic tipping problem is to optimize the amount of corrective tipping torque that is generated by the abrasive contact friction to approximately equal the lifting tipping torque caused by the abrasive water lubricant.

The abrasive contact friction force can also be calculated from the platen motor electrical current which is proportional to motor torque which, in turn, is also proportional to the abrasive friction contact force as the workpiece is typically located at a constant radius position relative to the platen center. This calculated friction force, along with knowledge of the characteristics of the hydrodynamic forces can be used in a manual, semiautomatic or automatic active control system so as to minimize the problem of hydraulic tipping.

To determine the portion of current of a motor that is required to power the motor against the abrasive contact friction as compared to the amount used to overcome the platen spindle bearing friction, a calibration procedure can be used. This would be done by comparing the torque current on a Direct Current platen drive motor while grinding "at speed" to that current which exists when not grinding.

84. FLUID WOBBLE PLATE with PRESSURE and VACUUM

When a fluid bearing spherical joint gimbal is used as a workpiece holder having one half (or less) of a sphere upper section and a pressurized liquid keeps the rotating piece separated from the workpiece holder housing, some method of captivating the loose rotating piece within the housing is required. It is also desirable that all or part of the pivoting workpiece holder be removed from the housing to pre-load a workpiece and then be re-attached to the workpiece holder housing. The workpiece holder housing would be mounted on a shaft which would be used to rotate the workpiece while it is in grinding contact with the abrasive surface so that there would be even wear across the surface of the workpiece. After the workpiece is re-attached to the workpiece housing it would be realigned into a flat position with the workpiece precisely parallel to the abrasive surface prior to the start of the grinding/lapping process. It is also desirable to hold workpieces or workpiece plates with vacuum to the workpiece holder.

The movable split half spherical workpiece holder can have both pressurized fluid supplied for the pivoting bearing action on the spherical surface and also a vacuum source supplied to temporarily hold the split sphere to the sphere housing. The combination of pressurized air or liquid fluid and the vacuum sections on a common pivoting mechanism can either be constructed from separate segments of the split sphere or they can co-exist in the same segment. If the vacuum and pressure areas are present in the same segment, then a member with discrete passageway holes would be used. These holes would be connected to either a vacuum or a pressure source. The form of distributed local hole entities over the contact area common to the movable and stationary spherical joint could be created by using many individual drilled holes or a semi-porous material.

Water is a natural pressurized liquid to be employed in this grinding or lapping operation as it is compatible with the water used as an abrasive lubricant. Water will also tend to wash the spherical joint contact parts free of airborne grinding debris, particles.

Another configuration allows water to be used to seal the upper surface of the movable spherical joint by sealing the common joint gap of the upper vacuum section. Also an evacuated lip on the bottom of the movable sphere can be used to collect any of the pressurized water applied to the pressure section of the joint.

A process technique can be employed to align a workpiece flat to the abrasive surface with this fluid spherical workpiece holder. A workpiece can be attached to a holder and the holder assembly can be lowered into contact with a stationary platen abrasive surface to initially align the spherical joint. Then vacuum is applied to lock the movable sphere to the housing, the assembly is raised, the abrasive platen is brought up to the desired rotating speed. Finally, the assembly is lowered with the pressurized water or other fluid lubricating film and the spherical joint is activated and the associated vacuum is reduced or shut off during the grinding or lapping cycle.

Another method to achieve this same type of combined pressure and vacuum would be to have a pattern of discrete high pressure fluid (liquid or air) holes spread over the contact surface area of the spherical joint. To compensate for lower pressure differential of the vacuum as compared to a pressurized water or liquid source, the vacuum hole areas could be enlarged. Also the vacuum holes could be used to collect and evacuate the water or air injected into the high pressure lubricating joint holes by the adjacent "pressure" holes.

85. HYDRAULIC VERTICAL SLIDE

It is important to control the downward contact force holding the workpiece to the moving abrasive to within 0.1 to 1 lb. or less at a nominal pressure force of 1 to 10 lbs. during the process of high speed lapping. Typically, an annular ring of abrasive on a 12 inch diameter platen, operating at 3,000 RPM is used with 9 micron coated diamond abrasive. Commercial linear ball bearing slides have static breakaway friction forces larger than 0.1 lb., an amount which prevents accurately controlling the downward force. Also these ball bearing slides become contaminated due to the presence of fine airborne abrasive particles in a water mist environment which discourages the use of an air-bearing slide. Leakage of water from the slide onto the workpiece and the platen should be minimized. Oil based lubricant hydraulic fluids are incompatible with this type of lapping which uses water as a lubricant. Further it is desirable to have the center of gravity of the workpiece holder assembly to be as close to the slide axis to minimize torque loads on the slide.

Construct a hydraulic slide using water as a hydraulic fluid acting to separate a moving slide member from a close fitting stationary slide member. This can be done by using a round or rectangular slide member which is solid or hollow and is captured by a close fitting external box with high pressure filtered water injected along the side contact length of the box to create a fluid bearing vertical slide. All water contacting surfaces would be of rustproof material, or rust inhibitors would be added to the water. Water which leaks from the hydraulic slide assembly would be collected in a trough surrounding the bottom and perhaps the top ends of the slide assembly. A thin section of a 0.005 inch thick polyester "doctor blade" wiper perhaps 1 inch long with the free edge in sliding contact with the movable slide member would act as a very low friction drag and would prevent high velocity water being ejected from the water collection box. The water collected in the box could be continuously evacuated by an aspirated air vacuum device and deposited in a tank where it can be pumped back into the hydraulic bearing. Pressure sensors can be used to increase the flow to high force areas of the slide with pumps or valves.

Another way to utilize a fluid slide which nominally has very low, or nonexistent slide friction, is to use a commercial slide system, which can be purchased from companies such as Professional Instruments co. and New Way Machine Co. These slides can either use air, water or a combination air-water mist with the intention that the liquid component would wash away any fine particles of abrasive or grinding swarf from the workpiece that was deposited on the bearing surface during the grinding operation. The configuration of the slide could have many combinations. A single round-post fluid bearing could be used with another device use to prevent the carriage from rotating around the post axis as it travels linearly along the post. To prevent rotation, two fluid bearing posts could be mounted parallel to each other. Also, a variety of square or rectangular shaped fluid slides would naturally prevent this axial rotation.

86. LIQUID SLIDE POST BEARING

For high speed lapping with a annular abrasive ring it is critical that a workpiece be held in contact with the moving abrasive with accurate force control of 0.5 lb. (or less) of force when using a vertical carriage that typically weighs 30 lb. or more. Most ball or roller bearing slides suitable for this application have static breakaway friction residuals (stiction) far in excess of this. Also, the friction from the slide bearing seals which are used to protect the fixed slide on the bearings from grinding dust also add even more friction to the slide. Torque on the slide (which is produced by overhung motor wights, spindle weights and/or also grinding forces acting perpendicular to the slide axis) increases this friction. The presence of this type of static residual friction, which prevents a slide from moving until the actuating force becomes large enough to overcome it, creates a problem in smooth control of the slide assembly. As static friction is known to be larger than dynamic friction, the large force required to overcome the stiction and break the slide loose from its stationary position can be excessive. To move a workpiece closer to the moving abrasive, many times the breakaway force can be larger than the desired small force intended to push the workpiece into the abrasive for the proper grinding action. The stiction force resists the input contact force actuator device, which may be a linear electric motor or an Airpel brand frictionless air cylinder. Air bearing slides commercially available are very expensive, are not good for wet, dirty environments and hydraulic slides are even more expensive.

A very rigid free moving slide can be inexpensively constructed from standard commercial components which can give a frictionless axial motion by using a single large diameter rod and having an outer cylindrical rod which contains one or more porous bearings. Water or other fluid can be pumped radially through the porous bearings and generate a high pressure liquid film around the circumference of the inside diameter of the bearing which pushes against the surface of the round support pad. The rod diameter and the length of the bearings are sized with their mating diameter fit so that the fluid interface pressure is larger than the applied forces which results in the bearings sliding on a film of liquid. Any grinding swarf deposited on the bearing shaft is washed from the bearings by exiting water. If a single fluid bearing is used, the slide is prevented from rotating about the slide axis by the use of an arm with a roller bearing mounted on the free end, which runs in a loose track. Here, the slide can move axially without friction and without the use of expensive ultra precision component parts. Simple or complex methods may be used to inject the water into the bearings to correct for the load forces. The water exiting the bearings may be collected and routed back for recirculation through the use of loose fitting end caps or collection chambers outboard of the bearing and surrounding the shaft.

87. HOLLOW POST FLUID SLIDE

When a vertical slide carriage which has a rotary spindle mounted on it to carry a workpiece holder to be in low force contact with a high speed rotating abrasive platen, there is usually a problem with the motor drive components being located off-center from the slide axis. The mass weight of these components located a distance from the axis produce a torque on the slide bearings which creates a slide friction force equal to the coefficient of friction times the normal force on the bearing perpendicular to the slide axis. The typical slide carriage may weigh 30 to 40 lbs. and the motor and spindle may be located 3 inches from the slide axis generating a torque of T=3 times 40=120 inch-lbs. Also, precision bearings are sensitive to the fine grinding particle debris in the mist air surrounding the bearing slide. Debris tends to jam the slide, increase its friction and wear it out.

A hollow slide can be constructed using a large diameter hollow support post of, about 2½ inches diameter (e.g., 1.5 to 3.5 inches). The hollow post could have a concentric external cylindrical hydraulic bearing surface upon which rides a slide carriage assembly. Another hollow cylindrical tube would act as a inner support for the hydraulic bearings and it would be attached in a rigid manner to a machine frame by the use of legs. These legs would be coupled to the top and bottom of the inner stationary tube and would penetrate clearance slots cut into the outer hollow post to allow them to be mounted to the frame. The slots would be cut long enough to allow the desired travel of the outer hollow-post for moving a workpiece from its start position into contact with a moving abrasive platen. A workpiece spindle shaft is then installed within the internal hollow-post hole and the spindle bearings are attached to the hollow support post carriage slide to allow the spindle to travel vertically along internal axis of the post. The spindle ball bearings can be protected from the liquid or air hydraulic bearing by protective flexible boots which collapse with the travel of the slide. The slide will have very low friction due to hydraulic bearing liquid film, which prevents the slide component parts from having physical contact. Hydraulic fluid such as water or oil is pumped at high pressure of 20 to 300 psi through porous slide bearings. An anti-rotation arm with a free end bearing prevents the slide from pivot rotation about the slide axis.

88. SACRIFICIAL WORKPIECE PROTECTOR

It is difficult to grind or lap parts flat to within 1 to 2 light bands of flatness when using an annular ring of diamond coated abrasive operated at 8,000 SFPM with water as a lubricant. This is because the workpiece has a tendency to hydroplane, tip away from the flat abrasive surface and produce a cone shaped ground surface. Soft materials such as porous carbon, which grind away very fast, are particularly difficult to process as they grind away so quickly and localized areas of the workpiece can be ground excessively. Also it is difficult to ascertain that the surface of a workpiece has been properly ground or lapped as it is hard to distinguish a lapped surface visually on light colored materials such as aluminum oxide by optical measuring methods or to measure it mechanically.

To verify that a workpiece has been correctly processed, it could be dye colored before processing. The surface area of the part which has been lapped will have the surface dye color removed and this effect can be seen visually by the operator or sensed by an optical sensor device as data input into an automated inspection or verification system. The amount or degree of material removal can also be determined by measuring the remaining color shade of the dye.

A workpiece can be mounted and then surrounded by another ring or segments of material outboard of the workpiece. These sacrificial pieces would form a periphery of protective devices that are at the same height as the workpiece to be lapped. Generally, the workpiece holder will not be perfectly aligned with the surface of the moving abrasive before initial contact is made. Since they are at the same height and lay outboard of the center of the workpiece, these pieces will come in contact with the moving abrasive before the workpiece surface contacts the abrasive. Using a free moving wobble plate workpiece holder assures that these protective sacrificial pieces will move the gimbaled holder such that the workpiece lays flat to the abrasive before enough of the surface material of the piece is ground away so that the workpiece is contacted before it is flat. The further the distance that the sacrificial parts are positioned radially from the outer radial width of the sacrificial part, and the greater the abrasive material rate removal resistance of the sacrificial part, the better the workpiece is protected. A rotating workpiece holder is used to stabilize the grinding of soft workpieces. The sacrificial ring or segments may be constructed of extra hard material which slows down the material removal rate while the workpiece is rotated sufficiently for uniform grinding. If the abrasive annular ring is more narrow than the workpiece equivalent diameter, then it particularly important that the workpiece holder make sufficient revolutions to effect uniform wear on the workpiece without grinding a track in the workpiece.

Sacrificial rings or segments and workpieces can be mutually mounted with a common flat surface by two methods, both of which use a very flat surface such as an optical glass. In one case, the workpiece can be first attached to a workpiece holder and "loose" sacrificial ring segments can be fixtured by a fast reacting adhesive such as hot-melt glue. A technique for initial mutual flat alignment is to attach them to the workpiece holder when both the workpiece and the sacrificial part segments lay flat on the flat optical glass fixture. The second way would be to first attach the sacrificial ring segments to the workpiece holder, lay it flat on the optical glass with the loose workpiece, and attach the workpiece to the workpiece holder with hot-melt adhesive.

Multiple small workpieces can be arranged in a "wagon-ring" and be individually protected by a single outer ring of sacrificial material. Also, the individual workpieces could be mounted within periphery protectors and this group of protected workpieces could even be given a secondary protection by a larger common sacrificial ring.

89. METAL DISK ANNULAR RING

When abrasive particles are attached to a thick metal disk, which has enough thickness to be handled, then the variations in thickness of the disk substrate and the distortions of the disk will prevent the coated or plated abrasive from making uniform contact with a workpiece. This is particularly the case for high speed, e.g., 3,000 RPM, lapping or grinding. Further, there are inner and outer radius edge problems with annular rings as particles break off there.

It is desirable to make an annular disk of very thin corrosion proof metal such as 0.003 inch thick stainless foil which is precise in thickness. This thin sheet of metal can be coated with abrasive particles such as diamond with the use of bonding agents or by metal plating techniques. Then the metal disk can be mounted on a high speed rotating platen operating at 3,000 or more rpm. This platen would be ground flat to typically within 0.0002 inches, which will assure that the abrasive surface will then be flatly presented to the workpiece surface.

To avoid workpiece contact with the inner and outer annular ring edges, the platen raised-area could be beveled at a shallow angle at both radii so to lower the abrasive at this position to be out of contact at these edges. The thickness of the thin flexible metal substrate would be controlled to allow the metal to bend at the shallow angle so as not to produce significant distortions at the radial bevel line. A single metal annular ring disk could be produced or a full round disk could be made. Either disk would be uniformly coated with abrasive. The outboard edge of the disk would be elevated by the use of a raised plateau annular ring on the platen. Also, a thin circular disk could be abrasive coated at the outboard annular ring area only. Further, a disk or annular ring substrate could have the inner and outer radii bevel ground at a shallow angle. The annular ring may be curved prior to application of the abrasive particles by plating or coating (either uniformly, in islands or in other patterns). This beveled inner and outer edge would prevent a workpiece from contacting individual particles of abrasive at the edge in such a way as to loosen them and break them off from the abrasive sheet.

90. WATER LUBRICANT DISPOSAL

When water is used as a lubricant for high-speed lapping, very fine particles of the abrasive media and also debris from the parent workpiece being ground, mix with the flowing water lubricant. These metal, ceramic, plastic and chemical contaminants must be separated from the water if the water is to be re-used as a lubricant. It also makes disposal easier if the debris is concentrated in a more solid form. Particles, which are in the submersion size range, have a tendency to stay suspended in the spent water and thus settling tanks do not work well. If the water is filtered, the filters tend to quickly plug up on their surface and lose their liquid pass-through capability. In this same way the water mist generated by high speed lapping is contaminated with fine particles.

The grinding debris contaminated water can be processed by centrifugal separation devices to separate the typical high density ground materials from the liquid stream. Also, the mist of airborne water droplets and minute solid particles can be subjected to centrifugal scrubbers to separate the solids and even some oil-like liquids from the water After the primary foreign material is separated, some extremely small particles may still remain in suspension but these small quantities can be filtered out using a progression of finer sized filters. The collected solids would be quite easy to handle and dispose of as would the filter cartridge element. Non-water liquids such as oils and some chemicals can be separated by use of preferential membrane filters. Any remaining chemicals in the water solution could be neutralized by pH adjusting additives or other chemical adjusting means. Another technique could be employed which would be the addition of new chemicals to create more desirable different new chemicals that can be easily disposed of. The cleaned water can be reused in the process.

91. CENTRIFUGAL SEPARATION OF WATER PARTICLES

When grinding workpieces with high speed lapping, the particles become suspended in the water and are so small that they will not settle out quickly and clog filters for recycling the water in the process.

This issue may be at least in part addressed by simply using a centrifugal separating device, which will concentrate the ground metallic or ceramic particles and clarify the water collected from the grinding process. After the larger particles are removed this spent water can then be sent through mechanical or other filter stages such as 1 micron filters to further remove particles. Then the water can be re-routed to the process for use and reduce water consumption and also ease the disposal of the concentrated debris particles.

92. ADDITION OF PLASTIC BEADS TO WATER LUBRICANT

When grinding workpieces with high speed lapping, the workpiece may not initially be perfectly aligned flat to the surface of the abrasive and a cone-shape will be ground on the workpiece before the workpiece has traveled completely down to make full flat contact with the abrasive surface.

Add inert or chemically active microspheres to the water lubricant just prior to initiation of the grinding or lapping action to physically separate the workpiece surface from the abrasive upon initial contact. Then stop dispensing the microsphere particles so that the first particles are washed away by the surface water lubricant and the workpiece then drops down to make flat intimate contact with the abrasive to continue flat grinding.

The microspheres may range in size from 0.001 inch to 0.020 inch diameter. Special chemicals can also be selected which are chemically reactive with the surface of the workpiece material to accelerate the grinding action of material removal, because of the grain boundary layer weakening or other chemical actions.

93. AIR BEARINGS AND COUNTER BALANCE SYSTEMS

It is desirable to reduce the apparent or effective weight of the workpiece slide assembly and to reduce the slide friction. It has been found that the placement of air bearings on counter weight systems that may be used on the apparatus of the present invention can reduce the slide friction. This system is shown in FIG. 24.

Figure 24A:
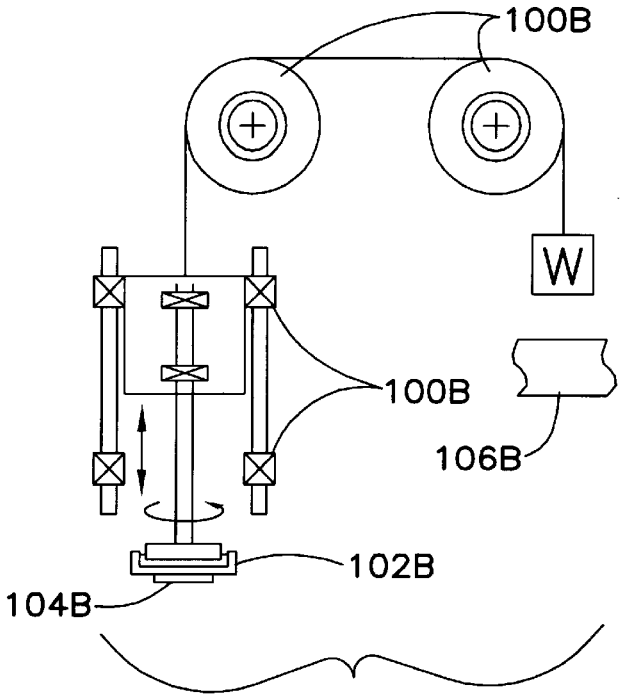
FIGS. 24*a*) *b*) *c*) *d*) *e*) and *f*) show side or perspective views of air bearings and counter weight counter balance systems.
Figure 24B:
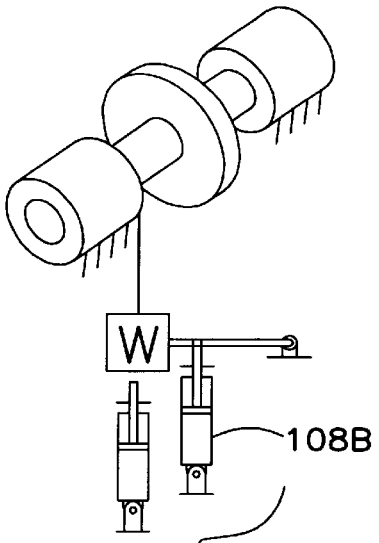
Figure 24C:
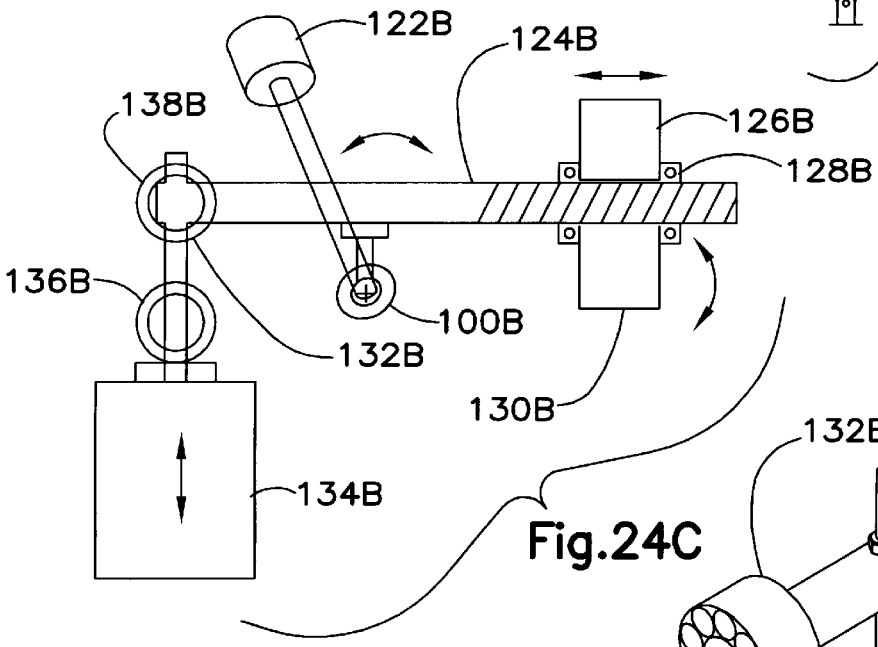
Figure 24D:
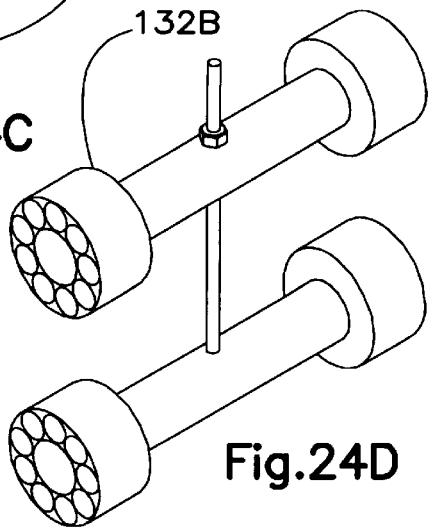
Figure 24E:
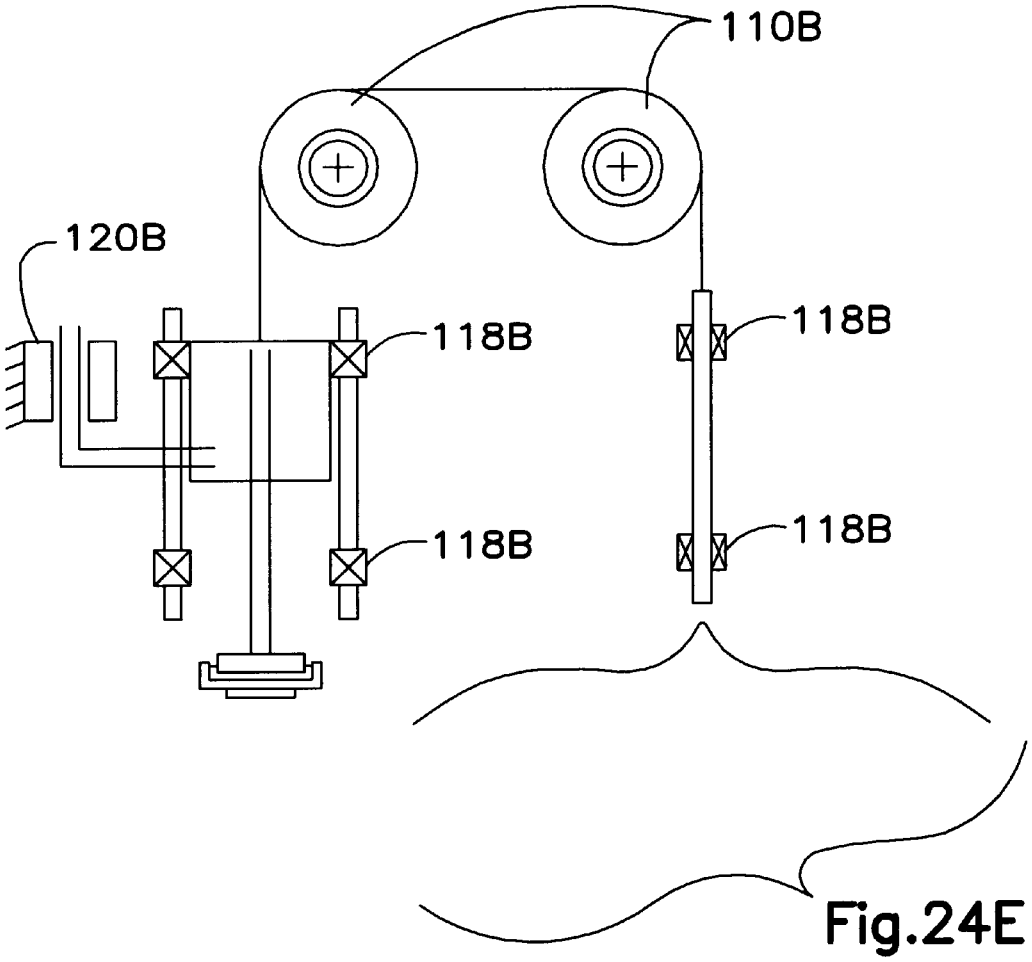
Figure 24F:
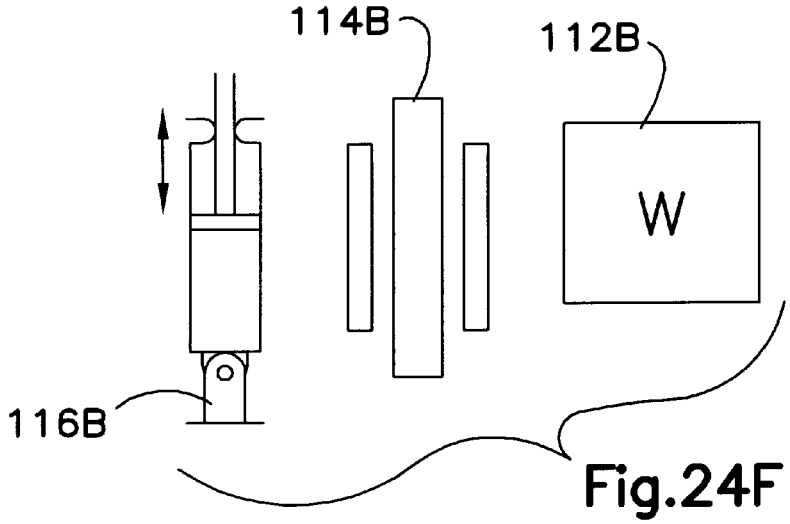

For example, in FIG. 24*a*), air bearings 100B are associated with the work piece holder 102B which is supporting a work piece 104B while the counter weight W is controlled in part by air bellows 106B. FIG. 24*b*) shows the counter eight W supported by an air cylinder lifter 108B. FIG. 24*c*) shows an air bearing 100B associated with an electrical torque motor or pivot shaft, hysteresis clutch 122B. The pivot arm 124B supports the split weight 126B (secured by a lock nut 128B) and the slide weight 130B. Ball or roller bearings 132B adjust movement of the pivot arm 124B, while a bar link rod 138B connects the ball or roller bearings 132B to a bolt type load cell 136B and the slide 134B. FIG. 24*e*) shows the rotary air bearings 110B, linear air bearings 118B, and an LYDT, non-contact linear position read-out to determine the specific position of the work piece holder. FIG. 24*f*) shows the weight W or 112B the frictionless air cylinders for reduced mass 114B and a liner electrical motor or solenoid 116B as they are associated within a referenced section of FIG. 24*e*).

An important aspect of one embodiment of this component which may be included within the practice of the invention is that the air cylinders, in addition to their use as elsewhere described in this invention, reduce slide and internal friction by supporting at least one of a pivot arm, sliding support element, counterweight and the like which may provide stiction or friction within the incremental movement of elements or components within the apparatus described herein.

94. SPHERICAL GIMBAL AXIAL RESTRAINT

It is necessary for an off-set gimbal spherical action mechanism to have both the "x" and "y" axis restrained to prevent relative motion between the two pivot frames. It is also desirable to minimize the overall size of the mechanism so that the unit or component is preferably smaller than the workpiece in the "x" and "y" directions. One method of addressing this issue is to provide a gimbal mechanism that has at least two pins running in a cylindrical groove, which pins employ a rigid ball support on one side of the pin and a spring-loaded compression device which pushes the frame section tight against the ball to create a small amount of rotational damping friction for relative rotation between the frames for vibration control. FIG. 25 shows an embodiment of one method of effecting this structure.

Figure 25A:
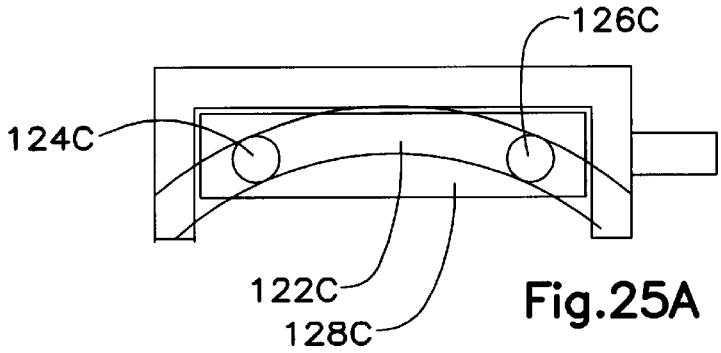
FIGS. 25 i a) *b*) *c*) *d*) *e*) and *f*) show spherical gimbal axial restraint mechanisms included within the scope of the present invention.
Figure 25B:
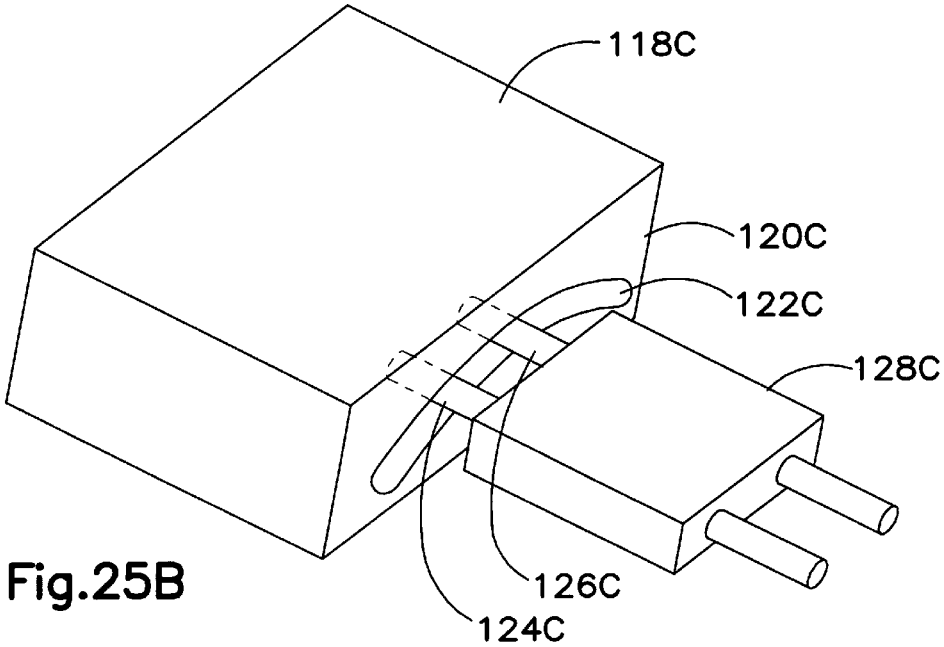
Figure 25C:
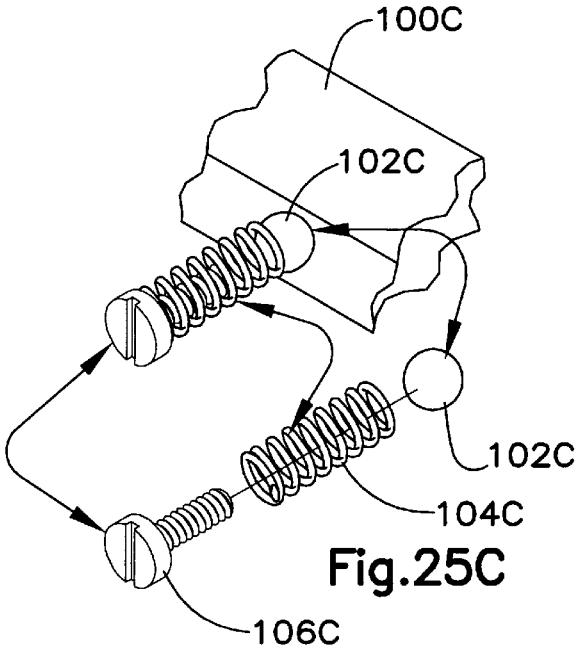
Figure 25D:
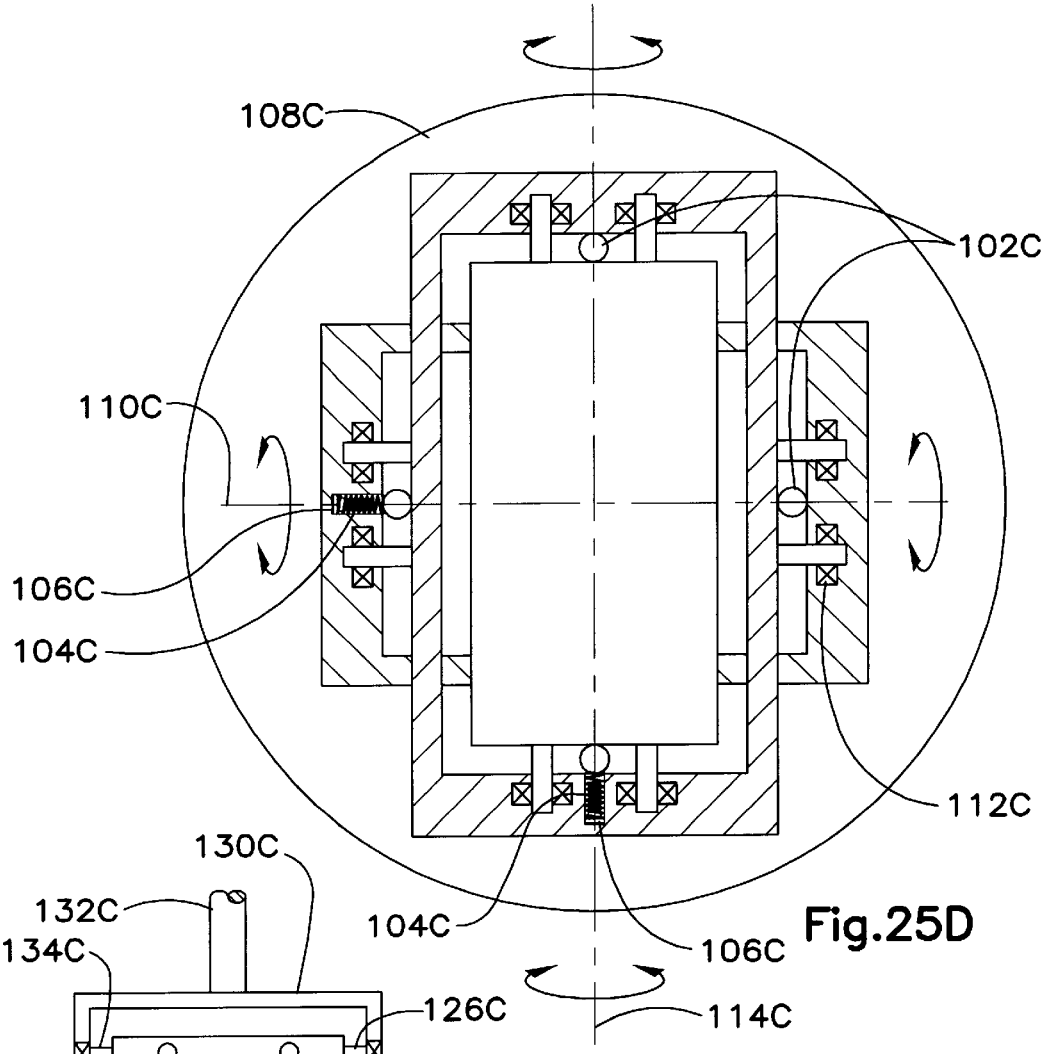
Figure 25E:
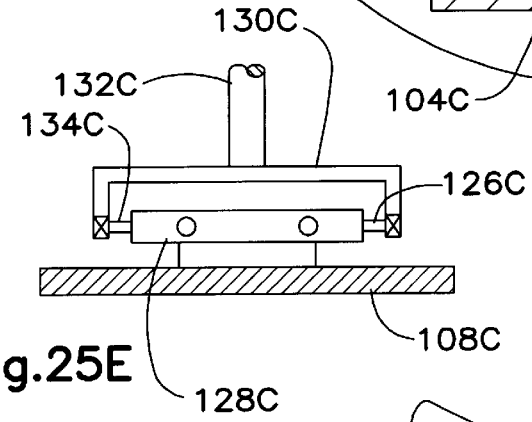
Figure 25F:
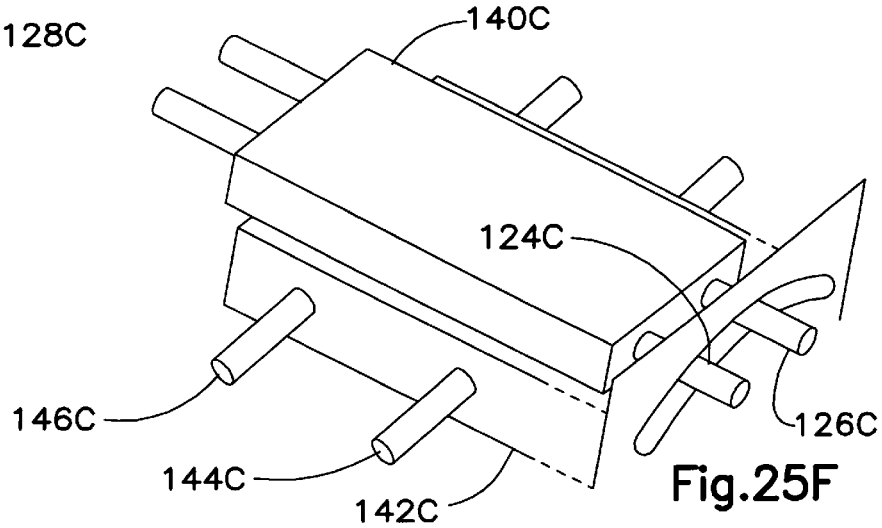

FIG. 25*a*) shows a section of a spherical gimbal axial restraint 118C with a support 120C having a groove 122C therein and two guide pins 124C and 126C inserted in the groove 122C. One of the bearings 128C are shown attached to the guide pins 124C and 126C. FIG. 25*b*) shows a frame 100C with a ball support 102C, preferably a rigid ball support 102C, against a side of the frame 100C. A spring 104C is in engaged contact with the support ball 102C and is engaged over the length of a screw 106C for the spring 104C. FIG. 25*b*) shows an end view of some of the elements of FIG. 25*a*). FIG. 25*d*) shows an overhead view of a spherical gimbal axial restraint with both the "x" and "y" axes mounted on a spherical gimbal system. The overhead view shows the workpiece 108C and shows the same elements 102C, 104C, and 106C from FIG. 25*c*). Also shown are the "x" axis 110C, the bearing 112C, and the "y" axis 114C. FIG. 25*e*) shows a view of the workpiece support element 128C and the workpiece 108C, attached to a shaft 132C and gimbal system 130C through pins 126C and 134C. FIG. 25*f*) shows a perspective view of a "x" axis gimbal element 140C and a "y" axis gimbal element 142C with their respective pins 124C 126C and 142C 146C.

95. SPHERICAL OFF-SET PIVOT BEARING SPRING

When sets of rollers are placed in a cylindrical channel to form one set of bearings for a spherical gimbal bearing device, these sets of bearings tend to be somewhat loose or to become somewhat loose within the channel groove. This loose fit can result in the two gimbal u-frames having a loose connection between the parts, and the workpiece holder u-frame portion tends to vibrate with this looseness. This is particularly a problem with a gimbal spherical pivot with an off-set pivot point which is located below the workpiece pivot.

This looseness can be addressed by adding an extra set (beyond the at least two bearings or pins) to fit within the same groove. It is particularly effective to provide a compliant spring device which connects the at least two bearings in a first set and the at least two additional bearings in the second set. The compliant spring device is used to provide a force between the bearing sets. This force, which may originate from any spring-like or elastomeric element will act to force each set (or at least a pair of bearings within each set) out to a respective side (or top and bottom) of the circular channel or groove. This forced contact with opposite sides of the channel will help to eliminate or reduce any loose gap which would exist by employing a single set of two bearings.

Figure 23A:
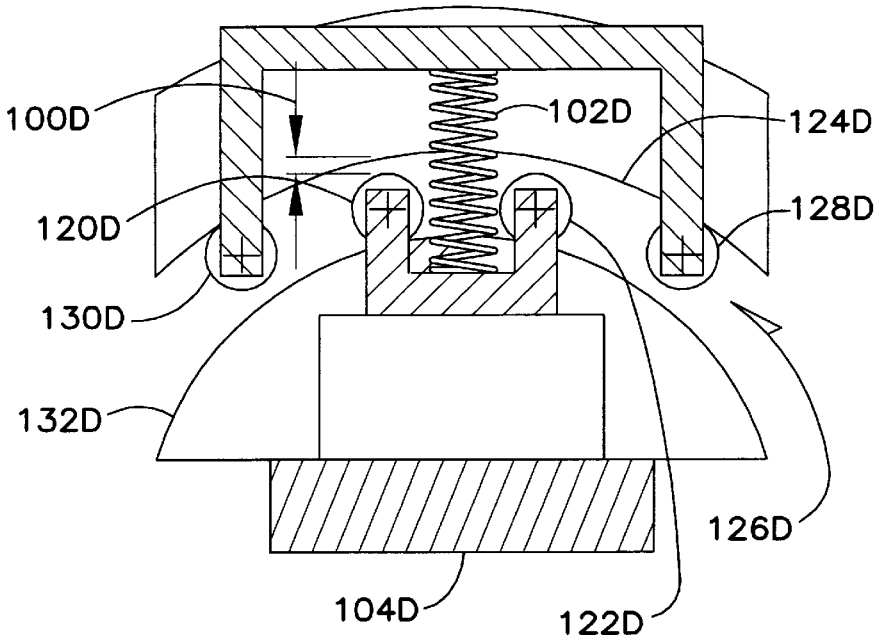
FIGS. 23*a*) *b*) and *c*) show side views of spherical gimbal mechanisms which may be used in the practice of the present invention.
Figure 23B:
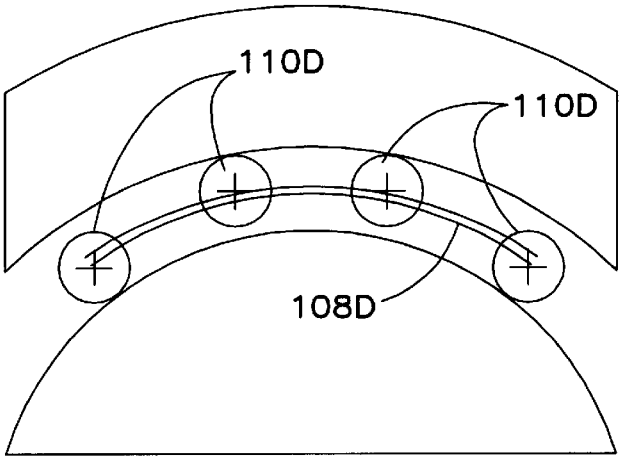
Figure 23C:
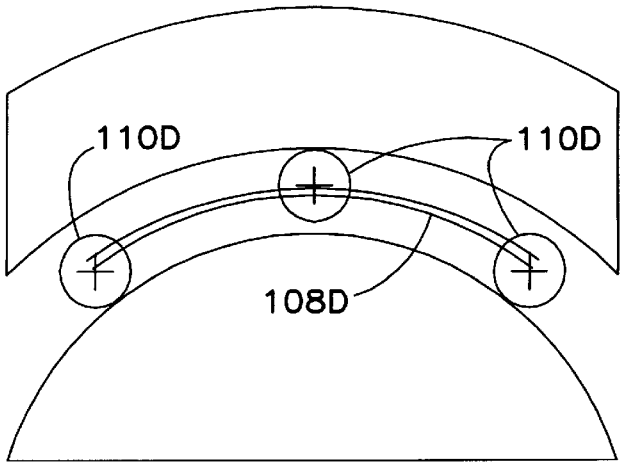

FIG. 23 shows a gap 100D between bearings 120D 122D and an upper portion 124D of the groove 126D. The spring 102D forces the distal bearings 130D 128D against the distal side 132D of the groove 126D. The workpiece 104D is also shown. A leaf spring 108D is also shown in FIGS. 23*b*) and 23*c*) where only three bearings 100D are shown with a spring leaf 108D.

96. AIR CYLINDER GIMBAL SWIVEL

Friction between a piston rod and the rod end slide is very substantial even in very low friction cylinders such as the Airpel™ model 9E cylinders. This type of air bearing cylinder has virtually no friction on the rod piston due to the film of air between the piston and the piston cylinder wall. However, the rod slides along stationary bearing which can generate substantial sliding friction or stiction due to normal forces acting perpendicular to the rod. These forces originate when the cylinder body is held rigidly and the mechanism attached to the rod travels in a direction that is not parallel to the piston rod. A low friction air bearing slide mechanism will have more friction in the "x" and "y" directions when it slides in the "z" direction. The same relative motion occurs with other types of bearing slides.

A long air bearing cylinder with a rod travel that is much longer than the intended rod travel distance assists in reducing this problem. The cylinder is mounted with the piston positioned toward the base of the cylinder body. This assists in the rod gaining the maximum leverage to easily push the rod bearing end of the cylinder to follow the path of the slide mechanism attached to the rod end. Then a low friction u-joint type of double bearing device is attached to the base of the cylinder. Having a long cylinder body maximizes the leverage on the spherical trunion base mounting bearing and minimizes the 90 degree "normal" force on the rod slide bearing. The use of a pivot/slide rod end coupler device is beneficial to reduce friction.

97. WORKPIECE HOLDER FLUID DAMPER

When a two-piece work-piece holder is provided with low friction bearings, vibrations tend to be engendered as a result of contact forces at the high rotational speeds and linear speeds of the lapping process. The vibrations can impart grinding patterns or variations in uniformity on the ground surface of the workpiece. Although many of the methods of attaching a single or multiple dampening elements between the two workpiece holder parts tend to add additional complexities or even new but lesser problems. For example, some of the constructions described above for reducing vibrations may tend to hold the two component parts away from each other with a weak spring or elastic action creating a separation force between the two components. This separation force must then be overcome by the applied contact force holding the workpiece against the moving abrasive surface.

The use of a liquid-filled can, such as an oil-filled can, attached to the lower moving part of the workpiece holder, in combination with a loose metal ball within the oil can, provides a viscous fluid dampening effect to reduce vibrations which does not create a separation or compressed elastic force acting to separate the two components. The metal ball is connected to, for example, the lower moving part of the workpiece holder (or any other part which can be subjected to vibration) by a rigid or hinged post or otherwise extended (in length) element. Alternatively, the oil-filled can can be attached to or rigidly mounted onto the lower moving part (or other moving part being protected against vibration) so that the movement of the can pulls the liquid against a fixed or suspended ball within the liquid. As the vibration forces attempt to impose vibrational movement against the part to which the post is connected, dampening or drag forces are created by movement of the ball through the viscous liquid, and the vibration is dampened, without any possibility of there being compressive forces retained by the incidental movement of the ball through the liquid. On the other hand, compressive forces against a spring or elastic element would create a compressive, spring-like force that would allow for the vibrational movement to occur. Vibrations of the lower workpiece holder section (to which the ball is connected through a connecting element) will move the rigidly mounted oil container in an oscillatory motion, but with the ball remaining stationary in space. In this way there will be relative motion between the ball (e.g., a metal ball, such as a steel, iron or lead ball) and the walls of the container, which relative motion will create shear forces against the viscous liquid as the ball resists movement through the viscous oil, changing the distance between the ball and the walls or sides of the liquid-filled can. The liquid can be Newtonian, thixotropic or the like, as long as it is sufficiently viscous to create shear forces sufficient to dampen movement caused by the imposed vibration creating forces. The shearing of the oil produces a vibration damping action where the energy of vibration is absorbed by the viscous liquid and converted to heat. There are many obvious variations of these configurations for shear inducing part suspension within a viscous liquid which could work equally as well. The suspended element does not have to be in the shape of a ball, but could be any solid shape, such as a polygon or amorphous shape. The suspended element could be nominally supported on top of a slender post which would then allow free motion of the ball in a direction perpendicular to the spring post (within the workpiece holder, e.g., parallel to the direction of advance of the workpiece holder). This type of vibration dampening design can be used with any design of spherical gimbal workpiece holder. The viscous liquid could even be replaced in part or whole by sand.

96. WORKPIECE HOLDER FLUID DAMPER

When a two-piece workpiece holder has low friction bearings, there tends to be vibrations set up by the high speed lapping contact forces. These vibrations can impart ground patterns on the workpiece ground surface. Many of the methods of attaching a single or multiple damper device between the workpiece holder parts create new problems such as holding the two component parts away from each other with weak spring action. This weak spring action must then be overcome by the applied contact force holding the workpiece against the moving abrasive surface.

This problem may at least be in part addressed and reduced by using an oil filled container which is attached to the lower moving part of the workpiece holder and by installing a loose metal ball within the oil container. Vibrations of the lower workpiece holder section will move the rigidly mounted oil container in an oscillatory motion, but the ball will tend to remain stationary in space. In this way, there will be relative motion between the steel ball and the walls of the container, which will shear the oil in the changing space distance between the ball and the walls. This shearing of the oil produces a vibration dampening action where energy is absorbed by the oil, which energy is then converted to heat. There are many configurations of this system which would work well, including one where the ball is nominally supported on top of a slender post which, allows movement of the ball perpendicular to the spring post. This passive damper can be used with a variety of designs of spherical gimbal workpiece holders. Another system could be oil-free, using particulate matter as the dampening agent or any thick fluid. Materials which display increased viscosity with increased shear force would also be especially desirable in the dampening system. This aspect of inventive elements according to the present invention is also shown in FIGS. 29*b*) as a mechanical awivel bearing and in FIG. 29*c*) as a high pressure air swivel bearing.

98. AIR-BEARING CYLINDER AND UNIVERSAL JOINT, DASHPOT DAMPER

Very low air friction cylinders are needed in the systems of the present invention. Even an AIRPEL™ brand cylinder exhibits significant friction on he rod bushing bearing even while the piston has low friction. AIRPEL™ brand cylinders tend to be very small in size and are fragile, with glass tube liners. Also low friction universal joints with rotational action and also translational slide action are needed to align and couple air cylinders or other mechanisms on slides to other mechanisms on slides, particularly where the second slides may not be parallel to the first slides.

An air cylinder or a fluid (liquid) cylinder can be constructed from air bearings contained in a cylindrical tube. A cylinder rod may be contained by the bearings, and the cylinder rod would have a travel limit stop plate on its end. Controlled air pressure can be introduced into the base of the cylinder and would create a force equal to the pressure multiplied by the cross-section area of the rod. High pressure air would be injected into an air bearing and this would partially exhaust into the controlled pressure area. A reducing pressure regulator would bleed this exhausted air out or an air bleed orifice would be used.

With a universal joint, the joint could be constructed of two air bearings through which round shafts are inserted and which are connected by a "Y" shaped linkage yoke. High fluid pressure (e.g., air pressure) would be fed to the air bearings. Mounting screws can be used to attach one end of the universal joint to one of the desired mechanisms at the top and the bottom block. Both rotational and sliding motion are present at both joint axes.

Figure 29A:
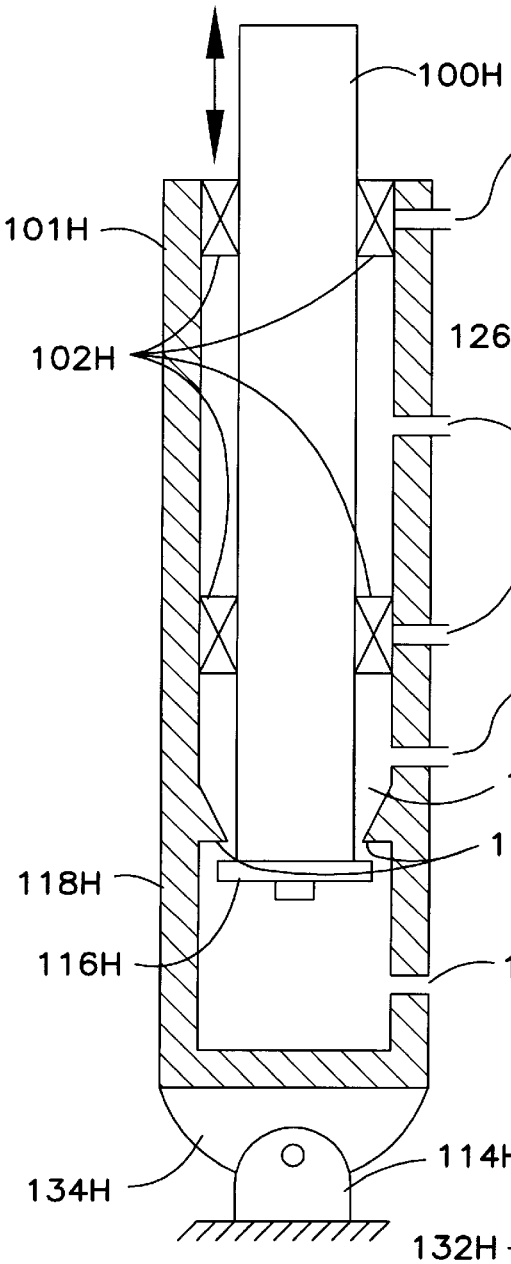
FIGS. 29*a*) *b*) and *c*) show an air bearing cylinder and universal joints as described in the practice of the present invention.
Figure 29B:
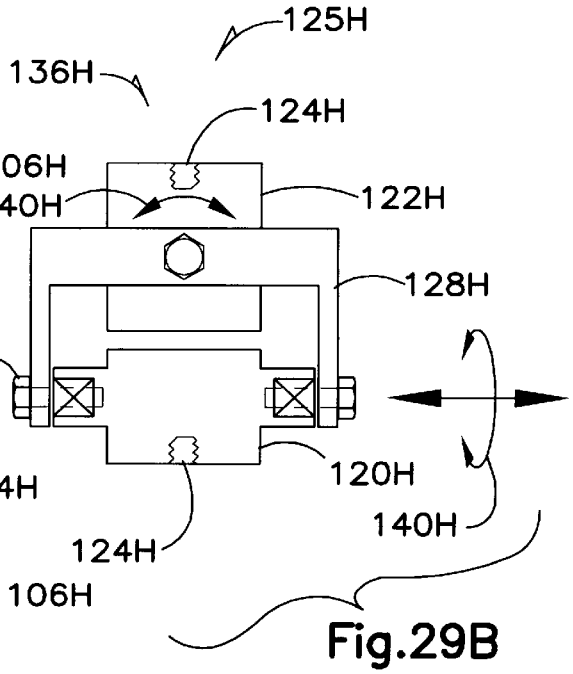
Figure 29C:
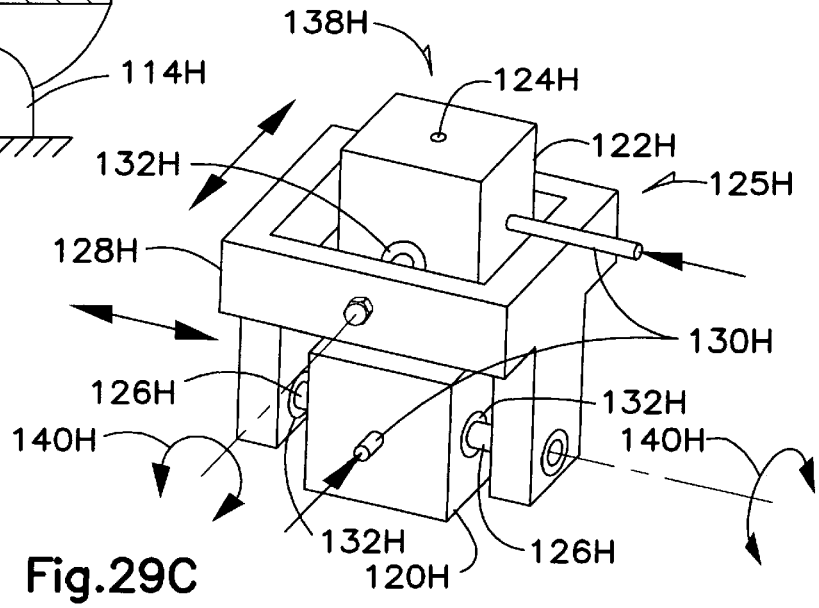

FIG. 29*a*), *b*) and *c*) shows one example of an air bearing cylinder and universal joint (swivel bearings). A piston shaft 100H is shown to move between four air bearings 102H. Exhaust port 104H is shown for the air bearing cylinder 101H. High pressure air ports 106H are shown as is an adjustable orifice valve 108H and another, compensating pressurize fluid port 112H. The piston shaft 100H moves within the cylinder chamber 110H. The mount 114H secures the cylinder 110H and the cylinder rod stop 116H abuts against flanges 111H to prevent the piston 100H from exiting the cylinder 101H or advancing too far. The cylinder 101H pivots about the cylinder body pivot 134H. In the operation of this air cylinder, there are certain dynamic forces which appear to be unique to its operation. For example, gas (e.g., high pressure air) passes through the air bearings 102H and leaks out from underneath the bearings 102H and moves towards available vents (e.g., such as 104H and 112H). If the pressure were allowed to build up within the cylinder chamber 110H below the cylinder rod stop 116H, there would be no way to drive the cylinder by the pressure entering from pressurized air supply vent 112H, which is at a lower pressure than the fluid coming into the cylinder through the high pressure air supply 106H going to the bearings 102H. To enable the lower fluid pressure entering below the cylinder rod stop 116H to drive the piston shaft 100H, it is necessary to vent some of the air released from the air bearings 102H, so that more air (either in volume or sufficient to reduce the pressure) is released above the cylinder rod stop 116H, than enters from below the cylinder rod stop 116H through the pressurized air or fluid supply 112H. In this way, the entering pressure of fluid through the air bearings 102H is higher than the air pressure entering through the pressurized air or fluid supply 112H below the cylinder rod stop 116H, yet greater fluid pressure exists below the cylinder rod stop B116H so that the piston shaft 100H is driven forward.

In the mechanical swivel bearing shown in FIG. 29*b*), the bottom block 120H of the workpiece holder and the top block 122H of the universal joint or air bearing gimbal pivot 138H are shown, with a mounting screw 124H shown on the bottom block 120H. The top block 122H of the workpiece holder is shown with a mounting screw hole 124H and the bottom plate 120H is also shown with a mounting screw hole 124H. A round shaft 126H is shown as part of the basis of axial motion 140H allowed and enabled for the universal joint 138H. In the high fluid pressure swivel bearing shown in FIG. 29*c*), a perspective view is provided of the universal bearing or joint 138H, a "Y" yoke linkage 128H is shown connected to the top block 122H and the bottom block 120H. High pressure air inlets 130H provide the pressurized air for the air bearings 132H allowing rotation between the "Y" yoke linkage 128H and the top block 122H and the bottom block 120H. In FIG. 24*a*), a needle bearing gimbal pivot 134H is shown supporting the air bearing cylinder 101H.

99. WOBBLE PLATE WITH SPRING AND BRAKE

When a workpiece holding element is use with high speed lapping (e.g., especially over 5,000 surface feet per minute and especially about or above 8,000 surface feet per minute), the exists some joint gap between upper and lower components of the spherical pivot holding element. When a workpiece is attached to the lower portion of the holder, the weight of the workpiece and holder block act with gravity to separate the two components by a few thousandths of an inch (a few ten thousandths of a cm) due to clearance requirements as a workpiece is held in free space above the abrasive platen. As the workpiece is lowered into contact with the abrasive surface of the rotating platen and a pressure force is applied to the workpiece holder to push the workpiece against the abrasive, this separation gaps disappears. The bearing gap can be very large as compared to the amount of material removed in a particular lapping or polishing process step for either high speed lapping according to the present invention or low speed slurry lapping (which itself may benefit from the present aspect of the invention). An accurate measurement device is commonly used to establish the relative position of the workpiece surface or the workpiece (e.g., relative to the abrasive surface or in terms of movement after pressure contact has been established) to indicate the lapping material removal rate, but this bearing gap tends to generate an error in the reference position by an amount equal to the dimensions of the gap. Other factors, such as the thickness of lubrication on bearing rollers, also produce short term unknowns or unpredictable gap variations so that a predicted offset compensation gap cannot be determined.

Figure 30:
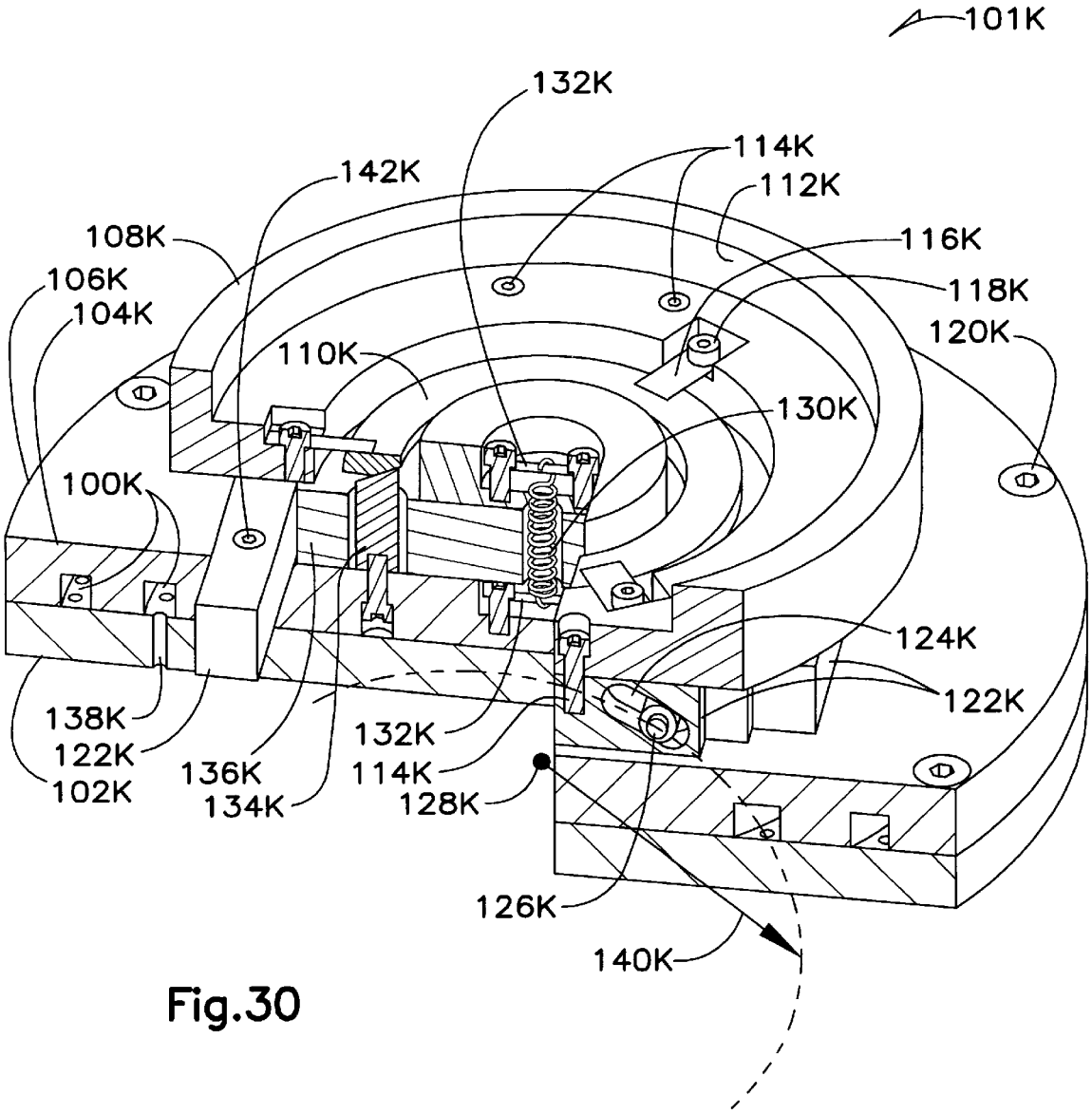
FIG. 30 shows a wobble plate with a spring and braking system.

For both conventional or slow moving lapping speeds (e.g., equal to or less than 300 surface feet per minute) and for the high speed lapping processes of the present invention (e.g., greater than 500 surface feet per minute, preferably greater than 2000 or greater than 5000 surface feet per minute), the work holder device components can be held together using a tension spring mounted as close as possible to the exact center of the spherical pivot device. The spring should be strong enough to hold the work holder parts together in the absence of any pressure against the bottom of the work piece holder and even acting against the force of gravity pulling bottom components down away from the other components. The spring should also be strong enough to keep the gap closed when a heavy workpiece part is being supported by the workpiece holder. Ads the spring is centered with respect to the spherical pivot device, there is no possibility of the retaining spring imparting an off-center toque force which would tilt a workpiece into a non-flat position. This construction also allows the axis of the retaining spring to pass through the center of the spherical gimbal rotation. This construction is illustrated in FIG. 30, where a complete cross-section of a workpiece holder 101K is shown. Within the workpiece holder 101K are shown the other elements of the present invention such as the vacuum channels 100K, the workpiece holder frame 102K, vacuum inlet 104K, lower gimbal pivot frame 106K, upper gimbal pivot frame 108K, a brake pad 110K, mounting area 112K for the spindle shaft (not shown), bolt mounts 114K for the upper gimbal pivot frame 108K and the gimbals (not shown), leaf springs 116K, mounting bolts 118K for the leaf springs 116K, bolt mounts 120K for the lower gimbal pivot frame 106K and the workpiece holder (not shown), a bearing hub 122K for a set of two pivot roller bearings (one shown as 124K), and roller bearing shaft 126K. The center of rotation of the X and Y axes of the gimbal bearings 128K is identified. The retaining spring 130K is shown centered at this center of rotation 128K, and the retaining spring 130K is shown attached at spring mounts 132K. A spherical ring housing 134K is provide adjacent to the center gimbal pivot frame 136K to effect some dampening and contacts the brake pad 110K. The location of vacuum passages 138K and bolt mounts 142K for the lower gimbal pivot frame 106K and the gimbals (not shown).

100. WORK HOLDER GIMBAL BRAKE

As noted in some of the above descriptions, when a workpiece holder uses low friction bearings to create a spherical gimbal rotation, substantial vibration can be present between the two primary upper and lower gimbal components. This vibration is induced by the contact forces of the surface of the workpiece which forces are present when the workpiece is touching the high speed rotating abrasive platen. Undesirable surface patterns can be caused from the grinding of the surface while these vibrations are occurring. As noted above, a variety of techniques can be employed to dampen these vibrations, but many of them (except for example the fluid damper described above) also tend to tilt the workpiece holder out or a flat orientation with the rotating surface of the abrasive platen. Vibrations tend to vary in amplitude and frequency, depending upon a large number of factors, including the mass and size of the workpiece, the contact force, the platen speed, amount of coolant flow, type of abrasive, and the like. This vibration effect is a particular problem with an offset gimbal device where the abrasive contact is located below the gimbal bearings traveling in a radially curved slot. Furthermore, it is desirable to mount a workpiece, lower the workpiece into flat contact with a stationary abrasive surface, and then fix the workpiece and workpiece holder into this position for subsequent process steps with the moving abrasive surface.

Figure 26:
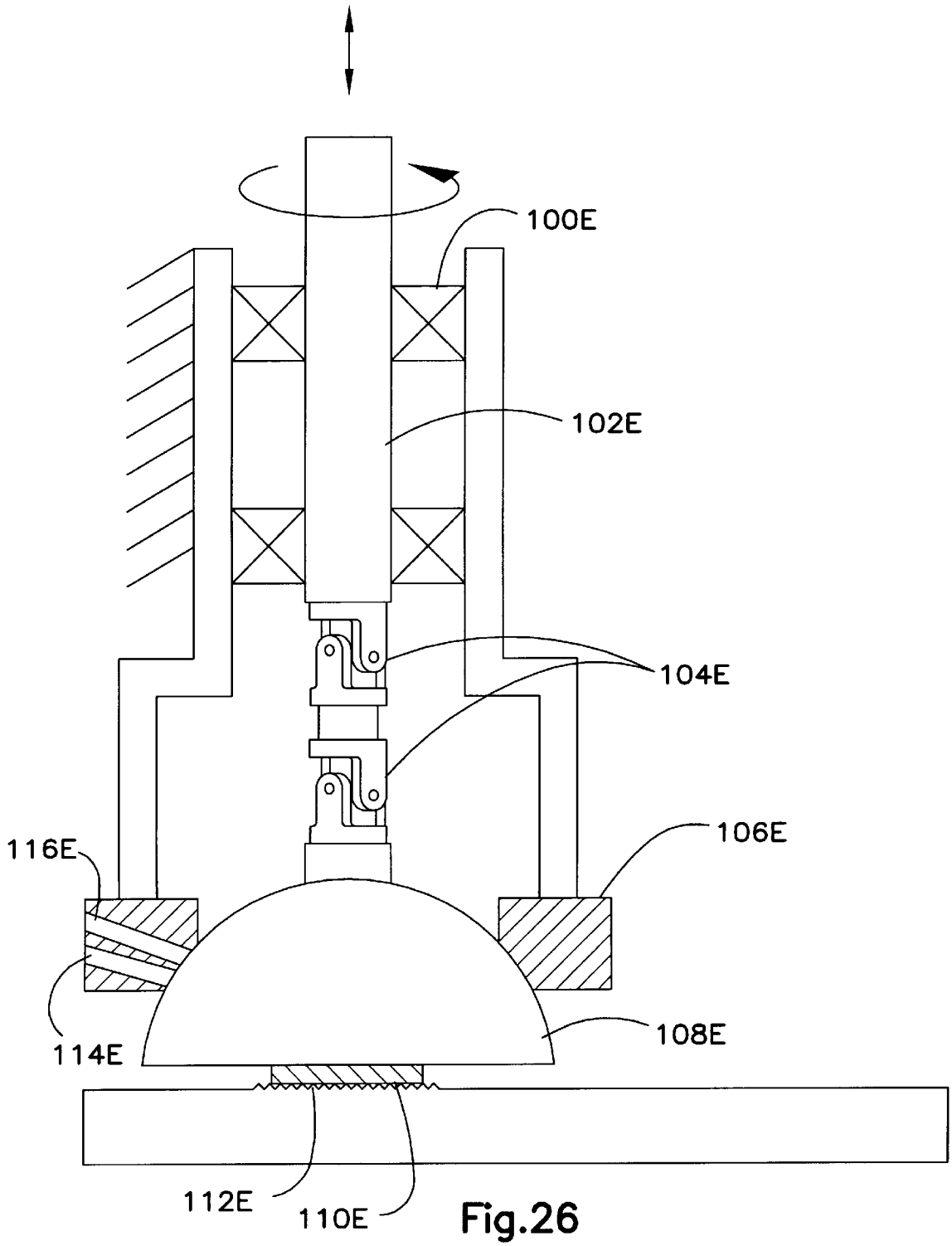
FIG. 26 shows air cylinder support of a work holder gimbal brake.
Figure 27A:
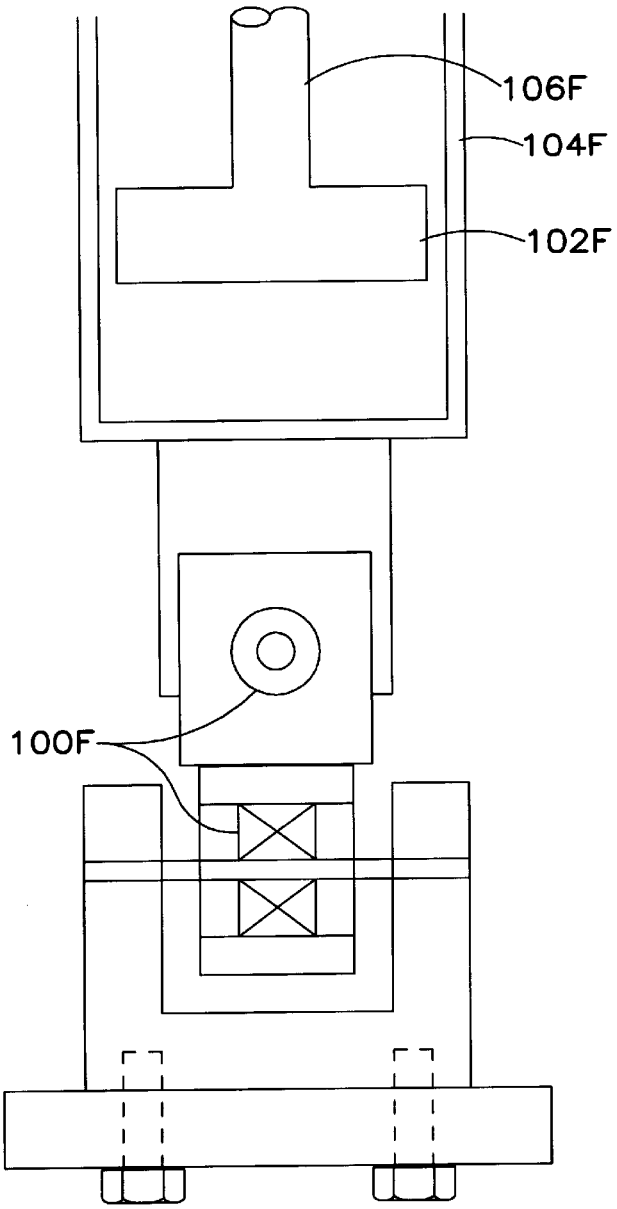
FIGS. 27*a*) and *b*) a braking system and support for the workpiece holder.
Figure 27B:
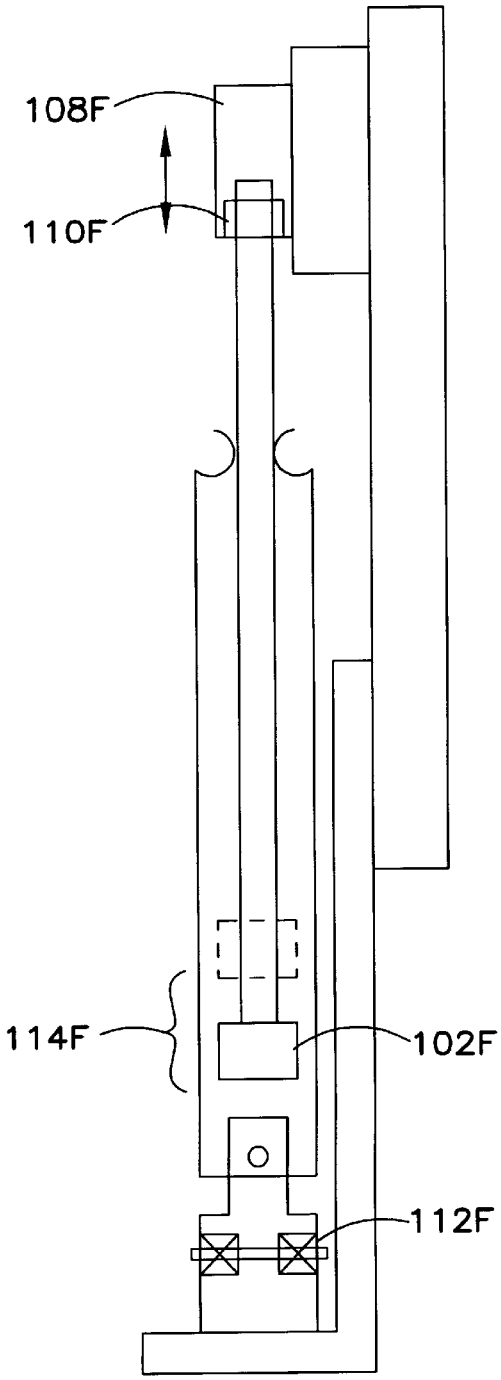
Figure 28:
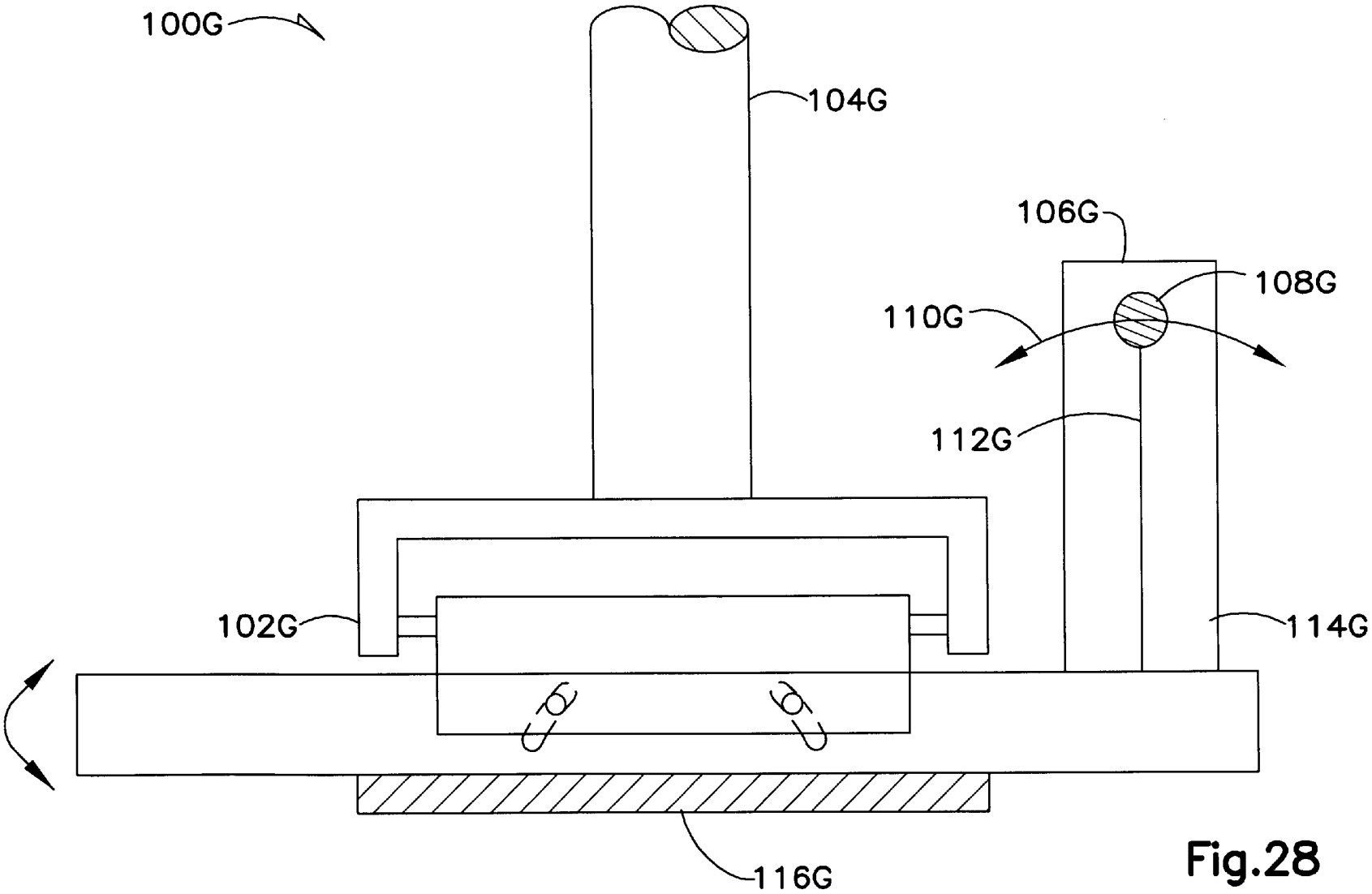
FIG. 28 shows an "oil-can" vibration dampening system described within the practice of the present invention.

A passive or active spherical brake can be used on a two-part gimbal work holder as shown in FIG. 30. Here an upper dome spherical shaped segment is attached to the lower moving part of the work holder which supports or contains the workpiece. A brake pad which has a matching spherical shape (matching to the upper dome portion of the segment) is mounted to the upper part of the workpiece holder in a way that the brake pad is stationary while the moving dome segment sides relative to the pad. The heat generated by friction between the brake pad and the dome surface when vibration oscillations occur tends to dampen the vibrations. The pad can be supported or pressed against the dome by a spring (flat spring or coiled spring) or a variable force air cylinder. This pad brake can also be used to hold a workpiece in a desired alignment with controlled restraint friction. Looking at FIG. 26, the pad (not shown) could be inserted between 106E and the surface of 108E or in FIG. 21, the pad could be inserted between the spherical part holer A108 and the two bearing components A108 and A144.

What is claimed:

1. A process for lapping a surface comprising:

a) providing a work piece to be lapped onto a workpiece support, said workpiece having a surface which is to be lapped, b) providing a rotating platen having
i) a back surface and
ii) front surface, c) providing an abrasive material on said front surface of said platen with the abrasive facing said surface of said workpiece which is to be lapped, and d) rotating said platen while said abrasive is in contact with said surface of said workpiece to be lapped, and e) supporting said workpiece on a workpiece support having a center of rotation and a support surface for said workpiece, said workpiece support comprising a spherical segment having a thickness along a radius passing through said center of rotation of the workpiece support which is less than the radius of a sphere defining the borders of the spherical segment, and said support surface has a surface area which is less than the surface area of the flat surface of a hemisphere cut from said sphere defining the borders of the spherical segment.

2. The process of claim 1 wherein said spherical segment comprises a split inverted spherical fluid bearing.

3. The process of claim 2 wherein said spherical segment is supported by a workpiece support holder which allows said workpiece support to rotate against at least three-point support of said spherical segment by said workpiece support holder.

4. The process of claim 2 wherein an anti-rotation pin is present in said spherical bearing which is connected to said workpiece support, and said anti-rotation pin restrains the spherical segment workpiece support from rotating axially while allowing the spherical workpiece support to pivot.

5. The process of claim 2 wherein said fluid bearing is a water bearing.

6. The process of claim 3 wherein said fluid bearing is a water bearing.

7. The process of claim 2 wherein said abrasive comprises a sheet of flexible abrasive.

8. The process of claim 7 wherein said abrasive comprises a sheet of flexible abrasive.

9. The process of claim 1 wherein said spherical segment is supported by a workpiece support holder which allows said workpiece support to rotate against at least three-point support of said spherical segment by said workpiece support holder.

10. The process of claim 9 wherein said abrasive comprises a sheet of flexible abrasive.

11. The process of claim 10 wherein said abrasive comprises a sheet of flexible abrasive.

12. The process of claim 1 wherein said abrasive comprises a sheet of flexible abrasive.

13. The process of claim 12 wherein said platen is rotated at at least 500 rpm and a surface speed at an outside edge of said sheet of abrasive material of at least 1500 surface feet per minute while said abrasive is in contact with said workpiece.

14. The process of claim 10 wherein said flexible abrasive sheet comprises diamond abrasive on a flexible support sheet.

15. The process of claim 14 wherein said diamond abrasive is embedded in metal on said flexible abrasive sheet.

16. The process of claim 12 wherein said sheet of abrasive material comprises a circular or annular sheet of material which is sufficiently non-porous as to be secured to a surface by reduced gas pressure with a differential between a front side of said sheet and a back side of said sheet of 600 mm Hg.

17. The process of claim 13 wherein an anti-rotation pin is present in said spherical bearing which is connected to said workpiece support, and said anti-rotation pin restrains the spherical segment workpiece support from rotating axially while allowing the spherical workpiece support to pivot.

18. The process of claim 14 wherein said workpiece and said abrasive contact each other within a plane which passes within 1.0 cm of the center of spherical rotation for said workpiece holder.

19. The process of claim 14 wherein an anti-rotation pin is present in said spherical bearing which is connected to said workpiece support, and said anti-rotation pin restrains the spherical segment workpiece support from rotating axially while allowing the spherical workpiece support to pivot.

20. The process of claim 14 wherein said platen comprises a platen with a raised annular area, with said abrasive present at least on said raised annular area.

21. The process of claim 1 wherein said workpiece and said abrasive contact each other within a plane which passes within 1.5 cm of the center of spherical rotation for said workpiece holder.

22. The process of claim 1 wherein said workpiece and said abrasive contact each other within a plane which passes within 1.0 cm of the center of spherical rotation for said workpiece holder.

23. The process of claim 1 wherein said workpiece and said abrasive contact each other within a plane which passes within 0.5 cm of the center of spherical rotation for said workpiece holder.

24. The process of claim 1 wherein said workpiece and said abrasive contact each other within a plane which passes within 0.25 cm of the center of spherical rotation for said workpiece holder.

25. The process of claim 1 wherein an anti-rotation pin is present in said spherical segment which is connected to said workpiece support, and said anti-rotation pin restrains the spherical segment workpiece support from rotating axially while allowing the spherical workpiece support to pivot.

26. The process of claim 1 wherein said platen comprises a platen with a raised annular area, with said abrasive present at least on said raised annular area.

27. A process according to claim 1 which includes initiating contact between a workpiece to be ground and an abrasive surface comprising abrasive sheeting on a rotatable platen, said process comprising:

a) supporting a workpiece on said spherical segment workpiece support, b) supporting said workpiece support on a linearly movable support, c) advancing the workpiece into contact with an abrasive surface comprising abrasive sheeting on said rotatable platen, said process being further characterized by d) determining a position at least approximating the position of contact between a surface of said workpiece to be ground and said abrasive surface, e) removing said workpiece from said position approximating the position of contact, f) advancing the workpiece towards said abrasive surface while said rotatable platen is rotating, and g) controlling forces which advance said workpiece towards said abrasive surface and into contact with said abrasive surface.

28. The process of claim 27 wherein said controlling forces provides a contact force between about 0.1 pounds per square inch and 10 pounds per square inch between a surface of said workpiece to be ground and said rotating platen during lapping of said workpiece while said abrasive sheet is moving with at least 1,500 surface feet per minute.

29. A process for lapping a surface of a workpiece comprising one of the following sequence of steps:

Sequence of steps A comprising:

a) providing a work piece to be lapped, having at least one surface to be lapped, b) providing a rotating platen having i) a back surface and ii) a flat surface and providing a workpiece which can adjusted to a position parallel to said platen, said flat surface of said platen having openings therein through which air may flow, c) providing a sheet of abrasive material having an abrasive face and a back side, said back side being on said flat surface of said platen with the abrasive face of said sheet facing said at least one surface to be lapped, d) reducing gaseous pressure between said back side of said abrasive sheet and said flat surface of said platen to secure said sheet of abrasive material to said flat surface of said platen, e) rotating said platen at a rotational speed of at least 500 revolutions per minute and a surface speed at an outermost edge of said platen of at least 1500 surface feet per minute, and f) contacting said abrasive face and said at least one surface to be lapped on said work piece;

Sequence of steps B comprising:

a) providing a work piece to be lapped, having at least one surface to be lapped, which can be adjusted to a position parallel to said at least one surface of b) where b) is a rotating platen having i) a back surface and ii) a flat surface said flat surface of said platen having openings therein through which air may flow, c) providing a sheet of abrasive material having an abrasive face and a back side, said back side being on said flat surface of said platen with the abrasive face of said sheet facing said at least one surface to be lapped, d) wherein said sheet has an outer edge and an inner edge defining an annular distribution of abrasive, said inner edge having a diameter which is greater than one-third the diameter of said outer edge, e) rotating said platen at a rotational speed of at least 500 revolutions per minute, and f) contacting said abrasive face and said at least one surface to be lapped on said work piece;

Sequence of steps C comprising:

a) providing a work piece to be lapped, having at least one surface to be lapped, b) providing a rotating platen having a back side and a front side, said front side facing said work piece and having a flat plateau which is continuous around the perimeter of said front side of said platen and is elevated with respect to a central area on said front side, thereby forming an annular region, c) providing a sheet of abrasive material on said flat plateau, said sheet of abrasive material having a front surface with an abrasive face and a back surface, with said abrasive face facing said at least one face to be lapped, d) securing said sheet of abrasive material to said flat surface of said plateau, and e) rotating said platen at at least 500 revolutions per minute and contacting said abrasive material and said work piece to remove material from said work piece;

Sequence of steps D comprising a) providing a workpiece to be lapped, having at least one surface to be lapped, b) providing a rotating platen having i) a back surface and ii) a flat surface and providing a workpiece which can be adjusted to a position parallel to said platen by rotation about a pivot joint of a workpiece holder supporting said workpiece, said flat surface of said platen having openings therein through which air may flow, and said back surface having a pivoting joint with a shaft which rotates said platen, c) providing a sheet of abrasive material having an abrasive face and a back side, said back side being on said flat surface of said platen with the abrasive face of said sheet facing said at least one surface to be lapped, d) reducing gaseous pressure between said back side of said abrasive sheet and said flat surface of said platen to secure said sheet of abrasive material to said flat surface of said platen, and e) rotating said platen at a rotational speed of at least 500 revolutions per minute by rotating said shaft, and f) contacting said abrasive face and said at least one surface to be lapped on said wvorkpiece, and allowing said workpiece holder to pivot around said pivot joint so that said abrasive sheet and said at least one surface to be lapped become more parallel towards each other;

Sequence of steps E comprising:

a) providing a work piece with two surfaces to be lapped, b) providing two rotatable platens, each rotatable platen having i) a back surface and ii) a front surface, c) providing a sheet of abrasive material having an abrasive face and a back side, said back side being on said front surface of each of said two rotatable platens with the abrasive faces of each said sheet facing the other sheet, d) placing said work piece with two surfaces to be lapped between said two rotatable platens, so that each abrasive face faces only one of said two surfaces to be lapped, e) rotating said two platens at a rotational speed of at least 500 revolutions per minute, f) contacting each of said abrasive faces with said only one of said two surfaces to lapped, and g) lapping said two surfaces of said two work piece simultaneously;

Sequence of steps F comprising:

a) providing a work piece having two surfaces to be lapped, having at least one surface to be lapped, b) providing two rotatable platens, each rotatable platen having a back side and a front side, said front side facing a surface to be lapped on said work piece and each of said two platens having a flat plateau which is continuous around the perimeter of said front side of each of said platens and is elevated with respect to a central area on said front side, thereby forming an annular region, c) providing a sheet of abrasive material of said flat plateau on each of said two platens, said sheet of abrasive material having a front surface with an abrasive face and a back surface, with each said abrasive face facing only one of said two surfaces on said work piece to be lapped, d) securing said sheet of abrasive material to each said flat plateau, and e) rotating said platen at least 500 revolutions per minute and contacting said abrasive material on said two platens and said two surfaces to be lapped on said work piece simultaneously to remove material from said work piece;

Sequence of steps G comprising:

a) providing a work piece to be lapped, having at least one surface to be lapped which can be adjusted to a position parallel to said at least one surface of a rotating platen, b) providing a rotating platen having i) a back surface and ii) a front surface with a periphery, said front surface of said rotating platen having a raised edge symmetrically disposed about said periphery, c) providing a sheet of abrasive material having an abrasive face and a back side onto said raised edge to provide a symmetrical distribution of abrasive material on said rotating platen, said back side being on said front surface of said platen with the abrasive face of said sheet facing said at least one surface to be lapped, d) securing said sheet of abrasive material to said front surface of said rotating platen, and e) rotating said rotating platen at a rotational speed of at least 500 revolutions per minute, and f) contacting said abrasive face and said at least one surface to be lapped on said work piece; and Sequence of steps H comprising:

a) providing a work piece to be lapped, having at least one surface to be lapped which can be adjusted to a position parallel to said at least one surface of a rotating platen, b) providing a rotating platen having i) a back surface, ii) a front surface, and a periphery, c) providing a sheet of abrasive material having an abrasive face and a back side onto said rotating platen, with the abrasive face of said sheet facing said at least one surface to be lapped, d) securing said sheet of abrasive material to said front surface of said rotating platen, e) rotating said rotating platen at a rotational speed of at least 500 revolutions per minute, and f) contacting said abrasive face and said at least one surface to be lapped on said work piece, g) providing a first amount of liquid to assist lapping to said abrasive surface physically in front of an area where work piece contacts said abrasive face, h) providing a second amount of liquid to assist in washing solid material from said abrasive surface physically after said area, and i) directing air against said abrasive surface physically after providing said first amount of liquid to assist in removing said first and second amounts of liquid from said abrasive surface.

30. An apparatus for lapping surfaces comprising:

a) a workpiece support, b) a rotatable platen having a back surface and a front surface, c) an abrasive material on said front surface of said platen with the abrasive facing said workpiece support, and d) a workpiece holder having a center of rotation and a support surface for a workpiece, said workpiece holder comprising a spherical segment having a thickness along a radius passing through said center of rotation of the workpiece holder which is less than, greater than or equal to the radius of a sphere defining the borders of the spherical segment, and said support surface has a surface area which is less than the surface area of the flat surface of a hemisphere cut from said sphere defining the borders of the spherical segment.

31. The apparatus of claim 30 wherein said workpiece holder comprising a spherical segment having a thickness along a radius passing through said center of rotation of the workpiece holder which is less than radius of a sphere defining the borders of the spherical segment.

32. The apparatus of claim 31 wherein said spherical segment is supported by a workpiece support holder which allows said workpiece support to rotate against at least three-point support of said spherical segment by said workpiece support holder.

33. The apparatus of claim 32 wherein said workpiece support holder has a dual-arm gimbal bearing mounted onto the workpiece support holder.

34. The apparatus of claim 33 wherein said dual-arm gimbal bearing is mounted such that arms of the dual-arm gimbal bearing extend down past the front surface of said platen.

35. The apparatus of claim 34 wherein said dual-arm gimbal bearing is mounted such that arms of the dual-arm gimbal bearing extend down past the front surface of said platen such that bearing axes of the gimbal bearing are mounted approximately at the front surface of the platen such that the spherical pivot center is located 0.1 to 1.2 cm below the front surface of the platen.

36. The apparatus of claim 33 wherein said dual-arm gimbal bearing is mounted such that arms of said dual-arm gimbal bearing extend down past the front surface of the platen such that axes of the gimbal bearing are located within 0.1 to 1.2 cm above and below the plane of the front platen surface.

37. The apparatus of claim 31 wherein said platen comprises a platen having a raised annular edge on said front surface.

38. The apparatus of claim 31 wherein said spherical segment comprises a fluid bearing.

39. The apparatus of claim 31 wherein a source of water to said fluid bearing is present in said apparatus.

40. The apparatus of claim 31 wherein an anti-rotation pin is present in said spherical segment which is connected to said spherical segment workpiece support, and said anti-rotation pin restrains the spherical segment workpiece support from rotating axially while allowing the spherical segment workpiece support to pivot.

41. The apparatus of claim 31 wherein said platen has air holes for transmittal of a pressure below atmospheric pressure to said front surface of said platen.

42. The apparatus of claim 31 wherein a retainer stop is attached to the spherical segment workpiece holder which limits a gap distance through which the spherical segment workpiece holder can free-fall down and away from a workpiece support holder and also limits the maximum spherical angle through which the spherical segment workpiece holder can be rotated.

43. The apparatus of claim 31 wherein said spherical segment workpiece holder has a recessed area into which a workpiece may be set for lapping.

44. The apparatus of claim 31 wherein said spherical segment workpiece support has a top portion and a lower portion, and between said top portion and said lower portion is an annular groove.

45. The apparatus of claim 44 wherein said top portion has reduced gas pressure applied thereto and said lower portion has fluid pressure applied thereto.

46. The apparatus of claim 45 wherein a liquid evacuation dam is present on said lower portion of said spherical segment workpiece support.

47. The apparatus of claim 46 wherein there is an extended peripheral lip around said lower portion to allow collection of the exiting liquid by a vacuum aspiration system.

48. The apparatus of claim 31 wherein a mechanical constraint is present which allows limited spherical gimbal motion of said spherical segment workpiece holder of up to 5 degrees and also acts to retain the spherical segment workpiece holder within a spherical segment workpiece support holder.

49. The apparatus of claim 48 wherein said mechanical restraint retains the spherical segment workpiece support away from said spherical segment workpiece support holder with a gap of between 0.001 and 0.5 cm.

50. The apparatus of claim 31 wherein both a top segment and a bottom segment of said spherical segment workpiece holder have been removed from said sphere defining the borders of the spherical segment.

51. The apparatus of claim 50 wherein liquid is present within a volume created by removal of said top segment of said spherical segment workpiece holder.

52. The apparatus of claim 31 comprising:

a) a shaft which is connected to said rotatable platen, said rotatable platen having a back side to which said shaft is connected and a flat front side on said rotatable platen to which can be secured an abrasive sheet by reduced air pressure conveyed through vents on said rotatable platen;

b) said work piece holder is attached to a movable element on said frame which is capable of moving along said frame in a direction towards and away from said platen to perform lapping of a work piece held on said work piece holder;

c) said work piece holder having control element thereon which allow for independent movement of said work piece holder towards and away from said platen; and d) said control elements having at least 100 settings per rotation, each setting moving said shaft along one of said three axes by a dimension less than 0.005 mm.

53. The apparatus of claim 52 wherein:

f) said shaft which is connected to said rotatable platen has a back side to which said shaft is connected and a front side on said rotatable platen to which can be secured an abrasive sheet.

54. The apparatus of claim 53 wherein said rotatable platen has a raised edge forming an abrading plateau on said front surface of said rotatable platen, with an abrasive sheet secured to said raised edge to form an annular abrading area.

55. The apparatus of claim 53 wherein said front surface of said rotating platen faces a spherical segment work piece support and said front surface has a flat plateau which is continuous around a perimeter of said front surface of said platen and is elevated with respect to a central area on said front surface.

56. The apparatus of claim 31 wherein a protective structure is present on said lapper system, said protective structure being selected from the group consisting of a) an upright frame extending around and above an uppermost surface of said rotatable platen to intercept material projected outwardly from said platen and b) an upright frame extending around and above an uppermost surface of said rotatable platen to intercept material projected outwardly from said platen, with an extension on the top of said upright frame which is angled or curved towards a central area over said platen.

57. The apparatus of claim 31 wherein a water based lubricant flow rate is controlled to provide enough water to flood individual abrasive particles up to an apex of particle peaks using metering pumps to apply desired flow rates of water based lubricant with a flow selected from the class consisting of steady state flow or pulsed flow.

58. The apparatus of claim 31 wherein a brake pad is positioned between said spherical segment and said support surface.

59. The apparatus of claim 31 having a vibration dampening arrangement of a viscous liquid supported within a container and an element supported within said viscous liquid which creates a shearing force when said viscous liquid is moved or said supported element is moved through said viscous liquid, said shearing forces acting to dampen vibration within said apparatus.

60. The apparatus of claim 31 wherein an upper gimbal pivot frame is restrained against movement relative to a workpiece holder frame by a restraining spring.

61. The apparatus of claim 60 wherein said restraining spring is positioned at the center of the upper gimbal pivot frame.

62. The apparatus of claim 31 wherein a workpiece is supported on said workpiece holder which is wider than a width of an annular ring segment of abrasive so that edges of said workpiece may extend over both an inner diameter and an outer diameter of said anulus.

63. The apparatus of claim 31 wherein said workpiece holder has a controlled degree of movement so that a workpiece which is narrower than a width of a platen annular ring may be oscillated so that edges of said workpiece may be moved outboard of the inner diameter and outer diameter of said annular ring of abrasive.

64. An apparatus for lapping surfaces comprising:

a) a workpiece support, b) a rotatable platen having a back surface and a front surface, c) an abrasive material on said front surface of said platen with the abrasive material facing said workpiece support, and d) a workpiece holder having a center of rotation and a support surface for a workpiece, e) said workpiece holder comprising a segment having a single arc of movement within a support, and the single arc of movement rotating around said center of rotation, said workpiece holder having a thickness measured along a line extending along a radius of said single arc of movement passing through said center of rotation of the workpiece holder, which thickness is less than the radius of a circle defining borders of the segment, and said support surface has a surface area which is less than the surface area of the flat surface of a semicircle cut from said circle defining the borders of the segment.

65. The apparatus of claim 64 wherein said segment comprises a segment of an annulus.

66. The apparatus of claim 65 wherein said segment of an annulus has grooves on at least one face of the annulus.

67. The apparatus of claim 66 wherein said annulus rotates with pins guided within the grooves.

68. The apparatus of claim 66 wherein said annulus has grooves on both of its faces.

69. The apparatus of claim 68 wherein said annulus rotates with pins guided within the grooves on both of its faces.

70. The process of claim 1 wherein said workpiece has an outside circumference on a surface facing said rotatable platen, and a sacrificial material of a composition other than said workpiece is located on at least a portion of said circumference.

71. A process for lapping a surface comprising:

a) providing a work piece to be lapped onto a workpiece support, said workpiece having a surface which is to be lapped, b) providing a rotating platen having i) a back surface and ii) front surface, c) providing an abrasive material on said front surface of said platen with the abrasive facing said surface of said workpiece which is to be lapped, and d) rotating said platen while said abrasive is in contact with said surface of said workpiece to be lapped, and e) supporting said workpiece on a workpiece support having a center of rotation and a support surface for said workpiece, said workpiece support comprising a spherical segment having a thickness along a radius passing through said center of rotation of the workpiece support which is greater than the radius of a sphere defining the borders of the spherical segment, and said support surface has a surface area which is less than the surface area of the flat surface of a hemisphere cut from said sphere defining the borders of the spherical segment.

72. The process of claim 71 wherein said spherical segment comprises a split inverted spherical fluid bearing.

73. The process of claim 71 wherein said spherical segment is supported by a workpiece support holder which allows said workpiece support to rotate against at least three-point support of said spherical segment by said workpiece support holder.

* * * * *